US012559928B2

(12) United States Patent
Say et al.

(10) Patent No.: US 12,559,928 B2
(45) Date of Patent: Feb. 24, 2026

(54) WALL-MOUNTED WATER CLOSET CARRIER ASSEMBLY

(71) Applicant: Zurn Water, LLC, Milwaukee, WI (US)

(72) Inventors: Christopher J. Say, Waterford, PA (US); Donald J. Bissell, Erie, PA (US); Michael T. Benesh, Erie, PA (US); David M. Gomo, Lake City, PA (US); Matt Lawrence, Erie, PA (US); Frank Schaetzke, Pipersville, PA (US); Matt Henderson, Erie, PA (US); Zach Cronin, Erie, PA (US); Chris Majocka, Erie, PA (US); Scott Young, Buffalo, NY (US); Jake Rose, Erie, PA (US); Seth Wenzel, Erie, PA (US); Jacob Twaroski, Erie, PA (US); Bill Woehlke, Wind Lake, WI (US)

(73) Assignee: Zurn Water, LLC, Milwaukee, WI (US)

( * ) Notice: Subject to any disclaimer, the term of this patent is extended or adjusted under 35 U.S.C. 154(b) by 40 days.

(21) Appl. No.: 18/062,907

(22) Filed: Dec. 7, 2022

(65) Prior Publication Data

US 2023/0175244 A1 Jun. 8, 2023

Related U.S. Application Data

(60) Provisional application No. 63/375,383, filed on Sep. 12, 2022, provisional application No. 63/374,341, (Continued)

(51) Int. Cl.
*E03D 11/14* (2006.01)

(52) U.S. Cl.
CPC ..... *E03D 11/143* (2013.01)

(58) Field of Classification Search
CPC ..... E03D 11/14; E03D 11/143; E03D 11/146
(Continued)

(56) References Cited

U.S. PATENT DOCUMENTS 1,471,154 A 10/1923 Graham
1,582,845 A 4/1926 Mcarthur
(Continued)

FOREIGN PATENT DOCUMENTS

CA 2849461 A1 10/2014
CA 2944072 A1 4/2015
(Continued)

OTHER PUBLICATIONS

Zurn Industries, Inc. "Zurn Z-1203-H carrier" , specification sheet, Aug. 9, 1994, 1 Page, published in USA.
(Continued)

*Primary Examiner* — Tuan N Nguyen
(74) *Attorney, Agent, or Firm* — Husch Blackwell LLP

(57) ABSTRACT

A water closet carrier assembly for mounting a water closet having an outlet to a plurality of wall members includes a faceplate having a central portion extending in a widthwise direction between a first side and a second side, and a water closet outlet opening configured to align with an outlet of the water closet, a first side portion coupled to the central portion at the first side, the first side portion including a first side portion mounting aperture, and a second side portion coupled to the central portion at the second side, the second side portion including a second side portion mounting aperture. The water closet carrier assembly also includes first and second fasteners configured to couple the first and second side portions, respectively, to first and second wall members, respectively, of the plurality of wall members. The faceplate is supported solely by the plurality of wall members.

19 Claims, 137 Drawing Sheets

Related U.S. Application Data filed on Sep. 1, 2022, provisional application No. 63/363,478, filed on Apr. 22, 2022, provisional application No. 63/305,243, filed on Jan. 31, 2022, provisional application No. 63/286,927, filed on Dec. 7, 2021.

(58) Field of Classification Search
USPC ..... 4/252.1–252.3
See application file for complete search history.

(56) References Cited

U.S. PATENT DOCUMENTS

| | | | |
|---|---|---|---|
| 1,709,132 | A | 4/1929 | Hinsdale |
| 2,065,523 | A | 12/1936 | Groeniger |
| 2,666,211 | A | 1/1954 | Schmid |
| 2,702,391 | A | 2/1955 | Schmid |
| 2,795,798 | A | 6/1957 | Boggess et al. |
| 2,810,918 | A | 10/1957 | Baker et al. |
| RE24,492 | E | 6/1958 | Gordon |
| 2,901,754 | A | 9/1959 | Manas |
| 2,932,037 | A | 4/1960 | Manas |
| 3,014,222 | A | 12/1961 | Pope |
| 3,054,119 | A | 9/1962 | Manas et al. |
| 3,098,242 | A | 7/1963 | Armbruster et al. |
| 3,271,054 | A | 9/1966 | Schmid |
| 3,271,794 | A | 9/1966 | Flegel et al. |
| 3,273,173 | A | 9/1966 | Morris et al. |
| 3,278,950 | A | 10/1966 | Hutchins |
| 3,286,280 | A | 11/1966 | Duggan |
| 3,323,143 | A | 6/1967 | Pope |
| 3,435,467 | A | 4/1969 | Flegel et al. |
| 3,540,065 | A | 11/1970 | Gidner et al. |
| 3,686,695 | A | 8/1972 | Mielback et al. |
| 3,732,582 | A | 5/1973 | Mielbeck et al. |
| 3,944,175 | A | 3/1976 | Kearney |
| 4,058,859 | A | 11/1977 | Arrowood |
| 4,091,473 | A | 5/1978 | Matthews et al. |
| 4,108,477 | A | 8/1978 | Morris |
| 4,482,161 | A | 11/1984 | Izzi, Sr. |
| 4,979,239 | A | 12/1990 | Klein et al. |
| 5,107,638 | A | 4/1992 | Unertl |
| 5,199,113 | A | 4/1993 | Glasow et al. |
| 5,205,056 | A | 4/1993 | Okajima et al. |
| 6,301,838 | B1 | 10/2001 | Hall |
| 6,889,392 | B1 | 5/2005 | Karnopp et al. |
| 6,928,669 | B2 | 8/2005 | Akin |
| 6,979,027 | B2 | 12/2005 | Hetzler et al. |
| 7,146,655 | B2 | 12/2006 | Karnopp et al. |
| 7,421,745 | B2 | 9/2008 | Levy |
| 7,571,497 | B2 | 8/2009 | Hetzler et al. |
| 8,141,177 | B1 | 3/2012 | Majocka et al. |
| 8,321,967 | B2 | 12/2012 | Mesun et al. |
| 8,505,124 | B2 | 8/2013 | Eichler et al. |
| 8,544,121 | B1 | 10/2013 | Majocka et al. |
| 8,881,318 | B2 | 11/2014 | Stammel et al. |
| 8,887,319 | B2 | 11/2014 | Whiteside |
| 9,021,620 | B1 | 5/2015 | Walker |
| 9,068,333 | B2 | 6/2015 | Sneve et al. |
| 9,464,426 | B1 | 10/2016 | Schaetzke et al. |
| 9,631,353 | B1 | 4/2017 | Walker |
| 9,732,507 | B2 | 8/2017 | Bucher et al. |
| D796,652 | S | 9/2017 | Vish et al. |
| 9,938,707 | B2 | 4/2018 | Frei et al. |
| 10,358,805 | B2 | 7/2019 | Tanimoto et al. |
| 10,526,775 | B2 | 1/2020 | Nakamura et al. |
| D875,224 | S | 2/2020 | Bucher et al. |
| 10,697,167 | B2 | 6/2020 | Bucher et al. |
| 10,738,454 | B2 | 8/2020 | Spankowski et al. |
| 10,851,534 | B2 | 12/2020 | Hetzler et al. |
| 10,858,815 | B2 | 12/2020 | Fratantonio et al. |
| 10,895,070 | B2 | 1/2021 | Hodge |
| 11,060,268 | B1 | 7/2021 | Snyder, Jr. et al. |
| 2004/0133969 | A1* | 7/2004 | Akin ..... E03D 11/14 4/252.2 |
| 2005/0012329 | A1 | 1/2005 | Brown |
| 2008/0000018 | A1 | 1/2008 | Laher |
| 2008/0172953 | A1 | 7/2008 | Piorkowski |
| 2009/0249535 | A1 | 10/2009 | Eichler et al. |
| 2013/0205494 | A1 | 8/2013 | Whiteside |
| 2014/0310860 | A1 | 10/2014 | Wroblewski et al. |
| 2015/0000349 | A1 | 1/2015 | Inagaki |
| 2015/0191903 | A1 | 7/2015 | Doerscher, Sr. |
| 2016/0090726 | A1 | 3/2016 | Verdecchia et al. |
| 2016/0312454 | A1 | 10/2016 | Mantel et al. |
| 2020/0263408 | A1* | 8/2020 | Hodge ..... E03D 11/143 |
| 2022/0243445 | A1 | 8/2022 | Lawrence et al. |

FOREIGN PATENT DOCUMENTS

| | | | |
|---|---|---|---|
| FR | 2908141 | B1 | 5/2011 |
| GB | 2223042 | B | 5/1992 |
| WO | 2009/071178 | A1 | 6/2009 |
| WO | 2013/062493 | A1 | 5/2013 |
| WO | 2015/061615 | A1 | 4/2015 |
| WO | 2016/162352 | A1 | 10/2016 |
| WO | 2017/203335 | A1 | 11/2017 |
| WO | 2019/190442 | A2 | 10/2019 |
| WO | 2019/194770 | A2 | 10/2019 |

OTHER PUBLICATIONS

Specification Sheet for 21210-45, "Finishing Frame for Siphon Jet System" , Zurn Industries, LLC, Nov. 18, 2010, 1 Page.

Specification Sheet for ZL203-N4-M, "Adjustable Horizontal Siphon Jet No-Hub", Zurn Industries, LLC, Feb. 24, 2011, 1 Page.

* cited by examiner

WALL-MOUNTED WATER CLOSET CARRIER ASSEMBLY

CROSS-REFERENCE TO RELATED APPLICATIONS

The present application claims benefit of U.S. Provisional Patent Application No. 63/286,927, filed Dec. 7, 2021, U.S. Provisional Patent Application No. 63/305,243, filed Jan. 31, 2022, U.S. Provisional Patent Application No. 63/363,478, filed Apr. 22, 2022, U.S. Provisional Patent Application No. 63/374,341, filed Sep. 1, 2022, and U.S. Provisional Patent Application No. 63/375,383, filed Sep. 12, 2022, the entire contents of which are incorporated herein by reference.

FIELD OF THE INVENTION

The present application relates to assemblies for mounting a water closet and, more particularly, to support a wall-mounted water closet within a modular wall.

BACKGROUND

Water closet carrier assemblies are generally used to mount water closets or toilets in a bathroom.

SUMMARY

A first embodiment includes a water closet carrier assembly for mounting a water closet having an outlet to a plurality of wall members. The water closet carrier assembly includes a faceplate having a central portion extending in a widthwise direction between a first side and a second side, and a water closet outlet opening configured to align with an outlet of the water closet, a first side portion coupled to the central portion at the first side, the first side portion including a first side portion mounting aperture, and a second side portion coupled to the central portion at the second side, the second side portion including a second side portion mounting aperture. The water closet carrier assembly also includes a first fastener configured to couple the first side portion to a first wall member of the plurality of wall members via the first side portion mounting aperture, and a second fastener configured to couple the second side portion to a second wall member of the plurality of wall members via the second side portion mounting aperture. The faceplate is supported solely by the plurality of wall members.

Another embodiment includes a water closet carrier assembly including a faceplate having a central portion extending in a widthwise direction between a first side and a second side, and a water closet outlet opening configured to align with an outlet of the water closet, the water closet outlet opening having a central axis, a first side portion coupled to the central portion at the first side, the first side portion including a first side portion mounting aperture, and a second side portion coupled to the central portion at the second side, the second side portion including a second side portion mounting aperture. The central portion is located in a first plane that is oriented perpendicular to the central axis. At least a portion of the first side portion and at least a portion of the second side portion are coplanar and are located in a second plane that is oriented perpendicular to the central axis and axially offset from the first plane.

Another embodiment includes a water closet carrier assembly configured for mounting to a wall having a plurality of wall members. The water closet carrier assembly includes a faceplate having a central portion extending in a widthwise direction between a first side and a second side, the central portion including a plurality of water closet mounting apertures, a water closet outlet opening defining an outlet axis configured to align with an outlet of the water closet, and a vertical axis oriented perpendicular to the outlet axis, a first side portion coupled to the central portion at the first side, the first side portion including a first side portion mounting aperture, wherein the first side portion defines a first contact surface configured to contact a respective wall member of the plurality of wall members, wherein the first contact surface defines a first contact surface height in a direction parallel to the vertical axis, and a second side portion coupled to the central portion at the second side, the second side portion including a second side portion mounting aperture, wherein the second side portion defines a second contact surface configured to contact a respective wall member of the plurality of wall members, wherein the second contact surface defines a second contact surface height in a direction parallel to the vertical axis. The first contact height is one to two times as large as a width of the central portion.

Another embodiment includes an outlet connector for use with a water closet carrier assembly for mounting to a faceplate of the water closet carrier. The outlet connector includes a flange having a plurality of mounting apertures configured to receive fasteners for coupling the outlet connector to the faceplate, the flange defining a central opening configured to align with a water closet outlet opening of the faceplate, the central opening defining a central axis, and an outlet pipe defining a pipe axis, wherein the pipe axis is not parallel to the central axis, and wherein the outlet pipe is coupled to the flange. The flange is configured to be coupled to the faceplate in a first position in which the outlet pipe slopes downwards in a first direction and in a second position in which the outlet pipe slopes downwards in a second direction, offset from the first direction by more than 90 degrees.

Another embodiment includes a method of mounting a water closet carrier assembly. The method includes coupling a foot to a faceplate via a fastener, locating the foot on a horizontal surface adjacent to a plurality of vertical wall members, coupling the faceplate to the plurality of vertical wall members, and decoupling the foot from the faceplate such that the faceplate is mounted to the plurality of vertical wall members at a height above the horizontal surface.

Another embodiment includes a modular wall assembly comprising a top plate, a bottom plate, and a plurality of vertical studs collectively defining an internal wall volume. A carrier assembly configured to support a wall-mounted water closet thereon is coupled only to the vertical studs of the wall assembly. In some embodiments, the carrier assembly is located fully within the internal wall volume. In some embodiments, fasteners extend through the carrier assembly and into the front surface of adjacent vertical studs to couple the carrier assembly to the wall assembly.

Another embodiment includes a method of coupling a carrier assembly to a wall assembly. The method includes coupling a fluid coupler to a wastewater pipe. In some embodiments, coupling a fluid coupler to a wastewater pipe includes fastening a saddle tee of the fluid coupler to the wastewater pipe via an adhesive and boring a hole into the wastewater pipe aligned with an outlet of the fluid coupler. The method further includes aligning vertical slots of a faceplate with threaded openings in the fluid coupler and extending fasteners through the vertical slots and threaded openings to couple the faceplate to the fluid coupler at a desired height of the faceplate. The method further includes fastening the faceplate to vertical studs of the wall assembly.

BRIEF DESCRIPTION OF THE DRAWINGS

FIGS. 11-74 illustrate additional features and additional embodiments relating to carrier assemblies, faceplates, brackets, wall studs, and the like.

DETAILED DESCRIPTION

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways.

Figure 1:
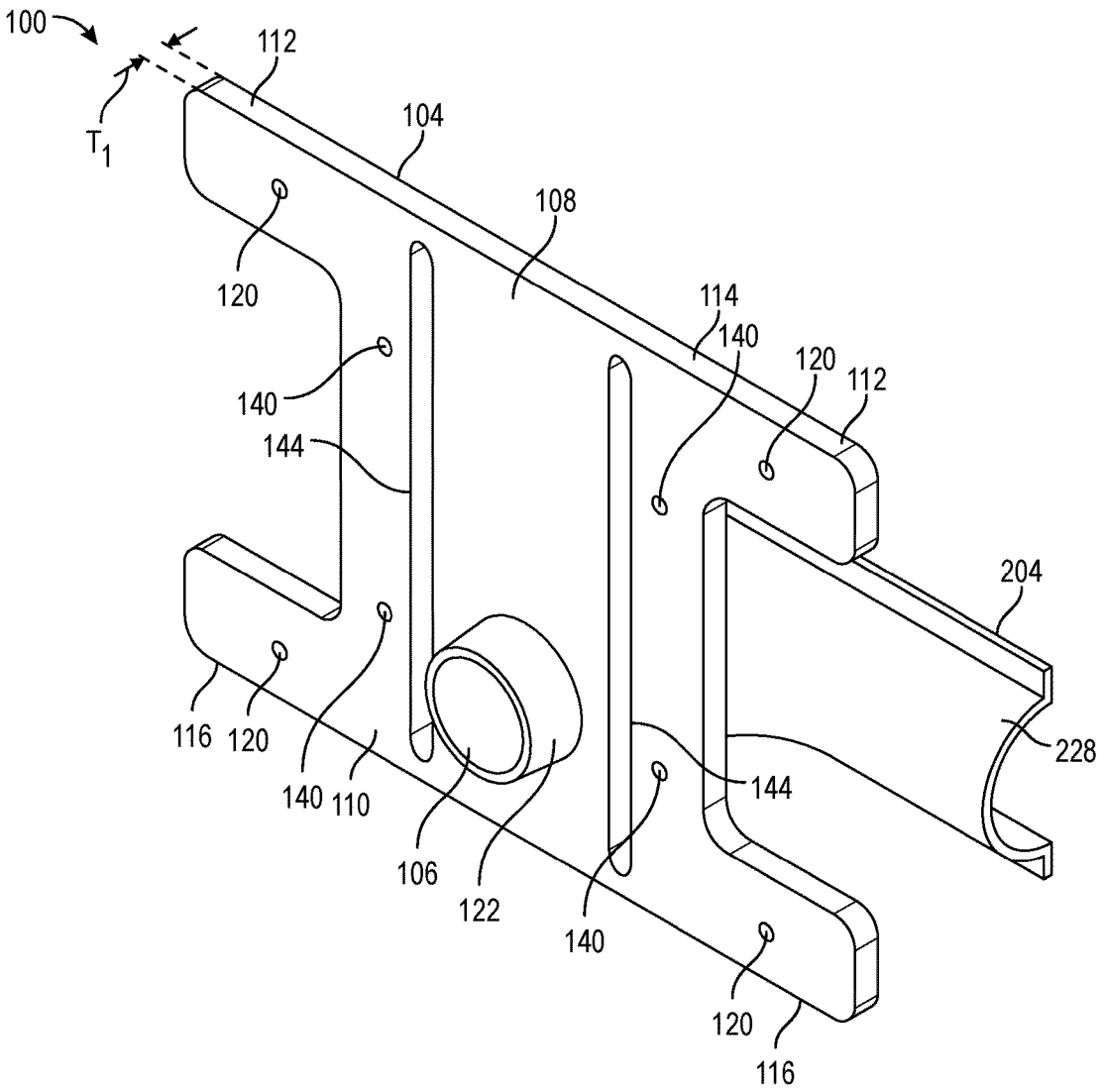
FIG. 1 is a front perspective view of a carrier assembly.
Figure 2:
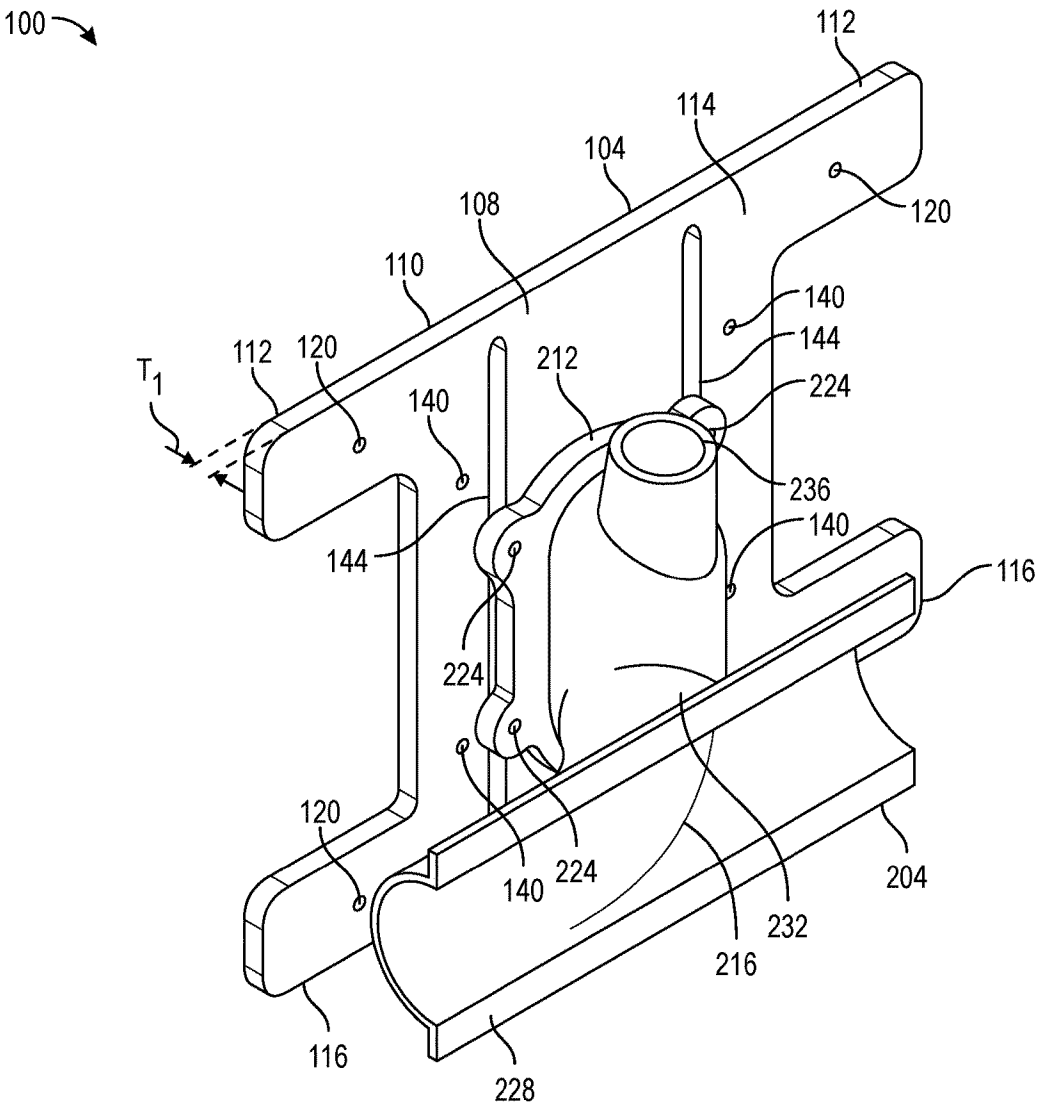
FIG. 2 is a rear perspective view of the carrier assembly of FIG. 1.
Figure 3:
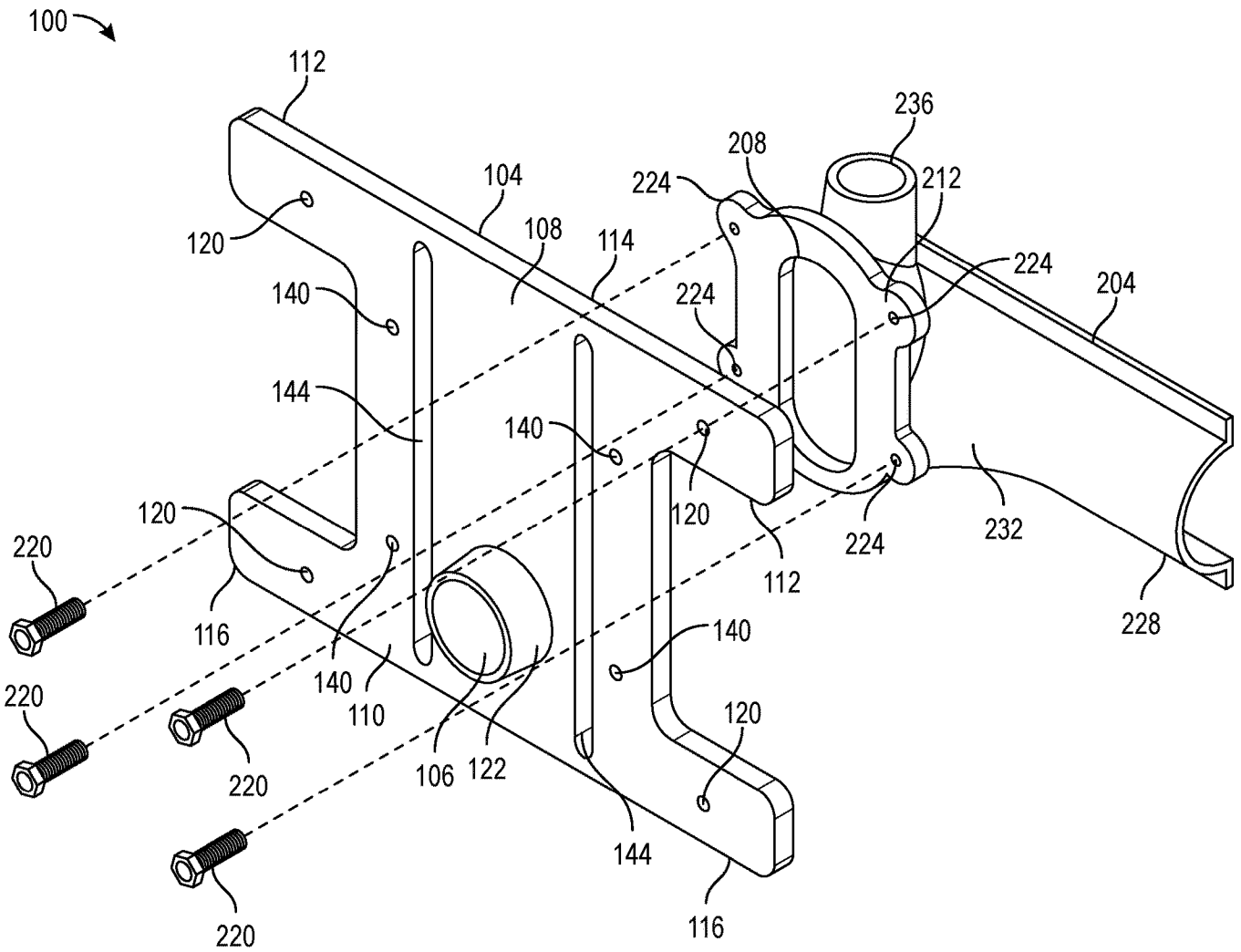
FIG. 3 is an exploded front view illustrating a faceplate and fluid coupler of the carrier assembly of FIG. 1.

FIG. 1 illustrates a carrier assembly 100 for supporting a wall-mounted water closet (e.g., a toilet, latrine, or lavatory) in an elevated cantilevered position. More specifically, the carrier assembly 100 is configured to be mounted to a modular wall assembly 300, described below, whereby the carrier assembly 100 provides a mounting location to which a water closet may be attached. Once attached, the carrier assembly 100 is configured to transmit any loads applied to the water closet (e.g., a person sitting thereon, and the like) into the wall assembly 300 for support. In the illustrated embodiment, the carrier assembly 100 not only provides physical support for the water closet but also serves as a fluid connection point by placing the outlet of the water closet in fluid communication with a corresponding wastewater pipe 308.

The carrier assembly 100 shown in FIGS. 1-4 includes a faceplate 104 and a bracket or fluid coupler 204 adjustably coupled to the faceplate 104. The faceplate 104, in turn, has an I-shaped profile including a front side 110, and a rear side 114 opposite the front side 110. In the illustrated embodiments, the two sides 110, 114, are spaced apart from one another a first distance defining a faceplate thickness T1 therebetween (see FIG. 1).

As shown in FIG. 1, the faceplate 104 includes a central portion 108 flanked by opposing upper arms 112 and lower arms 116. The upper arms 112 extend outward from the central portion 108 adjacent a top side of the central portion 108 and the lower arms 116 extend outward from the central portion 108 adjacent a bottom side of the central portion 108. Mounting openings 120 herein shown as through-holes extend through each of the upper and lower arms 112, 116 and function as mounting holes for coupling the carrier assembly 100 to a wall stud 304 of the wall assembly 300 (described below). During use, threaded fasteners 124 are driven through the mounting holes 120 into the wall assembly 300 to fixedly couple the carrier assembly 100 to the wall assembly 300.

The through-holes 120 in the opposing upper arms 112 and opposing lower arms 116 are spaced apart from one another by sixteen inches on center to align with spaced studs of the wall assembly 300, though other widths may be used dependent upon stud spacing standards. In some embodiments, the through-holes 120 are elongated slots such that the faceplate 104 can be mounted to the wall assembly 300 at positions offset from a central placement between adjacent studs of the wall assembly 300.

The faceplate 104 also defines an opening or fluid passageway 106 extending through a thickness T1 of the faceplate 104 and open to both the front side 110 and the rear side 114. More specifically, the cylindrical opening 106 is sized and shaped on the front side 110 of the faceplate 104 to align and form a water-tight seal with an outlet of the water closet. As shown, though the faceplate is generally flat (having a substantially uniform thickness T1), the passageway 106 includes a cylindrical boss or protrusion 122 that extends outward from the front side 110. While the illustrated embodiment is shown without a seal, the fluid passageway 106 may include a sealing element (e.g., a wax ring) to help provide a watertight seal between the carrier assembly 100 and the outlet of the water closet.

As shown in FIG. 1, the faceplate 104 also includes a plurality of threaded openings 140 located within the central portion 108 of the faceplate 104 for mounting the water closet to the faceplate 104. In the illustrated embodiment, the faceplate 104 includes four threaded openings 140 spaced apart from one another in a rectangular pattern to align and correspond with a similar pattern at the rear of the water closet. Threaded fasteners (not shown) extend through the rear of the water closet and into engagement with each of the openings 140 to mount the water closet to the carrier assembly 100.

The faceplate 104 additionally includes two elongated slots 144 extending substantially vertically along the height of the faceplate 104. During use, the slots 144 are configured to interface with the flange 212 of the fluid coupler 204 (described below) for coupling the two elements together. In the illustrated embodiment, the slots 144 are configured to allow the fluid coupler 204 to be vertically adjusted relative to the face plate 104. While the illustrated slots 144 are oriented substantially vertically to allow for vertical adjustment between the faceplate 104 and the fluid coupler 204, it is understood that in alternative embodiments the slots 144 may be oriented differently to permit adjustability in another orientation (e.g., horizontally and the like). In still other embodiments, the elongated slots 144 may be replaced with discrete circular openings at various locations to provide multiple, discrete mounting locations.

As shown in FIGS. 2-5, the fluid coupler 204 extends between and is configured to establish fluid communication between the opening 106 of the faceplate 104 and the wastewater pipe 308. More specifically, the fluid coupler 204 includes an inlet 208 configured to be coupled to and form a water-tight seal with the rear side 114 of the face plate 104, and an outlet 216 configured to be coupled to and form a water-tight seal with the wastewater pipe 308.

During use, the fluid coupler 204 is configured to establish at least one degree of adjustability at the inlet 208 (e.g., with respect to the faceplate 104), and at least one degree of adjustability at the outlet 216 (e.g., with respect to the wastewater pipe 308) while still forming a water-tight connection at both locations. More specifically, the fluid coupler 204 is configured to allow the inlet 208 to be adjusted vertically relative to the faceplate 104 and configured to allow the outlet 216 to be adjusted axially along the length of the wastewater pipe 308.

The inlet 208 of the fluid coupler 204 at least partially encloses a flange 212. The flange 212, in turn, forms a substantially obround shape that is elongated in the vertical direction (e.g., the direction of adjustability). The inlet 208 also defines a plurality (e.g., four) of openings 224 sized to allow a fastener to pass therethrough.

When assembled, fasteners extend through the slots 144 of the faceplate 104 and into engagement with openings 224 (e.g., threaded openings) to couple the faceplate 104 to the fluid coupler 204. By doing so, the fasteners place the flange 212 into contact with the rear side 114 of the faceplate 104 forming a water-tight seal therebetween. The combined use of the elongated slots 144 with the circular openings 224 permits an installer to vary the relative vertical location of the faceplate 104 relative to the fluid coupler 204 while maintaining the water-tight seal therebetween.

To further facilitate the vertical adjustability between the faceplate 104 and the fluid coupler 204, the obround shape of the inlet 208 permits full alignment of the inlet 208 with the opening 106 in the faceplate 104 at various heights within the mounting range permitted by the elongated slots 144. Stated differently, the inlet 208 and flange 212 enclose a volume that completely encompasses the opening 106 of the faceplate 104 over a range of relative mounting positions therebetween. The resulting alignment between the elements 106, 208 does not substantially decrease the cross-sectional area of the fluid flow path through the carrier assembly as fluid travels through the faceplate 104, into the fluid coupler 204, and to the wastewater pipe 308.

Figure 4:
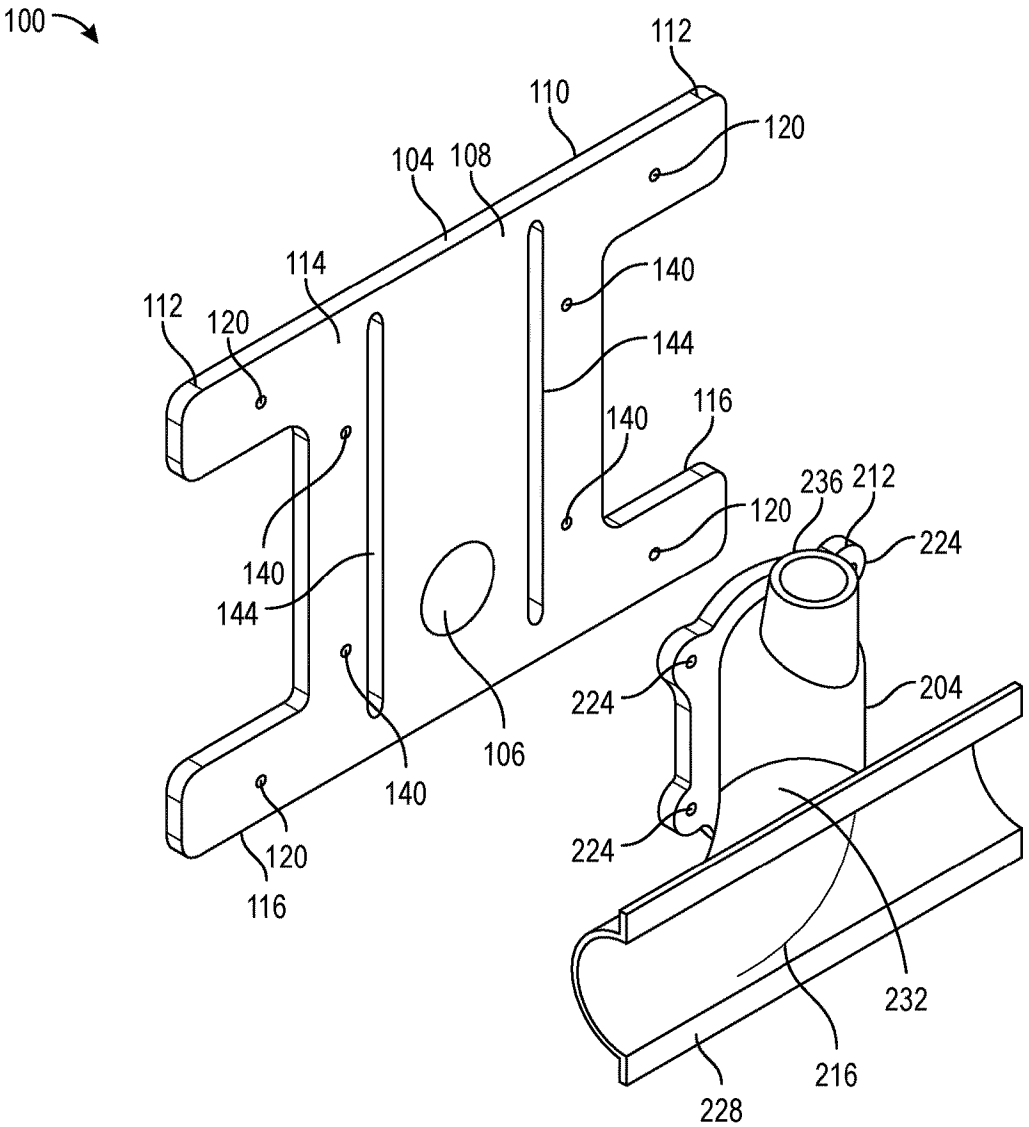
FIG. 4 is an exploded rear view illustrating the faceplate and fluid coupler of the carrier assembly of FIG. 1.
Figure 5:
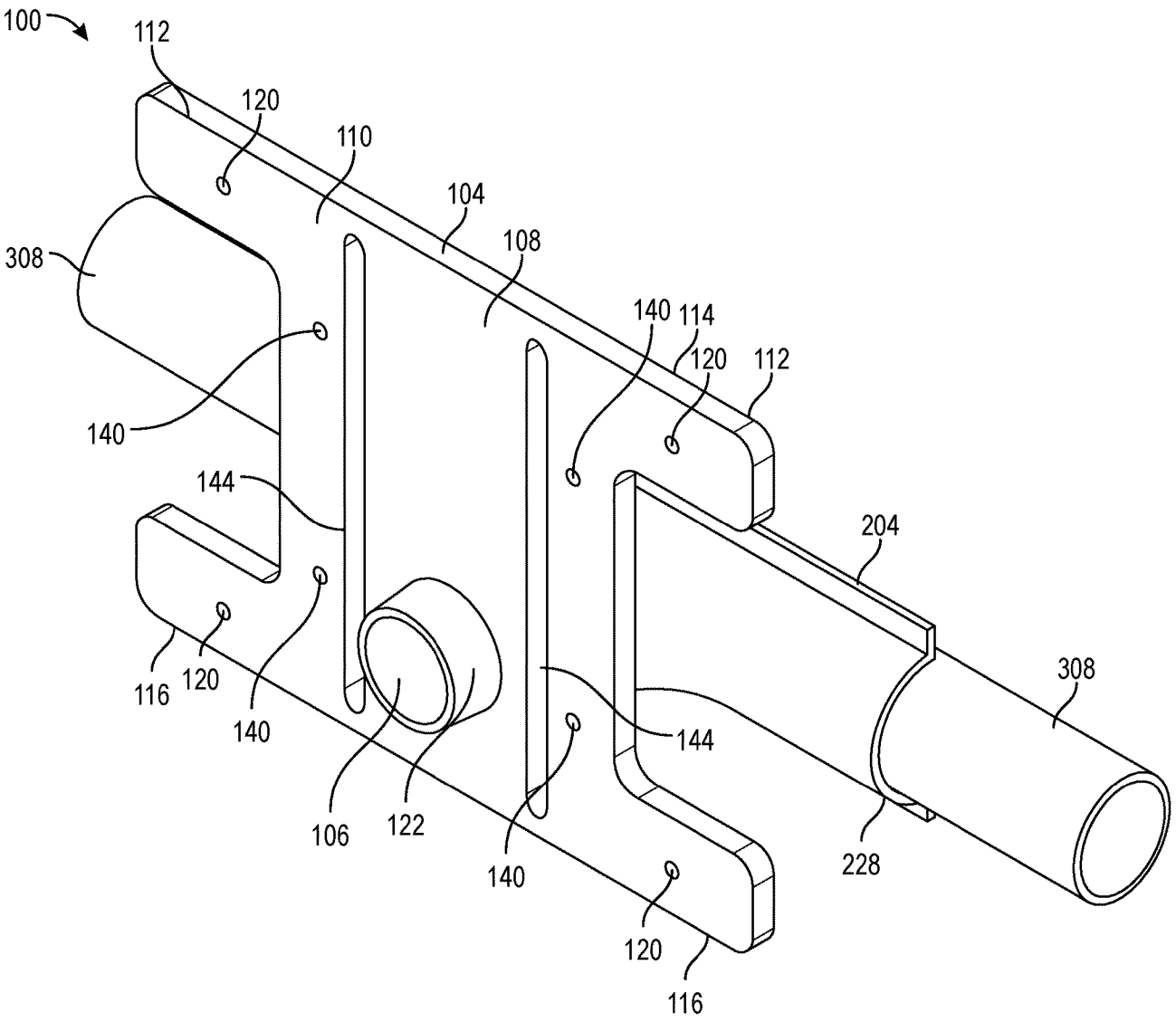
FIG. 5 is a perspective view of the carrier assembly of FIG. 1 positioned relative to a wastewater pipe.

As shown in FIG. 4, the outlet 216 of the fluid coupler 204 is a saddle tee and includes a first pipe portion 228 extending substantially perpendicular to the inlet 208 and flange 212, with the first pipe portion 228 having a semicircular cross-section. The inner radius of the first pipe portion 228 is similar to the outer radius of the wastewater pipe 308 such that the pipe portion can rest snugly against the wastewater pipe 308 and form a water-tight connection therebetween. The first pipe portion 228 is coupled to the flange 212 via a second pipe portion 232, the second pipe portion 232 extending between the inlet 208 at the flange 212 and the outlet 216 at the first pipe portion 228. The second pipe portion 232 follows an arc along its length such that the fluid flow through the second pipe portion 232 flows into the wastewater pipe 308 in a draining direction.

As a saddle tee, the fluid coupler 204 can be coupled to and integrated into an existent, installed wastewater pipe 308 by fastening the fluid coupler 204 to the wastewater pipe 308 (i.e., adhering the first pipe portion 228 to the outside of the wastewater pipe via a plumbing adhesive) and boring a hole into the wastewater pipe 308 that aligns with the outlet 216. By doing so, the outlet 216 of the fluid coupler 204 can be located anywhere along the length of the pre-existing wastewater pipe 308. In alternative embodiments, the first pipe portion 228 of the fluid coupler 224 may be fully cylindrical and installed inline between adjacent upstream and downstream wastewater pipes 308 such that the first pipe portion 228 forms a portion of the wastewater pipe 308.

The fluid coupler 204 further includes a vent 236 extending vertically upward from the second pipe portion 232. The vent 236 provides a fluid or air path between other plumbing fixtures via a pipe 328 (FIGS. 8-10) separate from the wastewater pipe 308. More specifically, the pipe 328 connects.

Wall assemblies 300 include a plurality of studs 304 spaced apart at substantially regular intervals between a bottom plate 312 and a top plate 316. While some uses, such as residential uses, may use wood lumber for the structure 304, 312, 316 of the wall assembly 300, the illustrated embodiment utilizes a metal (e.g., aluminum, steel, etc.) structure (see FIGS. 7A-7C). Such a metal structure may be more commonly utilized in a larger industrial or retail atmosphere. Collectively, the studs 304, bottom plate 312, and top plate 316 define an internal wall volume 320 having regularly spaced gaps 324 vertically between the top and bottom plates 116, 112 and laterally between the adjacent studs 304. A finishing surface (e.g., drywall, tile, paneling) is affixed to a front side of the wall assembly located outside of the internal wall volume 320 to cover the plates 112, 116, studs 304, and gaps 324.

Figure 6:
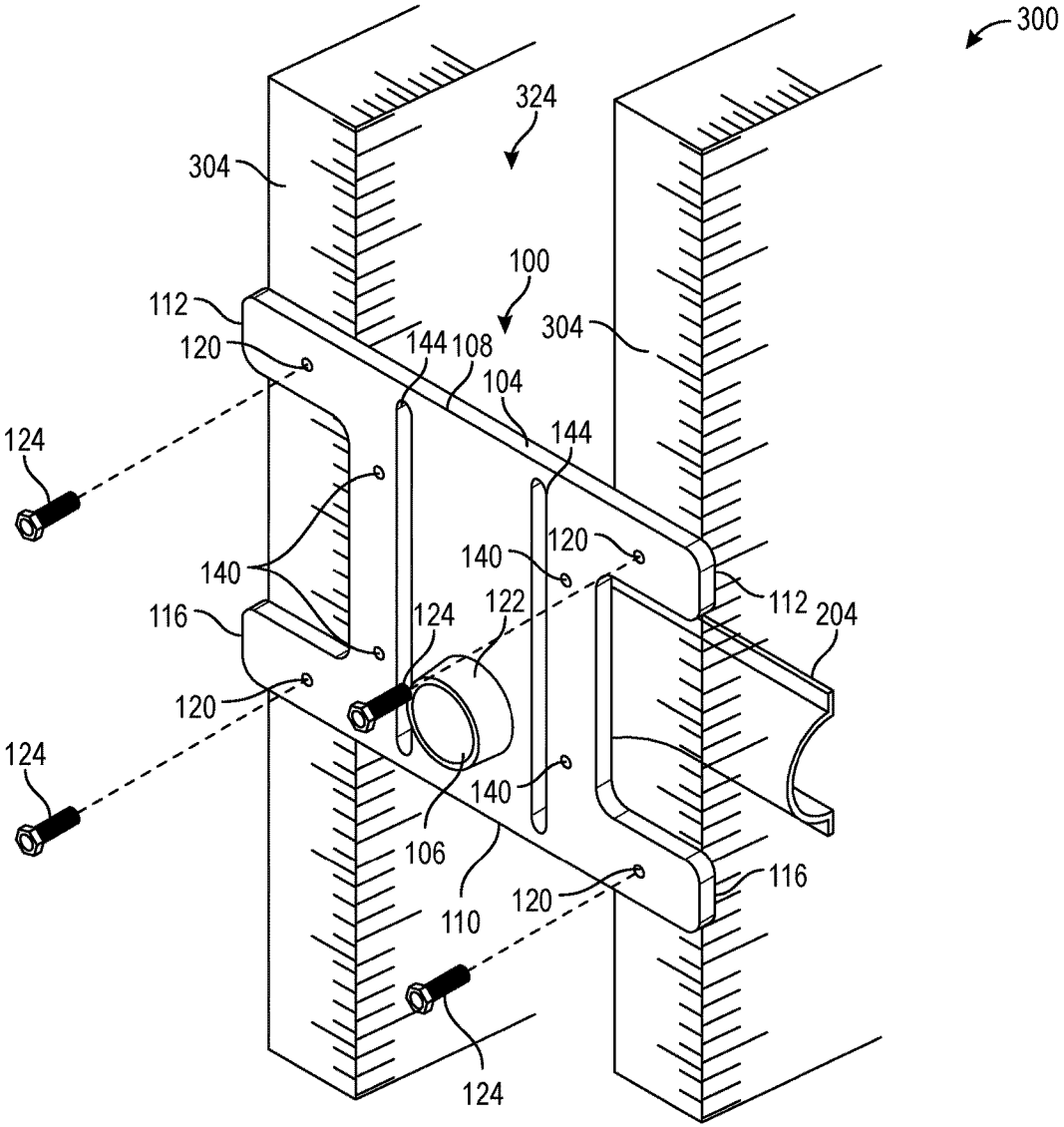
FIG. 6 is a perspective view of the carrier assembly of FIG. 1 positioned relative to a wall assembly.
Figures 7A, 7B, 7C:
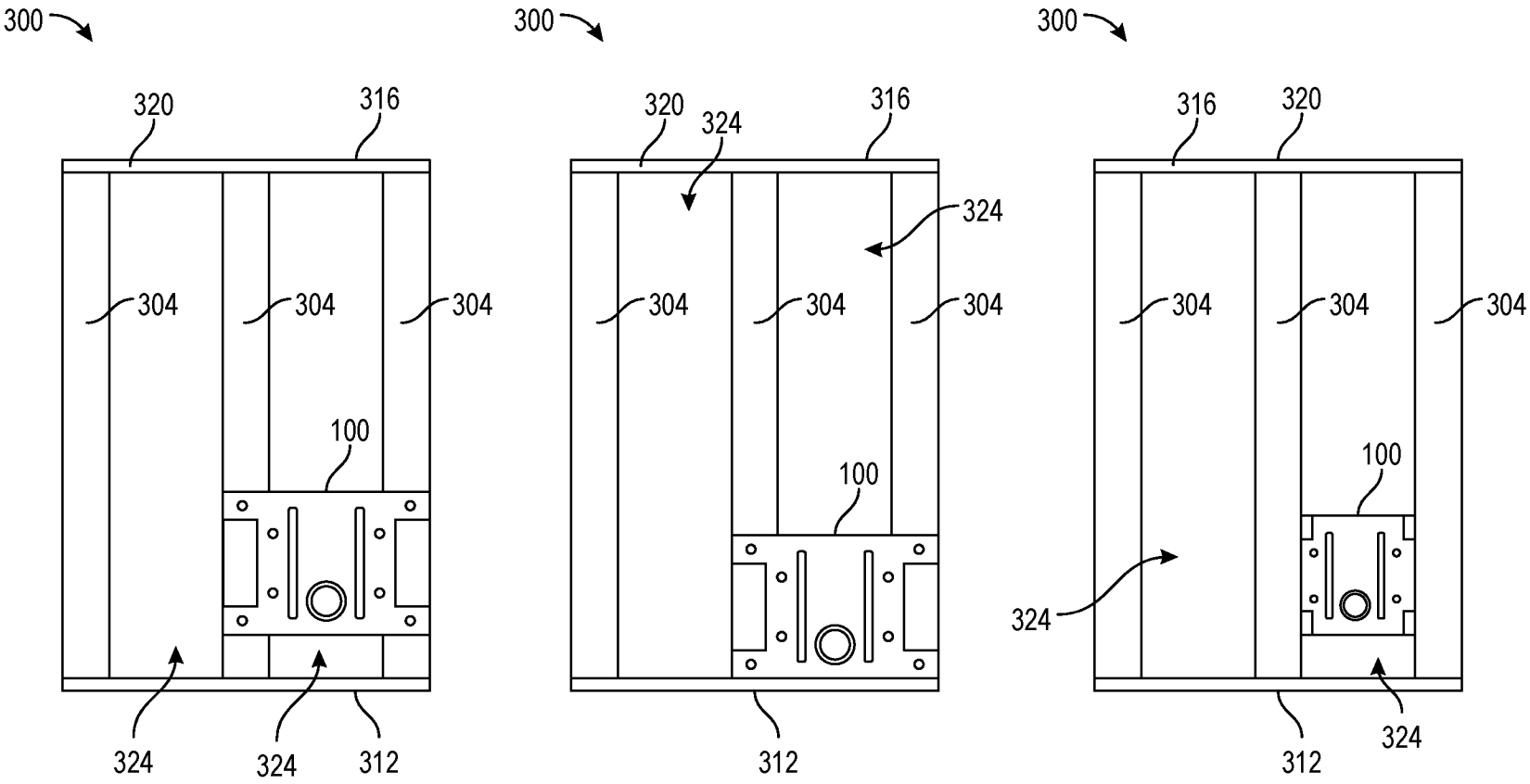
FIGS. 7A-7C are simplified front views of a modular wall assembly with carrier assemblies of various embodiments.
Figure 8:
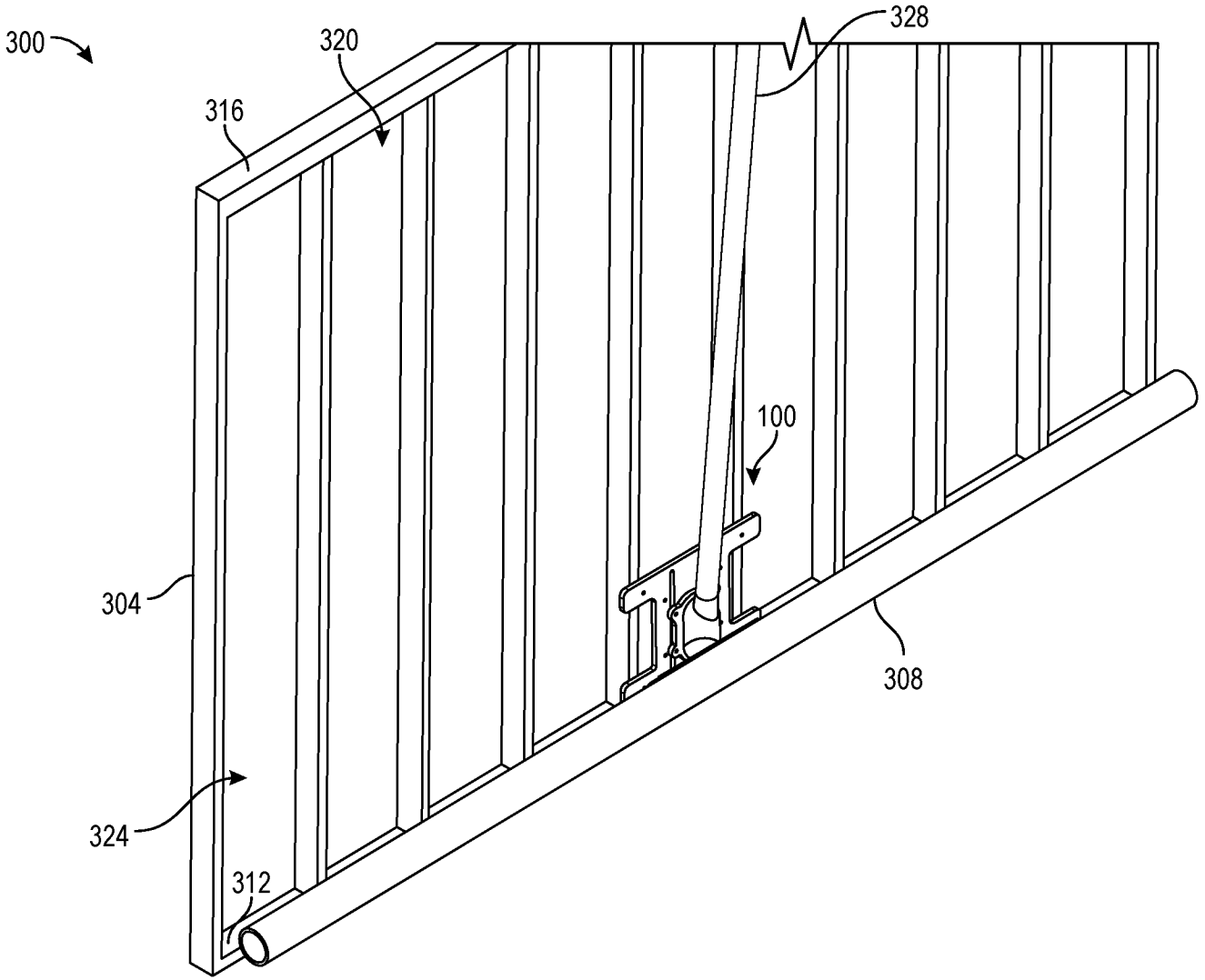
FIG. 8 is a rear perspective view of the carrier assembly positioned relative to a wall assembly in another embodiment.

In some embodiments, such as the embodiment shown in FIGS. 6-8, the wall assembly is a modular, prefabricated wet wall assembly that is fully assembled prior to installation. The bottom plate 312, top plate 316, and studs 304 are assembled together to define the internal wall volume 320 prior to delivery to the final installation location where the wall assembly 300 will function as one of the walls of a bathroom and may function as the wall separating two bathrooms. The wastewater pipe 308 and other pipes (e.g., water supply pipe) and fixtures are additionally preinstalled within the internal wall volume 320 prior to delivery of the complete wall assembly 300 at the installation location. In some embodiments, the carrier assembly 100 is likewise preinstalled within the wall assembly 300 prior to delivery and installation of the modular wall.

Therefore, the carrier assembly 100 is not fastened to the bottom plate 312 via threaded fasteners but is instead fastened only to the adjacent studs 304. As shown in FIG. 7A, the carrier assembly 100 is situated at a height above the bottom plate 312. In other embodiments, such as shown in FIG. 7B, a lower surface of the carrier assembly 100 may rest upon the bottom plate 312 without fasteners directly coupling the carrier assembly 100 to the bottom plate 312.

The lower surface of the carrier assembly 100 may be sized to provide balance and support, even if not fastened thereto. In some embodiments, the lower surface of the carrier assembly 100 may be otherwise coupled to the bottom plate 312 via non-penetrative fasteners, such as an adhesive.

In some embodiments, as shown in FIGS. 7A and 7B, the carrier assembly 100 is fastened to a front side of the studs 304 of the wall assembly 300, with the threaded fasteners 124 extending through the mounting openings 120 in the upper and lower arms 112, 116. In such embodiments, the faceplate 104 100 is located outside of the internal wall volume. Alternatively, the studs 304 may include cutouts sized to accept the carrier assembly 100 at a specified height such that when the mounting openings 120 are aligned with the studs, the front of the faceplate 104 is flush with or recessed within the front face of the studs 304 such that the faceplate 104, and carrier assembly 100 as a whole, is located fully within the internal wall volume.

In other embodiments, as shown in FIG. 7C, the upper and lower arms 112, 116 may be bent ninety degrees such that the opposing mounting openings 120 in the upper arms 112 are parallel to one another and the opposing mounting openings 120 in the lower arms 116 are likewise parallel to one another. Additionally, the faceplate 104 is narrower to fit between adjacent studs 304. The fasteners 124 therefore extend through the mounting openings 120 to engage an internal surface of the studs 304.

Figure 10:
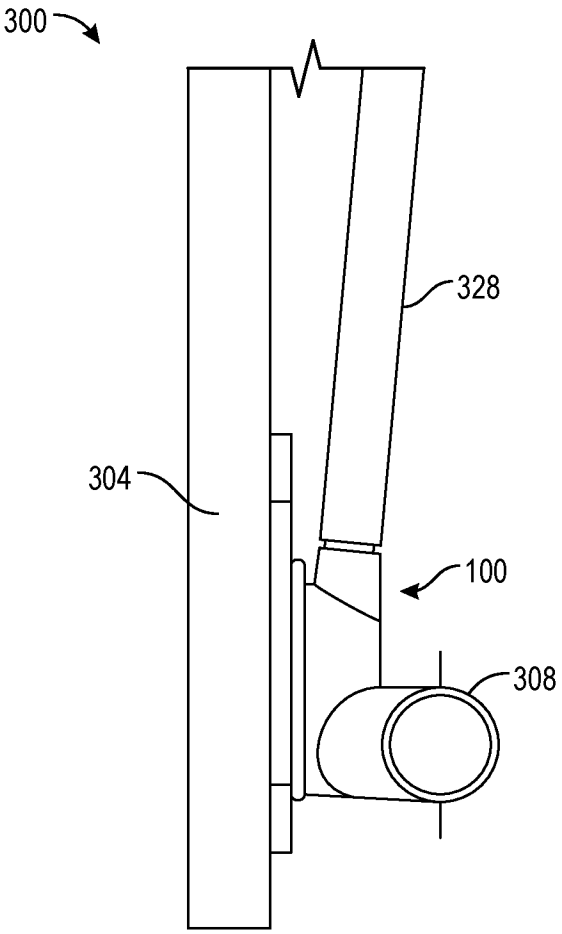
FIG. 10 is a side view of the carrier assembly of FIG. 8.
Figure 9:
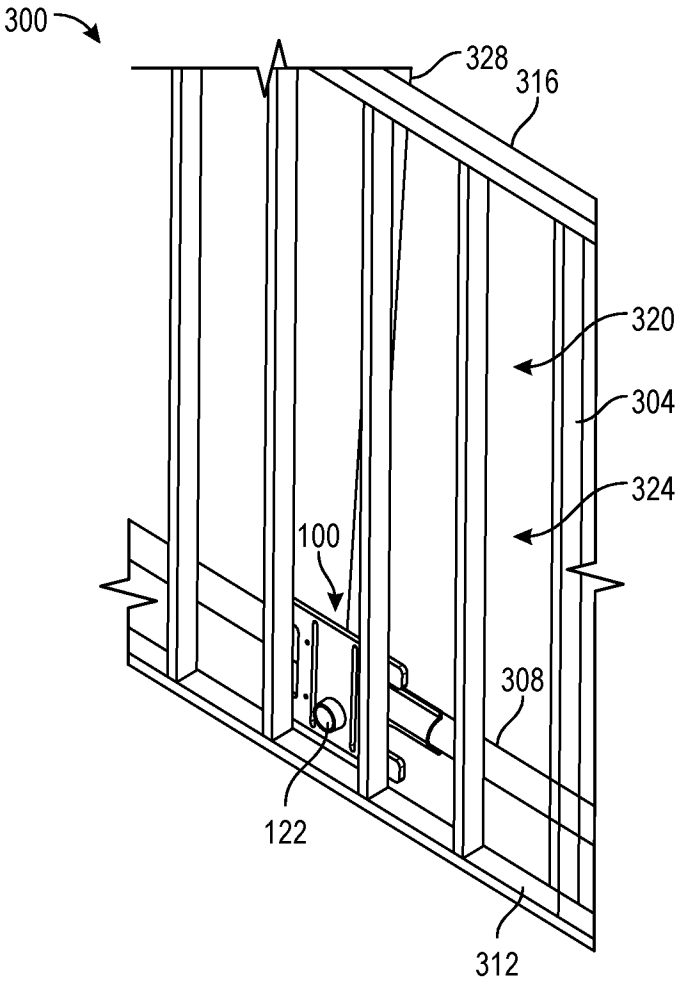
FIG. 9 is a front perspective view of the carrier assembly of FIG. 8.

In yet other embodiments, as shown in FIGS. 8-10, the carrier assembly 100 is mounted to a rear side of the wall studs 304 such that the cylindrical protrusion 122 is the only portion of the carrier assembly 100 that extends into the internal wall volume 320, with the remainder of the carrier assembly 100 being positioned behind the wall assembly 300. Such an arrangement may be provided in environments where spacing is provided behind wall assemblies to facilitate large plumbing arrangements or full technician access.

The protrusion 122 may have an extended length to pass through the internal wall volume and engage the mating outlet of the water closet. Alternatively, an insert (not shown) may be mounted between the protrusion 122 and the outlet of the water closet to complete the connection.

Figures 11, 12:
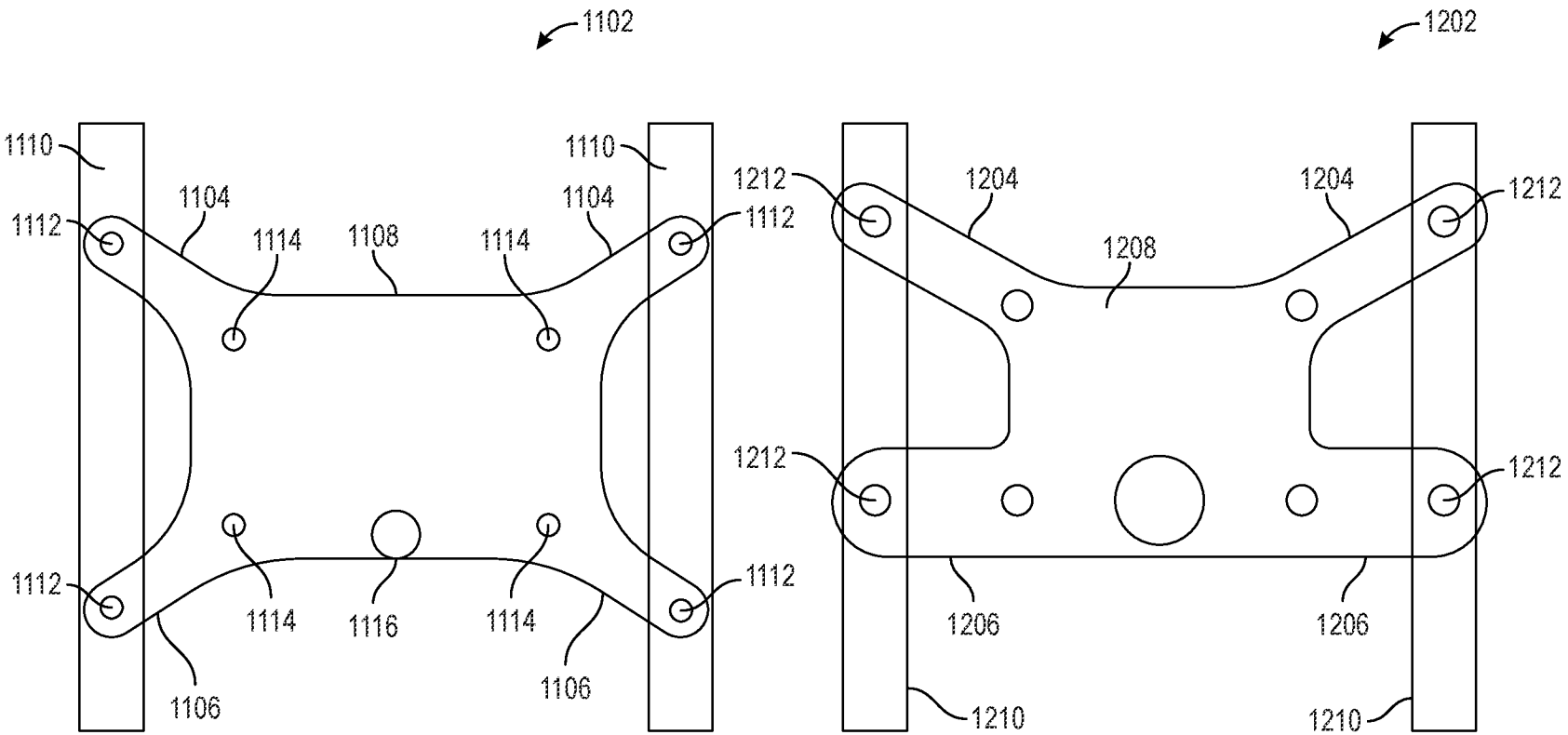

FIGS. 11-12 illustrates alternative embodiments of a faceplate 1102, 1202 having upper arms 1104, 1204 and lower arms 1106, 1206 that extend in directions that differ from those on the faceplate 104 (discussed above). Each faceplate 1102, 1202 includes two upper arms 1104, 1204 that extend outward from a central, rectangular portion 1108, 1208 of the faceplate 1102, 1202. More specifically, each of the arms 1104, 1106, 1204, 1206 extends from a corresponding corner of the rectangular portion 1108, 1208 of the faceplate 1102, 1202. The two upper arms 1104, 1204 extend upward and outward (left and right, as shown) from the rectangular portion 1108, 1208, at approximately 45-degree angles measured from vertical from their respective corner. However, in alternative embodiments, the two upper arms 1104 arms may extend from their corner at other angles from vertical such as, but not limited to 0 degrees, 20 degrees, 30 degrees, 60 degrees, 90 degrees, 110 degrees, 120 degrees, 135 degrees, 150 degrees, 160 degrees, and the like.

The two lower arms 1106 extend downward and outward from the rectangular portion 1108 at similar angles as the upper arms 1104 such that the lower left arm 1106 extends downwardly and outwardly from the central, rectangular portion 1108, 1208 substantially parallel with (or colinear to) the upper right arm 1104 and the lower right arm 1106 extends downwardly and outwardly from the central, rectangular portion 1108, 1208 substantially parallel with (or colinear to) the upper left arm 1104. More specifically, the lower left arm 1106 and the lower right arm 1106 both extend from the central, rectangular portion 1108, 1208 at approximately 135 degrees from vertical. However, in alternative embodiments the two lower arms 1106 may extend from their corner at other angles from vertical such as, but not limited to 20 degrees, 30 degrees, 60 degrees, 90 degrees, 110 degrees, 120 degrees, 135 degrees, 150 degrees, 160 degrees, 180 degrees, and the like.

The faceplate 1202 shown in FIG. 12 is substantially similar to the faceplate 1102, though the lower arms 1206 do not extend down from the rectangular portion 1208, instead only extending outward from the rectangular portion 1208 (e.g., forming a 90-degree angle relative to vertical). The distal ends of each arm 1104, 1106, 1204, 1206 of the faceplate 1012, 1202 couple to studs 1110, 1210 of the wall assembly, as described above with respect to FIGS. 1-10. Fasteners (e.g., threaded fasteners) extend through openings 1112, 1212 at the distal ends of the arms 1104, 1106, 1204, 1206 and into the studs 1112, 1212 of the wall assembly. The wall studs 1112, 1212 may include threaded openings to accept the fasteners or may otherwise include a separate fastener (e.g., a nut) to secure the respective arm 1104, 1106, 1204, 1206 to the respective stud 1112, 1212. The faceplate 1102, 1202 additionally includes mounting holes 1114, 1116, 1212, 1216 for coupling to plumbing implements and the water closet. In still other embodiments, it is understood that the arms 1104, 1106, 1206, 1204 may include alternative sizes and shapes. For example, in some embodiments the legs may not extend in a linear direction, but rather form a dogleg or have other bends and/or contours needed to accommodate the size and shape of the corresponding studs.

Figure 13:
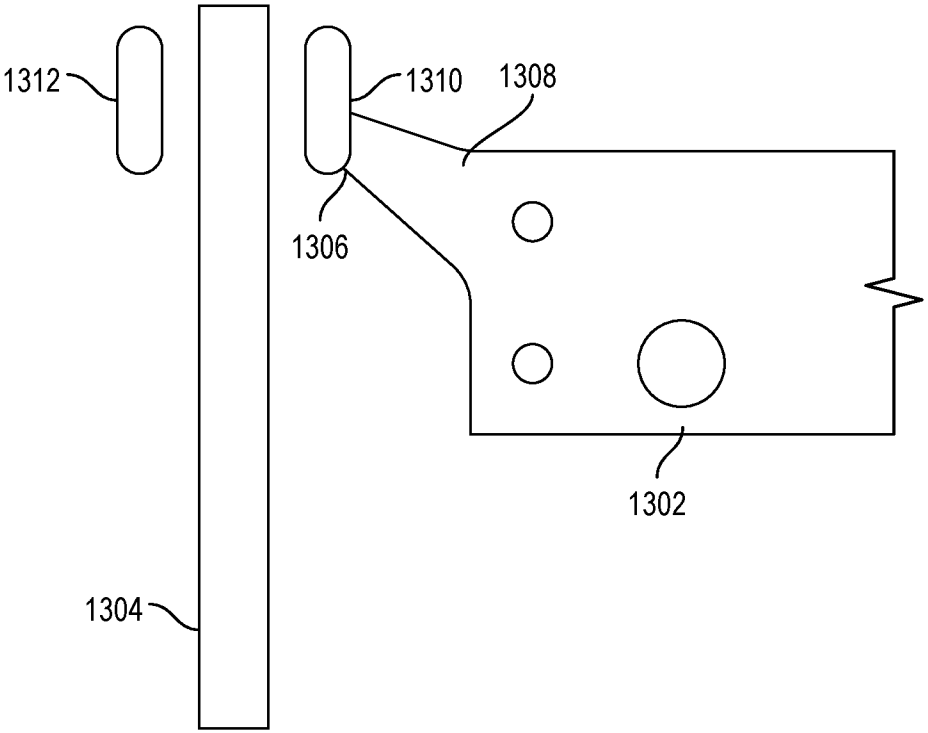

FIG. 13 illustrates an alternative embodiment of a faceplate 1302. As shown, the distal ends 1306 of the arms 1308 of the faceplate 1302 include magnets 1310. The magnet 1310 may, in turn, magnetically couple directly to a metal stud 1304 of a corresponding wall if the metal stud 1304 has sufficient magnetism. Alternatively, or additionally, a separate magnet 1312 may be coupled to and located within or adjacent the stud 1304 for increasing the magnetic attraction produced at the joint for coupling the faceplate 1302 to the stud 1304. In still other embodiments, the magnet 1310 may be covered with a high friction material to improve the holding power of the connection. In still other embodiments, the magnet 1310 may include studs or protrusions to engage the stud 1304 to increase the strength of the joint in the vertical direction.

Figure 14:
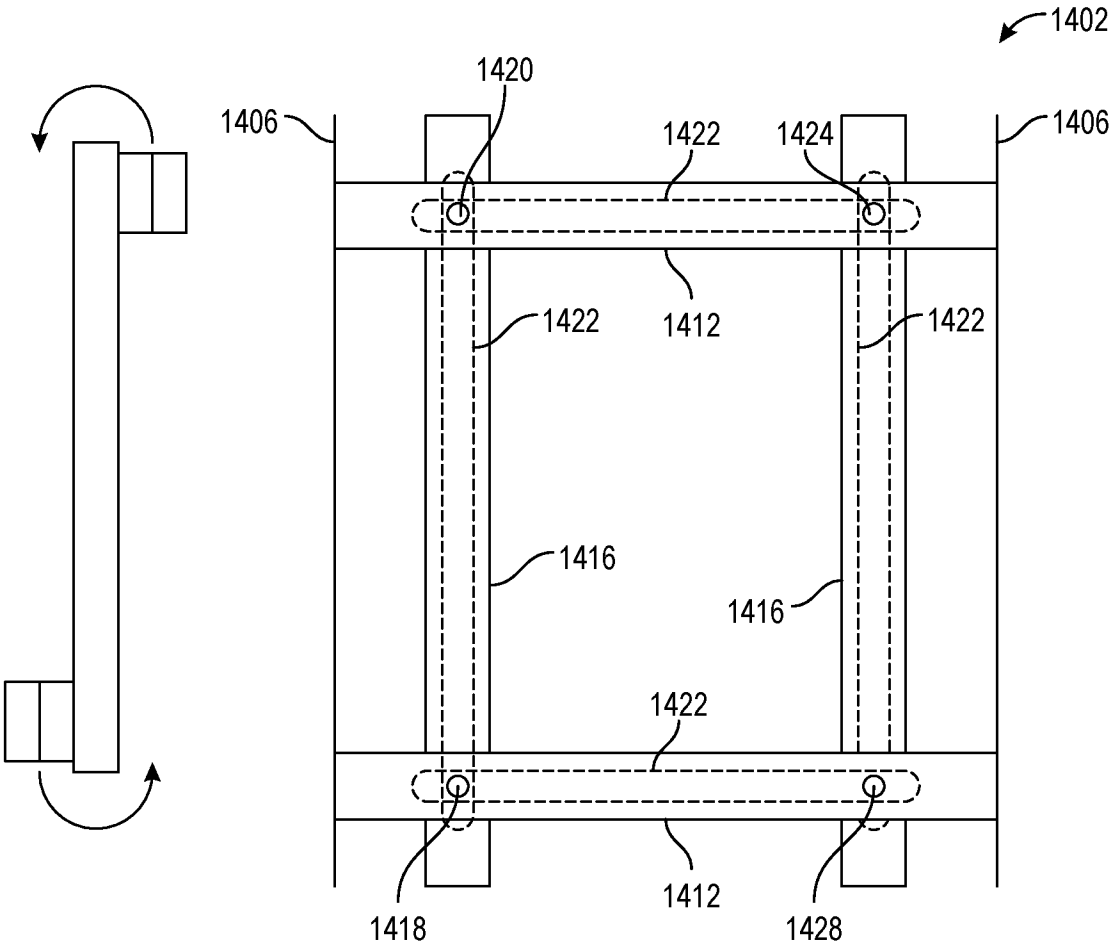

FIG. 14 illustrates an intermediate assembly 1402 for mounting a faceplate to the studs 1406 of the wall assembly. The intermediate assembly 1402 includes two horizontal cross braces 1412 that extend between adjacent wall studs 1406. Each of these horizontal cross braces 1412 is fastened to each of the adjacent wall studs 1406 to prevent relative movement therebetween. Two vertical braces 1416 extend between the horizontal cross braces 1412, are fastened to the horizontal cross braces 1412, and extend generally perpendicular to the horizontal cross braces 1412. The horizontal cross braces 1412 and vertical braces 1416 each include a longitudinal slot 1422 extending along a majority of the length of each respective cross brace 1412, 1416. A first fastener 1420 extends through the longitudinal slots 1422 of the first vertical brace 1416 and the first horizontal cross brace 1412. A second fastener 1418 extends through the longitudinal slots 1422 of the first vertical brace 1412 and the second horizontal cross brace 1416. A third fastener 1424 extends through the longitudinal slots 1418 of the second vertical brace 1426 and the first horizontal cross brace 1412.

A fourth fastener 1428 extends through the longitudinal slots 1422 of the second vertical brace 1426 and the second horizontal cross brace 1416. When the fasteners 1420, 1418, 1424, 1428 are loosened, the braces 1412, 1416 are capable of relative movement. More specifically, the vertical braces 1416 are able to move horizontally, vertically, and rotationally relative to the horizontal braces 1412 which are fixed relative to the studs 1406. In the illustrated embodiment, the movement of the vertical braces 1416 is generally limited to within a plane defined by the horizontal braces 1412.

When the fasteners 1420, 1418, 1424, 1428 are tightened, the braces 1412, 1416 are prohibited from relative movement and become fixed. As such, an installer can set any of a plurality of distances and spacing between the braces 1412, 1416 to accommodate wall studs 1406 and faceplates 1404 of different spacing and sizes. If it is determined that the faceplate 1404 is at a height below a desired height, the position of the apparatus 1430 can be quickly adjusted by loosening two or four of the fasteners 1420, 1418, 1424, 1428 and repositioning the braces 1412, 1416 relative to one another and/or relative to the adjacent wall studs 1406.

Figure 15:
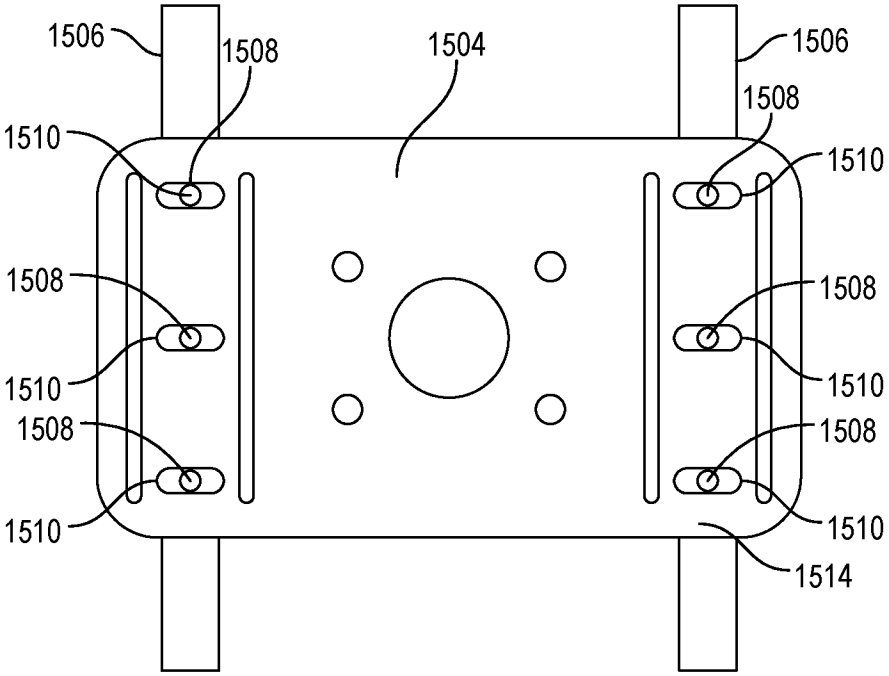

FIG. 15 illustrates an alternative embodiment of a faceplate 1504 that mounts to the front or rear faces of two adjacent wall studs 1506. The faceplate 1504 includes multiple slots 1508 that are elongated in a widthwise direction (perpendicular to the vertical height when mounted). As shown, three elongated slots 1508 are formed along each widthwise side of the faceplate 1504 to align with the two studs 1506 used to support the faceplate 1504. The use of slots 1508 as opposed to circular openings allows for some left/right widthwise adjustment of the location of the faceplate 1504 relative to the studs 1506. Fasteners 1510 such as threaded fasteners extend through the slots 1508 and into the studs 1506 to hold the faceplate 1504 to the stud 1506. In some embodiments, each of the six slots 1508 receives a fastener 1510. A washer 1514 (e.g., an EDPM washer) may additionally be used adjacent the head of each fastener 1510 to increase the surface area of the faceplate 1504 that is engaged by the fastener 1510.

Figure 16:
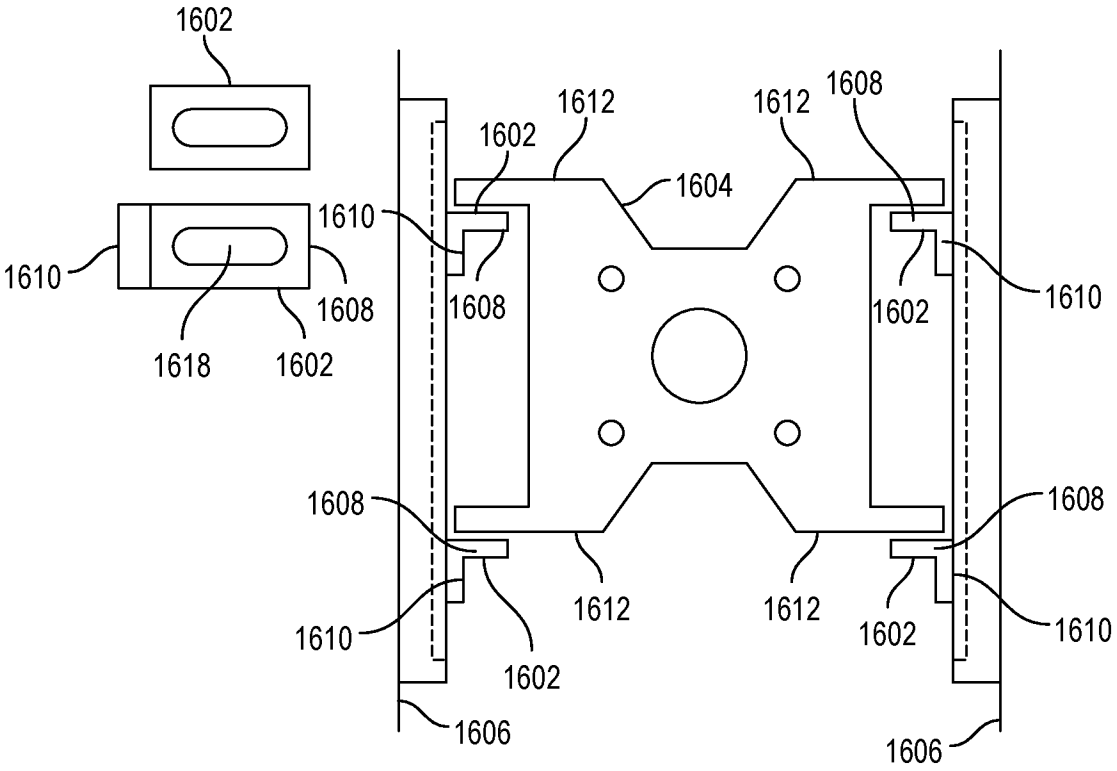

FIG. 16 illustrates a still further alternative embodiment of a faceplate 1602 that is coupled to a pair of wall studs 1606 via brackets 1602. As shown, the system incorporates four brackets 1602, each bracket extending between and being mounting to a stud 1606 and one corner or mounting point of the faceplate 1604. The brackets 1602 are L-brackets with one arm 1608 (the vertical arm) of the L-bracket extending along the inner wall of the stud 1606 (against which the L-bracket 1602 is positioned) and the other arm (the horizontal arm) 1610 of the L-bracket 1602 extending horizontally inward into the space between the adjacent wall studs 1606 into which the faceplate 1604 is mounted. The faceplate 1604 has outwardly extending legs 1612 (extending outward in a widthwise direction from a main body portion). Each of the legs 1612 rests upon one of the brackets 1602, and more specifically, on one of the arms 1610 of the L-bracket 1602 that extends into the space. The vertical arms 1614 are attached to their respective wall stud 1606 via, for example, threaded fasteners, magnets, etc. The faceplate 1604 can be lifted onto the brackets 1602. The brackets 1602 support the faceplate 1604 at the desired height without yet attaching the faceplate 1604. The brackets 1602 include elongated slots 1618 (elongated in the widthwise direction) such that the brackets 1602 can be mounted on wall studs 1606 having varying widths (within a range allowable by the slots 1618). Additionally, the faceplate 1604 can be secured at a position that is offset from the center of the posts. The legs 1612 of the faceplate 1604 may additionally or alternatively include elongated slots 1618 to provide added versatility in use. A first fastener extends through the L-shaped bracket 1602 and into the wall stud 1606 to secure the bracket 1602 to the stud 1606. A second fastener extends through a leg 1612 of the faceplate 1604 and into the elongated slot 1618 of the bracket 1602 to secure the faceplate 1604 relative to the wall studs 1606 via the brackets 1602.

Figure 17:
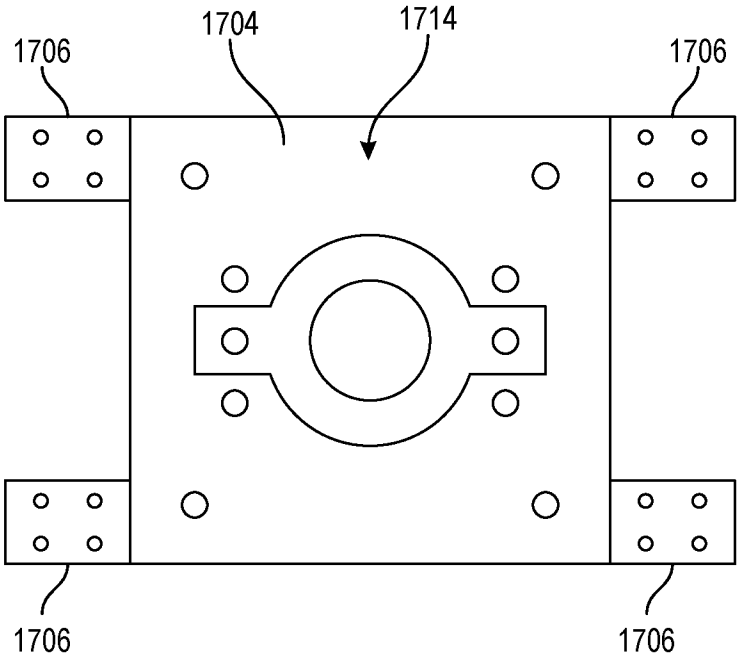

FIG. 17 illustrates a still further embodiment of a faceplate 1704 in which each arm 1706 includes a plurality of openings for mounting fasteners through the openings and into a pair of wall studs. The openings align with similar openings in a front or rear face of adjacent wall studs. The openings are through openings, each allowing a fastener to extend through the faceplate 1704 and into a front or rear surface of the studs. Each of the fasteners extends through the respective opening in a direction that is perpendicular to the planar surface 1714 of the faceplate 1704 that bridges the gap between the adjacent wall studs. In some embodiments, this faceplate 1704 and other faceplates 1704 described herein may be cast as a single faceplate 1704. In still other embodiments, the plurality of openings may be used to make small adjustments to the location of the faceplate 1704. More specifically, in instances where the location of the fastener is already determined, the user may slightly alter the vertical and horizontal location of the faceplate 1704 by altering which of the plurality of openings the fastener is inserted into.

Figure 18:
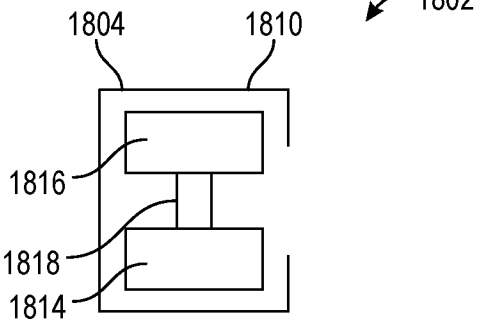
Figure 19:
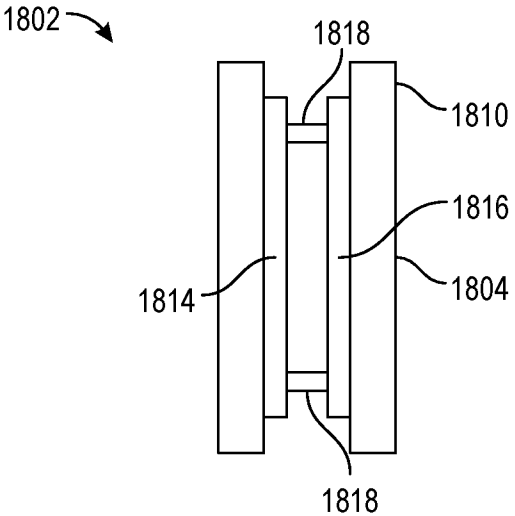

FIGS. 18-19 illustrate a reinforcing component 1802 that is inserted into the wall studs 1804 to further strengthen the wall studs 1804, especially at locations adjacent to the mounting points for the faceplate 1804. In some embodiments, the wall studs 1804 are metal wall studs and are formed as a hollow C-channel. To improve strength, especially in wall studs 1804 tasked with supporting high-weight fixtures, the reinforcing component 1802 is inserted into the C-channel 1810. The reinforcing component 1802 includes a first block 1814 and a second block 1816 separated by a threaded adjustment mechanism 1818. The first and second blocks 1814, 1816 are sized to substantially fill the interior of the C-channel 1810. In some embodiments, the thickness of the blocks 1814, 1816 allows the blocks 1814, 1816 to be inserted through the opening of the C-channel 1810 and rotated into position. The blocks 1814, 1816 are mounted on a threaded rod 1818 such that rotation of the threaded rod in a first direction pushes the blocks 1814, 1816 outward (away from each other) to apply pressure on the interior walls of the C-channel 1810. This arrangement provides reinforcing strength to the C-channel 1810.

In still other embodiments, the reinforcing component 1802 can also serve as a mounting location for a faceplate in instances where the user does not wish to drill holes into the stud 1804 itself. In such embodiments, the reinforcing component 1802 would be positioned within the C-channel 1810, expanded to engage the interior walls of the C-channel 1810 so that the reinforcing component 1802 is fixed relative thereto, and then faceplate (not shown) can be mounted to the reinforcing component 1802.

Figure 20:
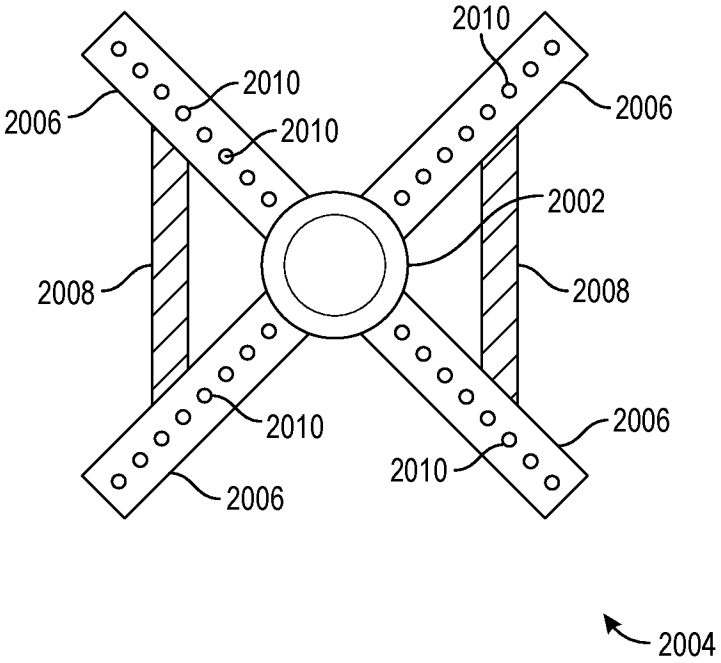

FIG. 20 illustrates a further embodiment of a faceplate 2004 that omits much of the material of other faceplates, instead comprising a central annular portion 2002 defining the central fluid passageway and a plurality (e.g., four) of arms 2006 extending radially outward from the central annular portion 2002. In the illustrated embodiment, each arm of the plurality of arms 2006 is offset from the adjacent arms 2006 by approximately ninety degrees. However, in alternative embodiments the arms 2006 may extend at different angles relative to the passageway and with respect to each other. In still other embodiments, the arms 2006 may be individually adjustable. In still other embodiments, more or fewer arms may be present as needed.

In the illustrated embodiment, two of the arms 2006 extend toward one of the wall studs 2008 and the other two arms 2006 extend toward the other wall stud 2008. The arms 2006 include a plurality of apertures 2010 (through holes) spaced along the length thereof for accommodating fasteners at various locations. By doing so, the apertures 2010 permit the faceplate 2004 to be adjustably mounted between two studs 2008. More specifically, the apertures are spaced such that the apertures 2010 permit the faceplate 2004 to be mounted between a pair of studs 2008 spaced at varying distances from each other. For example, as the distance between the studs 2008 grow greater, the use may simply direct a fastener through an aperture 2010 spaced further from the central annular portion 2002. Still further, the apertures 2010 allow the relative position of the central annular portion 2002 to be adjusted between the two studs themselves 2008. For example, if the user wishes the central annular portion 2002 to be positioned off-center between a pair of suds 2008 the user can "shift" the central annular portion 2002 to the side by advancing one pair of arms 2006 to apertures 2010 closer to the annular portion 2002 and advancing the opposing pair of arms 2006 to apertures 2010 further from the annular portion 2002. In some embodiments, the faceplate 2004 shown is only a first portion of a faceplate 2004 for spanning the gap and providing a mounting location for a second portion of the faceplate 2004, such as a rectangular portion shown in, for example, FIG. 15. The radially spaced apertures 2010 may be used for mounting the second portion to the first portion. In still other embodiments, reinforcing elements may extend between adjacent arms 2006 to increase the overall strength of the device.

Figure 21:
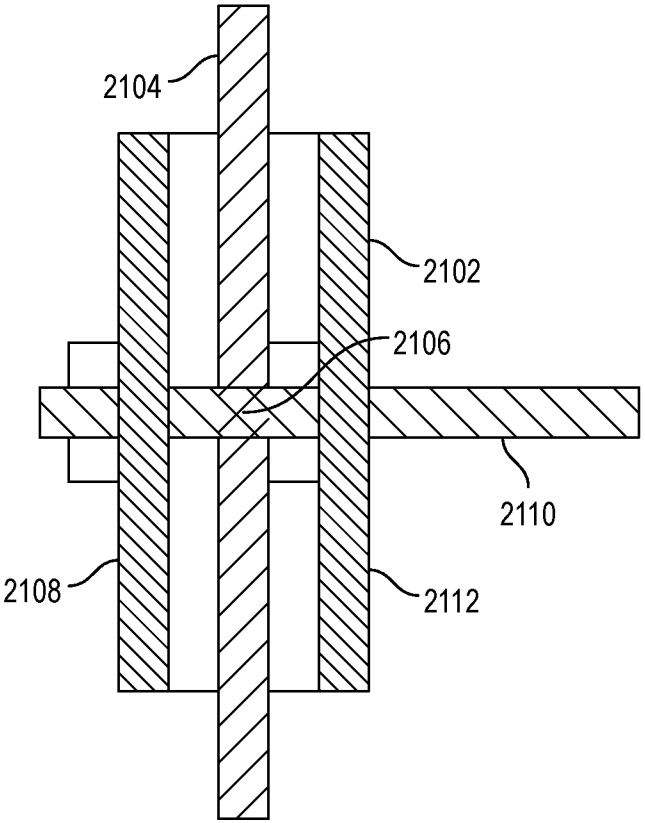

FIG. 21 illustrates an alternative method of mounting the faceplate 2104 to a wall stud 2102. The wall studs 2102, in the illustrated embodiment, are a C-channel 2106 having an opening extending the length of the wall stud 2102. As shown, in some embodiments, the faceplate 2104 may be inserted into the C-channel 2106 such that a portion of the faceplate 2104 is located within the C-channel 2106. A fastener 2110 extends through one sidewall 2108 of the C-channel 2104, through an aperture 2106 in the faceplate 104, and through a second sidewall 2112 (opposite the first sidewall 2108) to couple the faceplate 2104 to the wall stud 2102.

Figure 22:
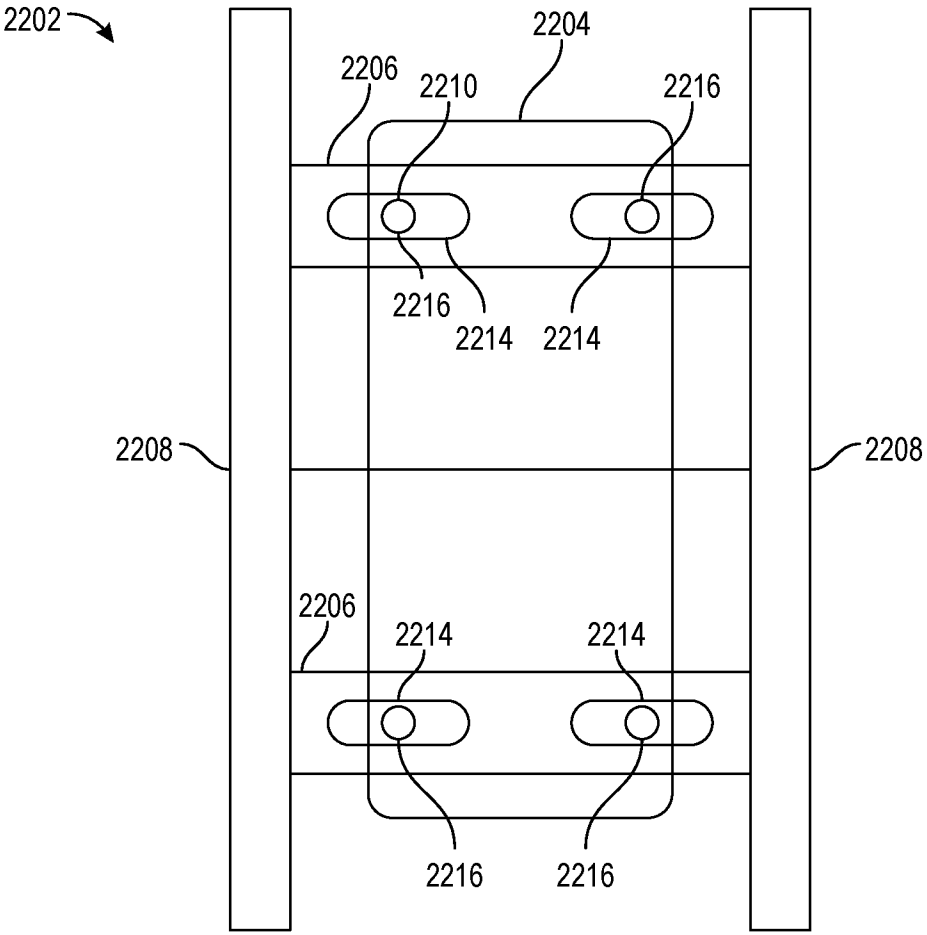

FIG. 22 illustrates an apparatus 2202 for mounting a faceplate 2204 to a plurality of wall studs 2208. Two horizontal brackets 2206 span the distance between two adjacent studs 2208, attaching to each of the adjacent studs 2208 (e.g., via fasteners such as threaded fasteners, magnets, etc.). Each of the horizontal brackets 2206 includes slots 2214 elongated along the length of the brackets 2206. A faceplate 2204 mounted to the horizontal brackets 2206 includes apertures 2216 for accepting fasteners 2210 such as threaded fasteners. The elongated slots 2214 allow lateral movement of a faceplate 2204 toward one or the other studs 2204, 2208 while still aligning the apertures 2216 in the faceplate 2204 with the slots 2214 in the horizontal brackets 2206. As such, the faceplate 2204 can be mounted closer to one wall stud 2208 or the other to accommodate a desired location that is not directly centered between the adjacent wall studs 2208.

Figure 23:
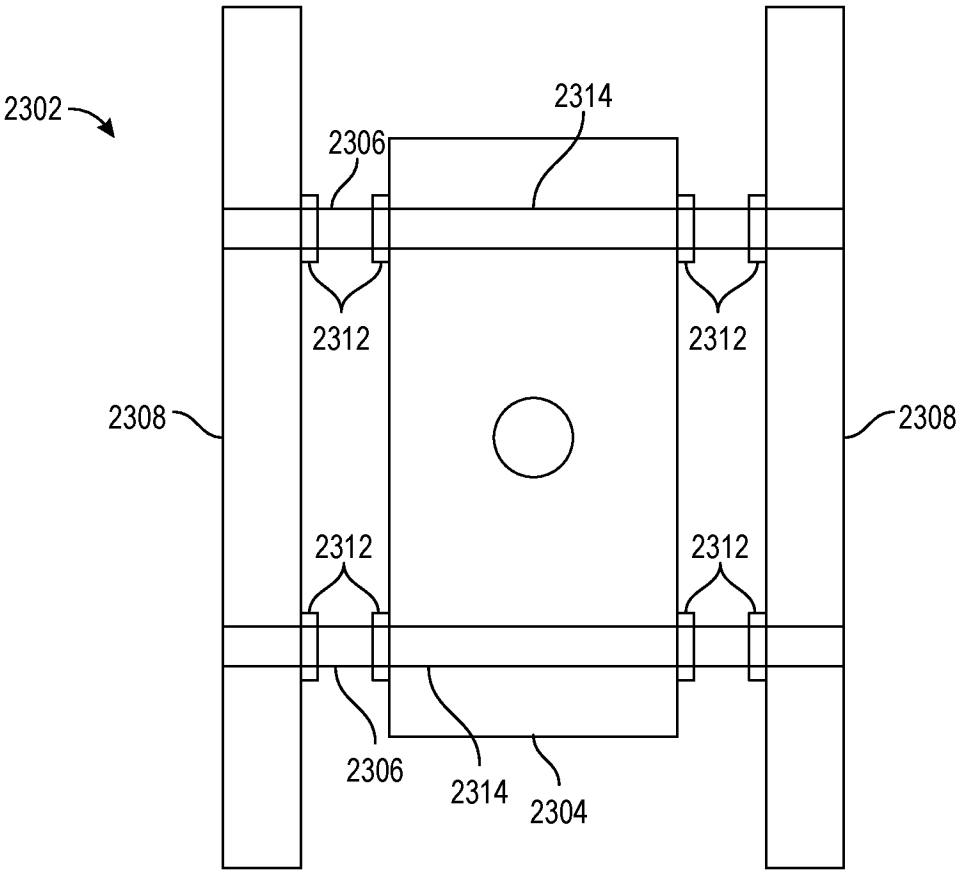

FIG. 23 illustrates an alternative apparatus 2302 for mounting a faceplate 2304 to a pair of wall studs 2308. The apparatus 2302 includes two threaded rods 2306, each extending between and being attached to two adjacent studs 2308 such that they are configured to support not only the weight of a faceplate 2304, but also the weight of a fixture (e.g., water closet) mounted to the faceplate 2304, and a user located on the fixture. In some embodiments, the threaded rods 2306 extend through openings in the wall studs 2308 and are held in place via nuts 2312 threaded on the threaded rods 2306 and tightened against the wall stud 2308. The faceplate 104 includes openings formed as channels 2314 or through holes extending through at least a portion of the width of the faceplate 2304. The faceplate 2304 is mounted to the threaded rods 2306 by inserting the threaded rods 2306 through the channels/through 2314 holes prior to mounting the threaded rods 2306 to the wall studs 2308. Nuts 2318 located at various positions along the length of the threaded rods 2306 (e.g., between the wall studs 2306 and the faceplate 2304) are tightened against the faceplate 2304 to hold the faceplate 2304 in a desired location. Still further, the user may slide the faceplate 2304 along the axial length of the rods 2306 to re-position the faceplate 2304 with respect to the studs 2308 by adjusting the relative positions of the nuts 2318 thereon. The channels/through holes 2314 on the faceplate 2304 are unthreaded and larger than the outer diameter of the threaded rods 2306.

Figure 24:
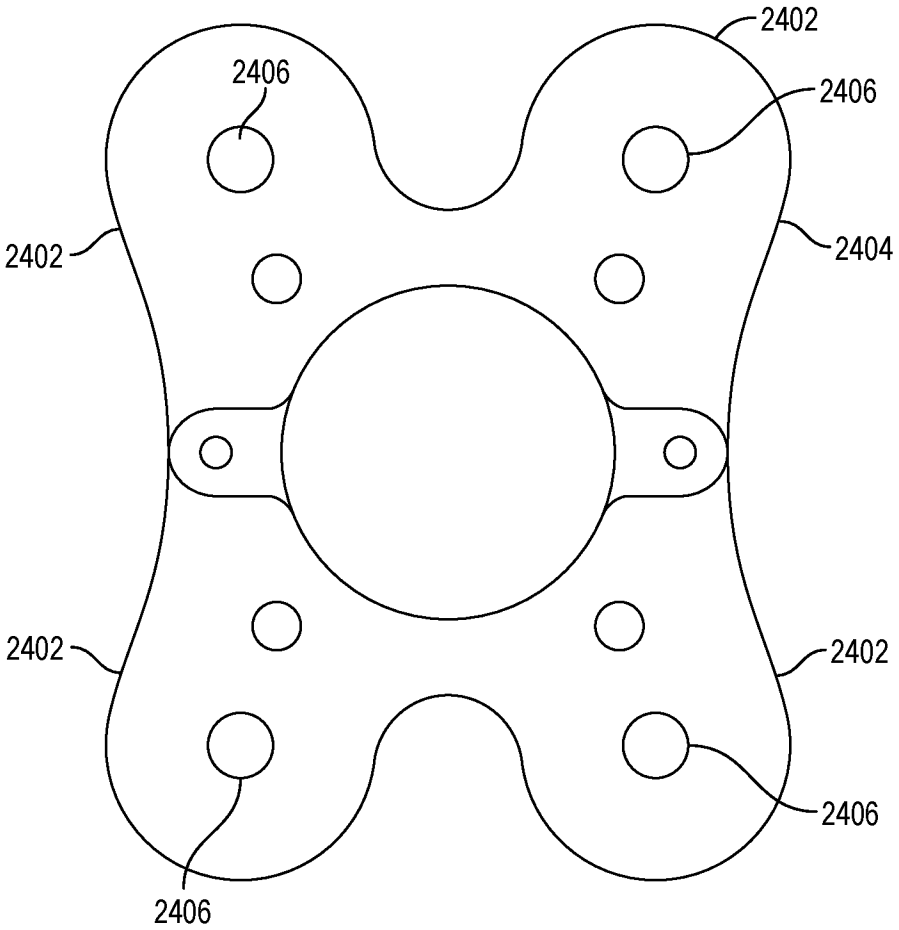

FIG. 24 illustrates another embodiment of a faceplate 2404 having an alternative faceplate geometry. Here, rather than having distinct legs extending outward from a main body, the faceplate 2404 has a butterfly shape with four lobes 2402 located at the corners. The lobes 2402 are sized to mount to adjacent wall studs via apertures 2406 in the lobes 2402.

Figure 25:
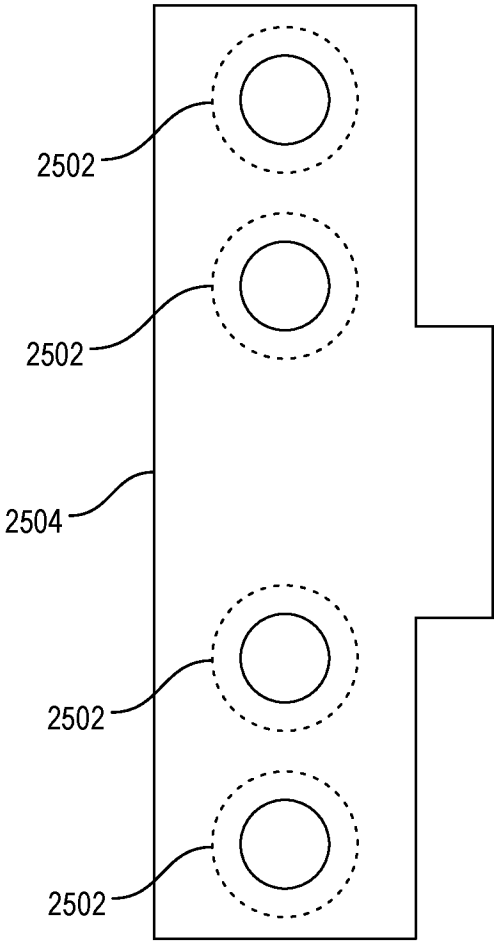

FIG. 25 illustrates a side view of another embodiment of a faceplate 2504. As shown, the faceplate 2504 includes threaded holes 2502 extending into a side of the faceplate 2504 such that when the faceplate 2504 is mounted relative to a wall stud, a fastener can extend through an opening in the wall stud and into threaded engagement with one of the apertures 2502 coupling the faceplate 2504 to the stud. As the threaded fastener engages the threaded aperture 2502 of the faceplate 2504, the rotational engagement of the threads translates the fastener into the faceplate 2504. The orientation of the apertures 2502 is such that when the faceplate 2504 is positioned between a first and second wall stud, threading fasteners into and out of the threaded holes 2502 may horizontally adjust the position of the faceplate 2504 with respect to the first and second wall studs. In other embodiments, the width of the faceplate 2504 may be such that it corresponds to the distance between the first and second wall studs so that the faceplate 2504 becomes clamped between the two studs when the fasteners are tightened.

Figure 26:
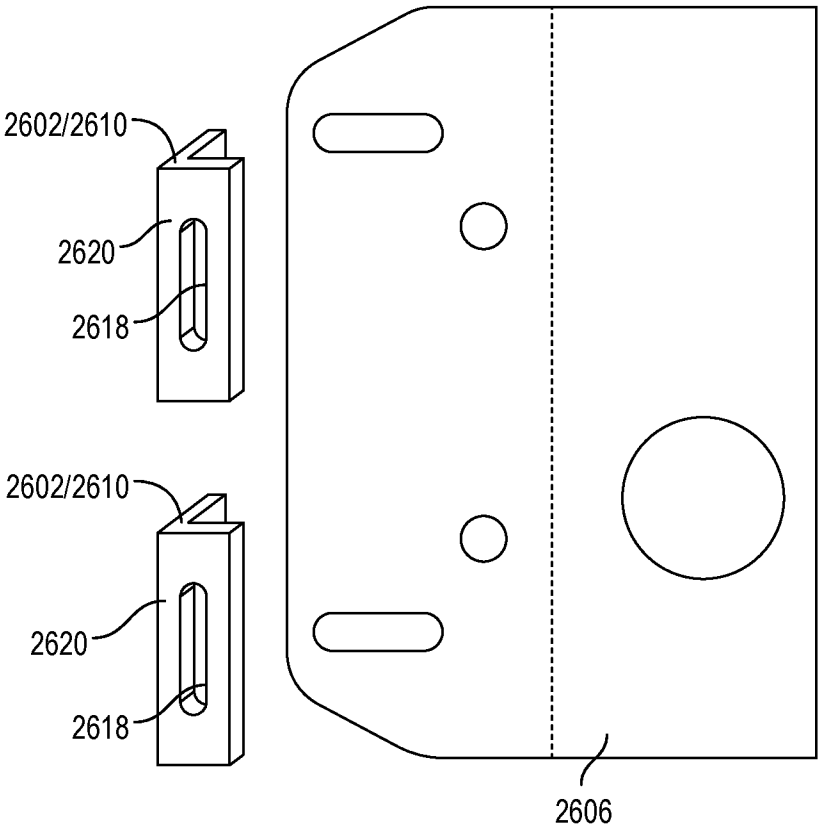

FIG. 26 illustrates another embodiment of a faceplate 2606 that is couplable to a wall stud via a plurality of brackets 2602 to provide increased adjustability of the position of the faceplate 2606 relative to the wall studs. The brackets 2602 are elongated L-brackets mounted in a vertical orientation with a first sidewall 2610 configured for mounting to a wall stud, and a second sidewall 2620 extending into the spaced between two adjacent studs. In some embodiments, the first sidewall 2610 include an attachment feature (a stud, a magnet) for attaching the bracket 2602 to the wall stud and in other embodiments, the first sidewall 2610 includes an aperture or slot 2614 for inserting a threaded fastener 2616 through the bracket 2602 and the wall stud to secure the bracket 2602 to the wall stud. The brackets 2602 include an elongated slot 2618 on a second sidewall 2620 of the L-bracket that provides vertical adjustability of the position of the faceplate 2606 relative to the bracket 2602 and to the wall studs. The faceplate 2606 may additionally include an elongated slot 2618 that is elongated perpendicular to the elongated slot 2618 in the bracket 2602 to allow for horizontal adjustability of the position of the faceplate 2606 as well. A threaded fastener extends through the elongated slot 2618 of the bracket 2602 and the elongated slot 2618 of the faceplate 2606 to couple the faceplate 2606 to the bracket 2602 and therefore also to the wall studs. Both sides of the faceplate 2606 may be mounted to respective wall studs via this arrangement.

Figure 27:
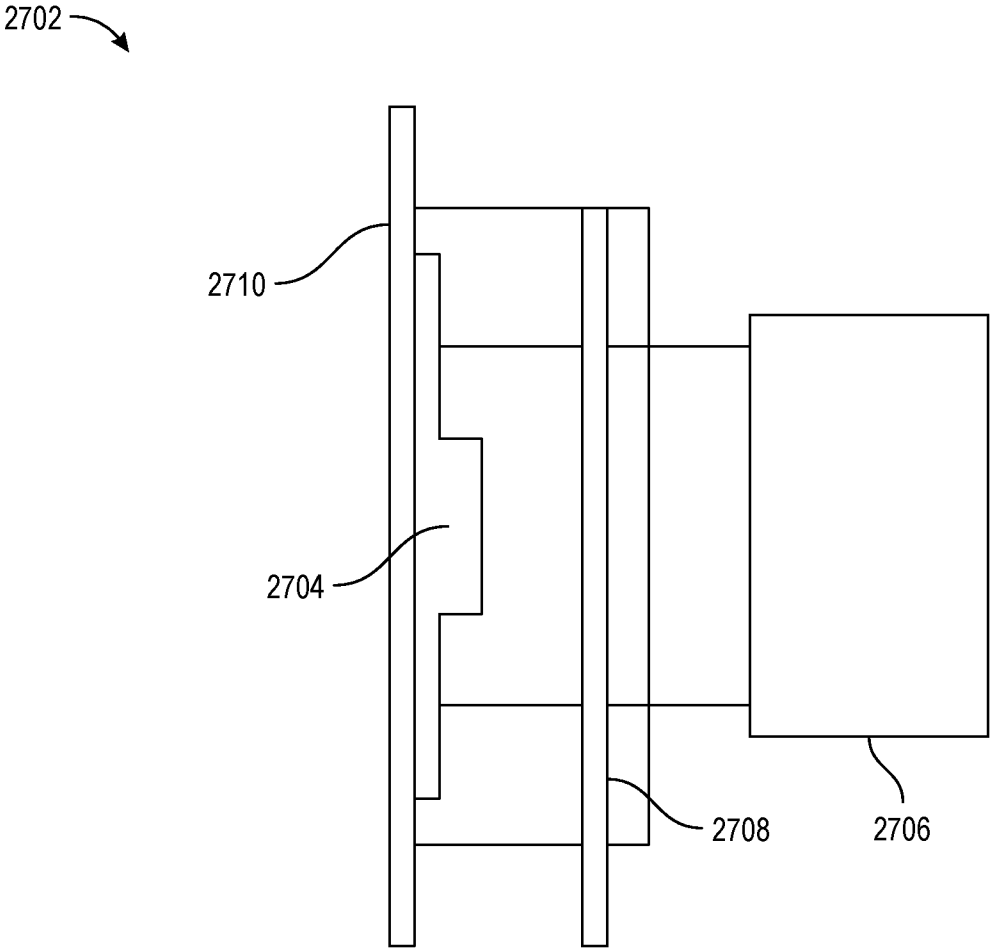

FIG. 27 illustrates a side view of a faceplate arrangement 2702 having a faceplate 2704, a water closet 2706 mounted to the faceplate 2704, and an external support system 2708. More specifically, as shown in FIG. 27, the faceplate arrangement 2702 includes a faceplate 2704 mounted to a pair of vertical studs 2710. The faceplate arrangement 2702 also includes an external support system 2708 horizontally offset from the faceplate 2704 and positioned between the faceplate 2704 and the water closet 2706. In some embodiments, the external support system 2708 may contact the floor or bottom of the modular wall although the faceplate 2704 is mounted solely to vertical studs 2710 and elevated above the floor. The external support system 2708 extends vertically through one of the water closet 2706 or the wall stud 2710 to provide additional support and to prevent the faceplate 2704 and water closet 2706 from deflecting downward.

In the illustrated embodiment, the faceplate arrangement 2702 includes a faceplate 2704 mounted in an elevated position on a pair of studs 2710 with a plurality of horizontal connecting members 2714 extending outwardly therefrom to provide a mounting point upon which the water closet 2706 is attached. The external support system 2708, in turn, includes a pair of legs that are coupled to the horizontal connecting members 2714 between the water closet 2706 and the faceplate 2704. As shown, the legs of the external support system 2708 engage the ground to provide additional support to the faceplate arrangement 2702.

Figure 28:
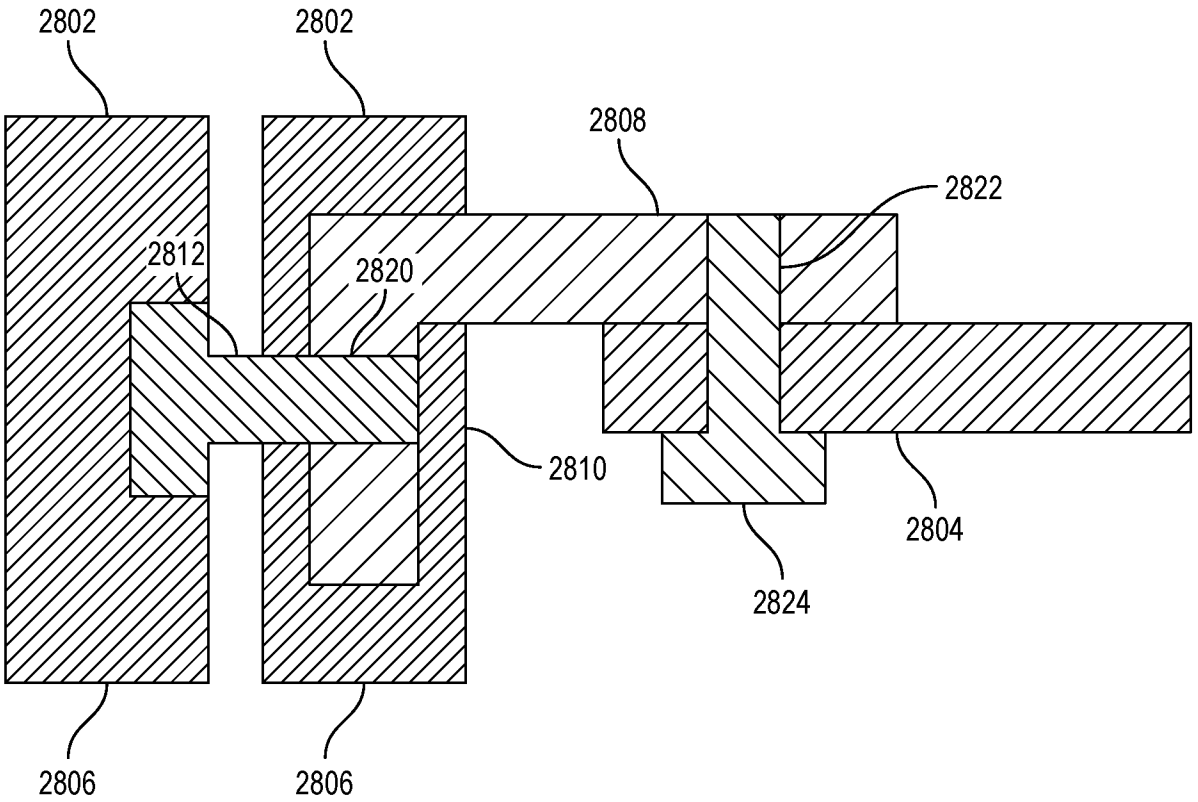

FIG. 28 illustrates a top view of a faceplate 2804 mounted to a wall stud 2802 using a bracket 2808 and fasteners 2810, 2824. As shown, the embodiment includes two C-channel wall studs 2806 positioned directly adjacent one another, with the openings of the C-channels facing away from each other. A bracket 2808 extends into the C-channel opening of one of the wall studs 2802. A fastener 2810 extends through apertures 2812 in both of the adjacent wall studs 2802 and into a first opening 2820 in the bracket 2808 to secure the bracket 2808 relative to the wall studs 2802. The bracket 2808 is L-shaped and includes a second opening 2822 perpendicular to the first opening 2820. The faceplate 2804 is mounted to the bracket 2808 by inserting a fastener 2824 (e.g., a threaded fastener) through an opening in the faceplate 2804 and the second opening in the bracket 2808. In some embodiments, a nut is tightened against the bracket 2808 to secure the connection. In this manner, the faceplate 2804 is secured to the wall studs 2802. In the illustrated embodiment, the legs of the bracket 2808 are long enough so that the second opening 2822 is positioned outside the c-channel of the wall stud 2806 so the user can gain access to both sides thereof.

Figure 29:
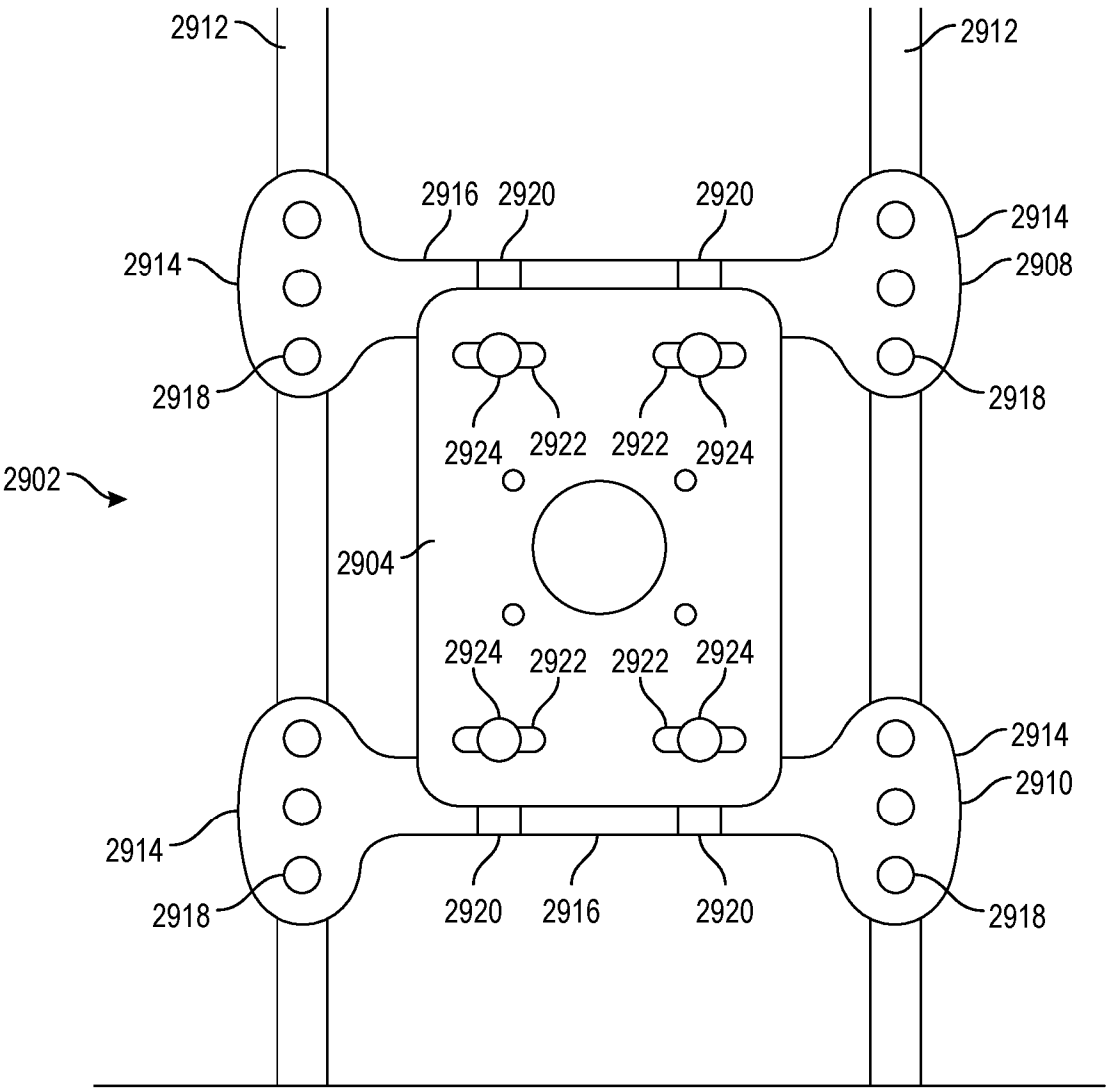

FIG. 29 illustrates a multi-part faceplate 2902 having a mounting plate 2904 that defines the fluid passageway opening 2906, and a pair of cross-braces 2908, 2910 that couple the mounting plate 2904 to the adjacent wall studs 2912. The mounting plate 2904 is generally planar and does not directly couple to the wall studs 2912. The cross-braces 2908, 2910 are bone-shaped, having enlarged distal ends 2914 interconnected by a generally rectangular central portion 2916. The large, rounded, enlarged distal ends 2914 of the cross-braces 2908, 2910 decreases stress concentrations within the cross-braces 2908, 2910. The enlarged distal ends 2914 include multiple (e.g., two, three, four) vertically spaced apertures 2918 that allow the cross-braces 2908, 2910 to be mounted to the wall studs 2912 at different heights and at different distances/spacing relative to one another. The central portion of the cross-braces 2908, 2910 includes vertical slots 2920 that selectively align with horizontal slots 2922 in the mounting plate 2904. Together, the elongated slots of the mounting plate 2904 and the cross-braces 2908, 2910 allow the mounting plate 2904 to be mounted at various horizontal and vertical locations relative to the cross-members 2908, 2910 and relative to the wall studs 2912. A fastener 2924 extends through the overlapping slots and is secured (e.g., with a nut) to fasten the mounting plate 2904 to the cross-braces 2908, 2910. In other embodiments, the vertical slots 2920 may be located on the mounting plate 2904 with the horizontal slots 2922 located on the cross-braces 2908, 2910. In some embodiments, only the mounting plate 2904 is considered to be the faceplate 2902 with the cross-braces 2908, 2910 being considered separate brackets.

Figure 30:
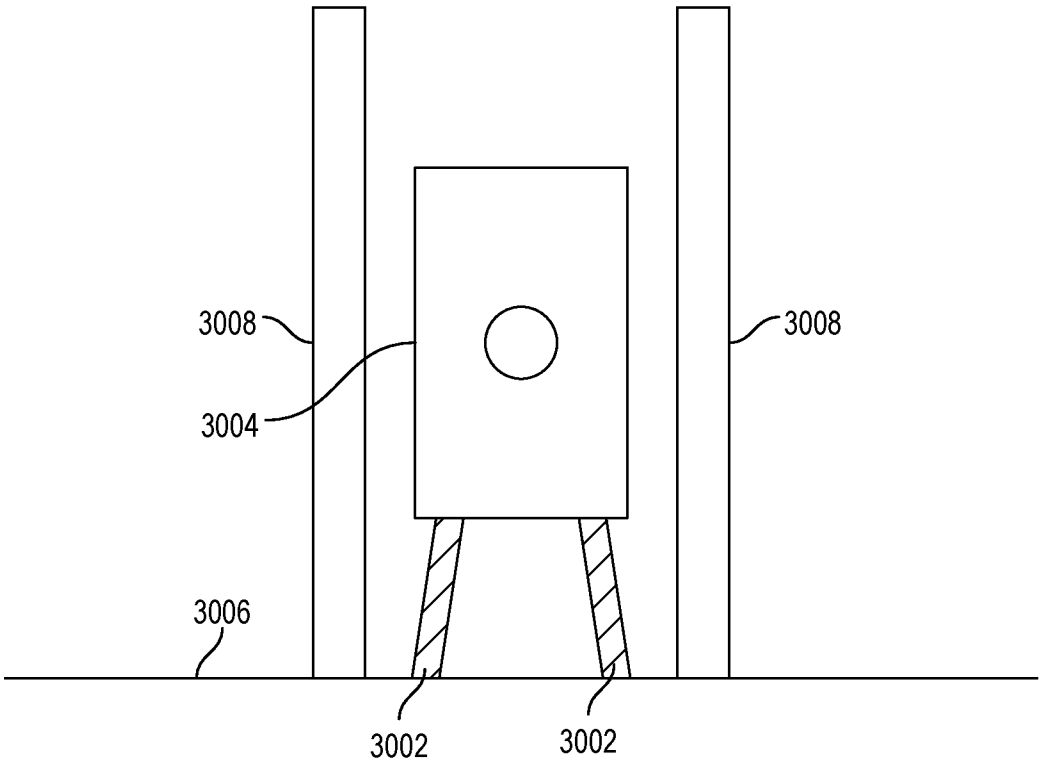

FIG. 30 illustrates a pair of support legs 3002 couplable to the underside of a faceplate/carrier 3004 and configured to engage a ground surface 3006 to assist in supporting the carrier 3004 either temporarily during the assembly process and/or permanently during operation. As shown, first and second legs 3002 extend downward from an underside of the carrier 3004 to provide additional support to the faceplate/carrier 3004 without actually being bolted or fastened to the floor or bottom of the modular wall. The legs 3002 extend not only downward but also extend outward horizontally from the carrier 3004 such that the distance between the legs 3002 is greater at the ground surface 3006 than at the carrier 3004. The legs 3002 are threaded adjustment legs and may threadedly engage the carrier 3004. In some embodiments, the overall length of the legs 3002 is adjustable to support carriers 3004 at different heights. The carrier/faceplate 3004 may additionally be coupled to the wall studs 3008 via any of the plurality of attachment mechanisms described and shown herein.

In some embodiments, the support legs 3002 may be used to temporarily support the faceplate 3004 during the assembly process. In such embodiments, the legs 3002 are placed in contact with the floor or bottom of the modular wall such that they support the faceplate 3004 at a pre-determined vertical height there above. The user may then (either ahead of time or once the legs are in place) adjust the height of the legs 3002 so that the faceplate 3004 is at the desired vertical height above the floor or the bottom of the modular wall. With the faceplate 3004 supported at the desired height, the user can then mount the faceplate 3004 to the adjacent studs 3008 without having to support the weight of the faceplate 3004 or without having to try to maintain the faceplate 3004 in the proper position. This not only helps with the installation process but also allows for more accurate installs. Finally, the user may then remove the legs 3002 or leave the legs 3002 in place to provide additional support to the faceplate 3004.

Figure 31:
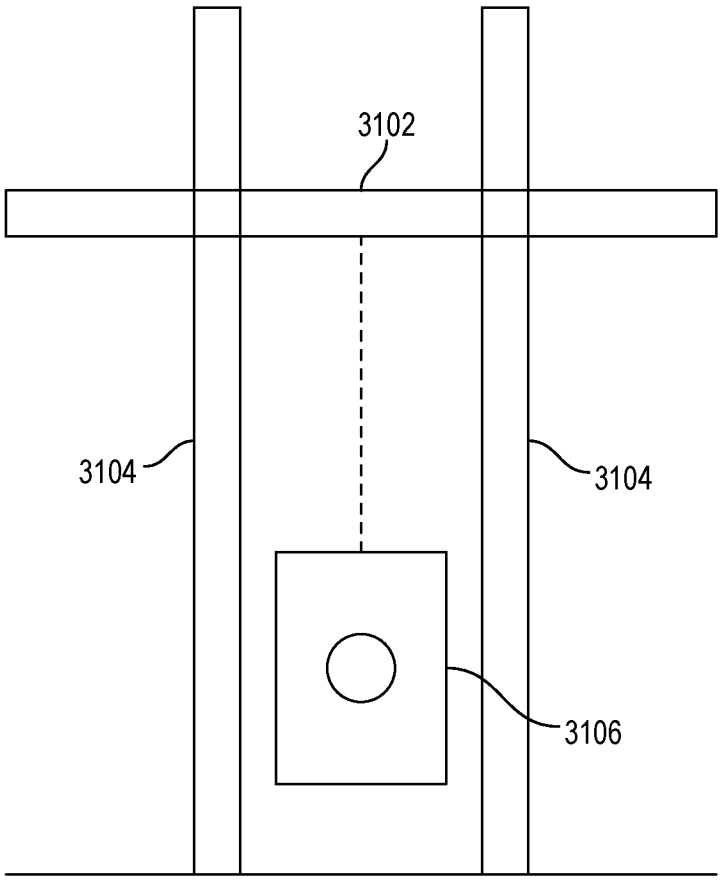

FIG. 31 shows an alternative mounting solution for a faceplate 3106 including a crossbar 3102 extending between the adjacent wall studs 3104 that operatively supports the faceplate 3106 positioned vertically below. More specifically, the crossbar 3102 is positioned significantly higher than the faceplate 3106 within the wall. For example, the vertical height of the cross-bar 3102 may be approximately 5 times greater than the vertical height of the faceplate 3106 itself. In still other examples, the cross-bar 3102 may be between 2 to 6 times greater than the vertical height of the faceplate 3106. In still other embodiments, the crossbar 3102 may be positioned between 2 to 6 feet above the faceplate 3106. In still other embodiments, the crossbar 3102 may be positioned approximately 5 feet above the faceplate 3106±15%. The increased height of the cross-bar 3102 relative to the faceplate 3106 reduces the moment generated by the water closet mounted to the faceplate 3106 and by a user seated upon the water closet to help improve overall strength and rigidity to the assembly. In other embodiments, in addition to the crossbar 3102, the faceplate 3106 may also be coupled to the wall studs 3104 with additional mounting structures positioned at the height of the faceplate 3106.

Figure 31A:
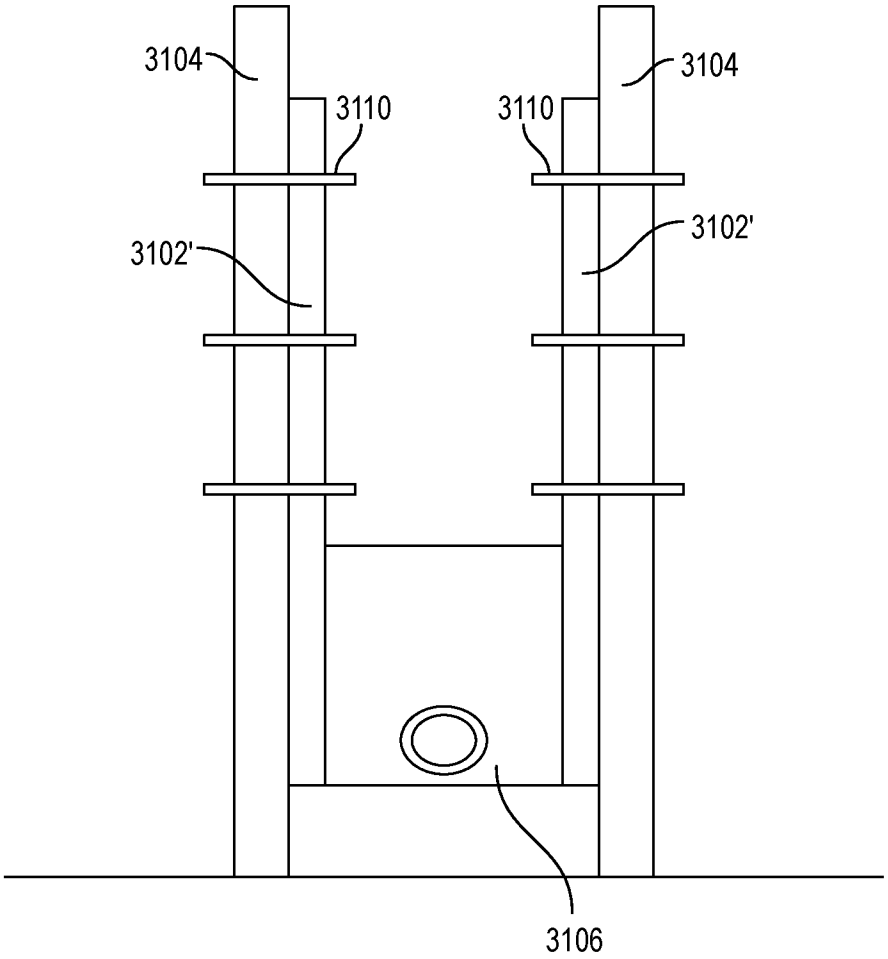

In another embodiment, as shown in FIG. 31A, the cross-bar 3102 may include a pair of uprights 3102' extending vertically upwardly from the faceplate 3106. When installed, each upright 3102' runs along a respective wall stud 3104 so that the forces applied to the faceplate 3106 may be spread out over a larger portion of the studs 3104. This increases the overall load capacity of the system for a given stud specification (e.g., dimension and material). In some embodiments, the uprights 3102' may form an "L" or "C" cross-sectional shape configured to encompass a portion of the corresponding stud 3104 so that they can better grasp and transmit forces to the corresponding studs 3104. In other embodiments a series of fasteners 3110 may be used along the length of the uprights 3102' to help transmit force between the uprights 3102' and the studs 3104. In still other embodiments, a cross-bar 3102 maybe used together with the uprights 3102'.

In such embodiments, the uprights 3102' may extend vertically above the faceplate 3106 so that the vertical height of the top of the uprights 3102' are approximately 5 times greater than the vertical height of the faceplate 3106 itself. In still other examples, the tops of the uprights 3102' may be between 2 to 6 times greater than the vertical height of the faceplate 3106. In still other embodiments, the tops of the uprights 3102' may be positioned between 2 to 6 feet above the faceplate 3106. In still other embodiments, the tops of the uprights 3102' may be positioned approximately 5 feet above the faceplate 3106±15%.

Figure 32:
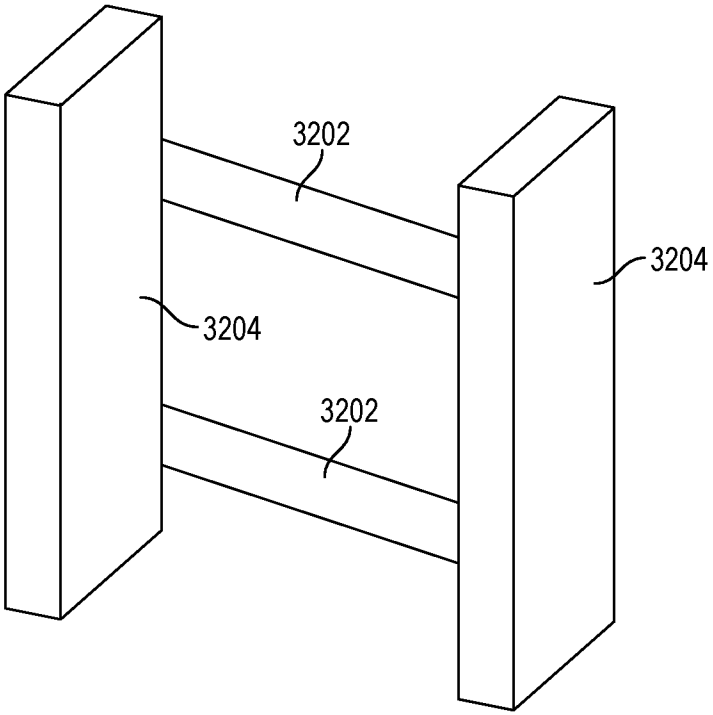

FIG. 32 shows brackets 3202 configured to support a faceplate. The brackets 3202 span the distance between adjacent wall studs 3204, similar to the horizontal brackets shown in FIG. 22. The horizontal brackets 3202 provide multiple mounting locations for a faceplate and can be mounted at different heights along the wall and with different spacing between the brackets 3202 to provide further adjustability to the mounting location of the faceplate relative to the wall studs 3204.

Figure 33:
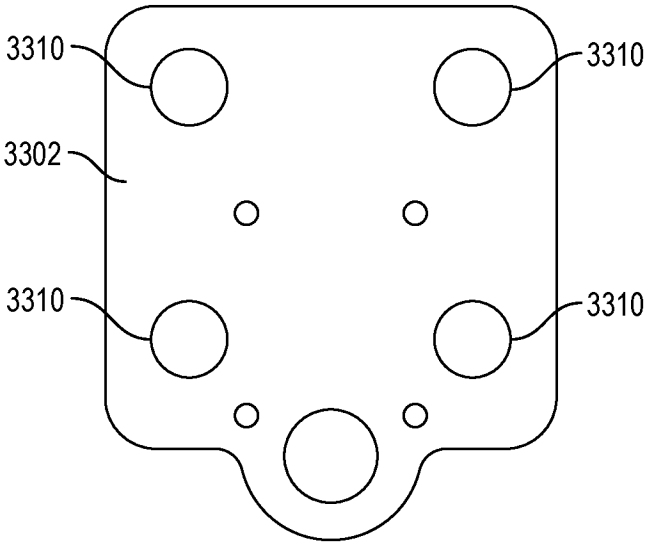

FIG. 33 illustrates a further alternative faceplate 3302. The faceplate 3302 is generally rectangular and is sized to overlap two adjacent wall studs or to overlap brackets such as those shown in FIG. 32. The wall studs or brackets may be provided with studs or bosses 3308 (e.g., threaded features) that extend out from the wall studs/brackets, perpendicular to the major plane of the faceplate 3302. The faceplate 3302 includes oversized apertures 3310 that can slide over the bosses with clearance between the oversized apertures 3310 and bosses that allow the faceplate 3302 to be moved relative to the bosses 3308. Once the desired position is achieved, the faceplate 3302 is secured in that position, for example, by threading a nut and washer over each stud and tightening the nut and washer against the faceplate 3302.

Figure 34:
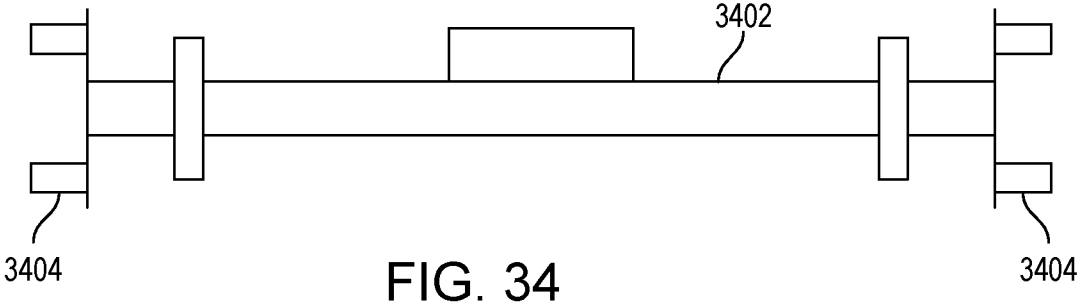
Figure 36:
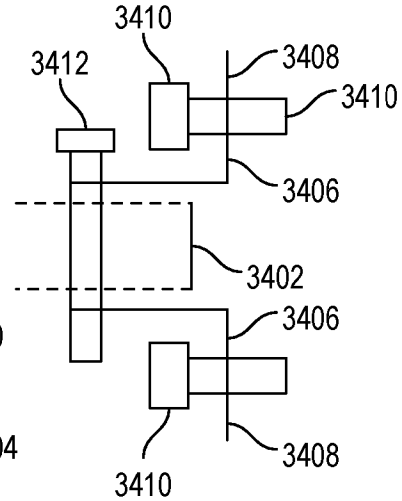
Figure 35:
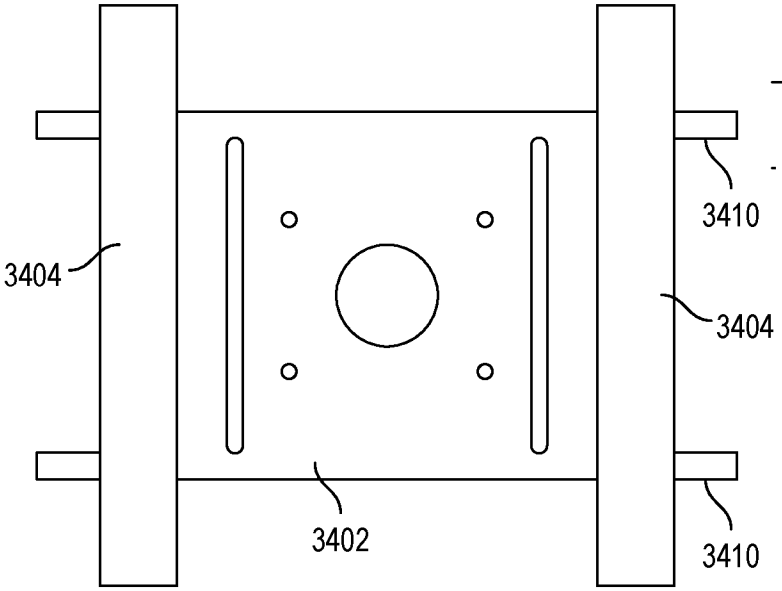

FIGS. 34-36 show a top view and a front view of an alternative embodiment of a faceplate 3402 mounted to a pair of wall studs 3404 and a closeup of a bracket assembly 3406 that facilitates the connection. Each bracket assembly 3406 includes two L-shaped brackets 3408 that are positioned back-to-back relative to one another with a space defined between them. A fastener 3410 (e.g., a threaded fastener) couples each bracket 3408 to the wall stud 3404. The faceplate 3402 extends into the space defined between the two brackets 3408 and a threaded fastener 3412 extends through the first bracket 3408, into and through the faceplate 3402, and then through the second bracket 3408. In this way, the faceplate 3402 is coupled indirectly to the wall stud 3404 via the brackets 3412.

Figure 37:
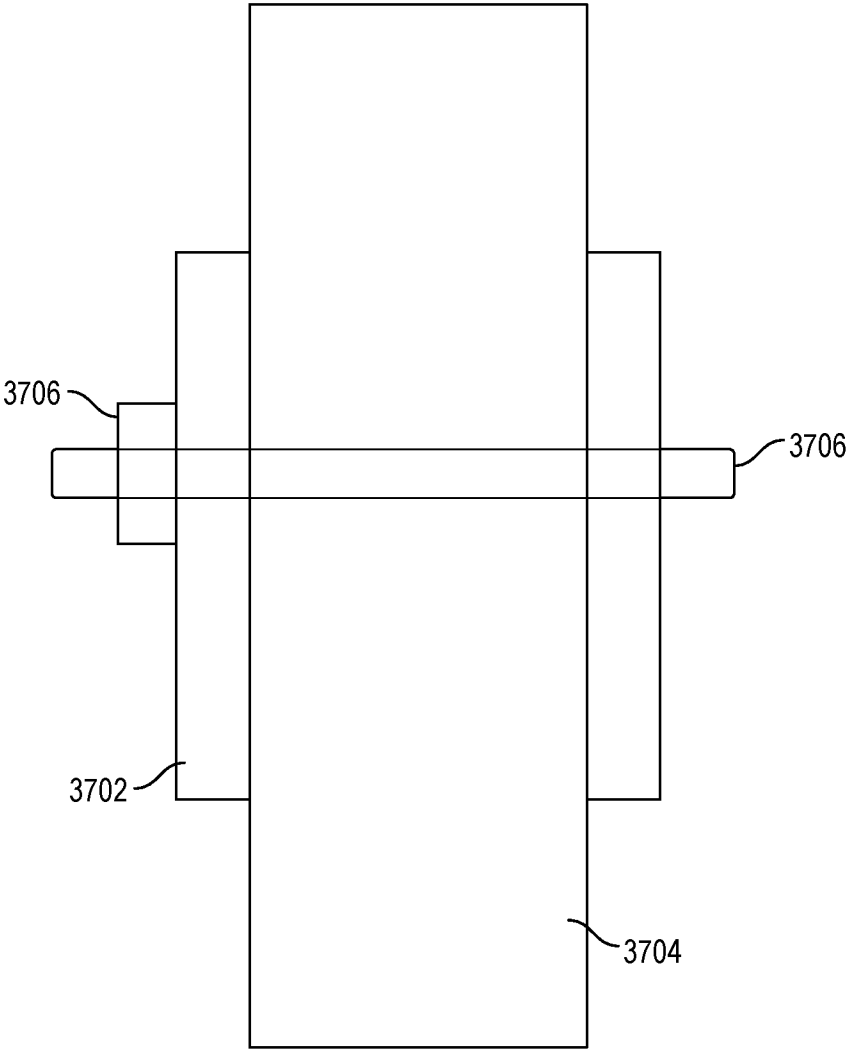
Figure 39:
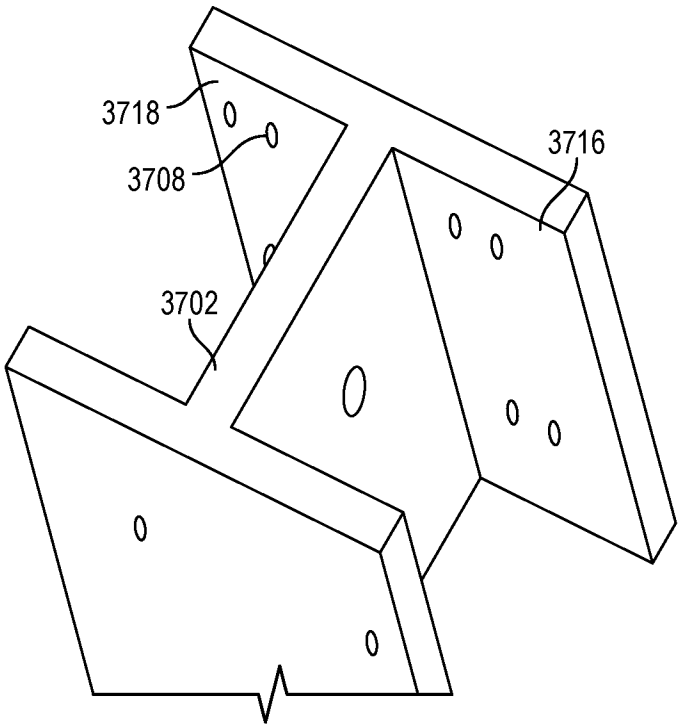
Figure 38:
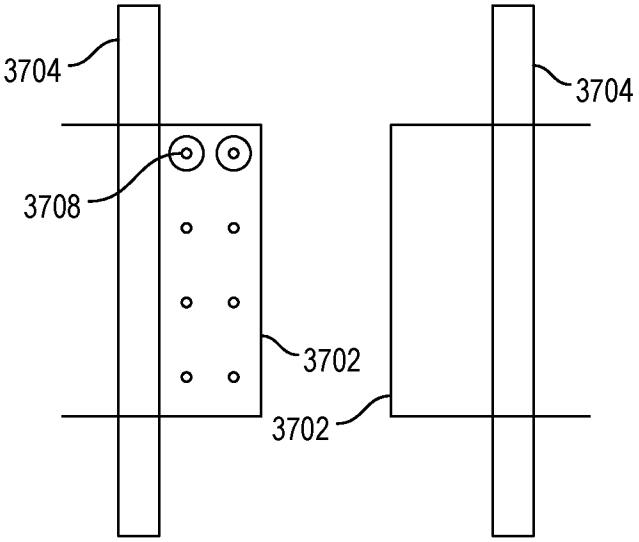

FIGS. 37-39 illustrate an alternative method of connecting brackets 3702 to a wall stud 3704. As shown in FIG. 39, the brackets 3702 are substantially I-beam in shape with a first open end configured for attachment to a corresponding wall stud 3704 and a second end opposite the first end configured for attachment to a faceplate. As shown in FIG. 37, the first open end of the bracket 3702 extends to either side of the width of the wall stud 3704 with a single fastener 3706 extending through the first bracket 3702, into and through the C-channel defining the wall stud 3704, and then through the other side of the first bracket 3702. A further fastener 3706 (e.g., a nut) is threaded onto the fastener 3706 to secure the fastener 3706 in place and maintain the connection between the brackets 3702 and the wall stud 3704. As shown in FIG. 38, the second open end of the bracket 3702 includes a plurality of through holes 3708 located at various heights and horizontal distances from the wall stud 3704. Each of the through holes 3708 function as a potential location for mounting the faceplate via a fastener 3706. In some embodiments, the through holes 3708 are surrounded by an indent for a washer or a bolt head.

Figure 40:
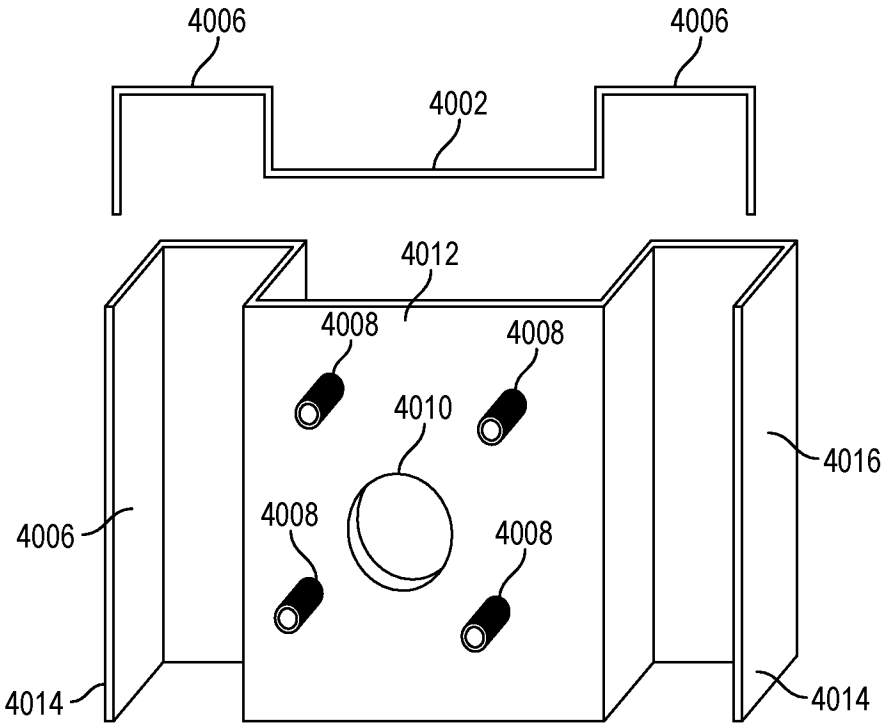

FIG. 40 illustrates an alternative embodiment of a faceplate 4002 including a pair of brackets 4006 integrally formed therewith. More specifically, the faceplate 4002 is formed from a single piece of plate material which is folded to form a center portion 4012, and a pair of elongated c-channel brackets 4006 positioned on either side of the center portion 4012. As shown in FIG. 40, the center portion 4012 of the faceplate 4002 includes a through hole 4010 and a plurality (e.g., four) of threaded mounting elements 4008 extending outwardly therefrom. When in use, the through hole 4010 is configured to receive a fluid coupler therethrough while the mounting elements 4008 are configured to serve as mounting elements to which the water closet may be attached.

Also shown in FIG. 40, each bracket 4006 of the faceplate 4002 includes an elongated c-channel extending vertically on either side of the center portion 4012. More specifically, each bracket 4006 includes a c-channel having an open end 4014 facing the front surface of the center portion 4010 (e.g., the side from which the mounting elements 4008 extend). In the illustrated embodiment, each bracket 4006 is sized and shaped to at least partially receive a portion of a corresponding stud therein so that, when installed, each a pair of adjacent wall studs are received within the pair of brackets 4006 and the center portion 4010 is positioned therebetween in a substantially vertical orientation. To install the faceplate 4002, the user aligns the open ends 4014 of both channels with a corresponding wall stud, and then horizontally introduces each stud into the two brackets 2006. The entire faceplate 4002 may then be secured in place by passing one or more fasteners through the side walls of the brackets 4006 and into the corresponding wall studs. In instances where adjustment is needed, the faceplate 4002 may be slid along the axial length of the wall studs until the desired vertical height is reached. While the illustrated brackets 4006 and center portion 4010 are formed from a single piece of folded plate material, it is understood that in alternative embodiments the brackets 4006 may be formed separately and coupled to the center portion 4010, such as by welding and the like.

Figure 41:
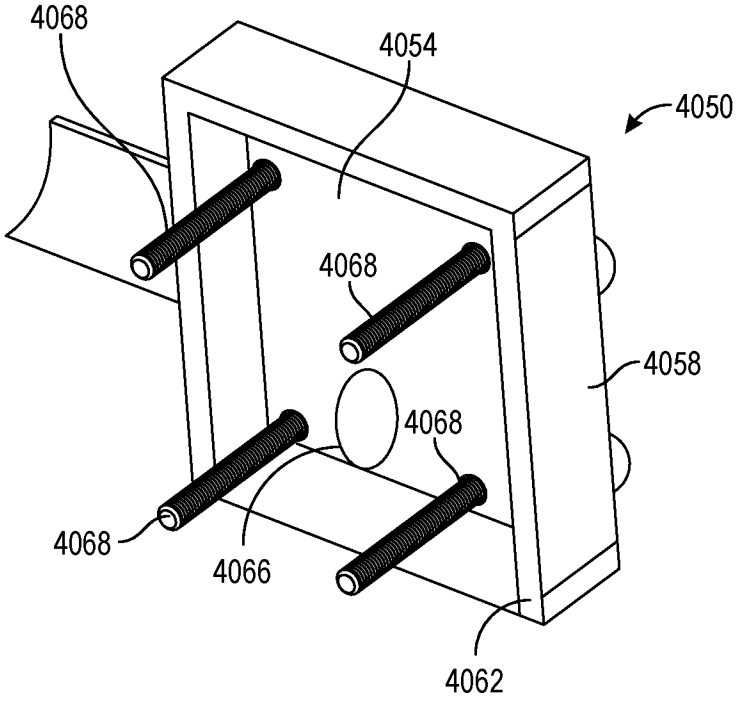

FIG. 41 illustrates a faceplate 4050 which includes a base wall 4054 and a plurality of side walls 4058 extending from the periphery of the base wall 4054 to form an open end 4062. More specifically, the base wall 4054 is substantially rectangular in shape such that four side walls 4058 extend perpendicularly therefrom to form an overall rectangular prism shape. As shown in FIG. 41, the base wall 4054, in turn, defines a through hole 4066 and includes a plurality of threaded mounting elements 4068 which extend out of the open end 4062. During use, the through hole 4066 is sized and shaped to receive a fluid coupler therethrough while the plurality of threaded mounting elements 4068 are configured to serve as a mounting point for a corresponding water closet. Furthermore, when installed, the base wall 4054 is mounted to the side walls 4058, which in turn, are mounted to a pair of adjacent wall studs. To do so, the user may pass one or more fasteners through the side walls 4058 and into the wall studs.

Figure 42:
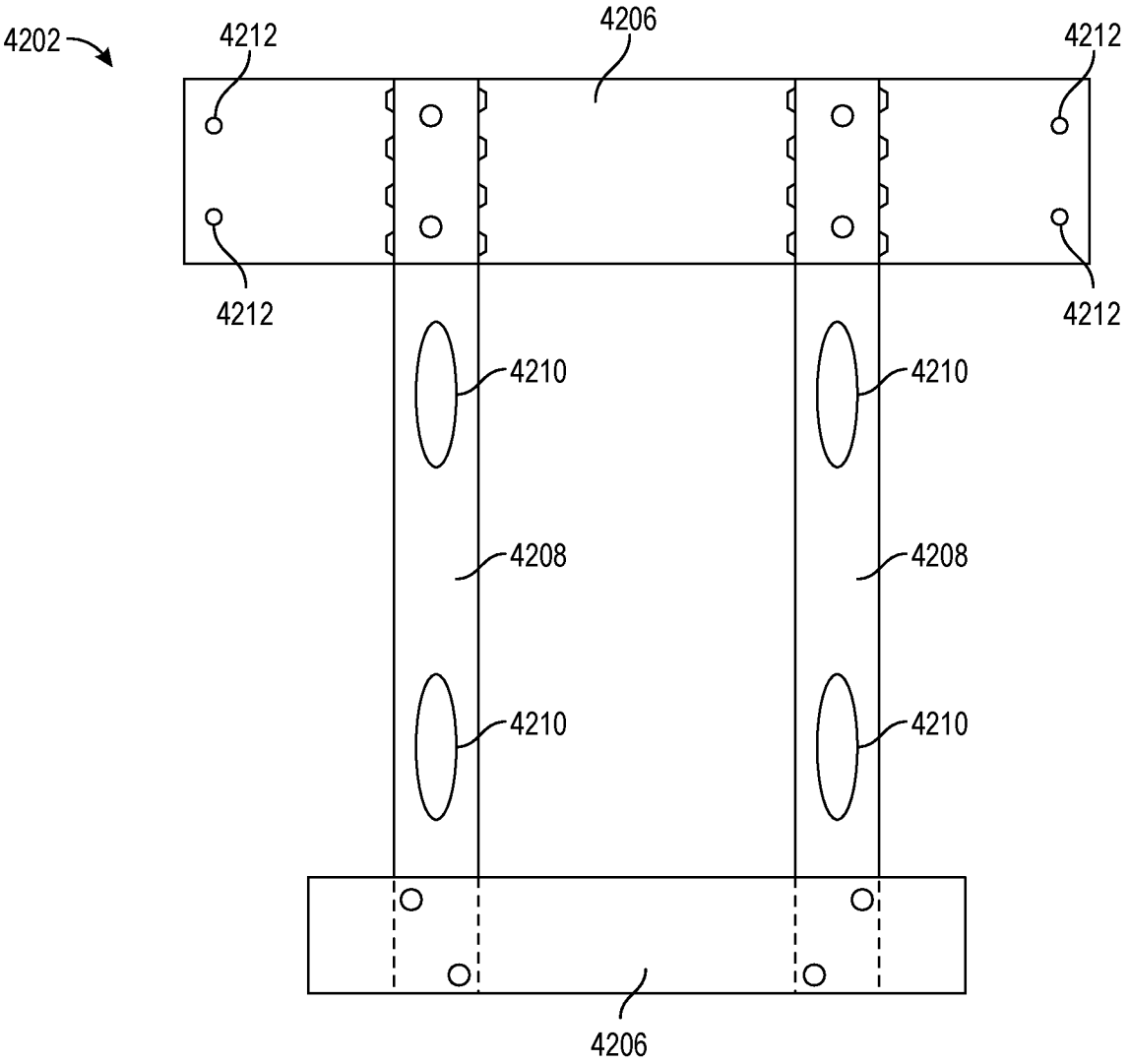

FIG. 42 illustrates a subassembly 4202 for mounting a faceplate thereon. The subassembly 4202 spans the distance between two adjacent wall studs and provides a mounting location for a faceplate having at least one degree of adjustment. The subassembly 4202 includes two horizontal brackets 4206 connected to one another via a pair of vertical brackets 4208 to form a frame. The vertical brackets 4208 include elongated slots 4210 for mounting a faceplate 4204 at various heights along the subassembly 4202. At least one of the horizontal brackets 4206, as shown the top horizontal bracket 4206, includes outer mounting apertures 4212 for attaching the subassembly 4202 to wall studs 4204. More specifically, in the illustrated embodiment only the upper horizontal bracket 4206 is coupled to the wall studs while the lower horizontal bracket 4206 hangs free.

Figure 43:
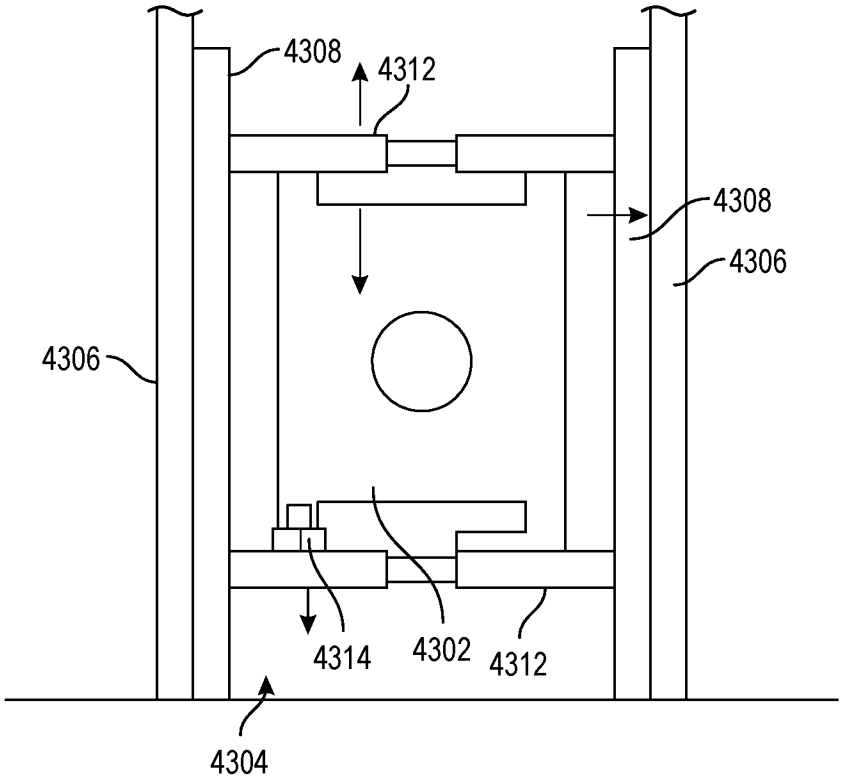

FIG. 43 illustrates a faceplate 4302 mounted to a pair of wall studs 4306 via a sub-frame 4304. The sub-frame 4304 includes a first vertical component 4308 located adjacent to a first wall stud 4306 and a second vertical component 4308 located adjacent to a second wall stud 4306. The sub-frame 4304 also includes a pair of horizontal or lateral brackets 4312 that extend between the first and second vertical components 4308. As shown in FIG. 43, the length of each lateral bracket 4312 is adjustable so that the distance between the first and second vertical components 4308 can be adjusted to correspond with the distance between the pair of adjacent wall studs 4306. As such, the user can adjust the length of the lateral brackets 4312 to place each vertical component 4308 in direct contact with its corresponding wall stud. In the illustrated embodiment, the lateral brackets 4312 include a pair of nested members allowing for adjustments in length however in other embodiments different layouts that permit the expansion and collapse of the lateral brackets 4312 may also be used. The faceplate 4302 is positioned between the lateral brackets 4312 and is coupled to the lateral brackets 4312 via fasteners 4314. As shown, the faceplate 4302 includes feet or extensions extending outward from a generally rectangular faceplate 4302 to provide a through hole.

Figure 44:
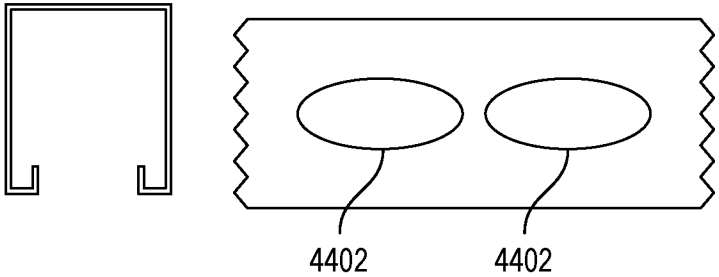

FIG. 44 illustrates a wall stud for use in a modular wall assembly that includes a plurality of elongated slots 4402 for attaching components thereto. Such slots 4402 may be used for coupling the vertical components of mounting elements to the wall studs or for coupling a faceplate to the wall studs. Such slots 4402 may also be found in elements of faceplate or mounting elements as well to improve connection and adjustment capabilities.

Figure 45:
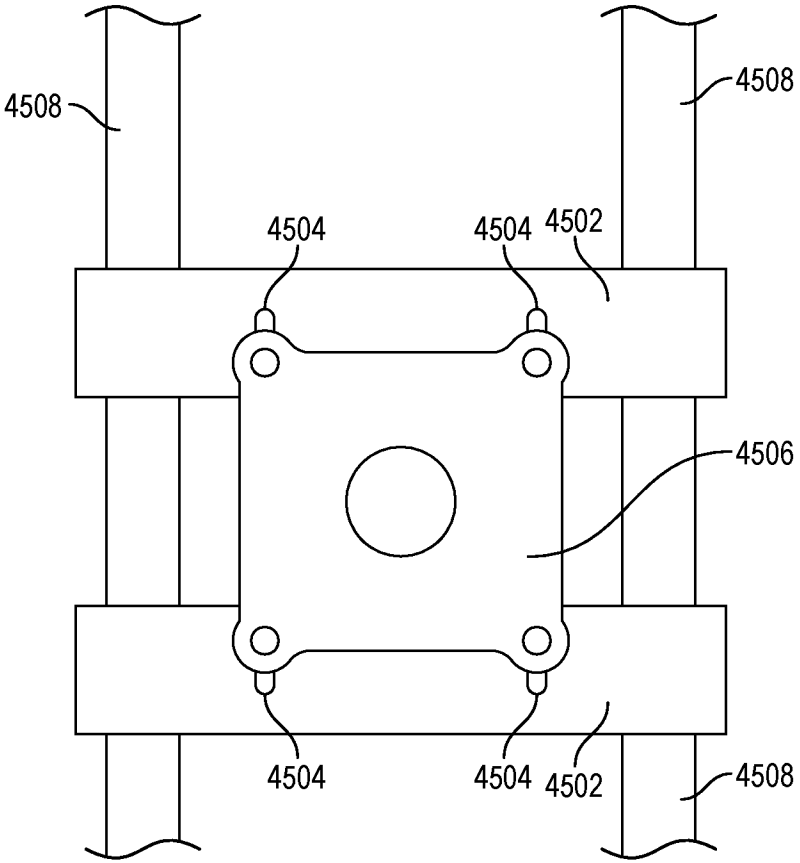

FIG. 45 illustrates an alternative arrangement similar to FIG. 29 in which a horizontal bracket 4502 includes vertical slots 4504 that allow for vertical adjustment of the faceplate 4506 mounted thereto. In contrast to the embodiment shown in FIG. 29, the horizontal brackets 4502 are coupled directly to the wall studs 4508. The brackets 4502 may be coupled to the wall studs 4508 at various locations to modify the height of the faceplate 4506 even further.

Figure 46:
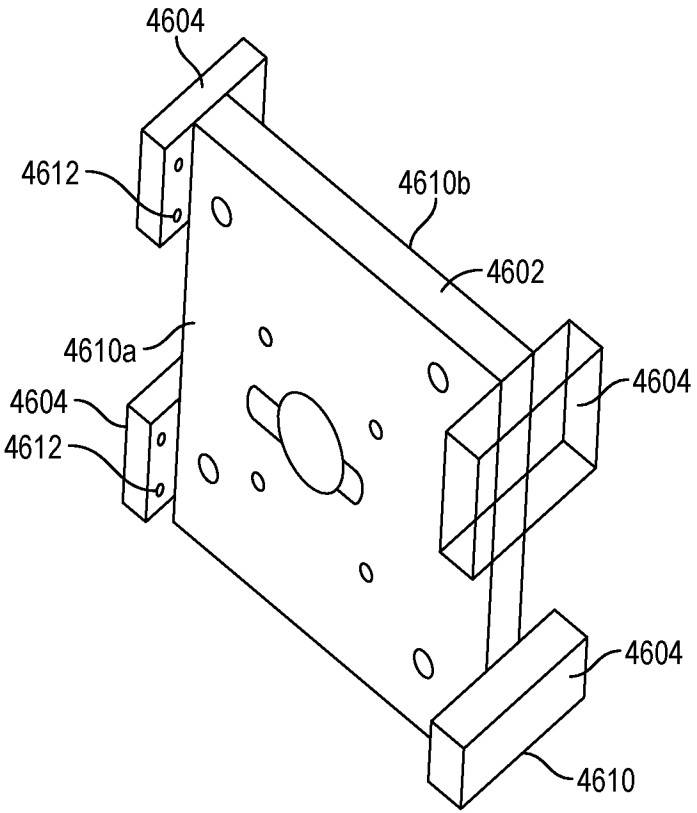

FIG. 46 illustrates another embodiment of a faceplate 4602 having four brackets 4604 for coupling the faceplate 4602 to a pair of adjacent wall studs. The brackets 4604 are generally oriented perpendicular to the faceplate 4602 (e.g., extending beyond the front and back surfaces 4610*a, b* of the faceplate 4602) and each define apertures 4612 oriented perpendicular to the front and back surfaces 4610*a, b* of the faceplate 4602. During use, the orientation of the apertures 4612 of the brackets 4604 permit the faceplate 4602 to be secured to the adjacent wall studs via a fastener passing directly through the sidewall of the wall studs (e.g., with a fastener oriented perpendicular to the front and rear surfaces 4610*a, b*). While the illustrated brackets 4604 are illustrated as blocks being joined to the side of a separate faceplate 4602, it is understood that in alternative embodiments the brackets 4604 and faceplate 4602 may be formed from a single piece of material.

Figure 47:
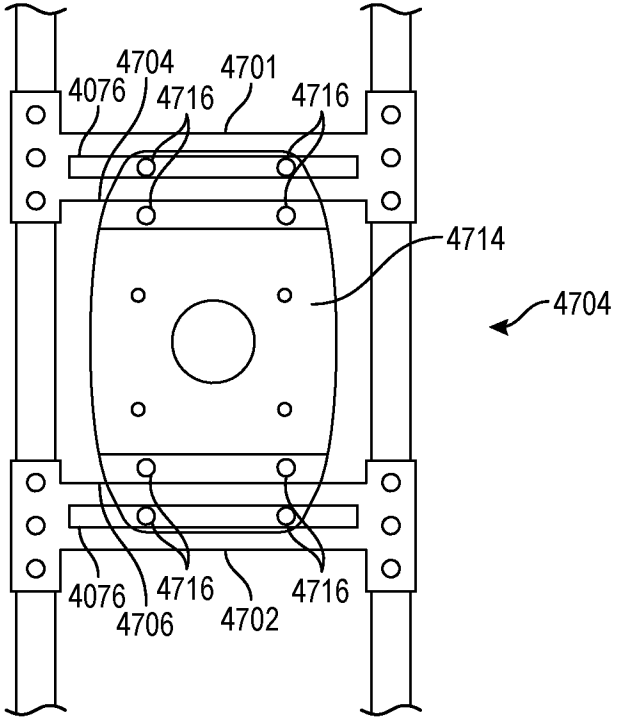

FIG. 47 illustrates another embodiment of a faceplate 4704. In contrast to the faceplate shown in FIG. 29, the cross-braces 4701, 4702 of faceplate 4704 include elongated slots 4706 that span a majority of the width of the respective portions 4701, 4702. Additionally, each of the cross-braces 4701, 4702 includes two elongated slots 4706 that extend parallel to one another. In some embodiments, the first portion 4714 includes apertures 4716 that are aligned with both of the slots 4706 on both of the cross-braces 4702. When the first portion 4714 is moved horizontally to the desired position, fasteners extend through the apertures 4716 and elongated slots 4710 to secure the first portion 4714 to the cross-braces 4702. In other embodiments 4712, the first portion 4714 can be offset vertically so that only one of the elongated slots 4710 on each of the cross-braces 4702 is engaged by a fastener. In such embodiments 4712, the use of multiple parallel slots 4706 on the second and third portions 4702 additionally provides vertical adjustability.

Figure 48:
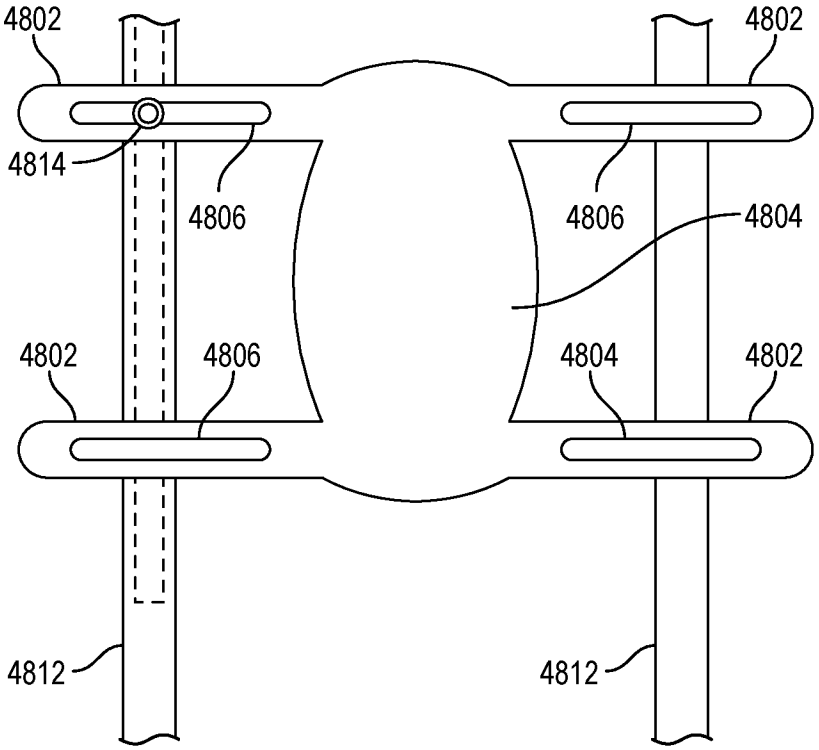

FIG. 48 illustrates another embodiment of a faceplate 4804. In contrast to the faceplate 4804 shown in FIG. 11, the upper and lower arms 4802 of the faceplate 4804 shown in FIG. 48 include slots 4806 that are elongated in the horizontal direction. The slots 4806 allow the faceplate 4804 to be moved horizontally relative to the wall studs 4812. Once the faceplate 4804 is in the desired location, the threaded fasteners 4814 positioned within the slots 4810 and into the respective wall studs 4812 and tightened against the faceplate 4804 to prevent unwanted relative movement between the faceplate 4804 and the wall studs 4812. In some embodiments, the wall studs 4812 are reinforced, and the threaded fastener 4814 may extend through a separate component located within the wall stud 4812 to increase the strength of the connection.

Figure 49:
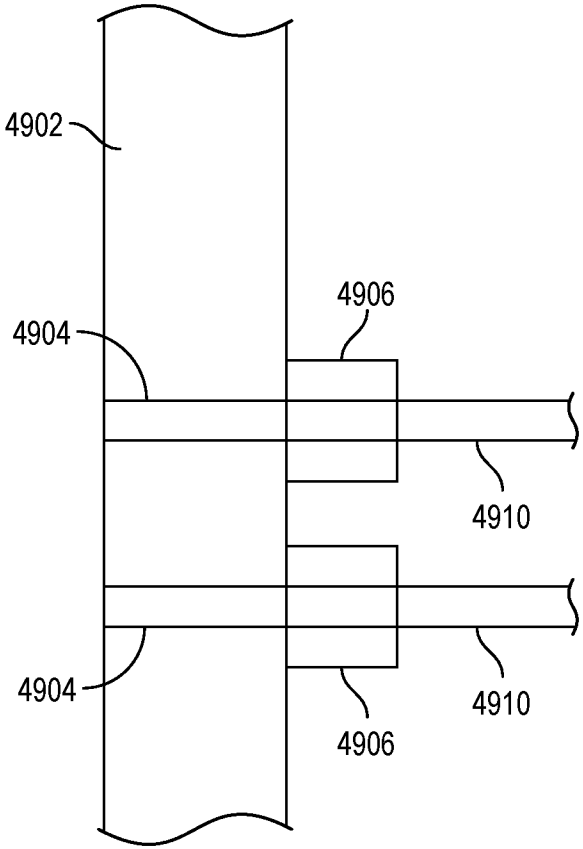

FIG. 49 illustrates a wall 4902 with a plurality of horizontally oriented water closet supports 4910 (e.g., threaded rods) extending therethrough via mounting holes 4904. To limit shaking or vibration at the joint between the wall 4902 and the water closet supports 4910, dampeners 4906 may be positioned on the water closet supports 4910 on the outside of the wall 4902 to be positioned between the wall 4901 and the water closet itself. During use, such dampeners 4906 may be used to reduce any vibrations or other unwanted forces produced in the water closet bowl or attached plumbing from being transmitted into the wall 4902. In the illustrated embodiment, the dampener 4906 is formed from rubber, however in alternative embodiments any vibration dampening material (e.g., silicone, and the like) may be used.

Figure 50:
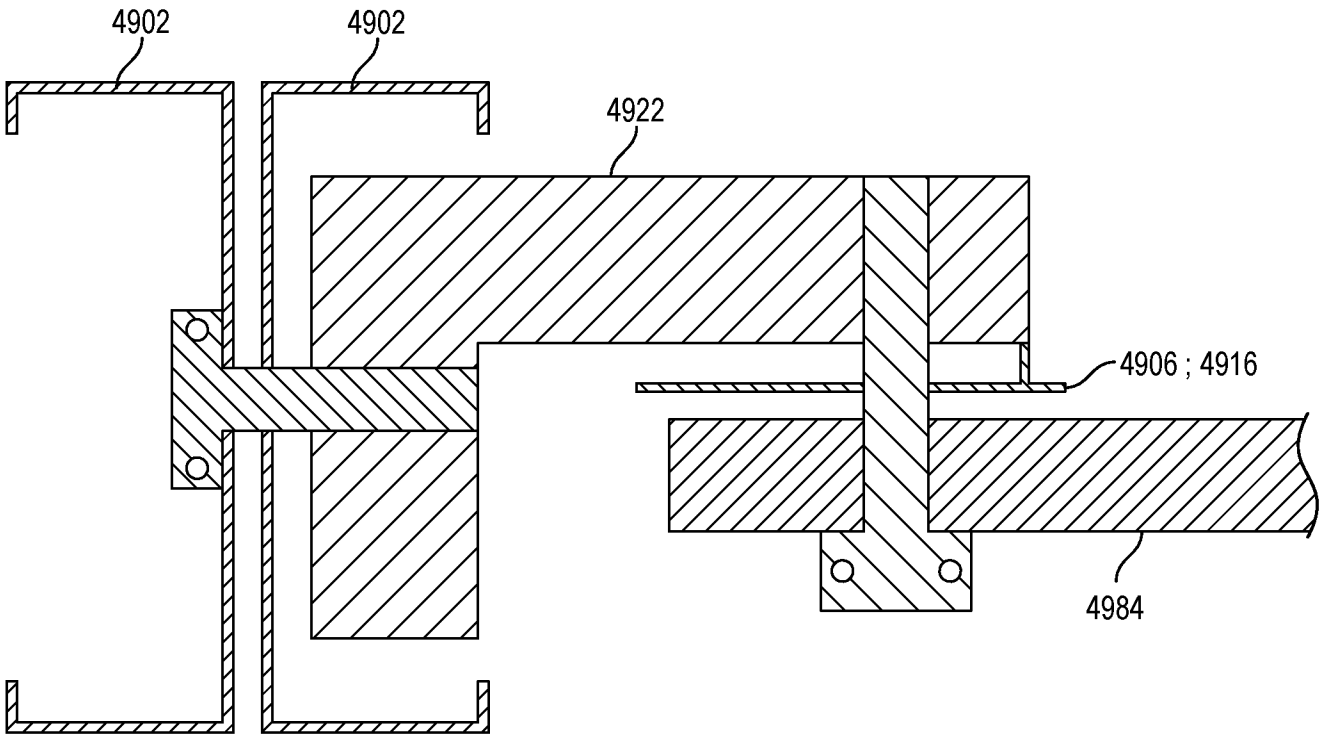

FIG. 50 illustrates another example of a faceplate 4984 where a dampener 4906 is used to dampen the transmission of vibrations and/or other forces between the faceplate 4984 and the elements of the wall (e.g., the studs 4902). In the illustrated embodiment, the dampener 4906 includes a rubber washer positioned between the faceplate 4984 and the corresponding bracket 4922. However, it is understood that in alternative embodiments the dampener 4906 may be positioned in other locations (e.g., between the bracket 4922 and the stud 4902). In still other embodiments, the dampener 4906 may be formed from other types of vibration dampening material.

Figure 51:
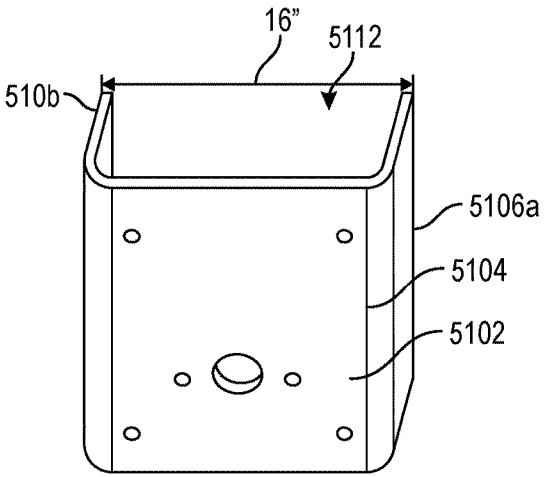

FIG. 51 illustrates another embodiment of a single-piece faceplate 5104 that is generally U-shaped (as viewed from above). More specifically, the faceplate 5104 includes a generally planar face 5102, a first edge portion or wing 5106*a* extending from one of the widthwise edges of the planar face 5102, and a second edge portion 5106*b* extending from another of the widthwise edges of the planar face 5102 opposite the first edge portion 5106*a*. In the illustrated embodiment, both edge portions 5106*a, b* extend from the planar face 5102 at approximately ninety-degree angles with respect thereto to form a U-shaped faceplate 5104. Furthermore, the illustrated edge portions 5106*a, b* are positioned a distance from each other substantially corresponding to the distance between two adjacent wall studs. As such, when the faceplate 5104 is installed, the exterior surfaces of the edge portions 5106*a, b* may contact and be coupled to (e.g., using fasteners and the like) the studs. In other embodiments, one or both of the edge portions 5106*a, b* may extend around the wall studs, thereby locating one or both wall studs 5110 within the U-shaped recess 5112.

Figure 52:
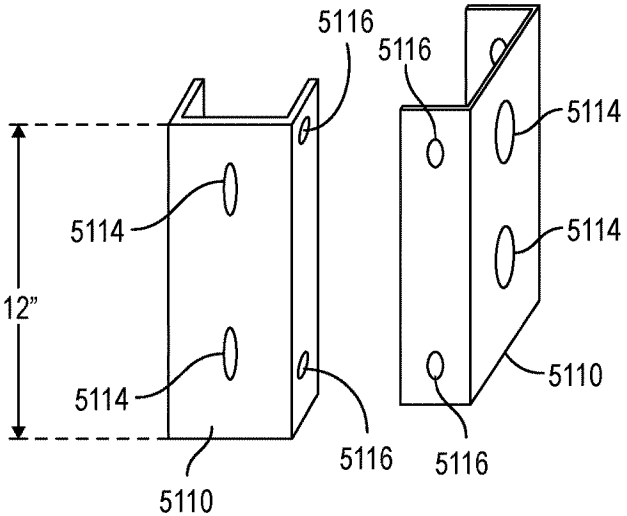

In still other embodiments, the edge portions 5106*a, b* may include apertures/elongated slots 5114 that align with similar openings 5114 or 5116 in the wall studs 5110 (see FIG. 52). A threaded fastener extends through the apertures/slots to couple the faceplate 5104 to the wall studs 5110. A nut may be used in combination with the threaded fastener to secure the threaded fastener in place. FIG. 52 illustrates the wall studs 5110 used in combination with the faceplate 5104 shown in FIG. 51. Still further, in still other embodiments, the edge portions 5106*a, b* may be sized and shaped to fit inside the studs 5110 in instances where C-channel style studs are used.

Figure 53:
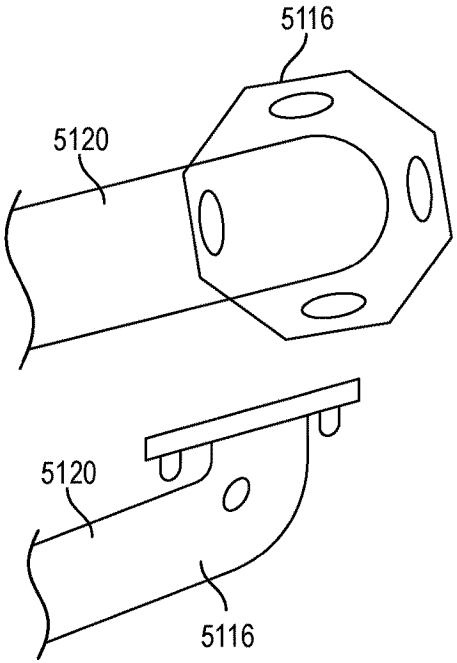

FIG. 53 illustrates another embodiment of a fluid coupler 5116. The fluid coupler 5116 is operable in a horizontal orientation in which the tube portion 5120 extends substantially horizontally. The fluid coupler 5116 is also alternatively operable in a vertical orientation, rotated ninety-degrees relative to the horizontal orientation.

Figure 54:
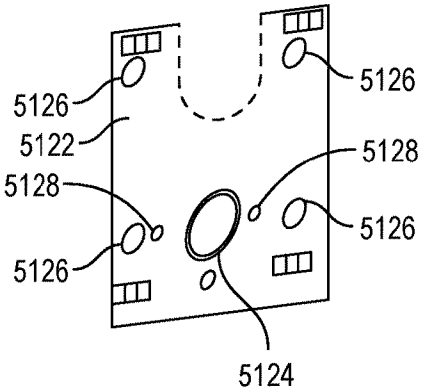
Figure 73:
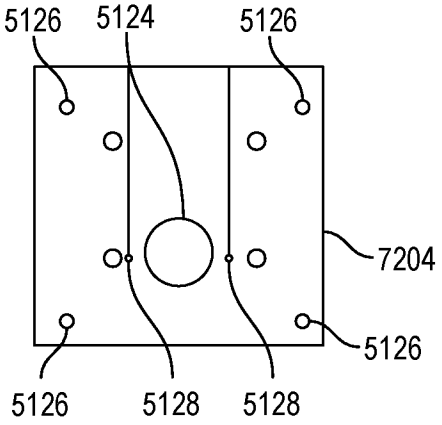

FIGS. 54 and 73 illustrates additional embodiments of a faceplate 5122, 7204, each having two bolt-patterns so the single faceplate 5122, 7204 can be used to mount either a floor mount back outlet style toilet or a wall mount style toilet thereto while utilizing a common fluid passageway 5124. More specifically, each faceplate 5122, 7204 includes a first bolt pattern 5126 including four apertures oriented relative to the fluid passageway 5124 in a rectangular orientation for allowing a "wall mount" style toilet to be mounted to the faceplate 5122. Each faceplate 5122, 7204 also includes a second bolt pattern 5128 including two apertures oriented relative to the fluid passageway 5124 with the two apertures positioned on either side of the fluid passageway 5124.

FIG. 73 also illustrates a faceplate 7204 with a substantially rectangular shape having all mounting and through holes being coplanar with one another.

Figure 55:
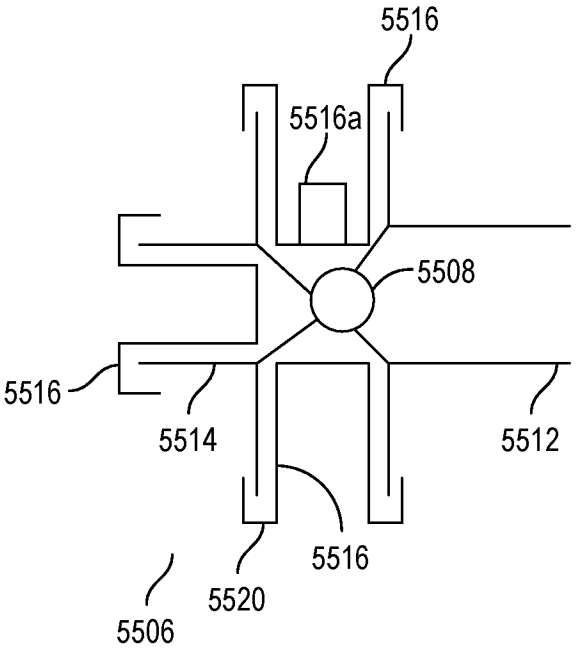

FIG. 55 illustrates a universal fluid coupler 5506. The universal fitting includes an inlet 5508 that is attached to the faceplate and four outlets 5512, 5514, 5516, 5520 that extend in four different directions while each being perpendicular to the direction of the inlet 5508. More specifically, the coupler 5506 includes a upwardly facing outlet 5516, a downwardly facing outlet 5520, a leftward facing outlet 5514, and a rightward facing outlet 5512. While the illustrated coupler 5506 includes four outlets spaced 90 degrees apart, it is understood that in alternative embodiments more of les outlets may be present at various intervals and orientations.

During use, the user can alter the manner in which fluids and gasses flow though the coupler 5506 by installing and removing various caps or plugs 5516 into each of the outlets 5512, 5514, 5516, 5520. The caps 5516, in turn, are configured to selectively seal the corresponding outlet. More specifically, the user may remove the cap 5516 from the outlet through which the user would like fluid to flow while installing caps 5516 into any outlets through which the user does not want fluid to flow. Furthermore, the user may install a "vent cap" 5516*a* into the outlet through which the user would like to vent gasses from the system. As shown in FIG. 55, the vent cap 5516*a* is configured to partially block the outlet in which it is installed but provide a venting nipple to which a vent tube or pipe may be attached.

In the illustrated example, the user has configured the coupler 5506 for flow to the right (e.g., to a pipe extending to the right side of the figure) and for venting vertically upwardly. To do so, the user has installed caps in both the leftward facing outlet 5514 and the downwardly facing outlet 5520 to seal those particular outlets. The user has also installed a vent cap 5516*a* in the upwardly facing outlet 5516 to allow venting vertically upwardly. The rightward facing outlet 5512 is left un-capped and attached to an external pipe to allow fluid to flow therethrough.

Figure 56:
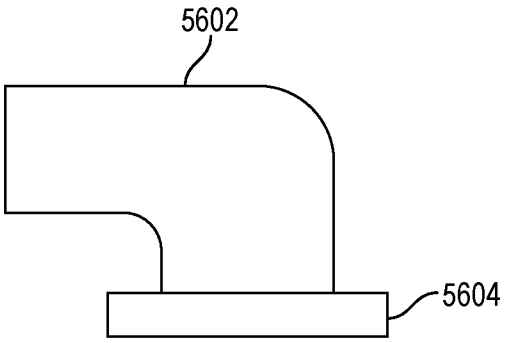
Figure 57:
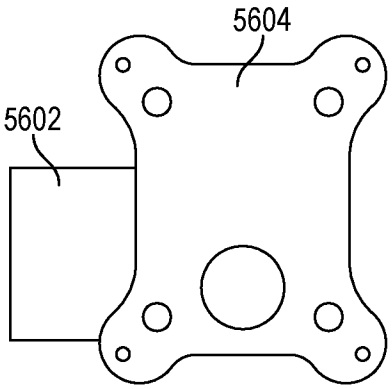

FIGS. 56-57 illustrate another embodiment of a faceplate 5604 that is formed as a single-piece construction with the fluid coupler/fitting 5602. FIGS. 1-6 illustrate a fluid coupler that is formed separately from the faceplate and the description of FIGS. 1-6 discloses how these components are attached. In the embodiment of FIGS. 56 and 57, the fluid coupler 5602 is integrally formed as a single piece (e.g., cast) with the faceplate 5604. In this embodiment, the mounting holes for attaching the fluid coupler 5602 to the faceplate 5604 are omitted. Additionally, a potential leak path between the fluid coupler 5602 and the faceplate 5604 is removed.

Figure 58:
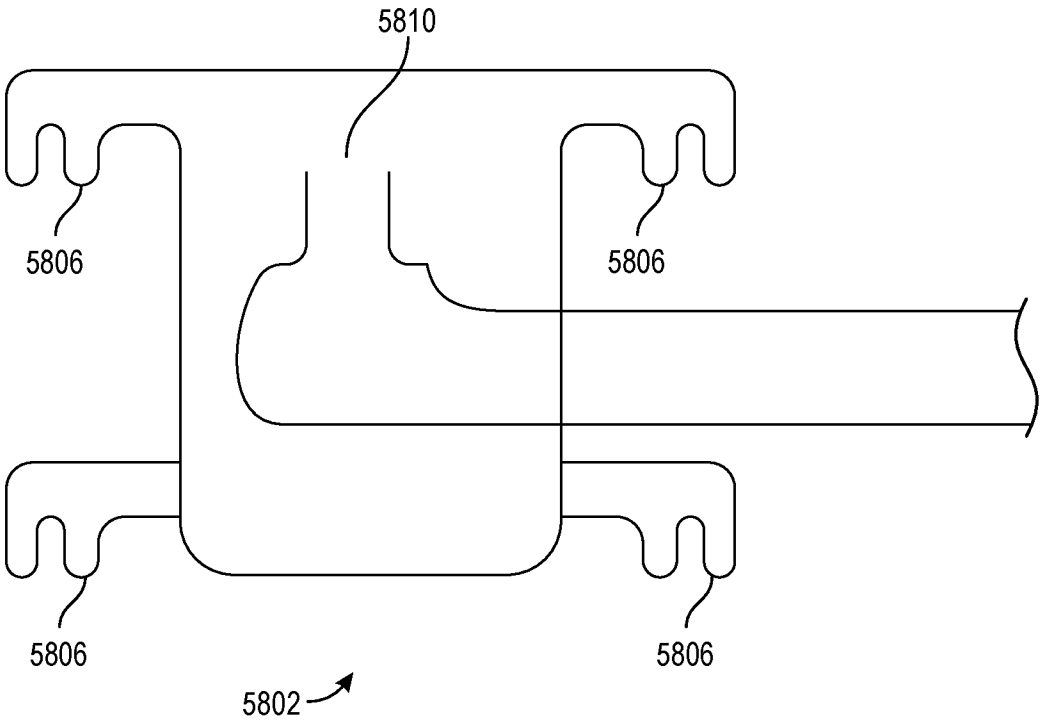

FIG. 58 illustrates another embodiment of a fluid coupler 5802 that, in contrast to the fluid coupler shown in FIGS. 1-6, utilizes open slots 5806 for attaching the fluid coupler 5802 to the faceplate 5804. More specifically, arms extending outward from the fluid inlet 5810 of the coupler 5802 have downward depending fingers that define open-ended slots 5806 therebetween. The slots 5806 receive fasteners for coupling the fluid coupler 5802 to the faceplate. By doing so, the fasteners may be pre-installed loosely in the faceplate 5804 whereby the slots 5806 of the coupler 5802 can be slid downwardly over the fasteners to initially position the coupler 5802 with respect to the faceplate 5804. With the coupler 5802 in place, the user can then secure the coupler 5802 in place by tightening the fasteners. This assembly process makes it easier for the user by not requiring the user to hold the coupler 5802 or faceplate 5804 in position while simultaneously threading the fasteners in place.

Figure 59:
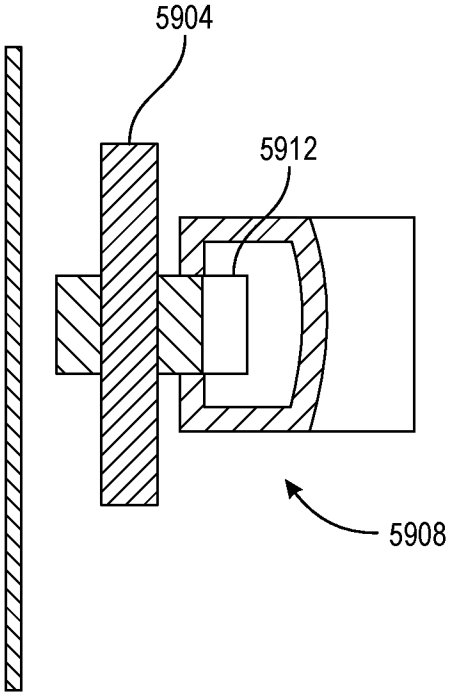

FIG. 59 illustrates a method for connecting the fluid coupler to the faceplate 5904. Such a method may be used for the final attachment between the two items or as a temporary measure to support the fluid coupler relative to the faceplate 5904 while the final attachment mechanism (e.g., threaded fasteners) are inserted/assembled. More specifically, FIG. 59 illustrates a faceplate 5904 having a cylindrical hub 5912 extending therefrom onto which the fluid coupler 5908 may be pressed thereon to form a slip fitting. Such a connection may also include an O-ring to improve the sealing capabilities of the joint. In still other embodiments, the hub 5912 may be threaded to form a threaded connection or include a union fitting 5908 formed by the faceplate 5904 and the fluid coupler.

Figure 60:
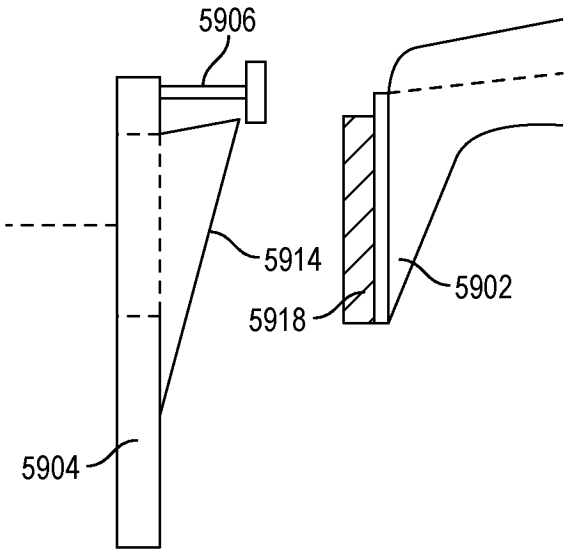

FIG. 60 illustrates another method for connecting the fluid coupler 5902 to the faceplate 5904. As shown in FIG. 60, the faceplate 5904 includes a wedge element 5914 sized and shaped to interact with a corresponding wedge element of the fluid coupler 5902. More specifically, the joint is configured so that the user can insert the wedge element of the fluid coupler 5902 vertically into the top of the wedge element 5914 of the faceplate 5904 whereby the relative vertical movement of the faceplate 5904 and the coupler 5902 cause the two wedge elements to interact and pull the fluid coupler 5902 into engagement with the faceplate 5904. More specifically, the wedge elements cause the fluid coupler 5902 and the faceplate 5904 to compress the gasket 5918 between the two elements to form a water-tight connection therebetween. Once the connection has been formed, a screw or other fastener 5906 may be used to lock the two elements in place.

Figure 61:
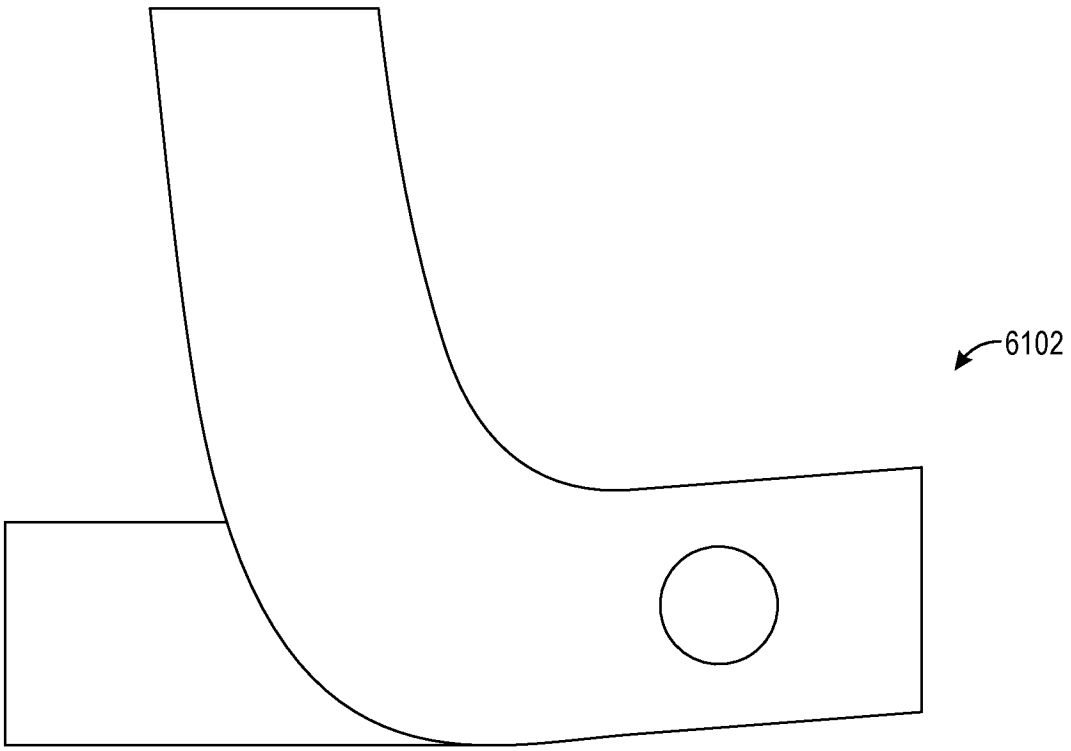
Figure 62:
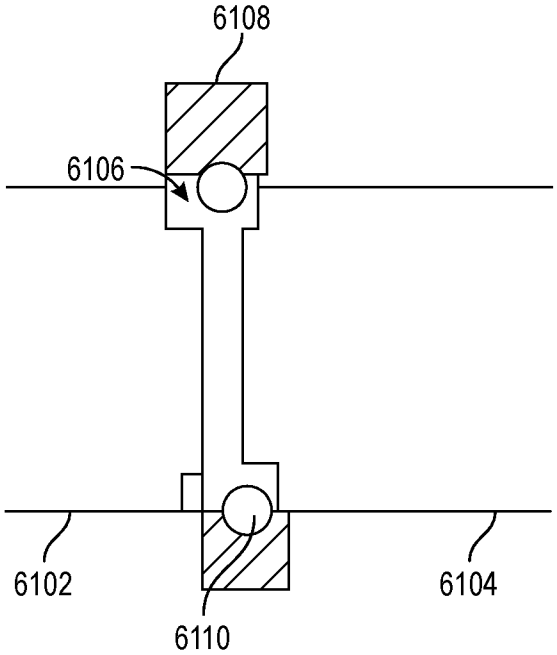

FIG. 61 illustrates a top view of an alternative embodiment of a fitting/fluid coupler 6102. FIG. 62 illustrates a connection between the fitting/fluid coupler 6102 and the hub of a faceplate 6104. In such a connection, the peripheral edges of the fluid coupler 6102 and the hub 6104 include a cutout 6106 sized to receive a seal such as an O-ring 6110 therein. When connected, a clamp 6108 is tightened on the O-ring 6110 to maintain the seal created by the O-ring 6110 and to fix the coupler 6102 to the hub of the faceplate 6104.

Figure 63:
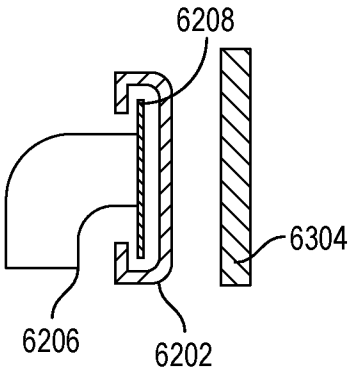

FIG. 63 illustrates an alternative embodiment of a gasket 6202 for the fitting/fluid coupler 6206. As shown, the gasket 6202 is configured so that it can be attached to the coupler 6206 and remain in place as the coupler 6206 is installed. By doing so, the user is free to use his or her hands for other aspects of the connection process and is not required to hold the gasket in place. More specifically, the gasket 6202 includes fingers sized and shaped to at least partially wrap around the flange 6208 of the fluid coupler 6206. With this arrangement, the gasket 6202 can be preinstalled on the fitting prior to coupling the fitting to the faceplate 6304 and will maintain its position during installation.

Figure 65:
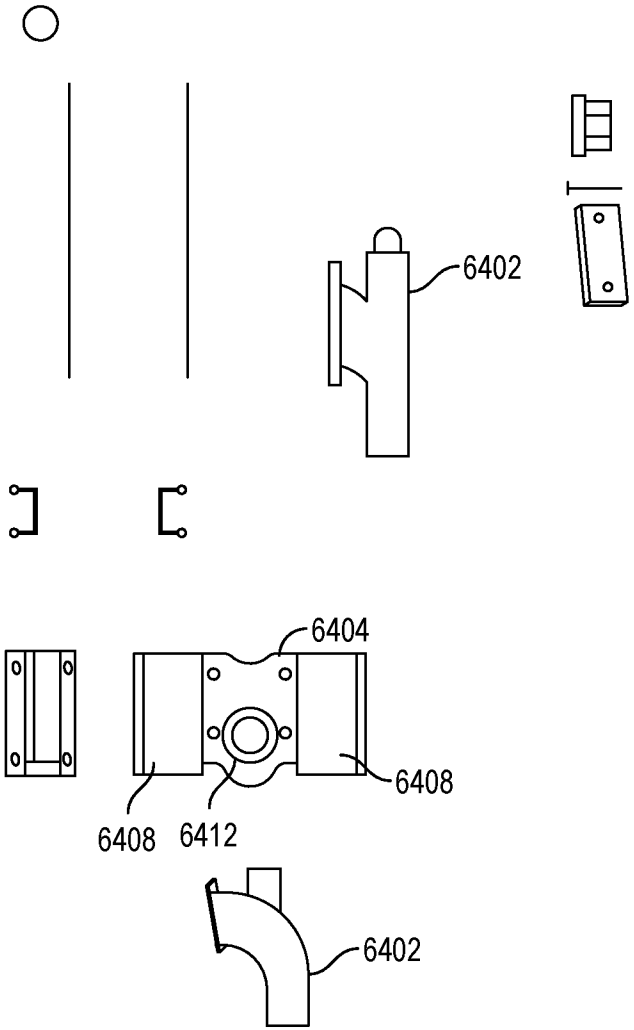
Figure 64:
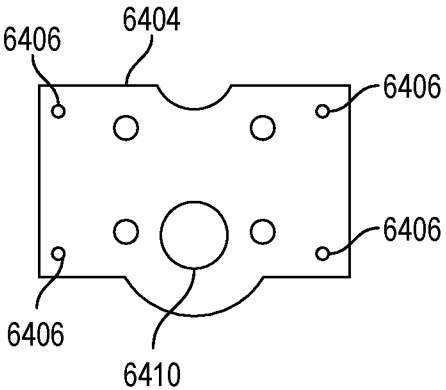

FIGS. 64-65 illustrate another embodiment of a faceplate 6404 and fluid coupler 6402, similar to the one shown in FIGS. 1-6. The faceplate 6404 is a one-piece faceplate 6404 with apertures 6406 for connecting to adjacent wall studs 6408. The shape of the faceplate 6404 is modified such that the fluid port 6410 and hub 6412 are located at a lower height with the rectangular cross-section being offset to accommodate the lower position. The fluid coupler 6402 is attachable to the faceplate 6404 in a similar manner as described above with respect to FIGS. 1-6.

Figure 66:
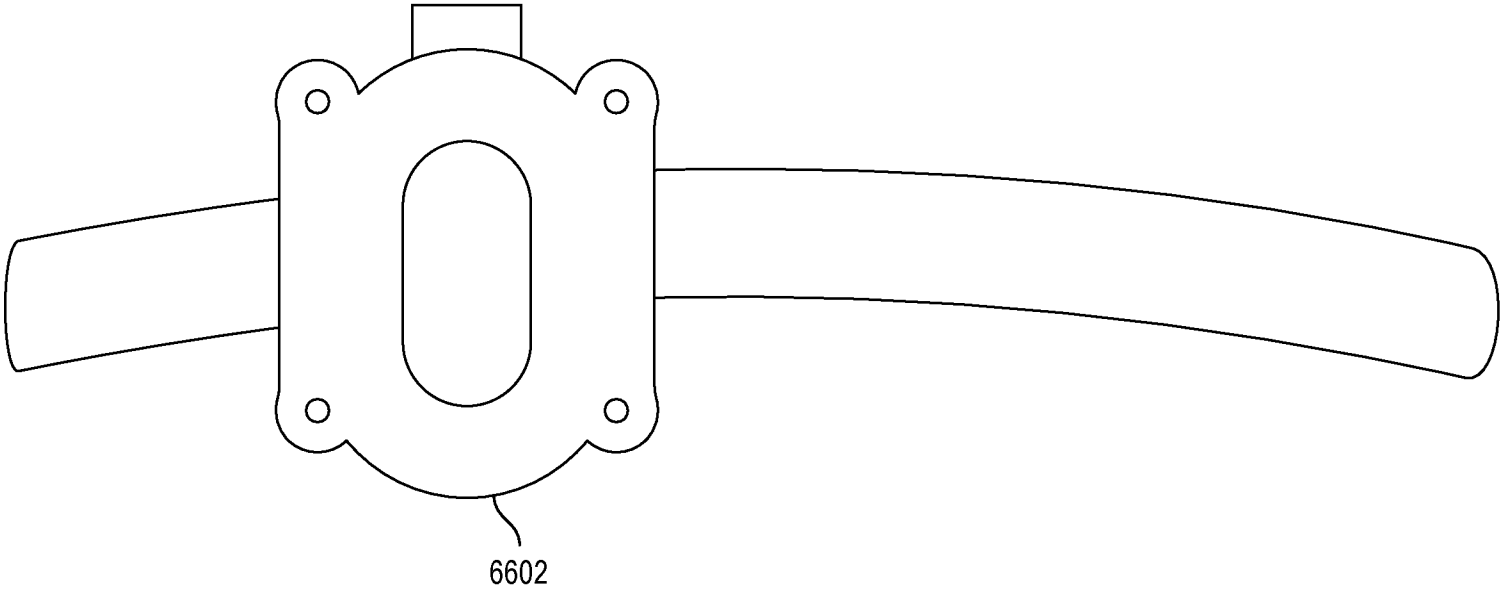
Figure 67:
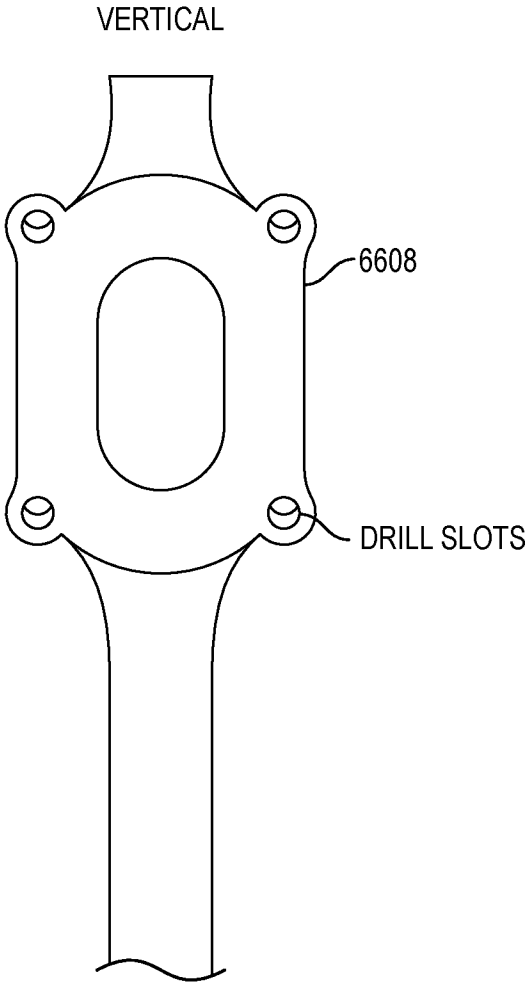

FIG. 66 illustrates another embodiment of a fluid coupler 6602 that is intended for use in a horizontal orientation. In general, the horizontal orientation is used to link to an adjacent fluid coupler 6602 associated with another water closet or the like (not shown). FIG. 67 illustrates a vertical fluid coupler 6608 that is implemented at the end of a run.

Figure 68:
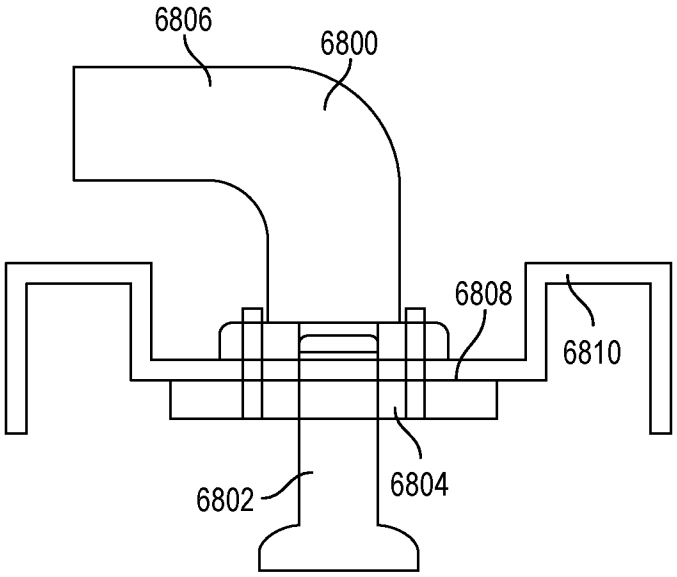

FIG. 68 illustrates an alternative embodiment of a carrier assembly 6800. The carrier assembly 6800, in turn, includes a faceplate 6804 having a rear or back surface 6808, a bracket 6810 coupled to the back surface 6808 of the faceplate 6804 and supporting the faceplate 6804 relative to a pair of wall studs, a fitting member 6806, and a coupling 6802. In the illustrated embodiment, the flange end 6812 of the fitting member 6806 is coupled to the back surface 6808 of the faceplate 6804 via the bracket 6810 such that the bracket 6810 is sandwiched therebetween. Furthermore, the bracket 6810, fitting member 6806, and faceplate 6804 are configured to form water-tight connections therebetween. By having the fitting member 6806 coupled to the faceplate 6804 via the bracket 6810, it is possible for the user to first install the faceplate 5804 or pre-install the faceplate 6804 using the bracket 6810 and later install the fitting member 6806 at the site. This way the bracket 6810 does not need to be removed to allow the joint to occur.

Figure 69:
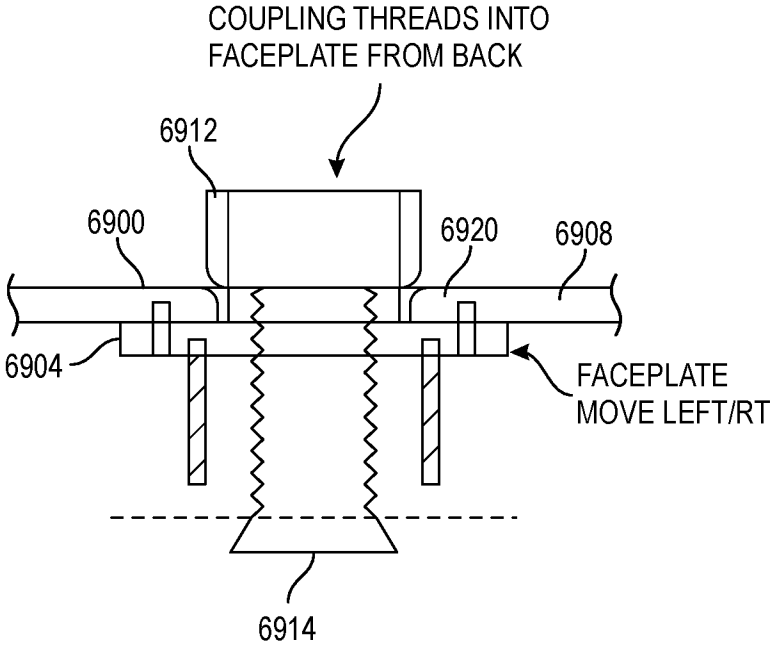

FIG. 69 illustrates another embodiment of a carrier assembly 6900. The carrier assembly 6900 includes a faceplate 6904 that is mounted to a pair of wall studs using a bracket 6908. The faceplate 6904 also includes a hub 6912 forming a set of internal threads therein. The assembly 6900 also includes a coupler 6914 that engages the internal threads of the hub 6912 of the faceplate 6904 and that is configured to be placed in fluid communication with the water closet when the carrier assembly 6900 is mounted thereto. In the illustrated embodiment, the coupler 6912 is sized and shaped so that it can be threaded into positioned (e.g., into fluid communication with a mounted water closet) from the back-side 6920 of the faceplate 6904. By doing so, the user is able to first mount the water closet on the carrier assembly 6900 and subsequently come back and install the coupler 6912 from behind the wall. This is highly advantageous in pre-formed wall assemblies where the faceplate 6904, water closet, or both may already be pre-installed when the modular wall arrives at the work site. In such embodiments, the length of the coupler 6912 may be cut down to size as needed to fit current installation.

Figure 70:
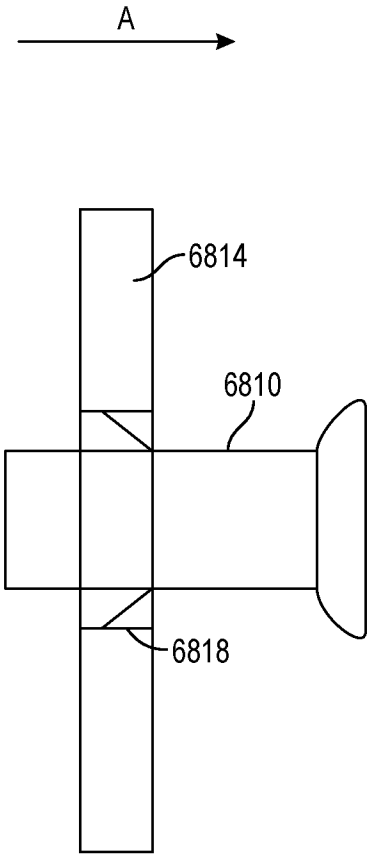

FIG. 70 illustrates a coupler 6810 that is configured for connection to a corresponding faceplate 6814 using a stab lock connection 6818 for coupling the fluid coupler 6810 to the faceplate 6814. More specifically, the stab lock connection 6818 is formed integrally with or coupled to the faceplate 6814 to operatively engage the coupler 6810 extending through an aperture formed in the faceplate 6814. In in some embodiments, the stab lock connection 6818 includes a plurality of fingers or tabs that engage the coupler

6810. However, in alternative embodiments different forms of stab lock couplers or one-way couplers may be used.

During use, the stab lock 6818 is configured to limit the axial movement of the coupler 6810 in a single direction (e.g., direction A). To assembly the device, the user first mounts the toilet seat to the faceplate 6814. With the toilet in place, the use then axially advances the coupler 6810 toward the toilet seat until the coupler 6810 engages and forms a seal with the toilet seat. Because the stab lock only allows movement in direction A, the coupler 6810 is then locked in place against the toilet seat to maintain the seal as the stab lock connection 6818 will not allow the coupler 6810 to retract rearwardly.

Figure 71:
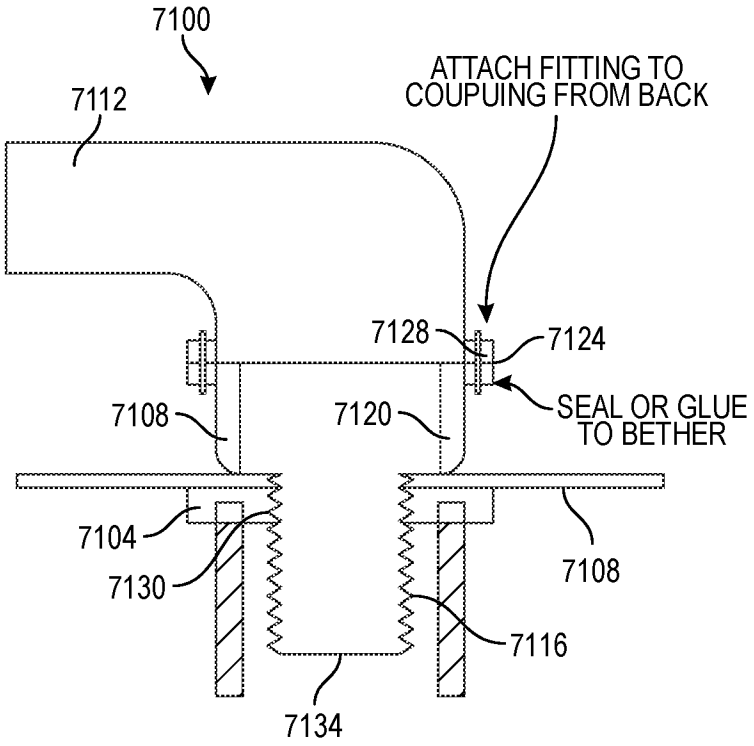

FIG. 71 another embodiment of a carrier assembly 7100. The carrier assembly 7100 includes a faceplate 7104, a bracket or brackets 7108 to support the faceplate 7104 relative to a pair of wall studs, a carrier hub 7108, and a fitting 7112 coupled directly to the carrier hub 7108 to form a continuous fluid pathway therebetween. As shown in FIG. 71, the carrier hub 7108 includes a threaded portion 7116 configured to threadably engage an aperture 7130 of the faceplate 7104, and an expanded coupling portion 7120 producing a first sealing interface 7124 configured to engage with a corresponding second sealing interface 7128 of the fitting 7112. More specifically, the carrier hub 7108 is sized so that the threaded portion 7116 can be introduced into the aperture 7130 of the faceplate 7104 from the rear (e.g., opposite the water closet) and threaded into the aperture 7130 until the distal end 7134 of the threaded portion 7116 engages with and forms a water-tight connection with the water closet. Furthermore, the coupling portion 7120, which is larger in cross-section than the aperture 7130, remains on the rearward side of the faceplate 7140 so that the first sealing interface 7124 remains accessible for subsequent attachment to the fitting 7112. In the illustrated embodiment, the first sealing interface 7124 and the second sealing interface 7128 include an annular surface with a plurality of lugs through which fasteners can be employed to secure the two elements together. However, in other embodiments different forms of connection and interaction may be used (e.g., threads, bayonet fit, etc.). Furthermore, the first and second interfaces 7124, 7128 may include a sealing element such as a gasket or glue to assure the joint is water-tight.

Figure 72:
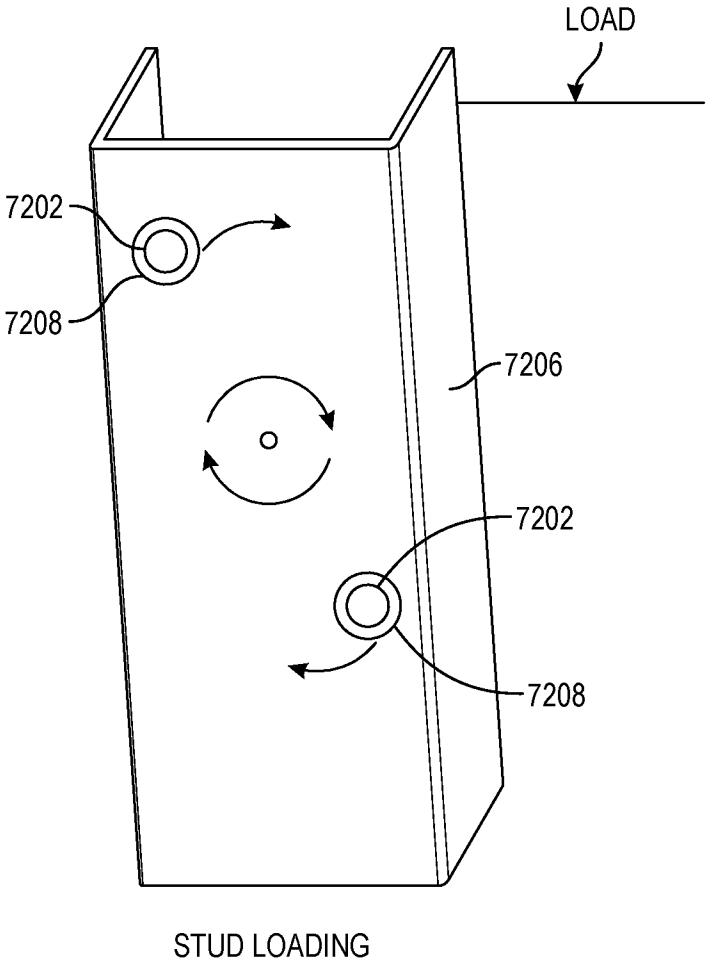

FIG. 72 illustrates potential mounting holes 7202 within a wall stud 7206 for mounting a faceplate 7204 (directly or indirectly via a bracket). The mounting holes 7202 include rubber grommets 7208 to limit vibrations and reaction forces between the wall and the fasteners extending therethrough. Additionally, the mounting holes 7202 are offset from one another, with an upper mounting hole 7202 located nearer a rear of the wall stud 7206 and a lower mounting hole 7202 located nearer the front of the wall stud 7206. With this arrangement, when the water closet is mounted on the faceplate 7204 and/or a user rests upon the water closet, a downward offset load 7218 is applied on the wall stud 7206 through the fasteners. The offset location of the openings 7202 (in comparison to openings aligned along a vertical axis) leads to a reduction in the rotational loading forces applied to the wall studs 7206.

Figure 74:
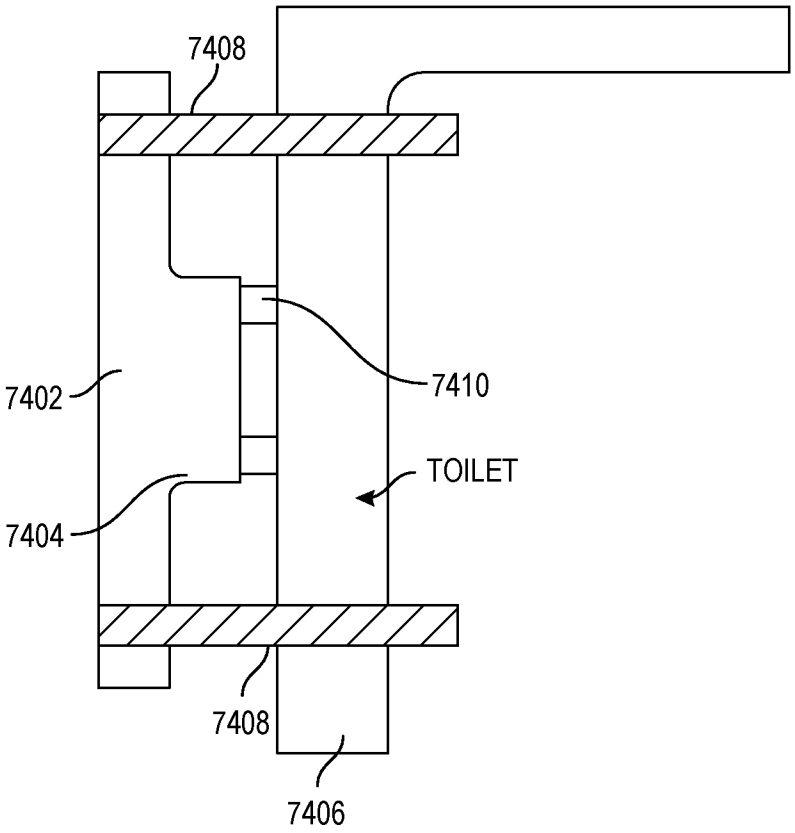
Figure 75:
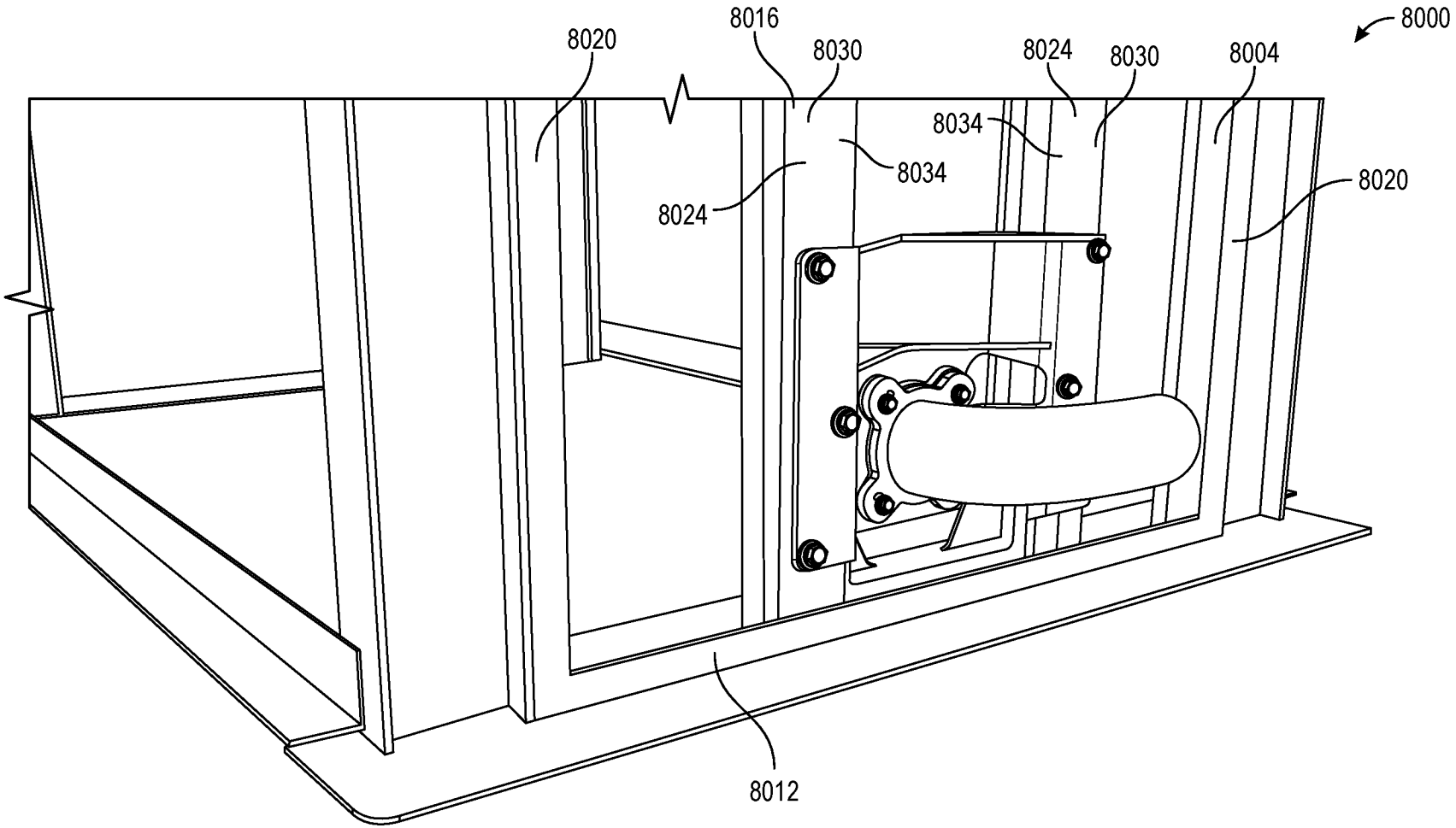
FIGS. 75-94 illustrate another embodiment of a carrier assembly for installation on a modular wall assembly.
Figure 76:
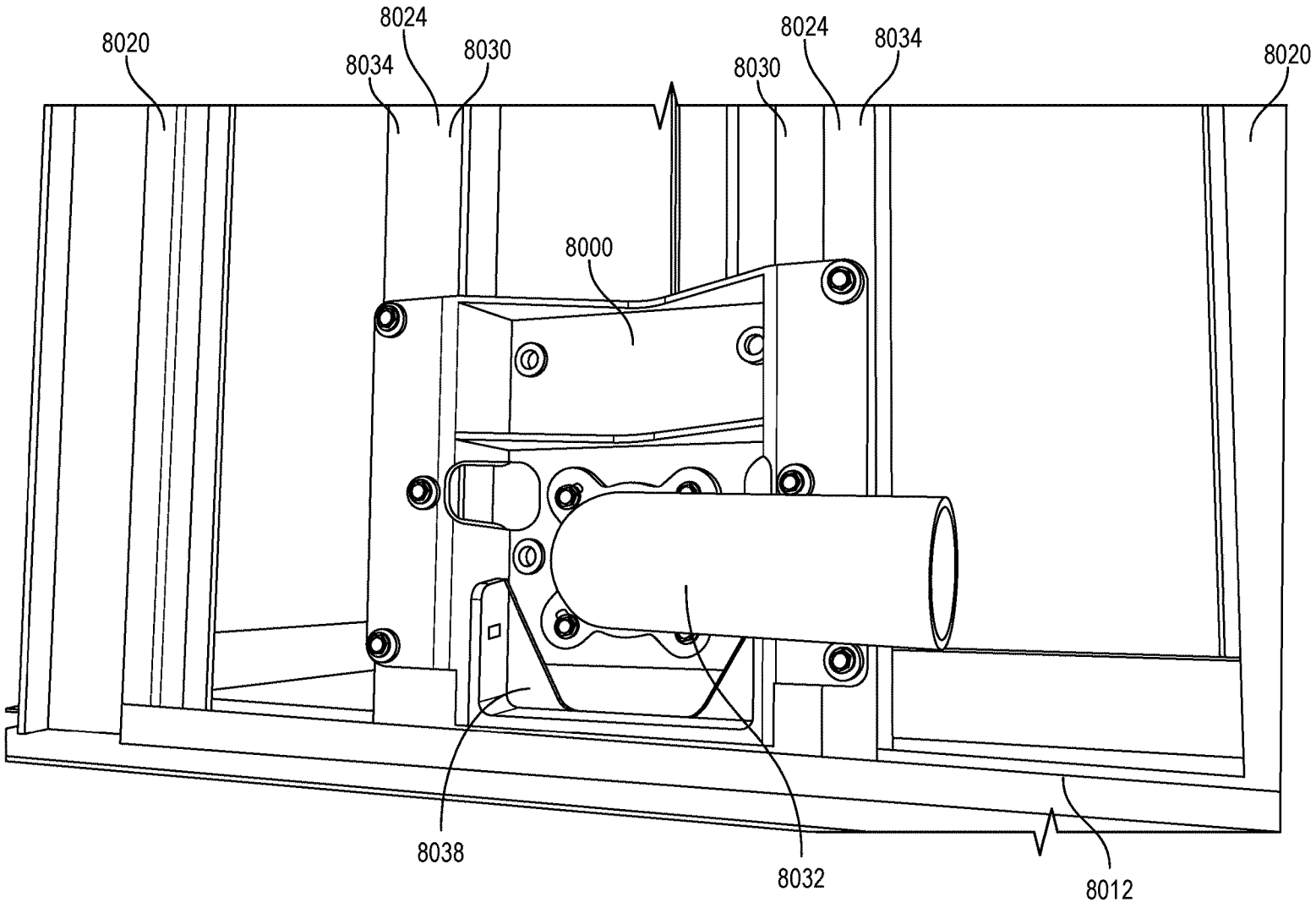
Figure 77:
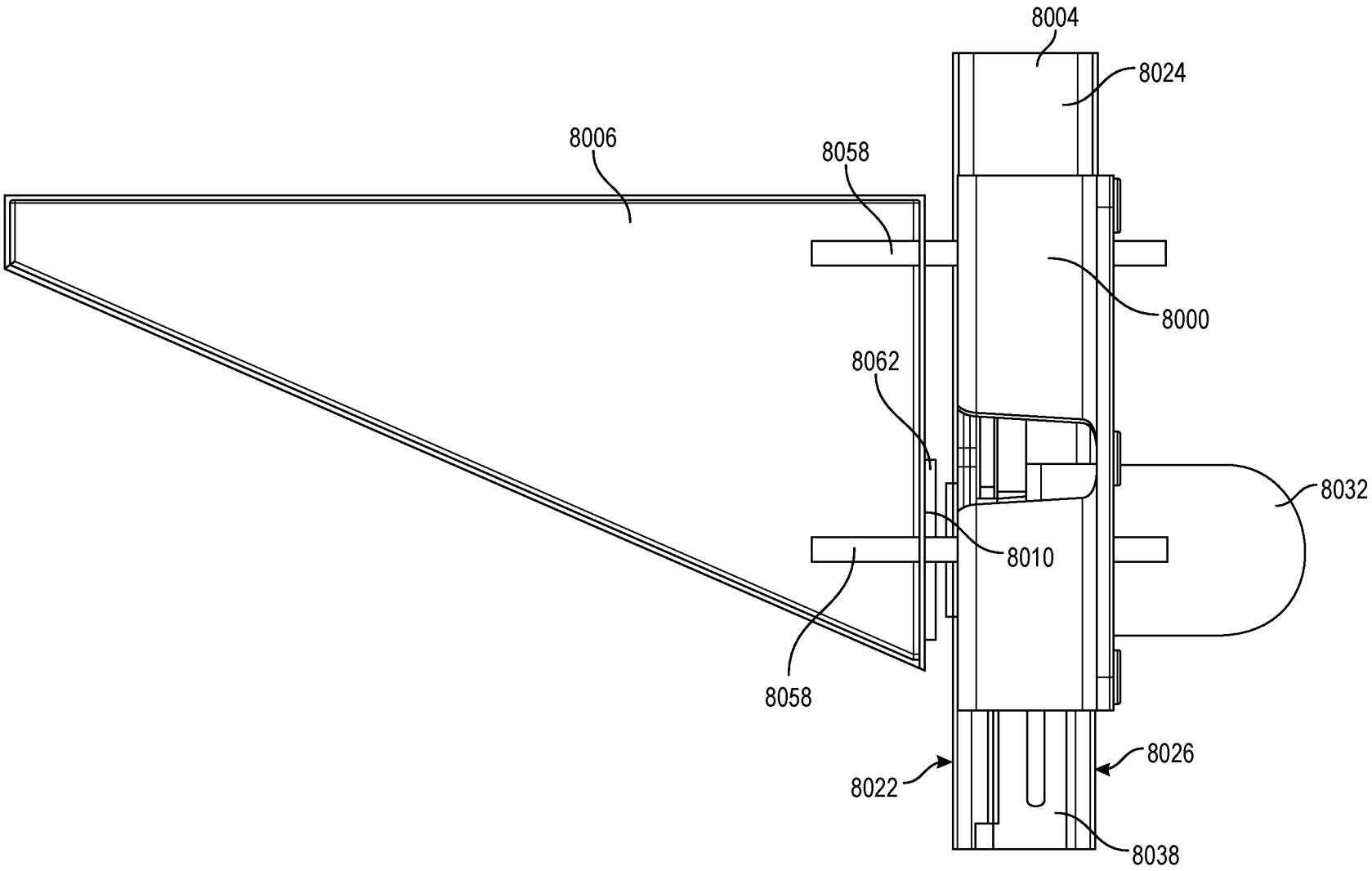

FIG. 74 illustrates another embodiment of a faceplate 7402 having an integral hub 7404. More specifically, the faceplate 7402 includes a substantially cylindrically-shaped hub 7404 extending outwardly therefrom that is configured to directly engage the toilet or water closet 7406 via a gasket 7410. When assembled, the toilet 7406 is coupled to the faceplate 7402 via fasteners 7408 such as threaded fasteners such that the gasket 7410 is captured between the hub 7404 and the toilet 7406 to form a water-tight seal therebetween. Integrating the hub 7404 into the faceplate 7402 decreases the total number of parts to be installed and also eliminates a leakage point between the hub 7404 and the faceplate 7402

FIGS. 75-80 illustrate another embodiment of a carrier assembly 8000. The carrier assembly 8000 is substantially similar to the carrier assembly 100 so only the differences will be discussed in detail herein. The carrier assembly 8000 is configured for installation within a modular wall assembly 8004, described below, whereby the carrier assembly 8000 provides a mounting location to which a water closet 8006 may be attached. Once attached, the carrier assembly 8000 is configured to transmit any loads applied to the water closet 8006 (e.g., a person sitting thereon, and the like) into the wall assembly 8004 for support. In the illustrated embodiment, the carrier assembly 8000 not only provides physical support for the water closet but also serves as a fluid connection by placing the outlet 8010 of the water closet 8006 into fluid communication with a corresponding waste-water pipe of the plumbing system of the building (described below).

The modular wall assembly 8004 to which the carrier assembly 8000 is to be installed includes a pre-fabricated wall segment that is configured for installation within a building as a pre-assembled unit. More specifically, the modular wall assembly 8004 includes a bottom member 8012, a top member 8016 opposite the bottom member 8012, and a plurality of uprights or studs 8020 extending between the bottom member 8012 and the top member 8016. In the illustrated embodiment, each upright 8020 has a substantially "C" channel cross-sectional shape (channel stock). However, in other embodiments, the uprights 8020 may include other have I-beam or other cross-sectional shapes such as but not limited to angle iron, bulb plate, T-bar, square bar, round bar, and the like). Together, the bottom member 8012, the top member 8016, and the uprights 8020 form a front wall surface 8022 and a rear wall surface 8026 opposite the front wall surface 8022. The front wall surface 8022 generally corresponds with the surface of the wall 8004 to which the water closet 8006 is installed.

Figure 78:
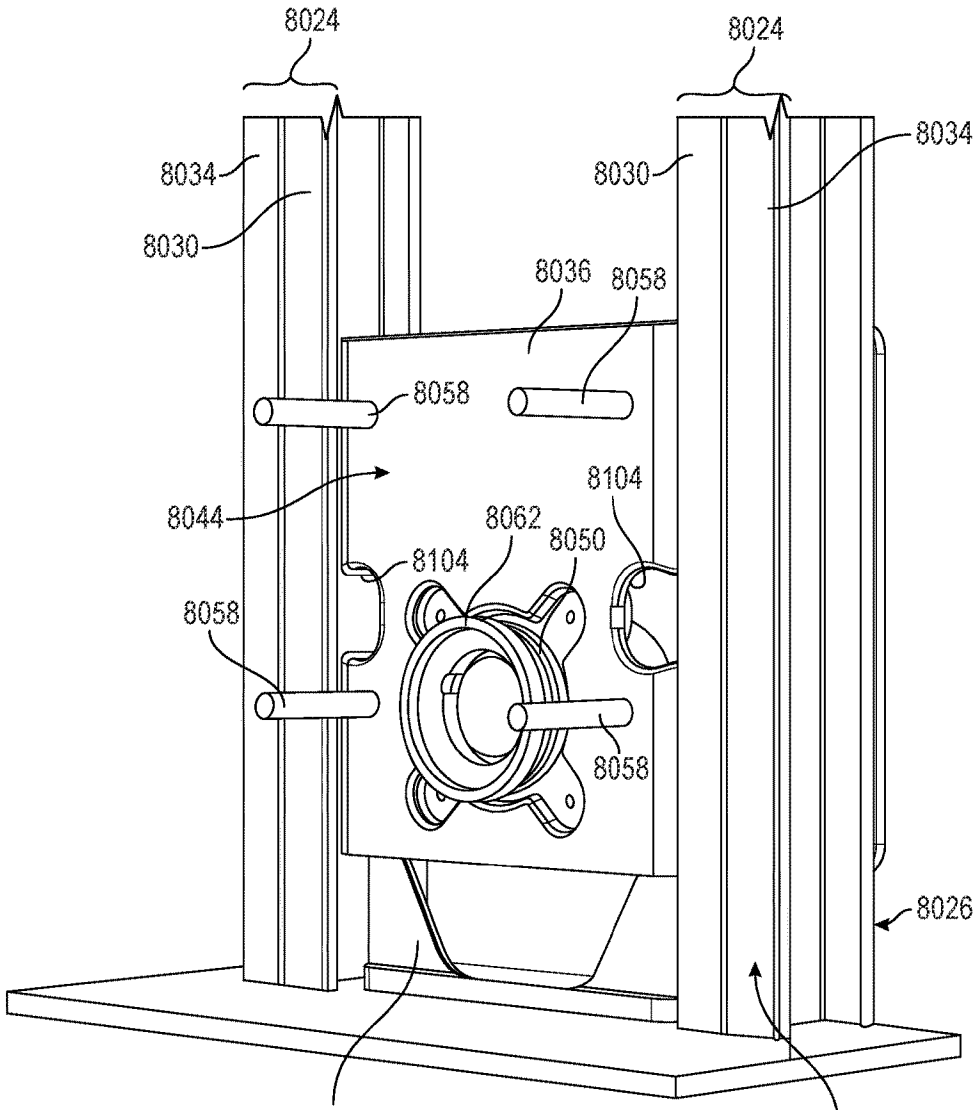
Figure 79:
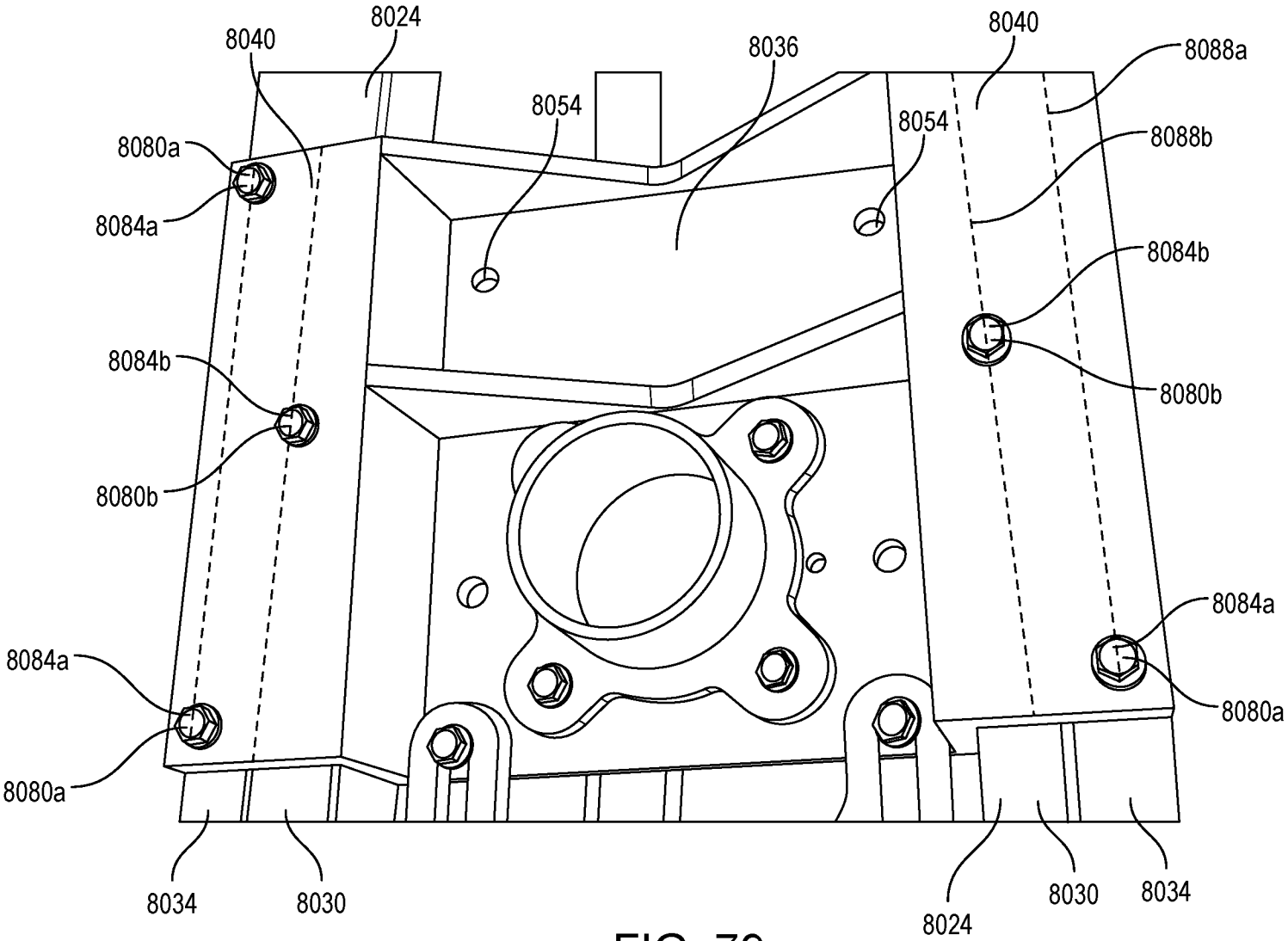

As shown in FIG. 78, the modular wall assembly 8004 also includes one or more "double-uprights 8024" consisting of two uprights (e.g., a first upright 8030 and a second upright 8034) installed back-to-back or immediately adjacent to each other. The double-uprights 8024 of the illustrated embodiment include a pair of C-channels placed back-to-back with the open ends facing away from each other. The double-uprights 8024 are configured to provide additional strength and stability to the modular wall assembly 8004 and provide additional stability to the carrier assembly 8000 when attached thereto.

The carrier assembly 8000 includes a faceplate 8028, an outlet tube or fluid coupler 8032 coupled to the faceplate 8028, and a foot support 8038 extending between and coupled to the faceplate 8028 and the bottom member 8012 of the modular wall assembly 8004. During use, the faceplate 8028 and the foot support 8038 are configured to be pre-installed in the modular wall assembly 8004 so that the wall assembly 8004, together with the faceplate 8028 and foot support 8038 (when present) may be installed in a building as a single unit. Once the wall assembly 8004 and faceplate 8028 are in place, the fluid coupler 8032 and water closet 8006 may be installed to form a fluid connection with the corresponding building's plumbing system.

The faceplate 8028 of the carrier assembly 8000 includes a central portion 8036 and a pair of side portions 8040 flanking the central portion 8036 on opposite sides thereof.

When installed, the central portion 8036 and the side portions 8040 are configured so that the mounting surface 8044 of the central portion 8036 is aligned with the front wall surface 8022 of the modular wall assembly 8004 while each side portion 8040 is coupled to the rear surface 8026 of a corresponding upright 8020 (e.g., a double upright 8024). By doing so, the illustrated faceplate 8028 provides additional strength to the finished water closet assembly by minimizing the cantilevered length between the faceplate 8028 and the water closet (see FIG. 77) while allowing all of the mounting points between the carrier assembly 8000 and the uprights 8020 of the modular wall 8004 to be accessed via the rear surface 8026. By doing so, the user can install and perform maintenance on the faceplate 8028 without having to cut into or otherwise modify the visible wall materials (e.g., the drywall) attached to the front wall surface 8022.

The central portion 8036 of the faceplate 8028 defines the mounting surface 8044, a fluid passageway 8050, and a plurality of threaded apertures 8054 configured to receive a corresponding threaded mounting element 8058 therein. When assembled, the water closet 8006 is coupled to the faceplate 8028 via the threaded mounting elements 8058 while the fluid passageway 8050 is configured to form a water-tight seal with the outlet 8010 of the water closet 8006. In the illustrated embodiment, the fluid passageway 8050 includes an aperture formed into the faceplate 8028 that holds a fluid coupler 8062 therein. The fluid coupler 8062, in turn, is axially adjustable relative to the central portion 8036 to engage and form a water-tight seal with the outlet 8010 of the water closet 8006. In other embodiments, the fluid passageway 8050 itself may form a water-tight seal with the water closet 8006.

Figure 83:
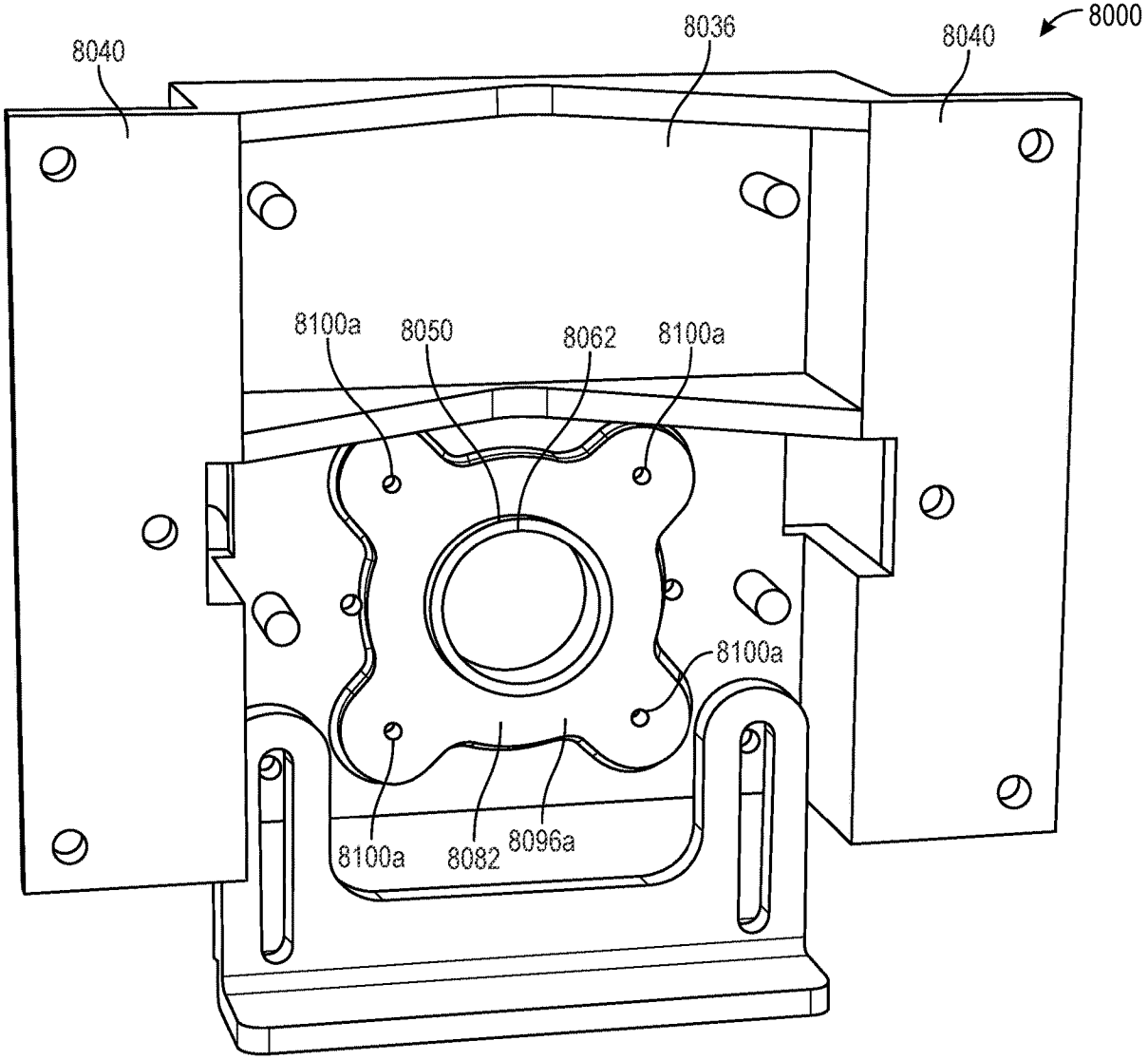
Figure 84:
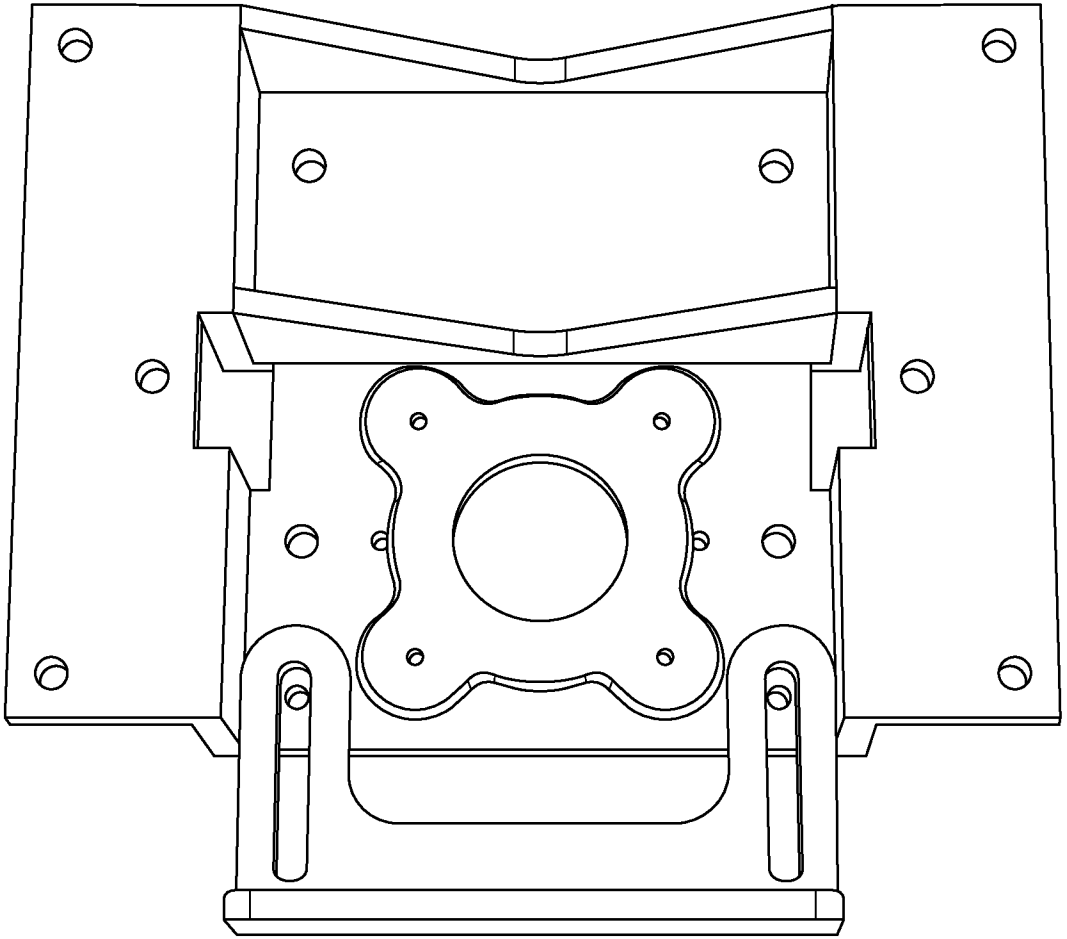
Figure 85:
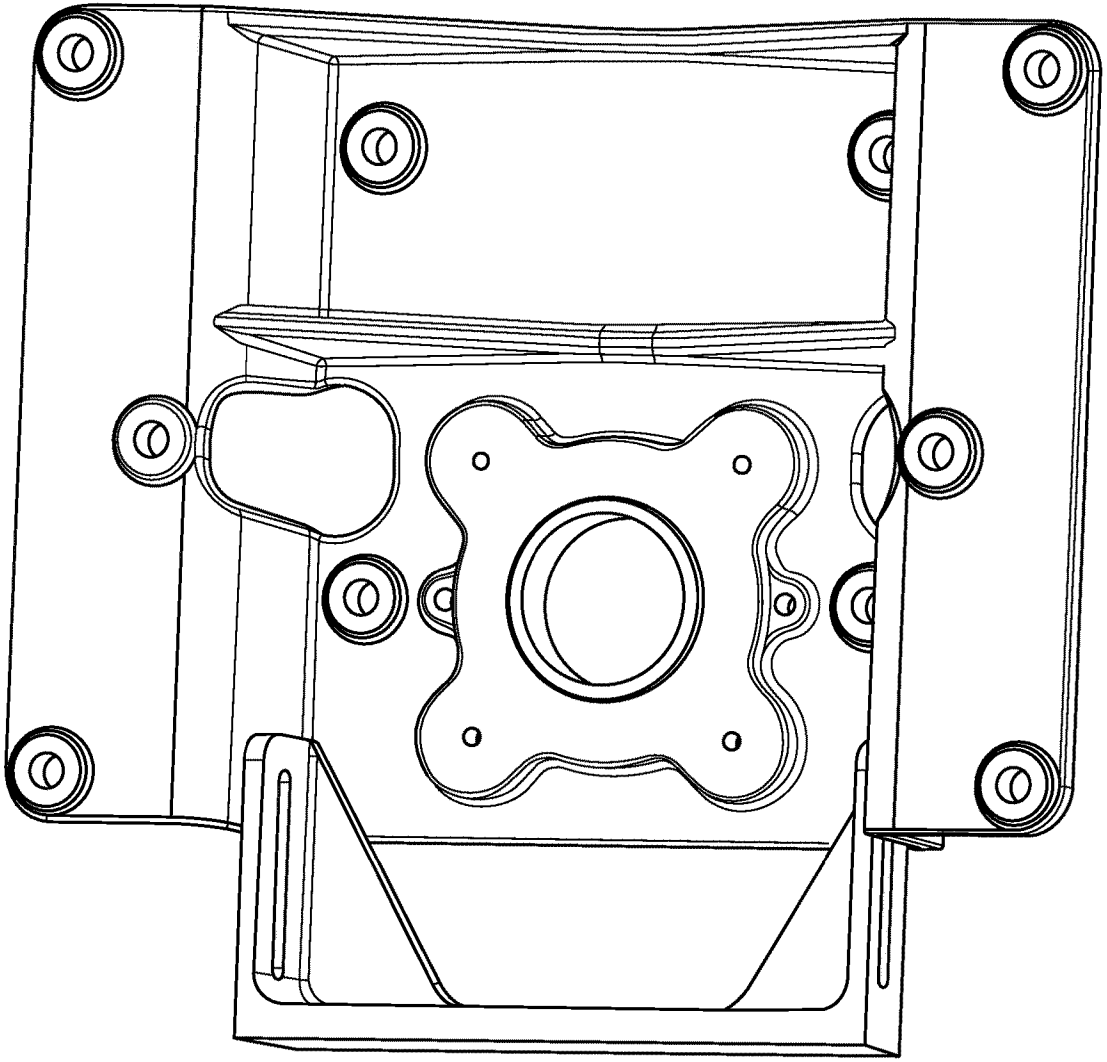
Figure 86:
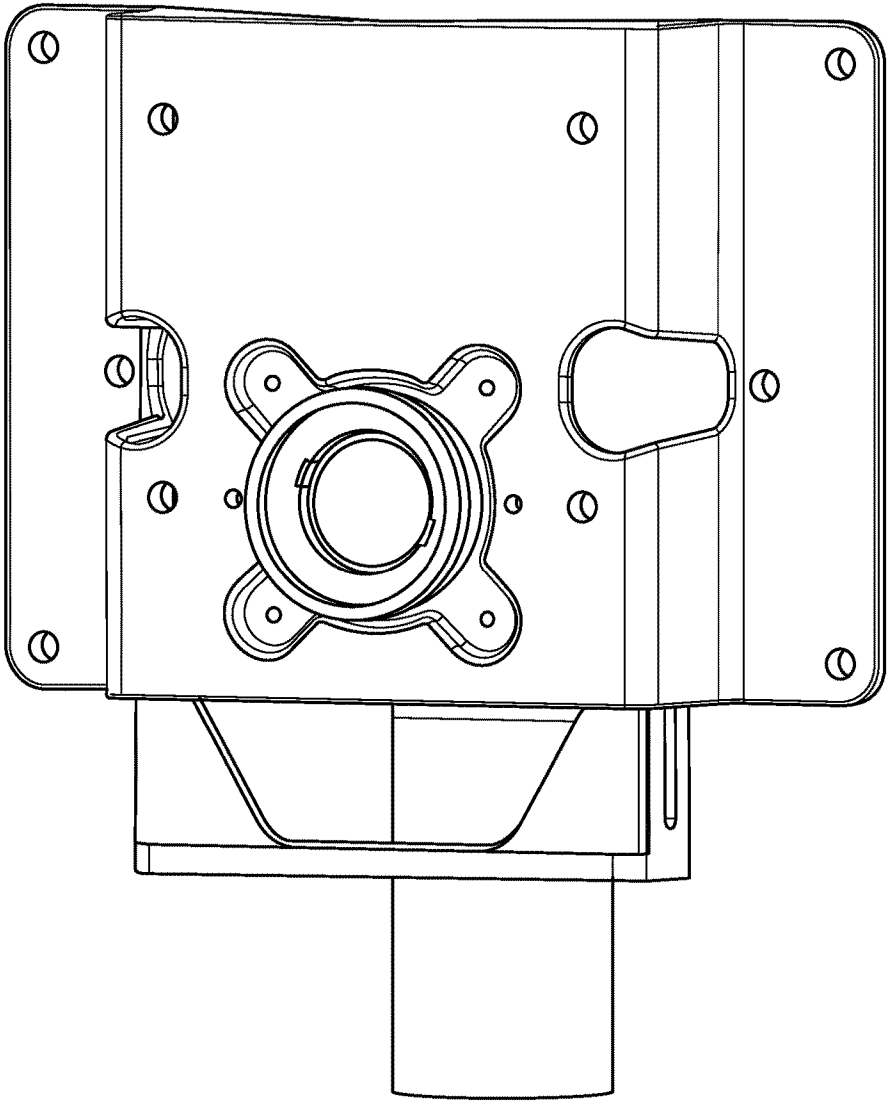

The central portion 8036 also includes a mounting hub 8092 on the back side thereof and corresponding with the fluid passageway 8050. More specifically, the mounting hub 8092 of the central portion 8036 is configured to provide a location to which the fluid coupler 8032 (described below) may be attached (e.g., via the rear surface 8062). As shown in FIG. 83, the mounting hub 8092 includes an annular sealing surface 8096*a* encircling the fluid passageway 8050 and four mounting elements 8100*a* encircling the annular sealing surface 8096*a* and spaced 90 degrees apart from each other.

Each side portion 8040 of the faceplate 8028 is offset behind the central portion 8036 a distance corresponding to the width of the uprights 8020. As such, when both side portions 8040 are coupled to the rear surface 8026 of the uprights 8020 the mounting surface 8044 of the central portion 8036 is generally aligned with the front wall surface 8022 of the uprights 8020 (e.g., ±2%, ±3%, ±5%, and ±10%). More specifically, each side portion 8040 includes a first leg 8068 extending rearwardly from the periphery of the central portion 8036, and a second leg 8072 extending outwardly from the first leg 8068 opposite the central portion 8036 to form a general "L" shape. While the illustrated side portions 8040 include a pair of panels set at 90 degrees to each other it is understood that in alternative embodiments other forms of side portion may be used, such as pipes, connecting members, and the like.

Figure 80:
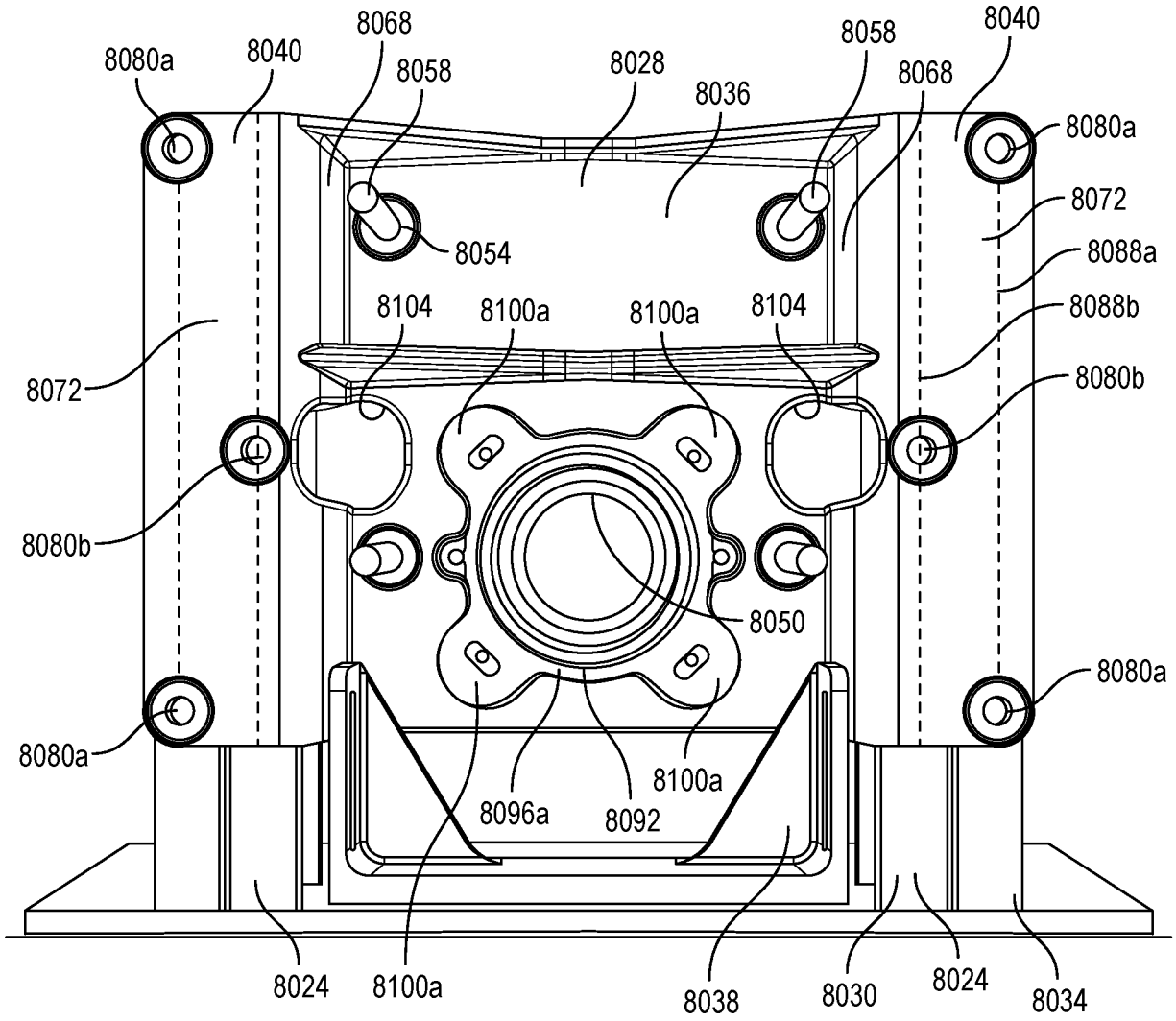
Figure 81:
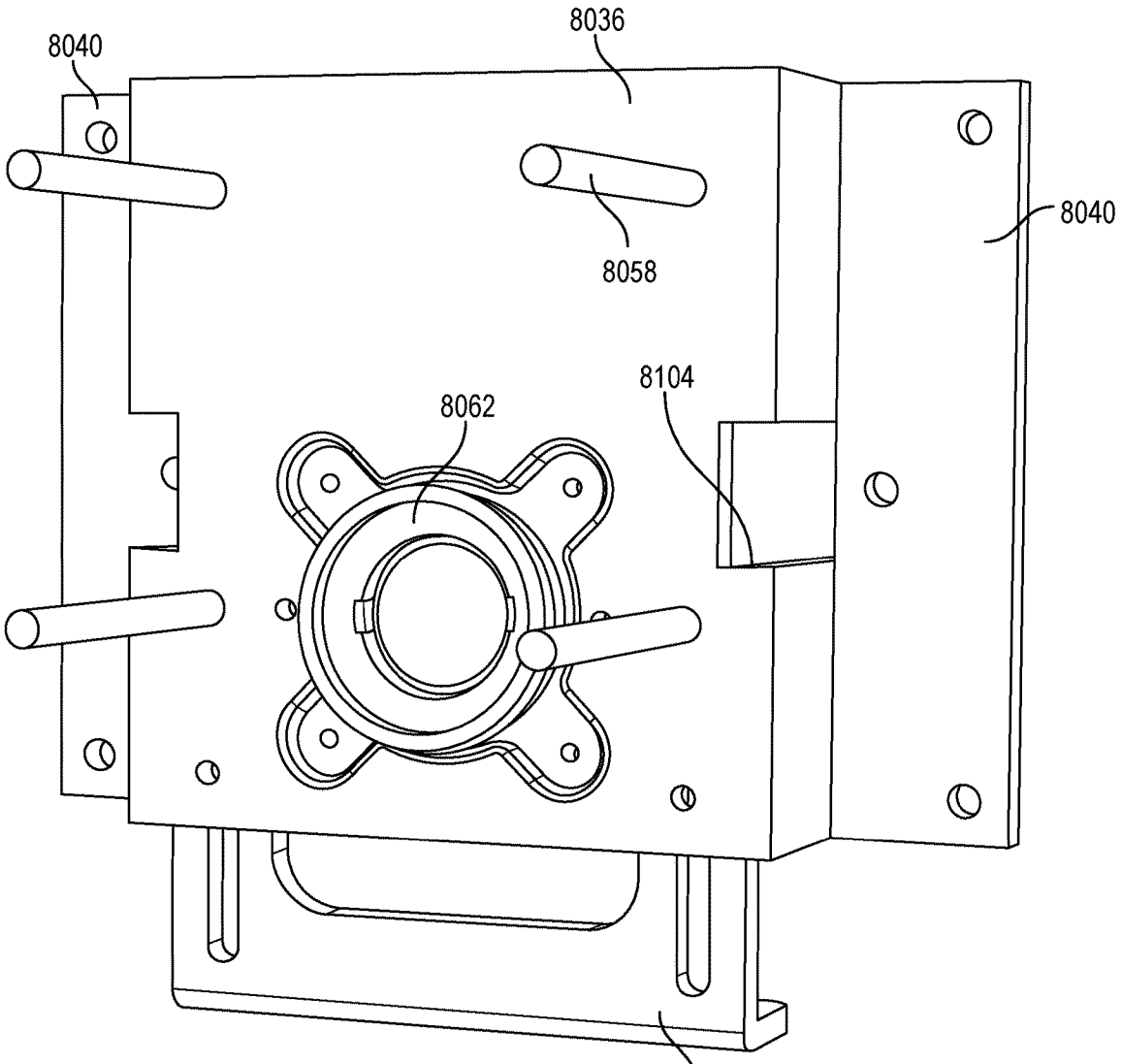
Figure 82:
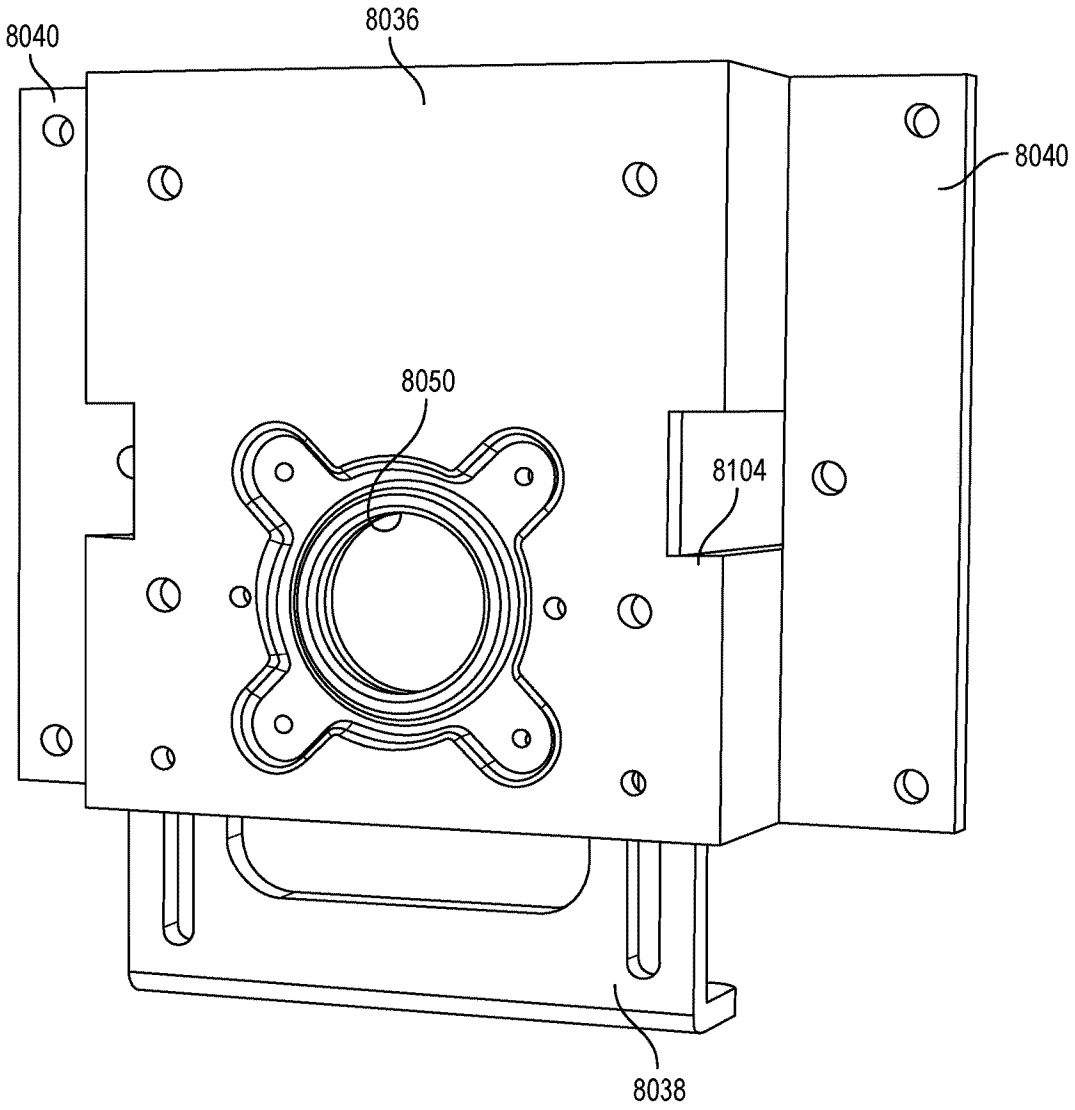

As shown in FIG. 80, the second leg 8072 of each side portion 8040 defines a plurality of mounting apertures 8080 sized to receive a fastener 8084 therethrough to removably couple the faceplate 8028 to a pair of adjacent uprights 8020 or double-uprights 8024. In the illustrated embodiment, each side portion 8040 includes a first set of mounting apertures 8080*a*, located so a fastener 8084*a* passing therethrough will couple with the first upright 8030 of a double-upright 8024, and a second set of apertures 8080*b*, located so a fastener 8084*b* passing therethrough will coupled with the second upright 8034 of the double-upright 8024. As such, once installed, the faceplate 8028 is directly connected to both uprights 8030, 8034 of both adjacent double-uprights 8024 for additional strength. In the illustrated embodiment, each aperture of the first set of mounting apertures 8080*a* is positioned along a first vertical axis 8088*a* that generally corresponds with the location of the first upright 8030 while each aperture of the second set of mounting apertures 8080*b* is positioned along a second vertical axis 8088*b* that is offset from the first vertical axis 8088*a* and generally corresponds with the location of the second upright 8034. In the present invention, all of the fasteners 8084 include bolts secured with nuts, however in alternative embodiments different forms of fastener may be used.

As shown in FIG. 80, the faceplate 8028 also defines a pair of access apertures 8104. Each access aperture 8104 is formed into the faceplate 8028 and is configured to allow the user to access the backside of the fastener 8084*b* passing through the second set of mounting apertures 8080*b* via the rear surface 8026 of the modular wall 8004. More specifically, the faceplate 8028 includes an access aperture 8104 formed into the first leg 8068 of each side portion 8040 adjacent to a corresponding aperture of the second set of mounting apertures 8080*b*. The access aperture 8104 then extends a sufficient distance to permit the user to place his or her hands behind the fastener 8084*b* to gain access thereto (e.g., the nut applied to the back of the fastener 8084*b*). In other embodiments, the access aperture 8104 may be sized to allow a socket or wrench to gain access to the nut applied to the back of the fastener 8084*b*.

Figure 87:
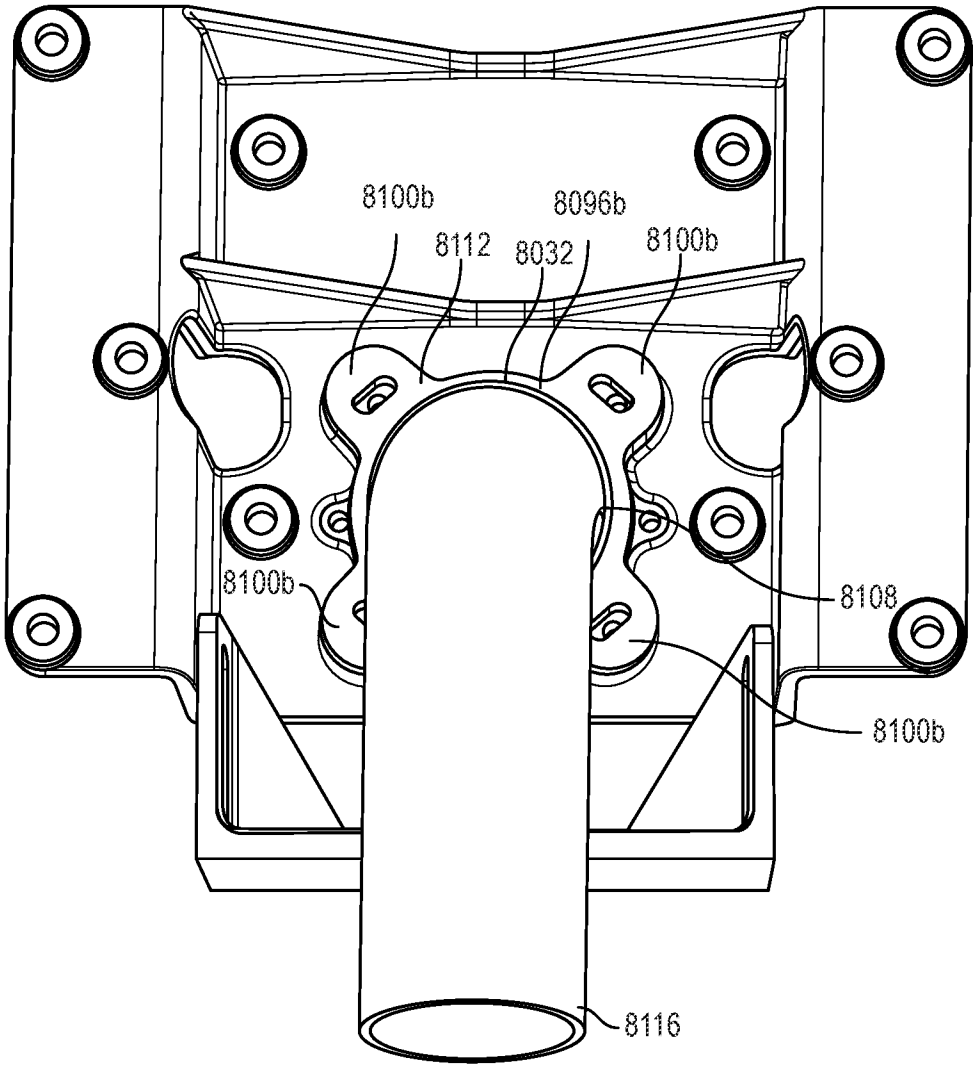
Figure 88:
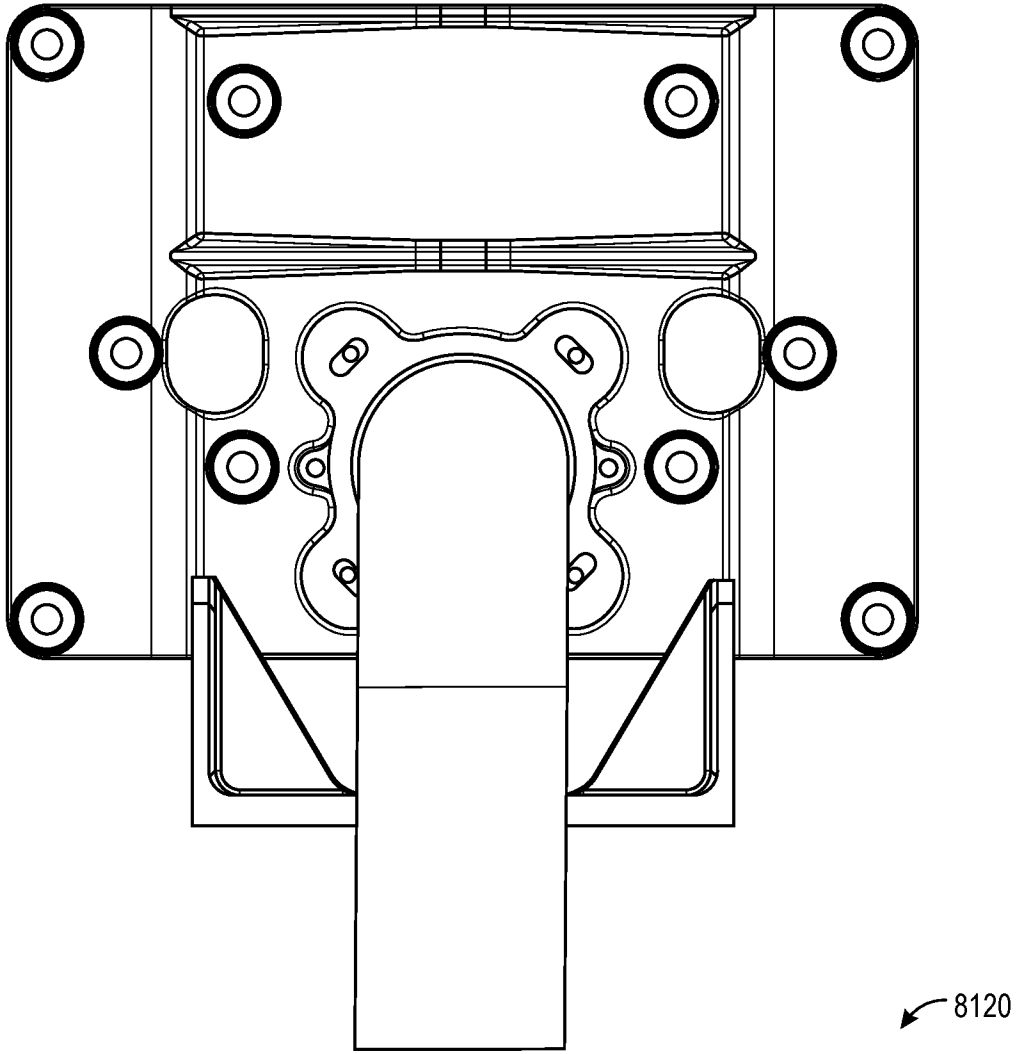
Figure 92:
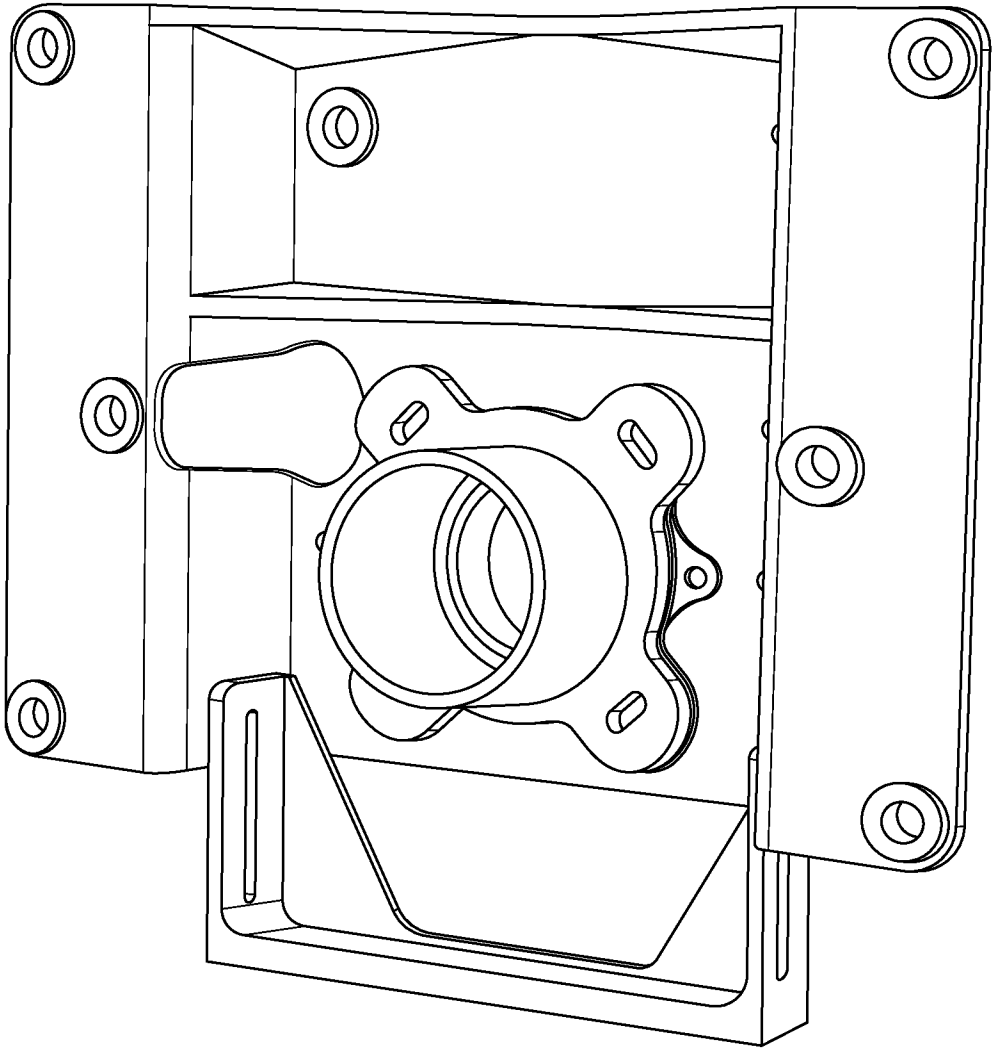
Figure 93:
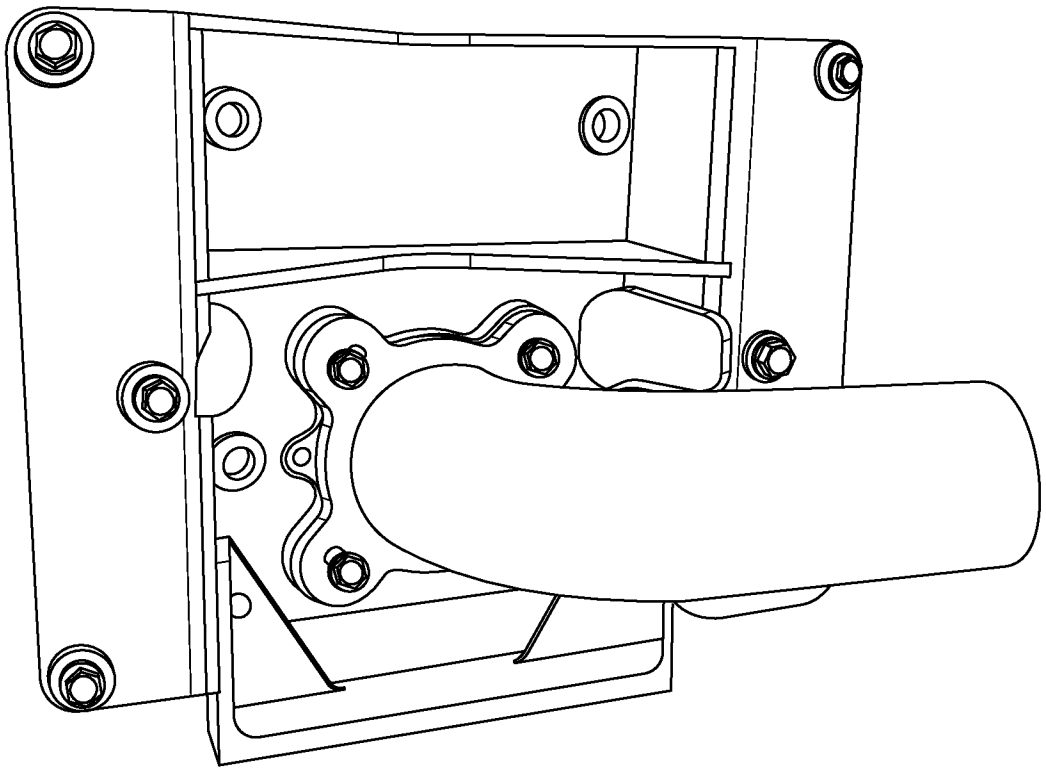
Figure 94:
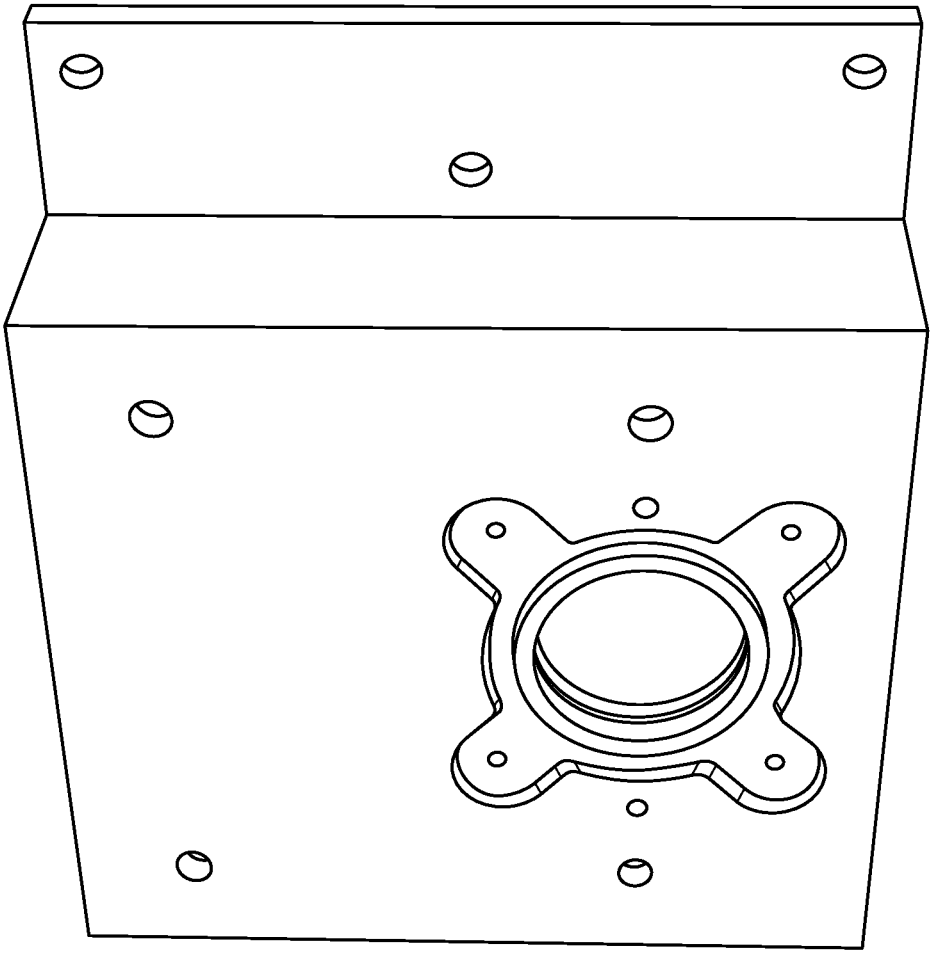

As shown in FIG. 87, the carrier assembly 8000 also includes a fluid coupler 8032 couplable to the fluid passageway 8050 of the faceplate 8028 to form a water-tight connection therewith. More specifically, the fluid coupler 8032 is configured to be coupled to and establish a fluid connection between the water closet 8006 (e.g., via the fluid passageway 8050) and the plumbing system of the corresponding building. In the illustrated embodiment, the fluid coupler 8032 includes an elongated tube having a first end 8108 forming a mounting flange 8112 sized and shaped to correspond with the mounting hub 8092 of the faceplate 8028, and a second end 8116 opposite the first end 8108. As shown in FIG. 87, the fluid coupler 8032 includes a bend therein to form a generally "L" shaped pipe. When installed, the second end 8116 of the fluid coupler 8032 is configured to be attached to a wastepipe of the building's plumbing system. While the illustrated fluid coupler 8032 is "L" shaped, it is understood that in alternative embodiments the fluid coupler may be straight or have other shapes as needed to produce a fluid connection between the water close 8006 and the building's plumbing system (see FIG. 92).

The mounting flange 8112 of the fluid coupler 8032 is configured so that it can be coupled to the mounting hub 8092 of the faceplate 8028 in a plurality of different orientations while maintaining fluid communication with the fluid passageway 8050 and a fluid tight seal with the faceplate 8028 in each position. More specifically, both the mounting flange 8112 and the mounting hub 8092 include corresponding annular sealing surfaces 8096*a*, 8096*b* and equally spaced mounting elements 8100*a*, 8100*b* so that the fluid coupler 8032 can be mounted to the faceplate 8028 into any position where the mounting elements 8100*a* of the fluid coupler 8032 align with the mounting apertures 8100*b* of the faceplate 8028. As such, the number of mounting elements

8100*a*, 8100*b* defines the number of "mounting positions" that are possible between the two elements. In the illustrated embodiment, four mounting elements 8100*a*, 8100*b* are present in both components spaced 90 degrees apart. As such, the fluid coupler 8032 can be coupled to the faceplate 8028 in four orientations spaced 90 degrees apart (e.g., so that the second end 8116 of the fluid coupler 8032 is facing vertically up, vertically down, horizontally right, and horizontally left). However, in alternative embodiments more or fewer mounting elements 8100*a*, 8100*b* may be present to permit more or fewer mounting positions (e.g., eight mounting elements 8100*a*, 8100*b* allowing eight mounting locations spaced 45 degrees apart, or two mounting elements 8100*a*, 8100*b* allowing two mounting locations spaced 180 degrees apart, and the like).

Figure 89:
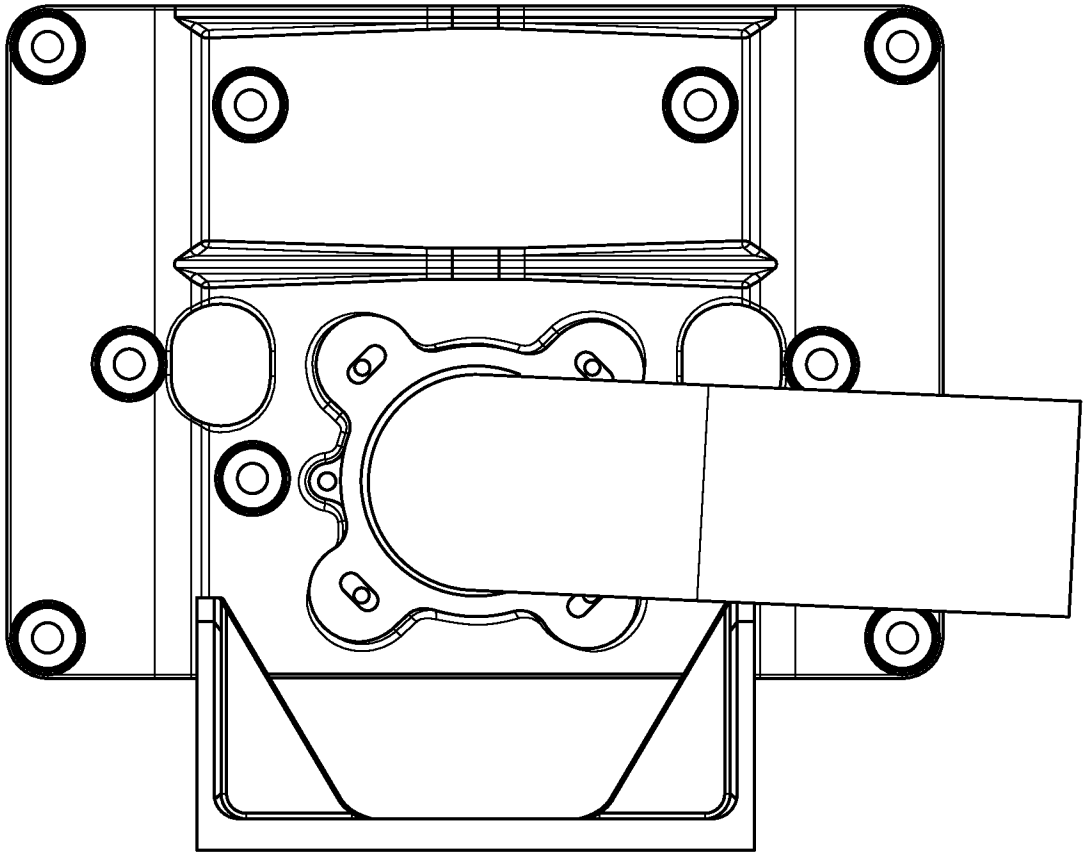
Figure 90:
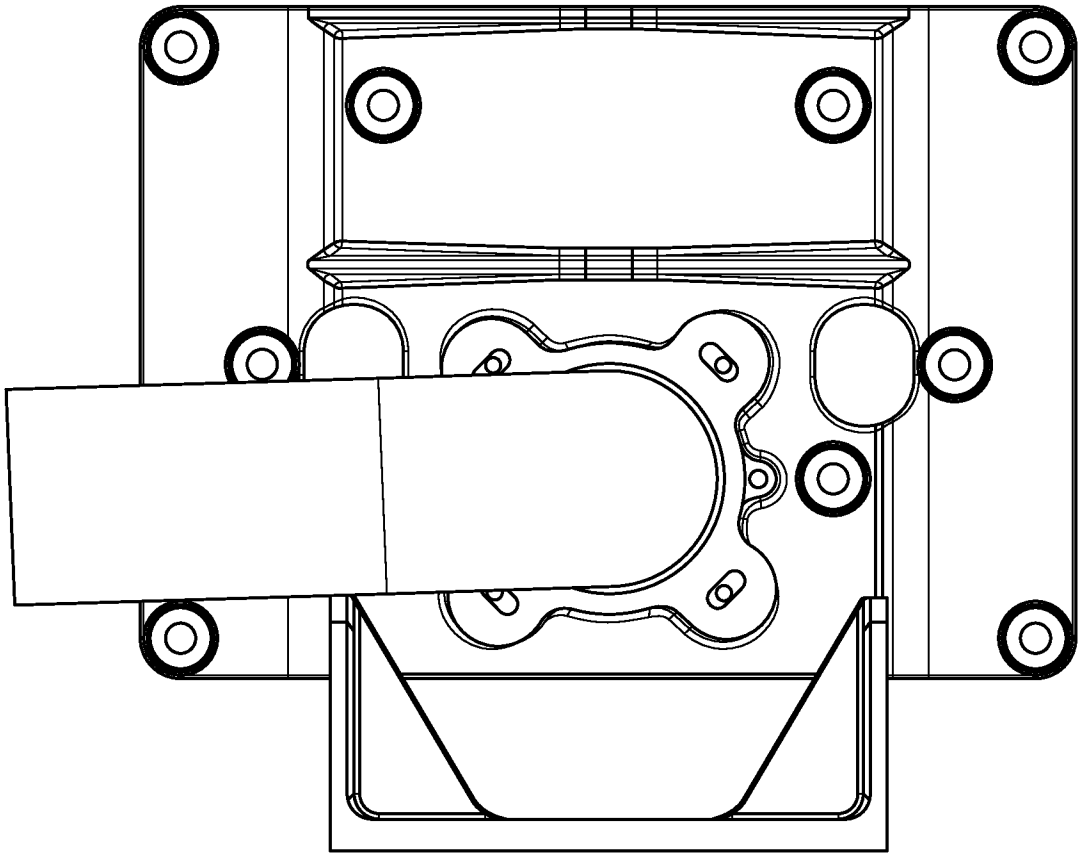
Figure 91:
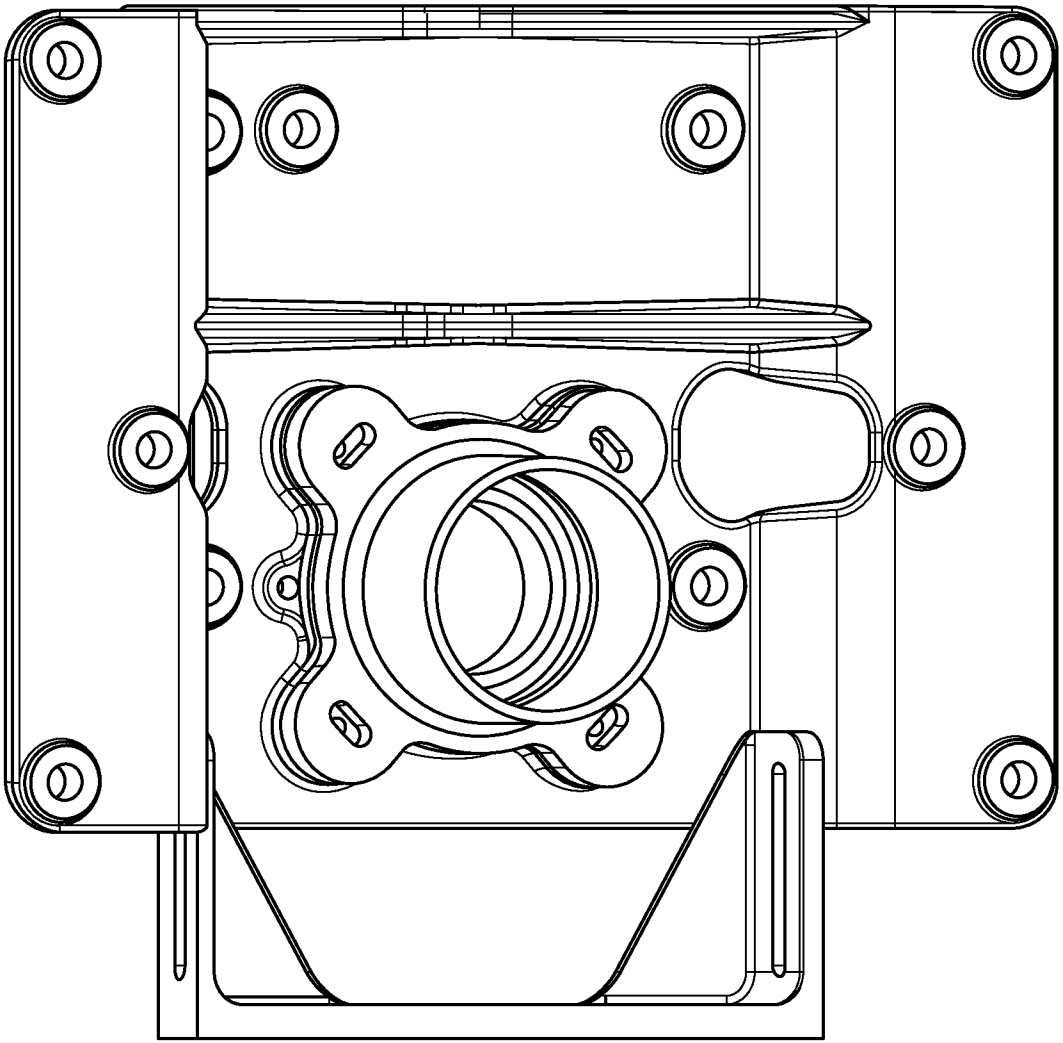

In the illustrated embodiment, the mounting elements 8100*a* of the faceplate 8028 include threaded apertures while the mounting elements 8100*b* of the fluid coupler 8032 include slots so that fasteners passing through the slots and received within the threaded apertures can be used to couple the fluid coupler 8032 to the faceplate 8028 (e.g., installed from behind). More specifically, the slots of the fluid coupler 8032 are elongated so that the fluid coupler 8032 can be rotated a few degrees in each direction at a particular mounting location. For example, if the fluid coupler 8032 is mounted to the faceplate 8028 so that the second end 8116 is located at the 3'oclock position (e.g., at 90 degrees, see FIG. 89), the fluid coupler 8032 may further be rotated a few degrees clockwise and counterclockwise from that position (e.g., between 86 to 94 degrees). This capability is present at each of the four possible mounting locations (e.g., between 176 and 184 degrees if mounted at the 6 o'clock position, and the like). In some embodiments, the slots are sized to allow the axis of the fluid coupler 8032 to be adjusted ±2 degrees, ±3 degrees, ±4 degrees, ±5 degrees, ±6 degrees, ±7 degrees, ±8 degrees, ±9 degrees, ±10 degrees, ±15 degrees, ±20 degrees from the nominal mounted position.

The carrier assembly 8000 also includes a support 8038 coupled to the faceplate 8028 and engaging the bottom member 8012 of the modular wall assembly 8004 to transmit forces therebetween. During use, the support 8038 is configured to provide additional strength and support to the faceplate 8028 by providing an additional point of contact between the faceplate 8028 and the wall 8004. While the illustrated support 8038 is only mounted to the faceplate 8028 (e.g., at the side portion 8040), it is understood that in alternative embodiments the support 8038 may also be coupled to the bottom member 8012 of the modular wall assembly 8004.

Furthermore, the support 8038 is adjustable so that the support 8038 can accommodate for the faceplate 8028 being mounted at different vertical heights. In still other embodiments the support 8038 may be attached to the faceplate 8028 at different locations.

Figure 95:
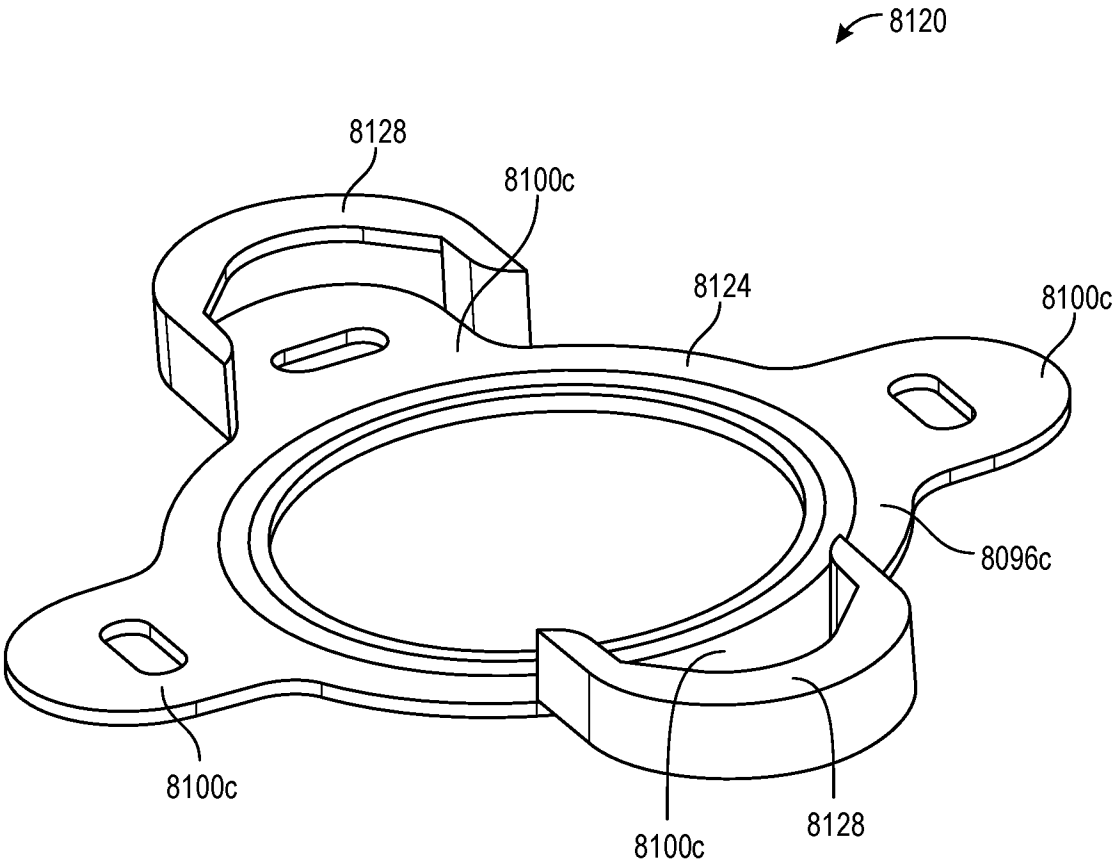
FIGS. 95-97 illustrate a gasket for use on a fluid coupler of the carrier assembly of FIG. 75.
Figure 96:
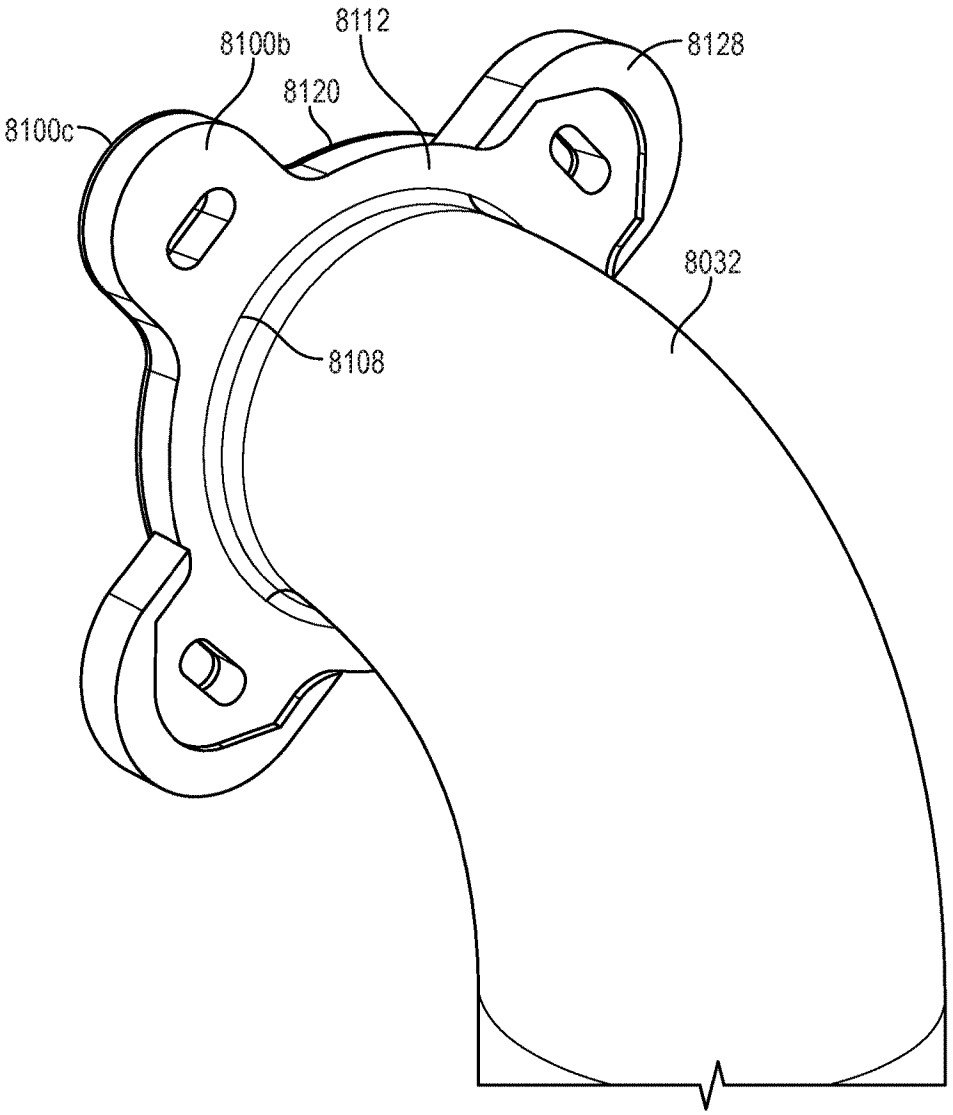
Figure 97:
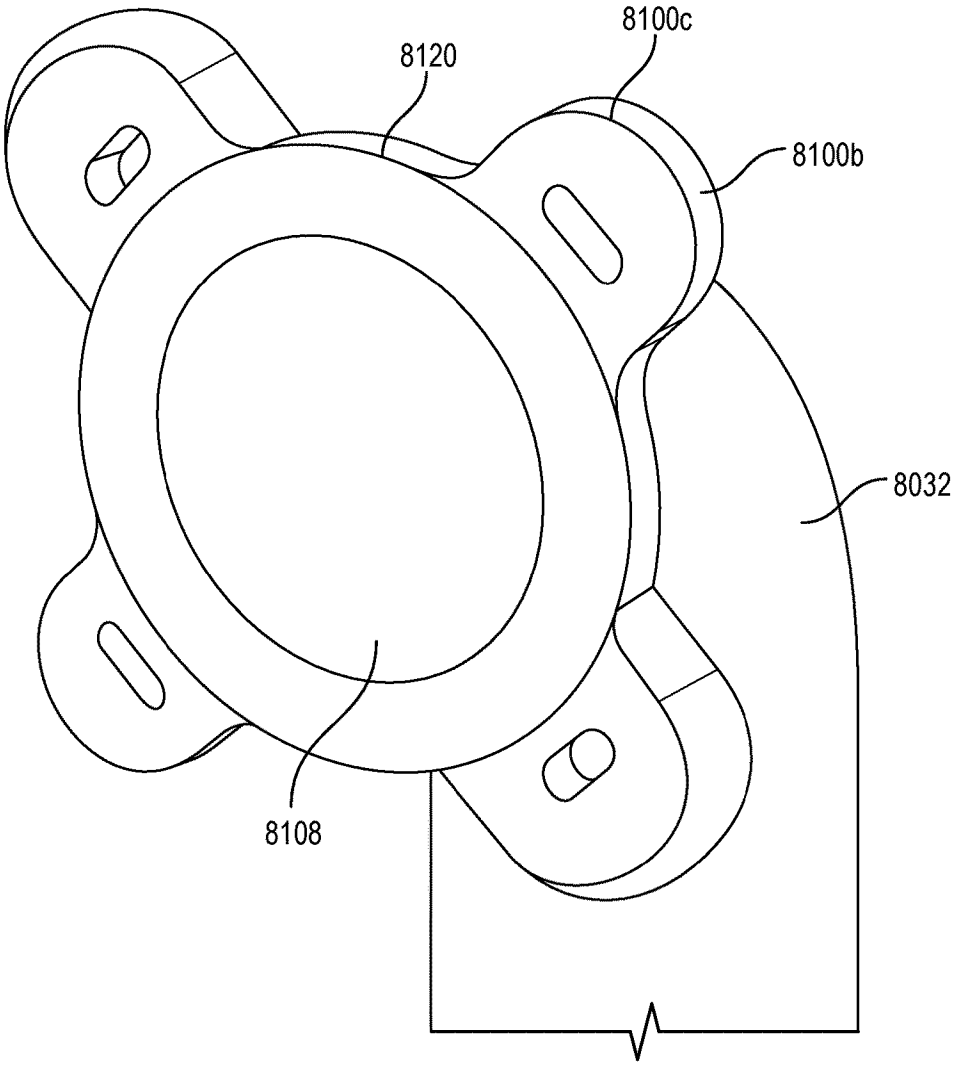
Figure 98:
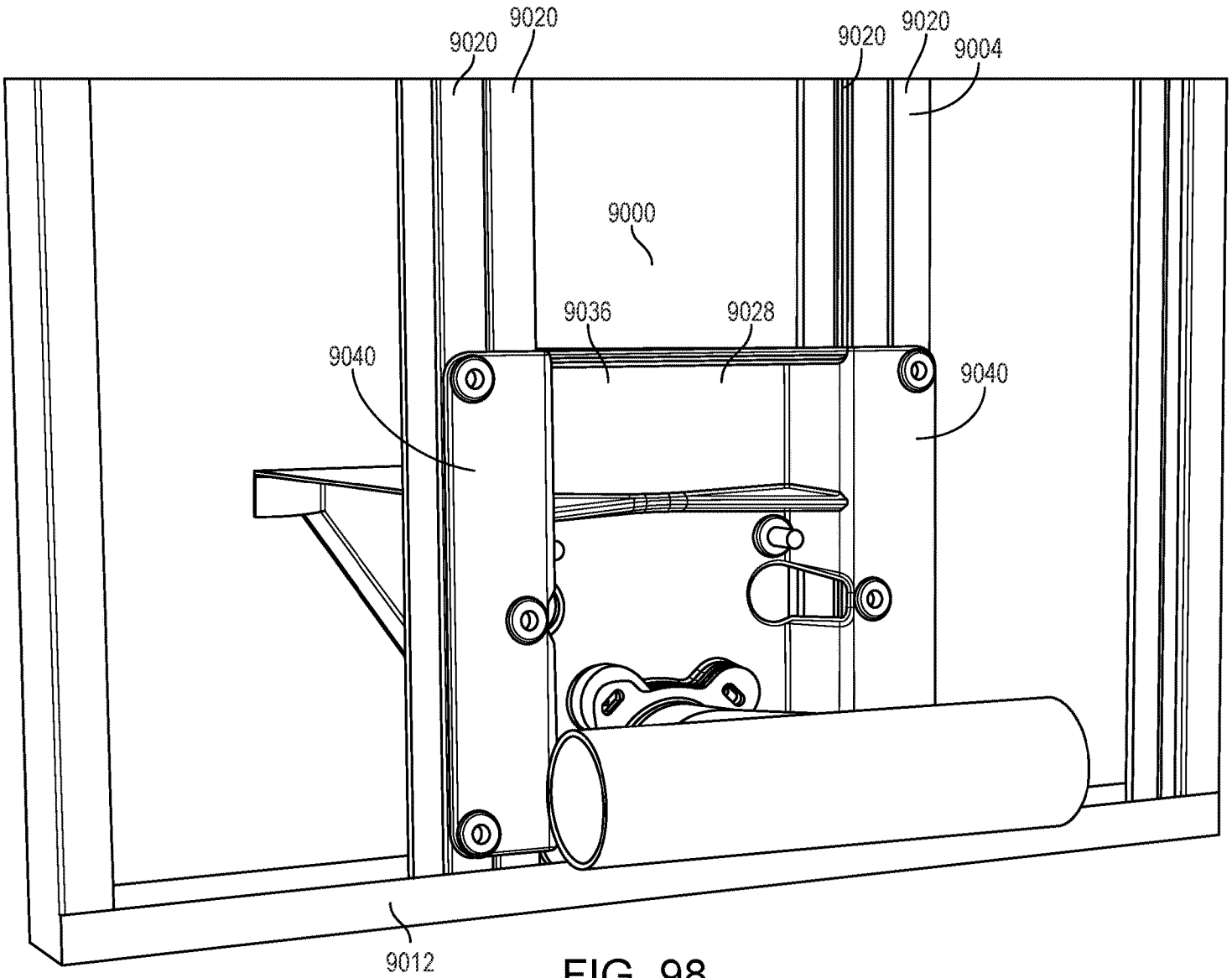
FIGS. 98-108 illustrate another embodiment of a carrier assembly for installation on a modular wall.
Figure 99:
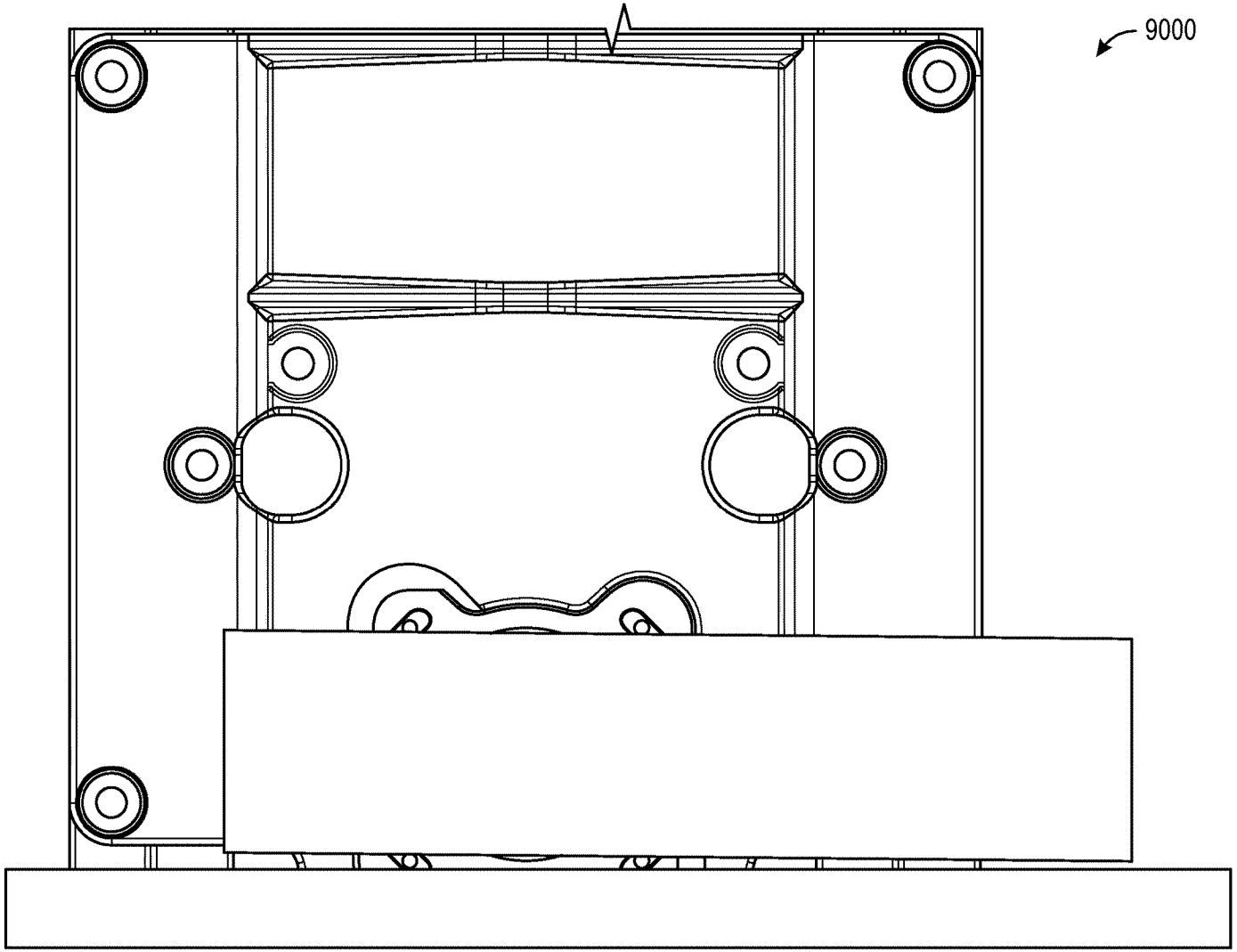
Figure 100:
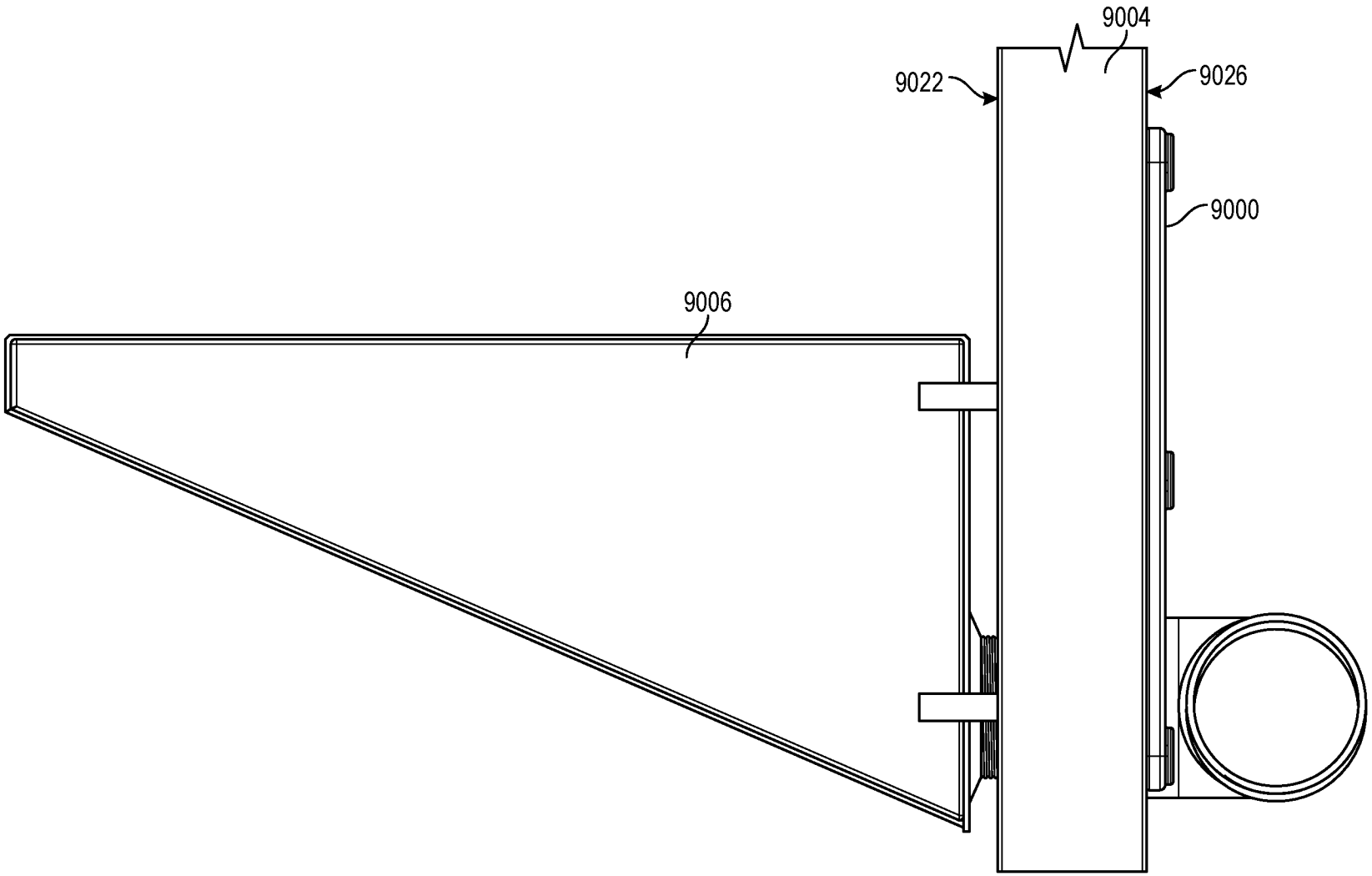
Figure 101:
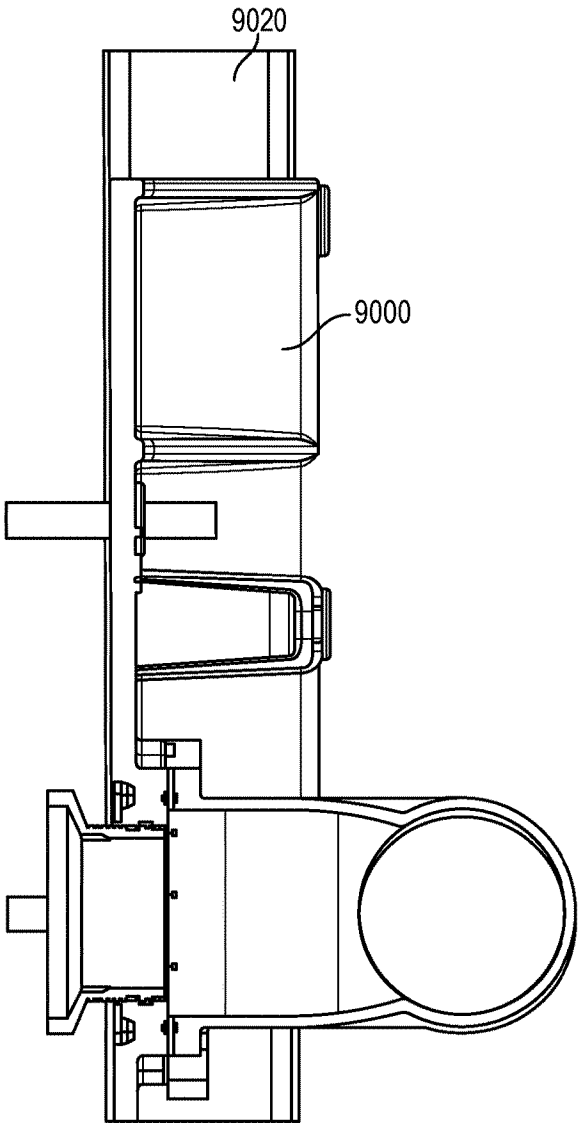
Figure 102:
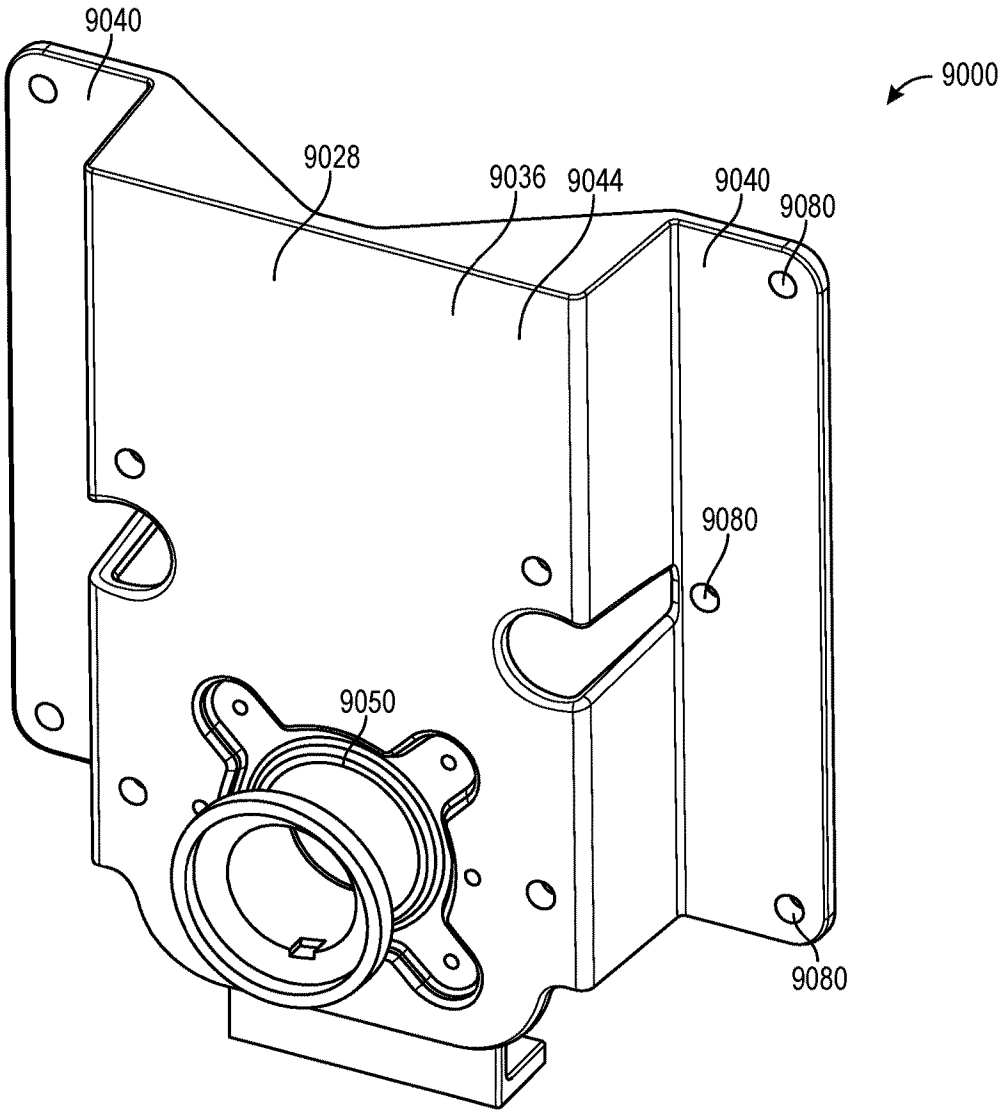
Figure 103:
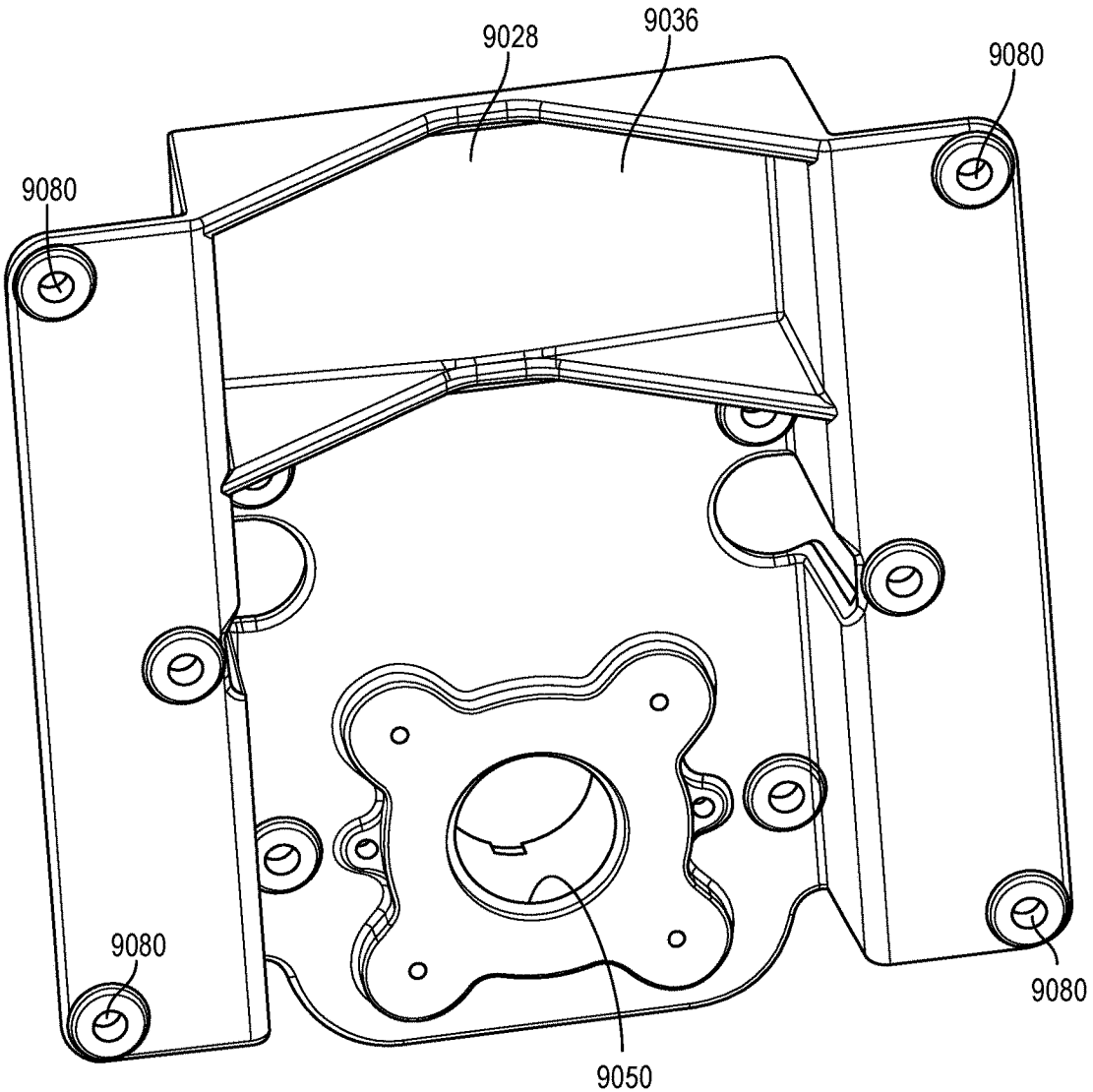
Figure 104:
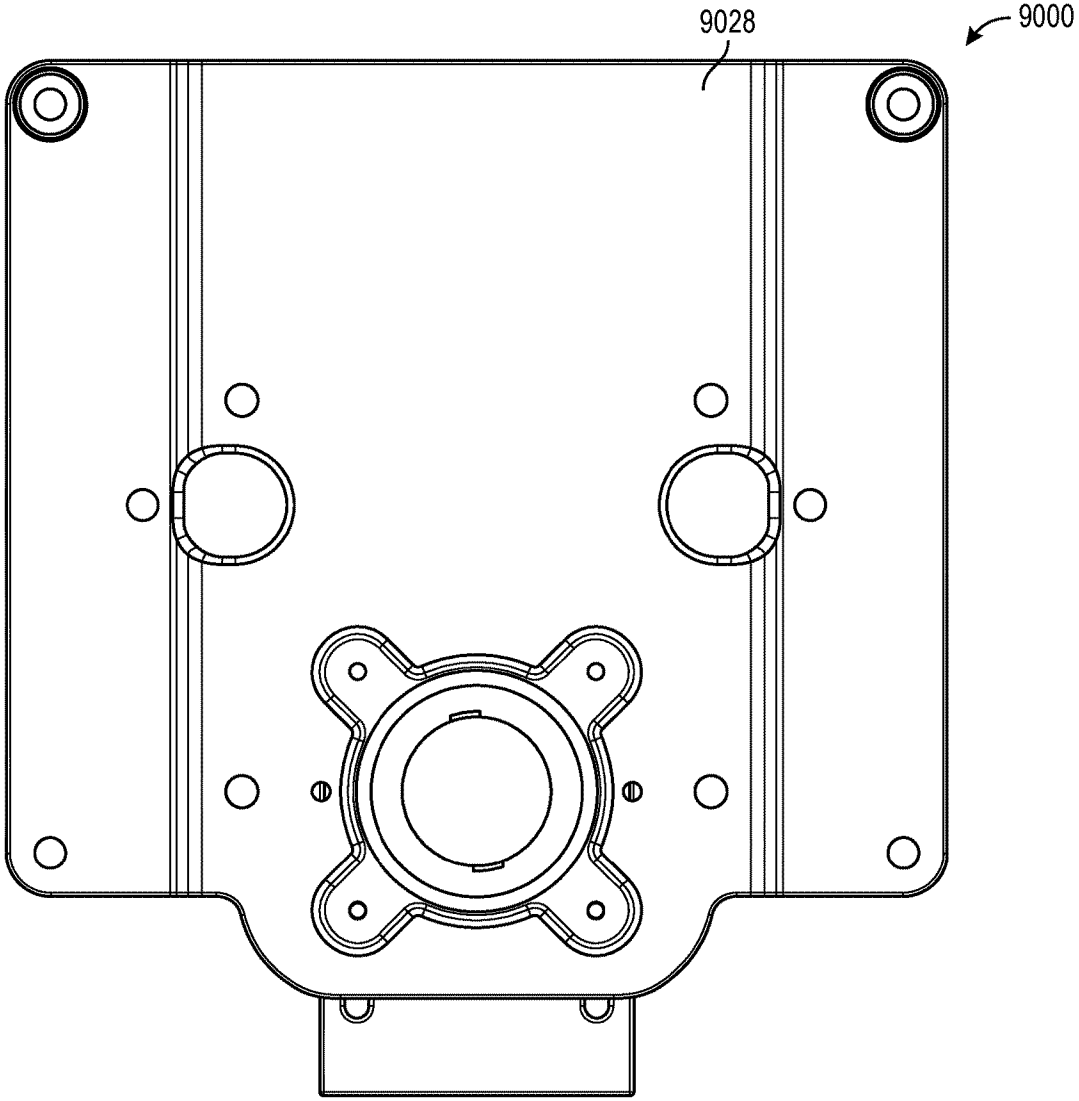
Figure 105:
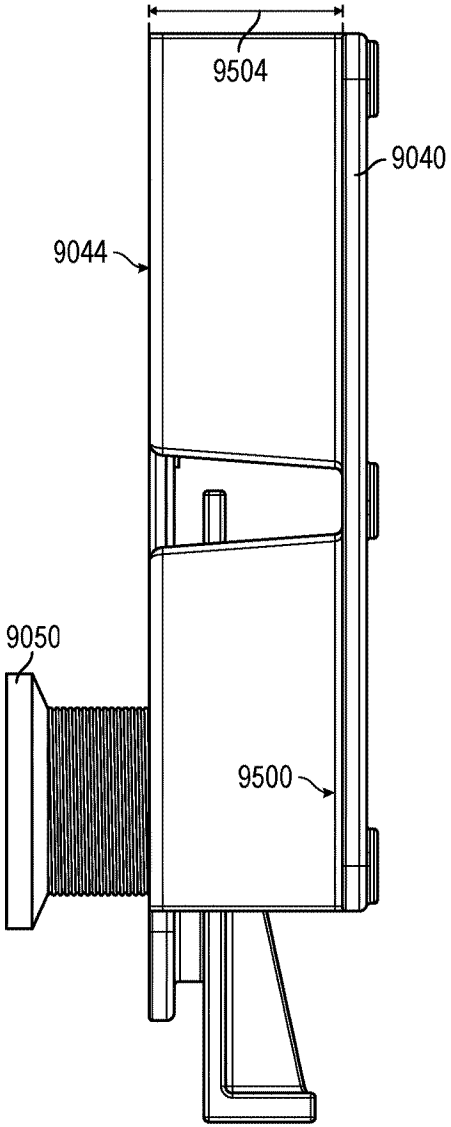

As shown in FIGS. 95-97, the fluid coupler 8032 is coupled to the faceplate 8028 using a gasket 8120. The gasket 8120 is formed from a gasket material (e.g., rubber, cardboard, and the like) and includes a planar body 8124 with a size and shape that generally corresponds to the shape of the mounting hub 8092 and the mounting flange 8112. More specifically, the body 8124 includes an annular sealing surface 8096*c* and four mounting elements 8100*c* extending radially outwardly therefrom.

The gasket 8120 also forms one or more pockets 8128 configured to at least partially receive a portion of a mounting element 8100*b* of the mounting flange 8112 of the fluid coupler 8032 therein. By doing so, the gasket 8120 is removably coupled to the first end 8108 of the fluid coupler 8032 and properly aligned therewith without using a separate adhesive. In the illustrated embodiment, the gasket 8120 includes a pair of pockets 8128 spaced 180 degrees apart (e.g., to receive opposite mounting elements 8100*b* therein) but in other embodiments more or fewer pockets 8128 may be present. During assembly, the pockets 8128 allow the user to couple the gasket 8120 to the first end of the fluid coupler 8032 where it will remain in place even with no fasteners present. With the gasket 8120 in position, the fluid coupler 8032 may then be maneuvered relative to the faceplate 8028 and installed without having to hold the gasket 8120 in place.

FIGS. 98-108 illustrate another embodiment of the carrier assembly 9000. The carrier assembly 9000 is substantially similar to the carrier assembly 8000 so only the differences will be discussed in detail herein. The faceplate 9028 of the carrier assembly 9000 includes a central portion 9036 with a first mounting surface 9044 and a pair of side portions 9040 flanking the central portion 9036 on opposite sides thereof. The side portions 9040, in turn, each include a second mounting surface 9500 configured to directly contact the rear wall surface 9026. When installed, the first mounting surface 9044 is offset from both second mounting surfaces 9500 such that when the second mounting surfaces 9500 are in contact with the rear wall surface 9026 the first mounting surface 9044 is substantially aligned with the front wall surface 9022. More specifically, the first mounting surface 9044 and the second mounting surfaces 9500 define an offset distance 9504 therebetween of between 3.25 inches and 6 inches. In other embodiments, the offset distance 9504 is between 3.25 and 3.75 inches. In still other embodiments, the offset distance 9504 is between 3.25 and 3.5 inches. In still other embodiments, the offset distance 9504 is approximately 3.25 inches ±0.125".

Figure 107:
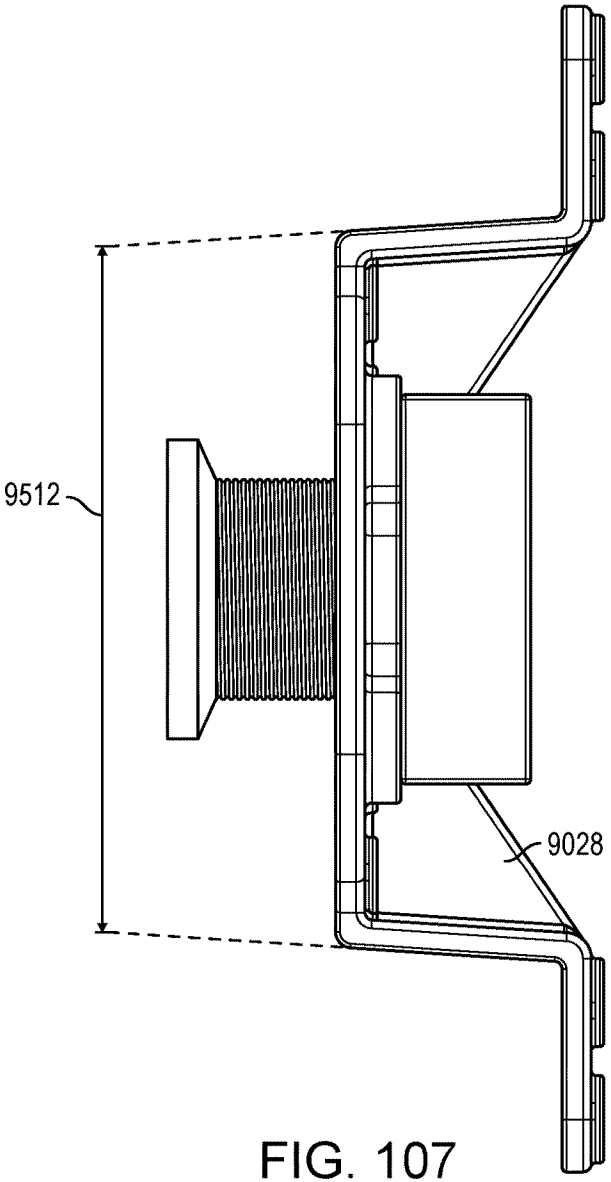

The faceplate 9028 also defines a stud width 9512 generally defined as the horizontal width of the central portion 9036 of the faceplate 9028 (see FIG. 107). In the illustrated embodiment, the stud width 9512 is approximately 11.5 inches. In still other embodiments, the stud width 9512 is between 11 inches and 12 inches. In still other embodiments, the stud width 9512 between 10.5 and 12.5 inches. In still other embodiment, the stud width 0512 is approximately 11.5 inches ±5%.

Furthermore, the faceplate 9028 defines an overall width 9518 of approximately 18 inches. In other embodiments, the overall width 9518 is between 17 and 19 inches.

Figure 106:
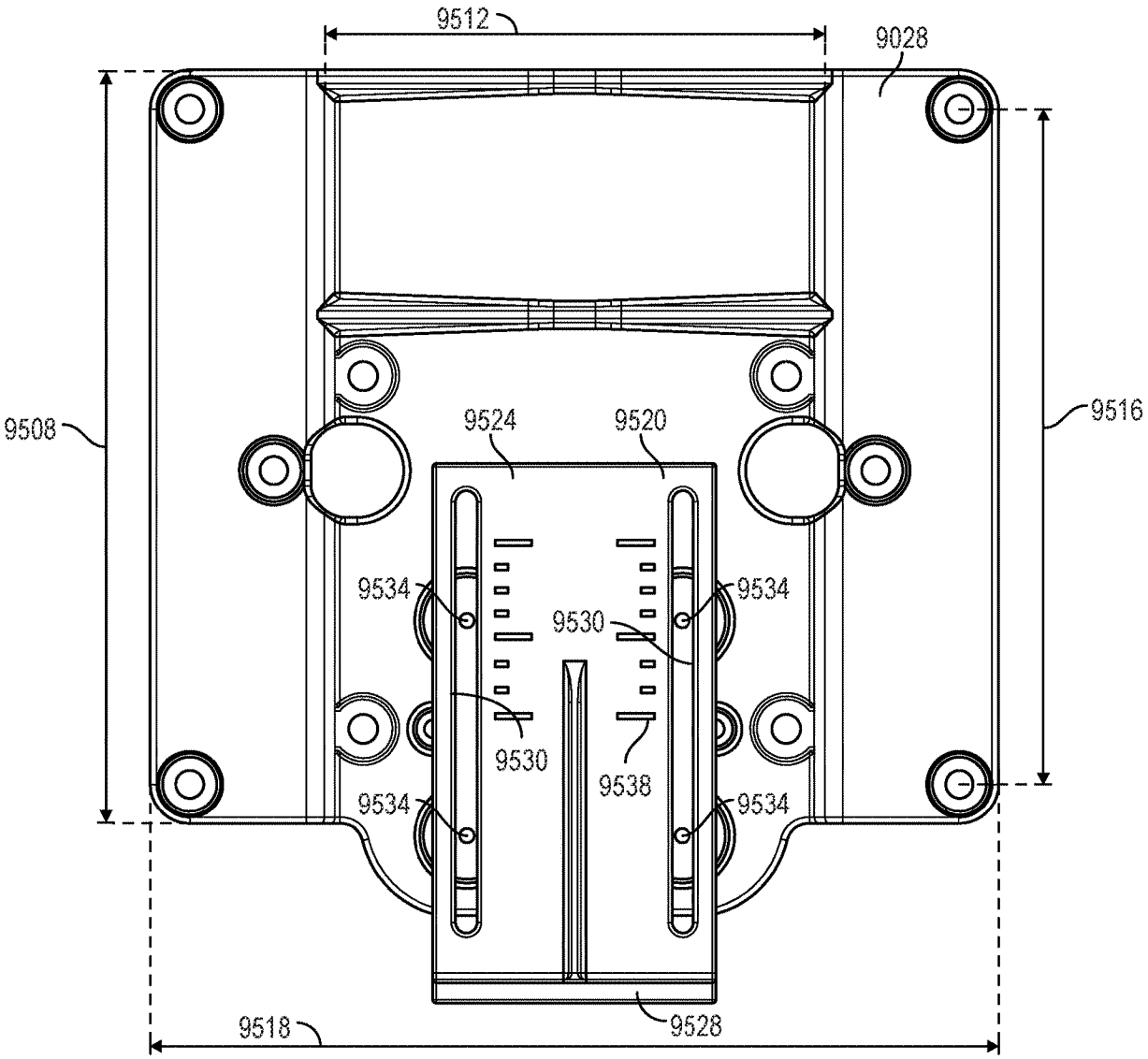

As shown in FIG. 106, each side portion 9040 of the face plate 9028 is comparatively tall relative to the width between adjacent studs 9020 to minimize the amount of deflection that occurs for a given load applied to the water closet 9006. More specifically, each side portion 9040 defines a contact height 9508 generally defined as the vertical height (e.g., measured along the length of the corresponding studs 9020) of the second mounting surface 9500 in contact with the studs 9020. In the illustrated embodiment, the contact height 9504 is between 1 to 2 times as large as the stud width 9512. In other embodiments, the contact height 9508 is between 1.25 and 2 times as large as the stud width 9512. In still other embodiments, the contact height 9504 is between 1.25 and 1.5 times as large as the stud width 9512. In still other embodiments, the contact height 9504 is approximately 1.4 times as large as the stud width 9512. In still other embodiments, the contact height 9508 is 1.4 times as large as the stud width 9512±10%.

Each side portion 9040 also defines a bolt height 9516 generally defined as the vertical height (e.g., measured along the length of the corresponding studs 9020) between the vertically highest and vertically lowest mounting aperture 9080 of a particular side portion 9040. In the illustrated embodiment, the bolt height 9516 is between 1 to 2 times as large as the stud width 9512. In other embodiments, the bolt height 9516 is between 1.25 and 2 times as large as the stud width 9512. In still other embodiments, the bolt height 9516 is between 1 and 5 times as large as the stud width 9512. In still other embodiments, the bolt height 9516 is approximately 1.25 times as large as the stud width 9512. In still other embodiments, the bolt height 9516 is 1.25 times as large as the stud width 9512±10%.

Figure 108:
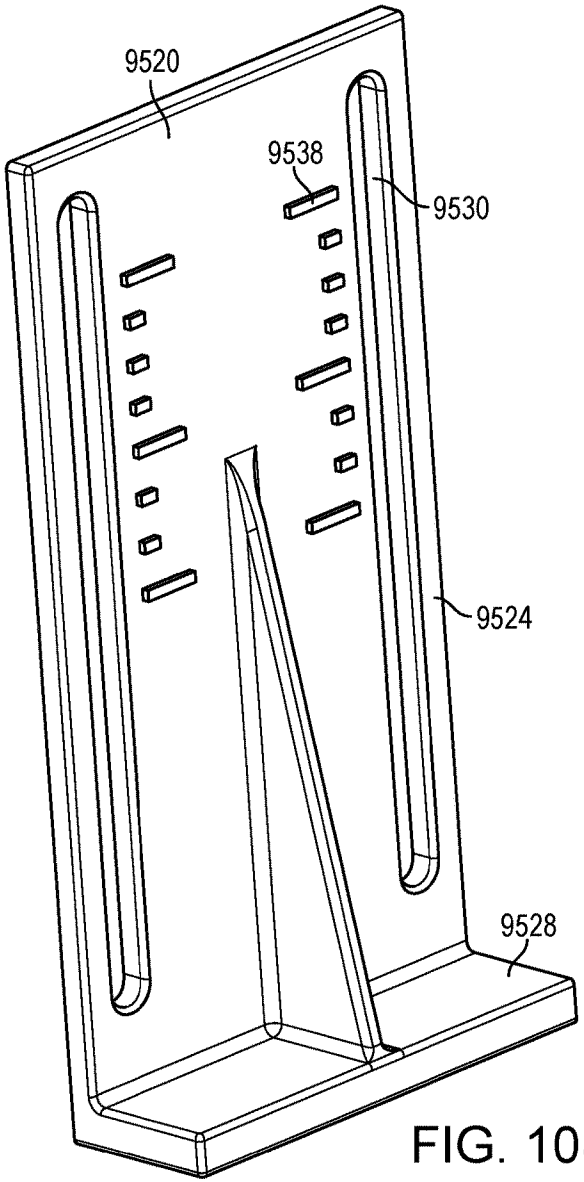
Figure 109:
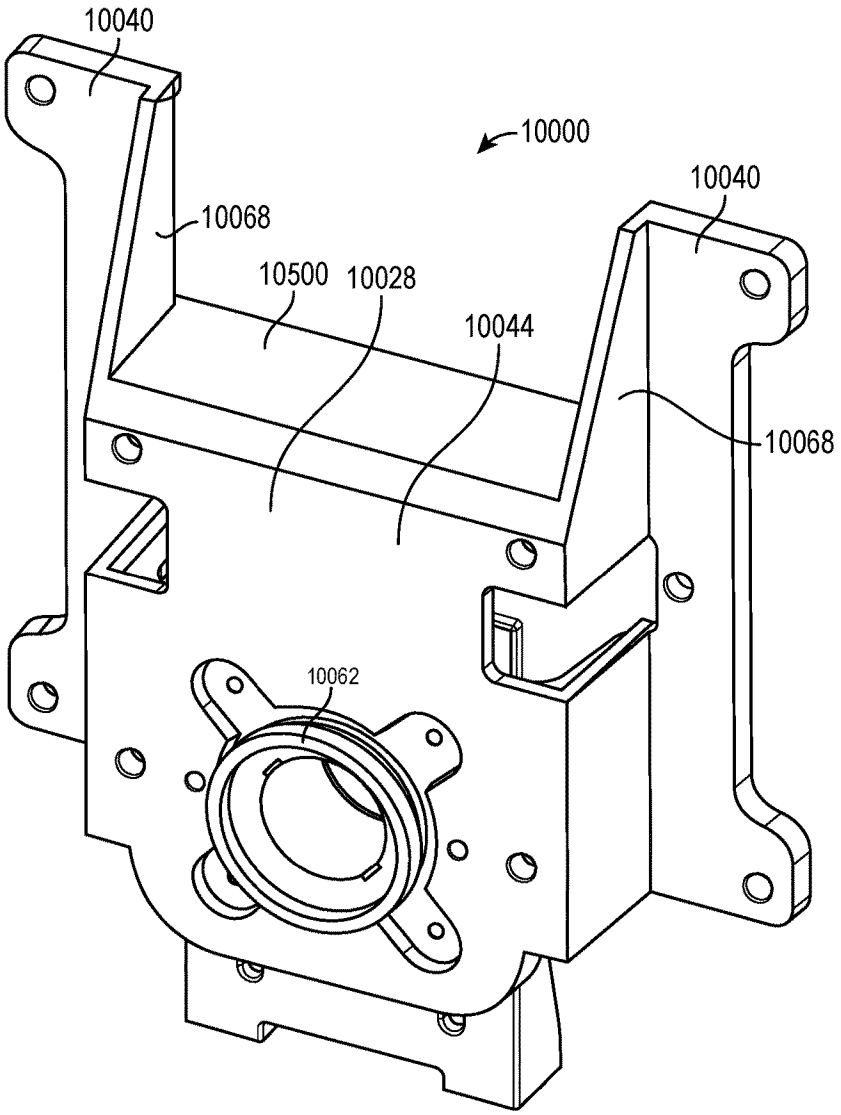
FIGS. 109-116 illustrates another embodiment of a carrier assembly for installation on a modular wall.
Figure 110:
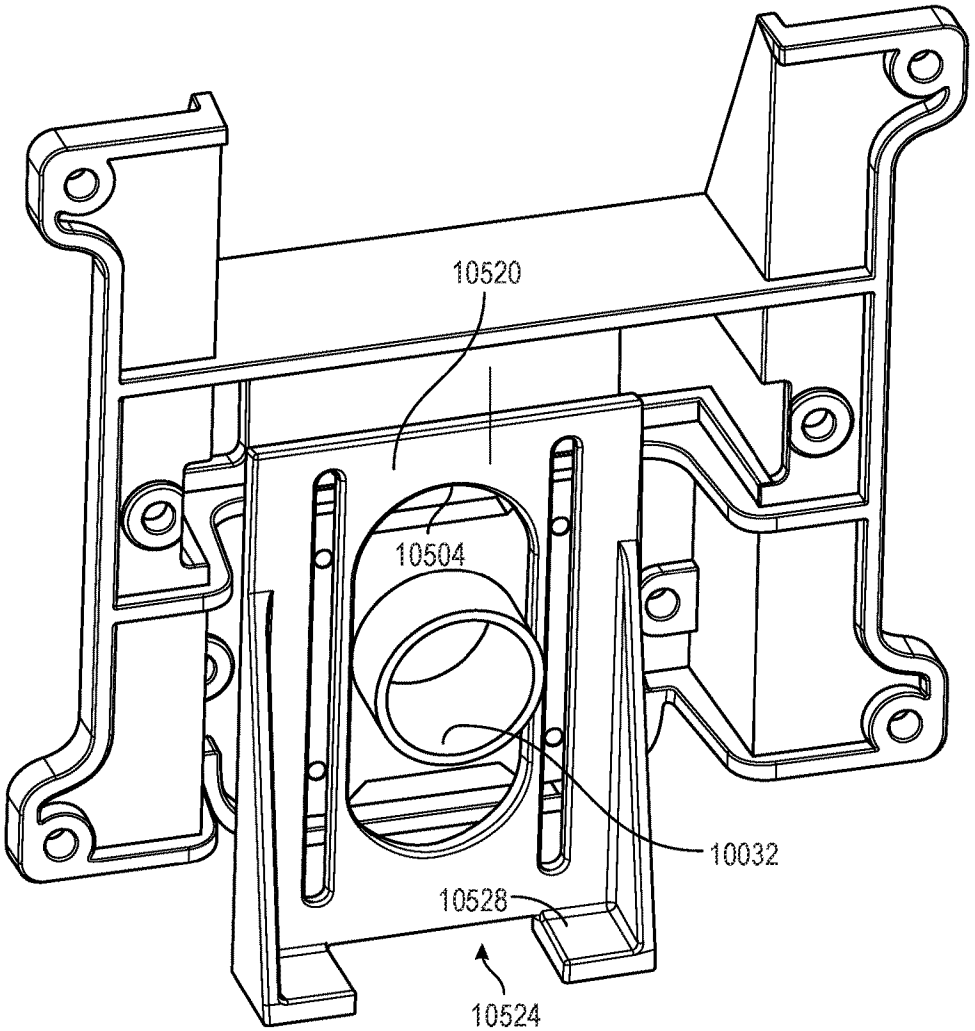
Figure 111:
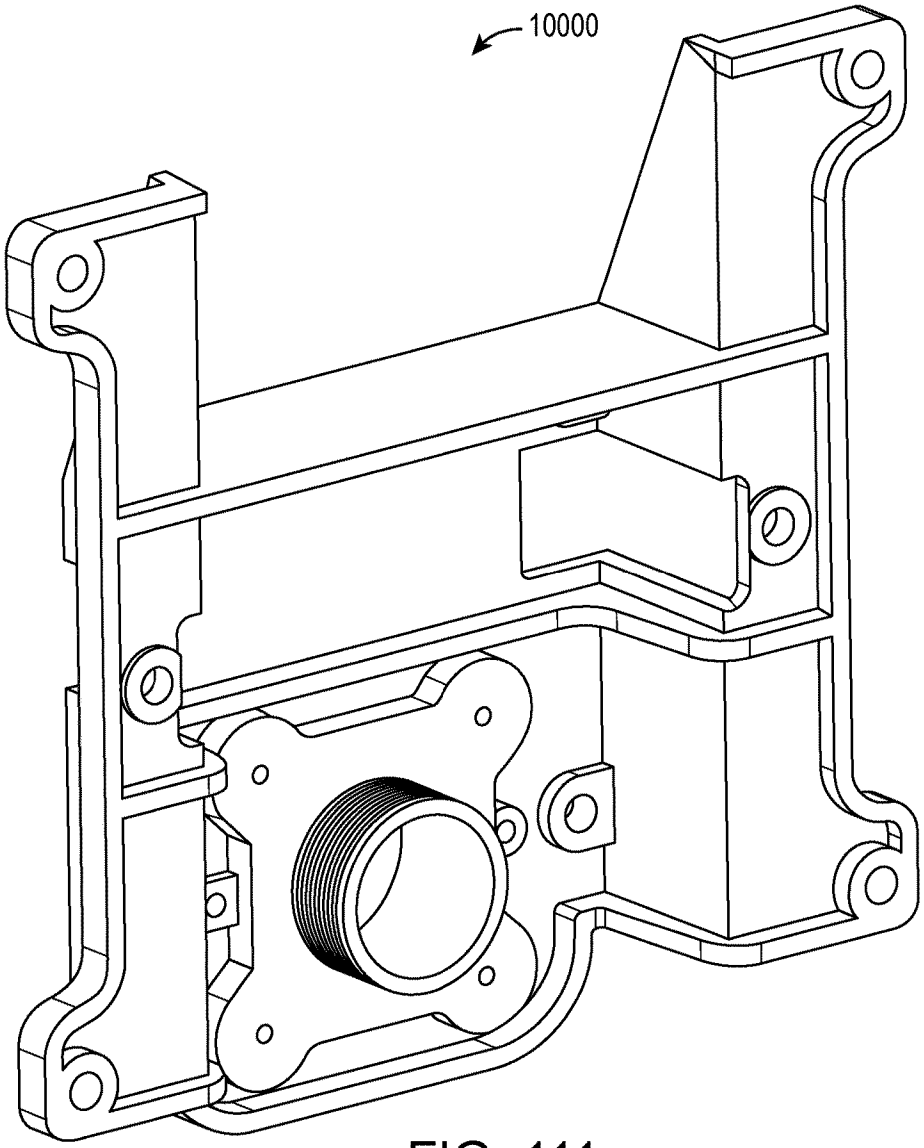
Figure 112:
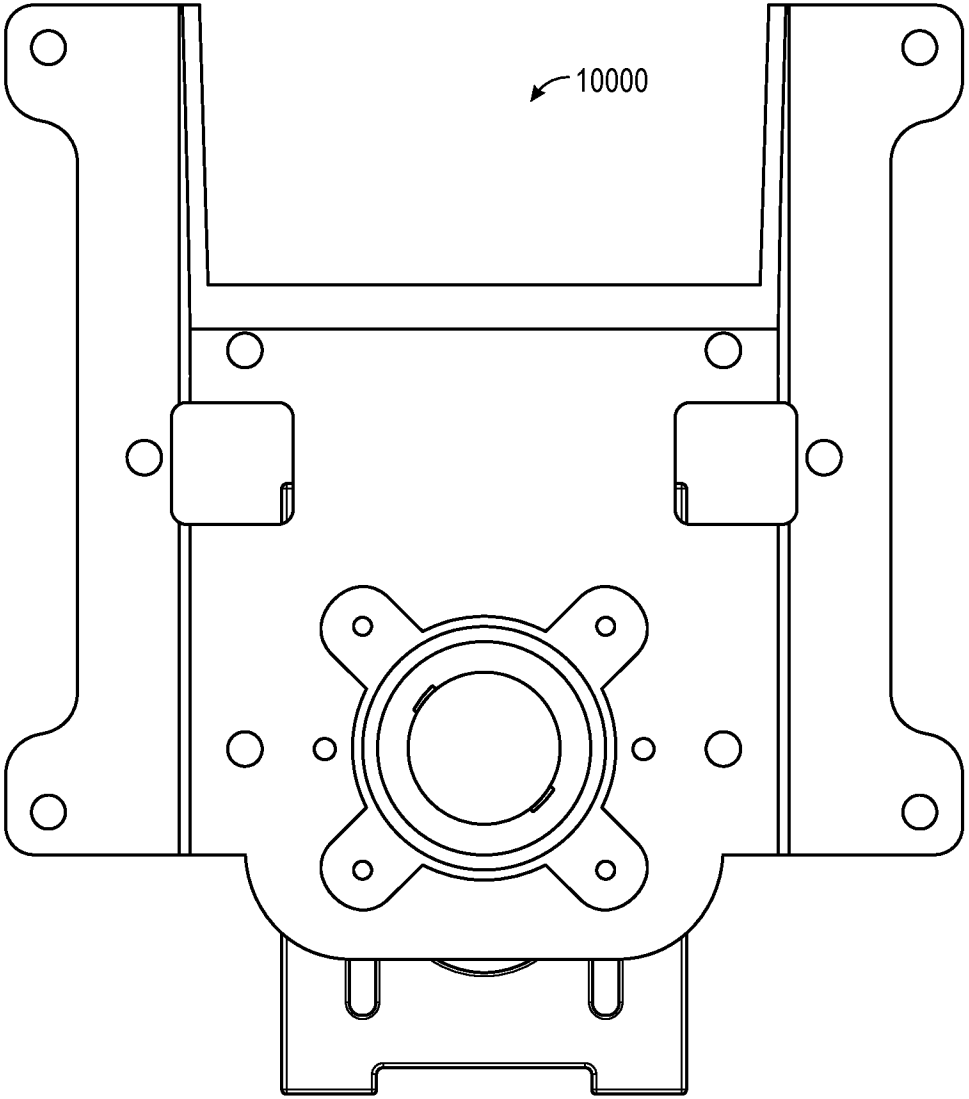

As shown in FIGS. 106 and 108, the carrier assembly 9000 also includes an installation foot 9520. The foot 9520 is substantially "L shaped having an upright portion 9524 and a bottom portion 9528 extending from the upright portion 9524. The upright portion 9524, in turn, defines a pair of vertical slots 9530 sized and spaced to allow a plurality of apertures to pass therethrough and be received within the apertures 9534 of the mounting hub 9092 (see FIG. 106). The upright portion 9524 also includes a series of graduations 9538 formed into or otherwise printed thereon and that are positioned so they are visible when the foot 9520 is mounted to the faceplate 9028. More specifically, the graduations 9538 are positioned so that the indicated graduation (e.g., the graduation 9538 aligned with the corresponding indicating indicia on the faceplate 9028) generally corresponds to the vertical mounting height of the fluid passageway 9050 from the floor.

To mount the faceplate 9028 to modular wall assembly 9004, the user first loosely mounts the installation foot 9520 to the mounting hub 9092 by passing a plurality of fasteners (not shown) through both of the vertical slots 9530 and into a corresponding aperture 9534. With the fasteners left loose to allow movement between the faceplate 9028 and the foot 9520, the user may then adjust the foot 9520 relative to the faceplate 9028 (e.g., in a generally vertical direction) until the graduation 9538 corresponding to the desired mounting height of the fluid passageway 9050 is aligned with indicating indicia on the faceplate 9028.

Once aligned, the user can then tighten the fasteners to fix the foot 9520 relative to the faceplate 9028. With the foot 9520 locked in place, the user can then rest the bottom portion 9528 on the floor or bottom member 9012 whereby the foot 9520 supports the weight of the faceplate 9028 while maintaining the fluid passageway 9050 at the desired mounting height. With the weight removed, the user can then properly position the faceplate 9028 between two studs 9020 without having to hold the faceplate 9028 in place.

With the faceplate 9028 positioned between two adjacent studs 9020, the use can then drill the necessary holes in the studs 9020 and secure the faceplate 9028 in position by passing a fastener through each of the mounting apertures 9080.

FIGS. 109-116 illustrate another embodiment of the carrier assembly 10000. The carrier assembly 10000 is substantially similar to the carrier assembly 8000 so only the differences will be discussed in detail herein. The faceplate 10028 includes a top shelf 10500. During use, the top shelf 10500 is configured to serve as a mounting location for fixture mounts, tubing mounts, and the like. In the illustrated embodiment, the top shelf 10500 is oriented substantially perpendicular to the mounting surface 10044 and extends laterally between the first legs 10068 of each side portion 10040 being offset vertically below the top-most point thereof.

Figure 113:
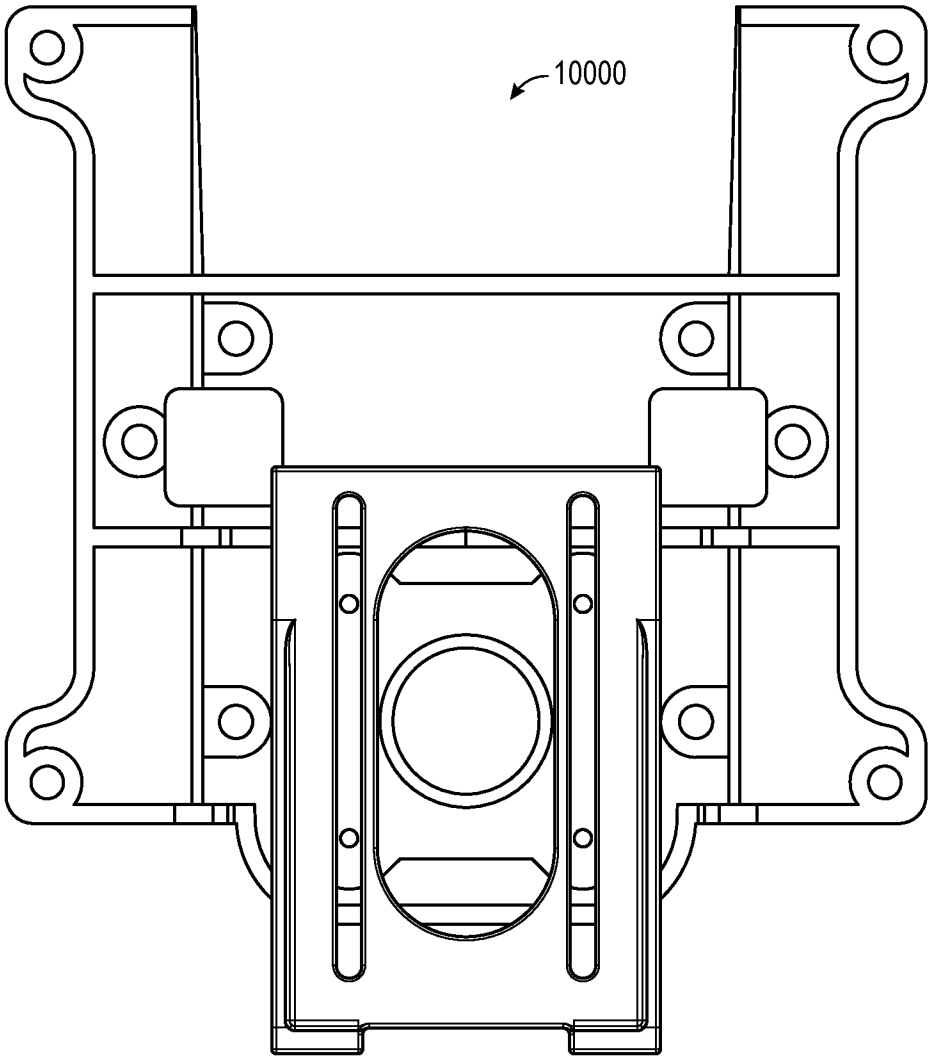
Figure 114:
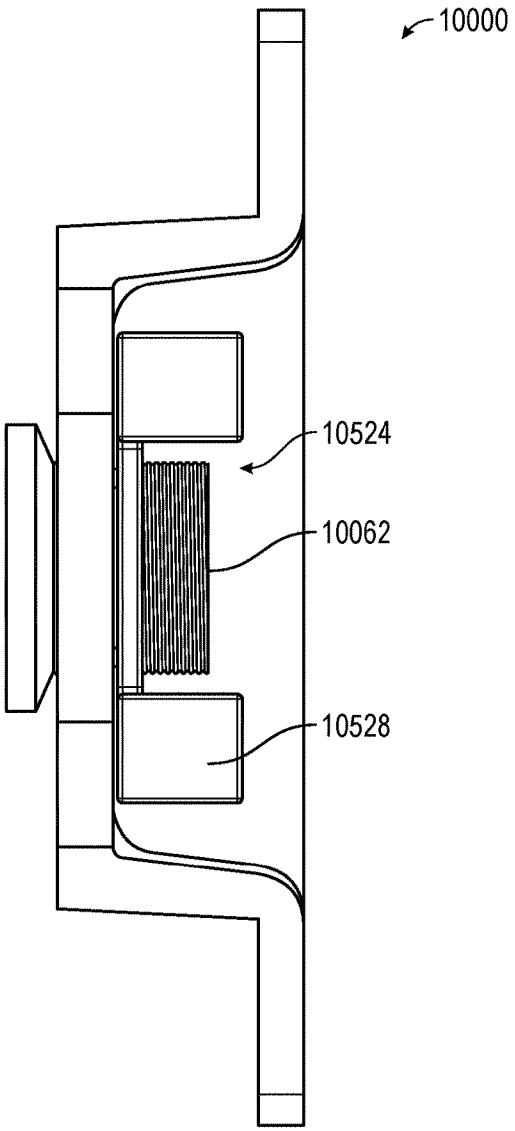
Figure 115:
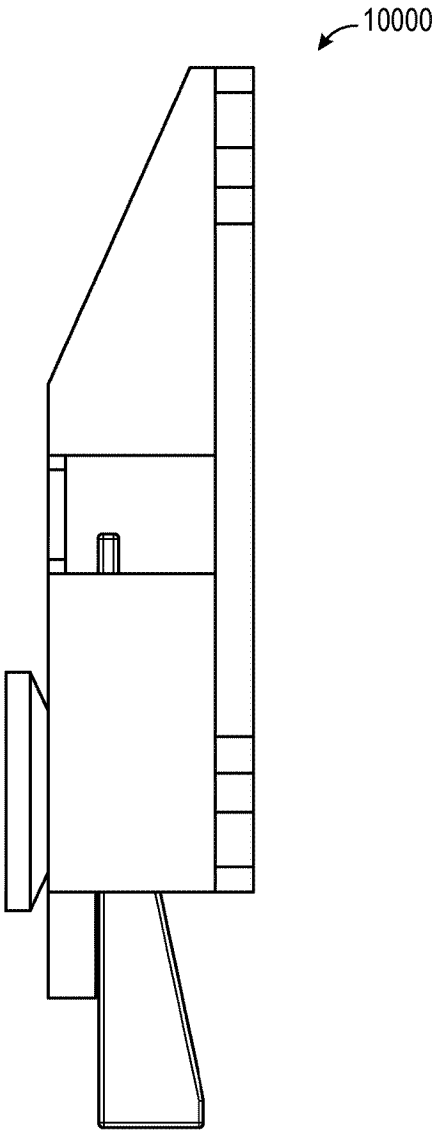
Figure 116:
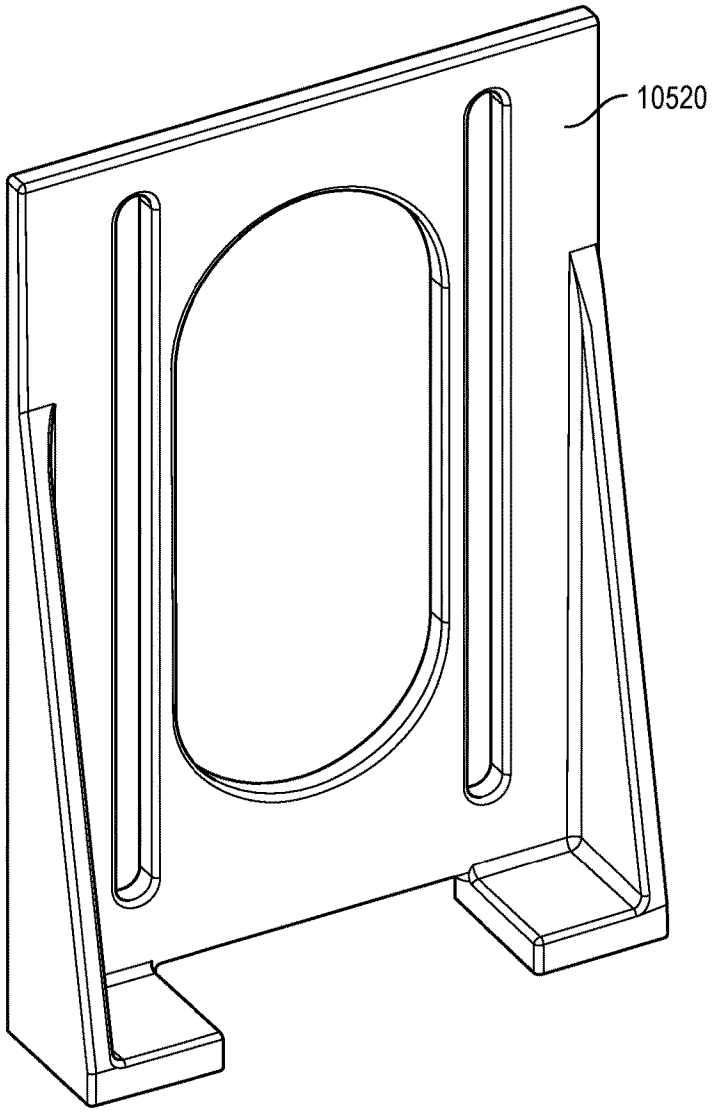

As shown in FIGS. 113 and 116 the installation foot 10520 is substantially similar in construction and operation of the installation foot 9520 described above. As such, only the differences will be described in detail herein. The installation foot 10520 includes a central aperture 10504 sized and shaped to allow the fluid coupler 10062 to pass therethrough. The installation foot 10520 also includes a gap 10524 formed into the bottom portion 10528 thereof. In the illustrated embodiment, the gap 10524 is centrally positioned and aligned with the central aperture 10504 so that a pipe segment of the corresponding plumbing system extending through the floor or bottom member 9012 can pass therethrough. More specifically, the gap 10424 allows the installation foot 10520 to be placed flat against the floor or bottom member 9012 even in installation situations where a pipe segment is already in place.

Figure 117:
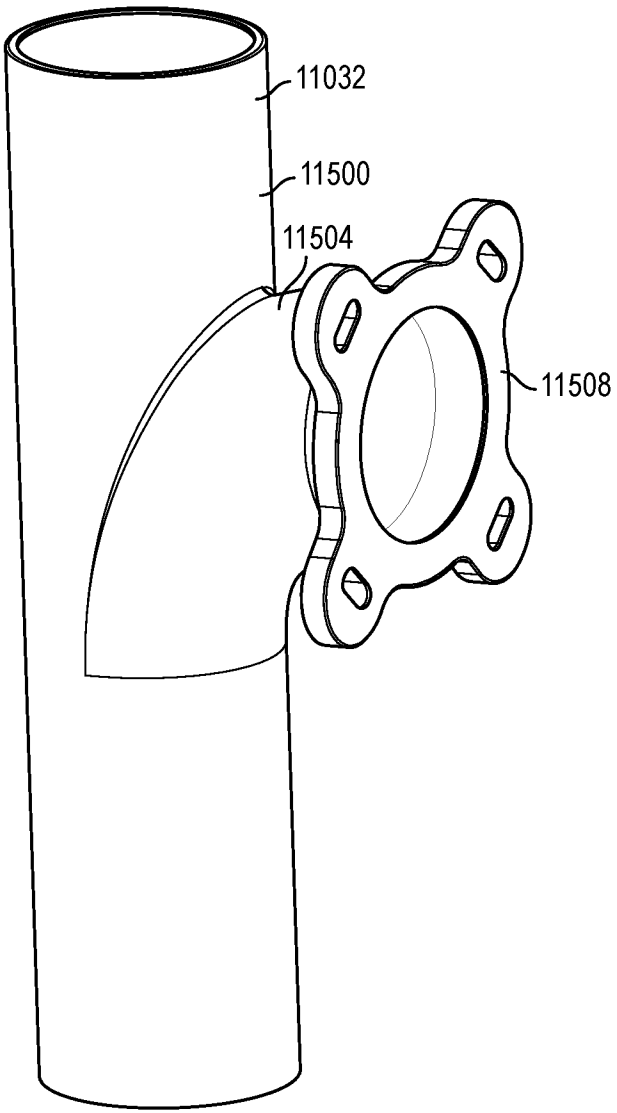
FIG. 117 illustrates another embodiment of a fluid coupler.

FIG. 117 illustrates another embodiment of the fluid coupler 11032. The fluid coupler 11032 is substantially similar to the fluid coupler 8032 so only the differences will be described in detail herein. The fluid coupler 11032 includes a primary segment 11500 and a secondary segment 11504 extending from the primary segment 11500. As shown in FIG. 117, the primary segment 11500 is an elongated pipe being substantially linear in shape. The secondary segment 11504, in turn, extends from the primary segment 11500 along the length thereof to produce a flanged end 11508 oriented perpendicular to the primary segment 11500.

Figure 118:
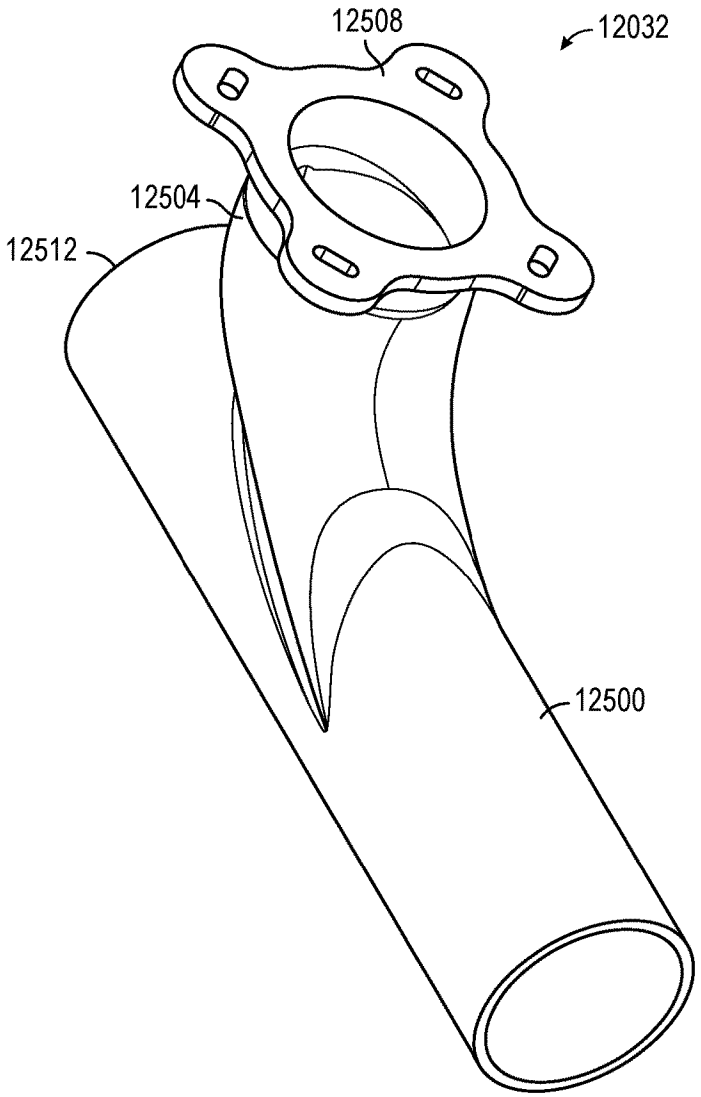
FIGS. 118-121 illustrate another embodiment of a fluid coupler.
Figure 119:
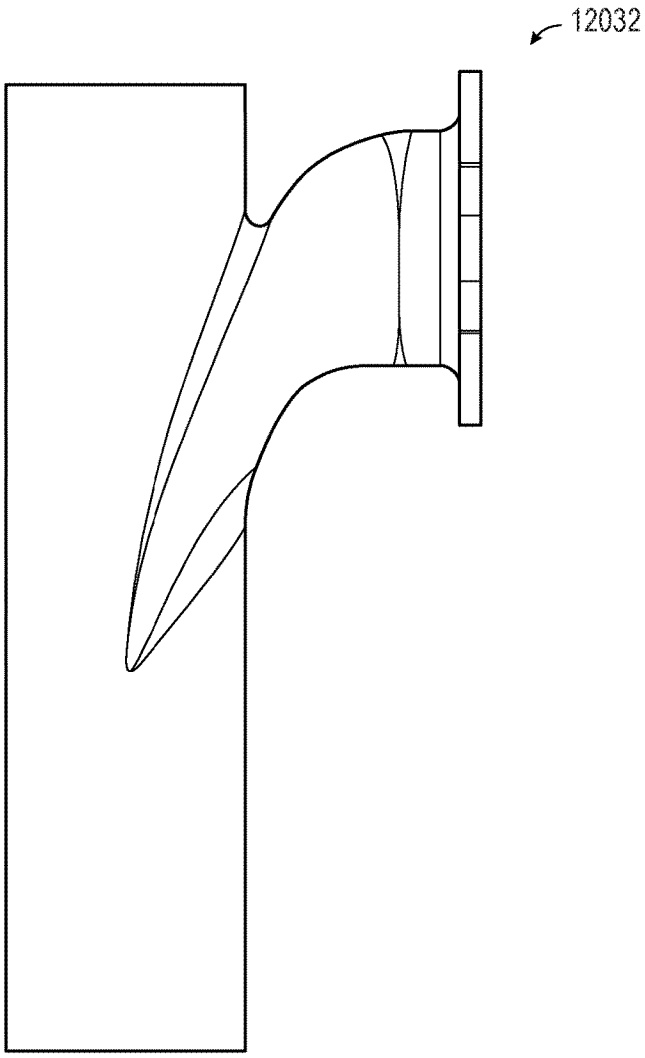

FIGS. 118-121 illustrate another embodiment of the fluid coupler 12032. The fluid coupler 12032 is substantially similar to the fluid coupler 11032. As such, only the differences will be described in detail herein. The secondary segment 12504 extends from the primary segment 12500 along the length thereof to produce a flanged end 12508 oriented perpendicular to the primary segment 12500. The secondary segment 12504 is sized and shaped to encourage improved fluid flow from the secondary segment 12504 into the primary segment 12500. More specifically, the secondary segment 12504 is sized and shaped to minimize backflow toward a first end 12512 of the primary segment 12500. As shown in FIG. 118, the secondary segment defines an inlet cross section 12516 defined by the flanged end 12508 and an outlet cross section 12520 defined by the location at which the secondary segment 12500 enters into the primary segment 12500. In the illustrated embodiment, the outlet cross section 12520 is laterally offset relative to the inlet cross section 12516 so that the upstream point 12526 of the outlet 12520 is offset by approximately 50% of the diameter of the inlet cross section 12516. In other embodiments, the upstream point 12526 is laterally offset between 30% and 60% of the upstream diameter, between 25% and 75% of the upstream diameter, between 50% and 100% of the upstream diameter, between 60% and 100% of the upstream diameter, and between 75% and 100% of the upstream diameter.

Figure 122:
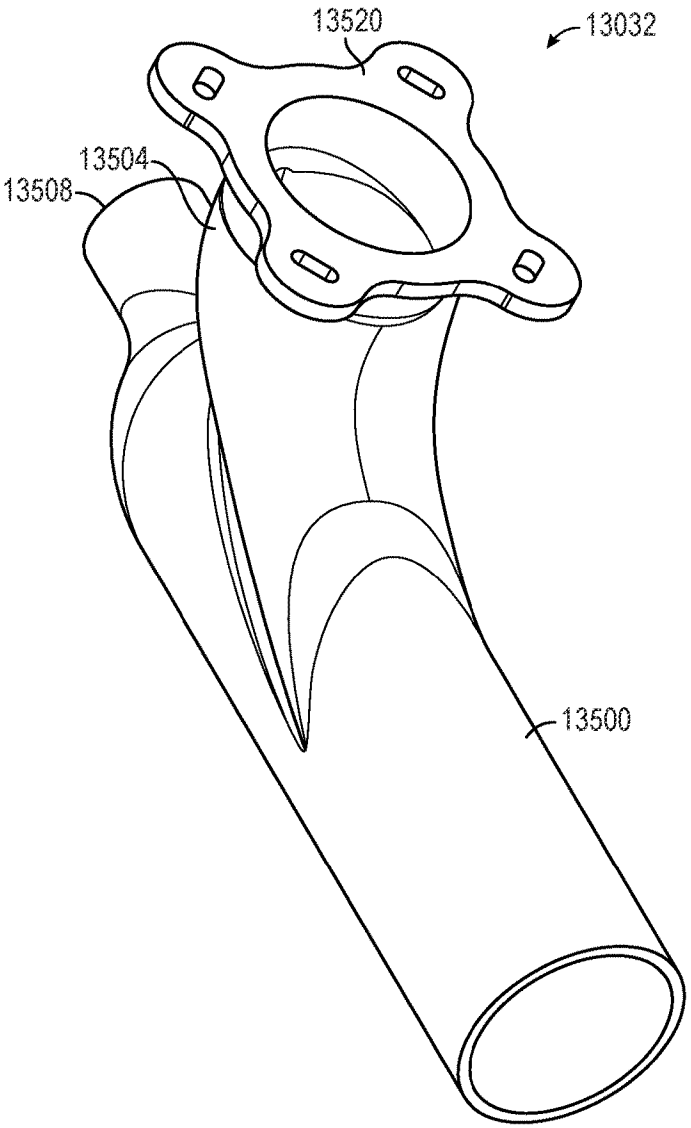
FIGS. 122-124 illustrate another embodiment of a fluid coupler.
Figure 123:
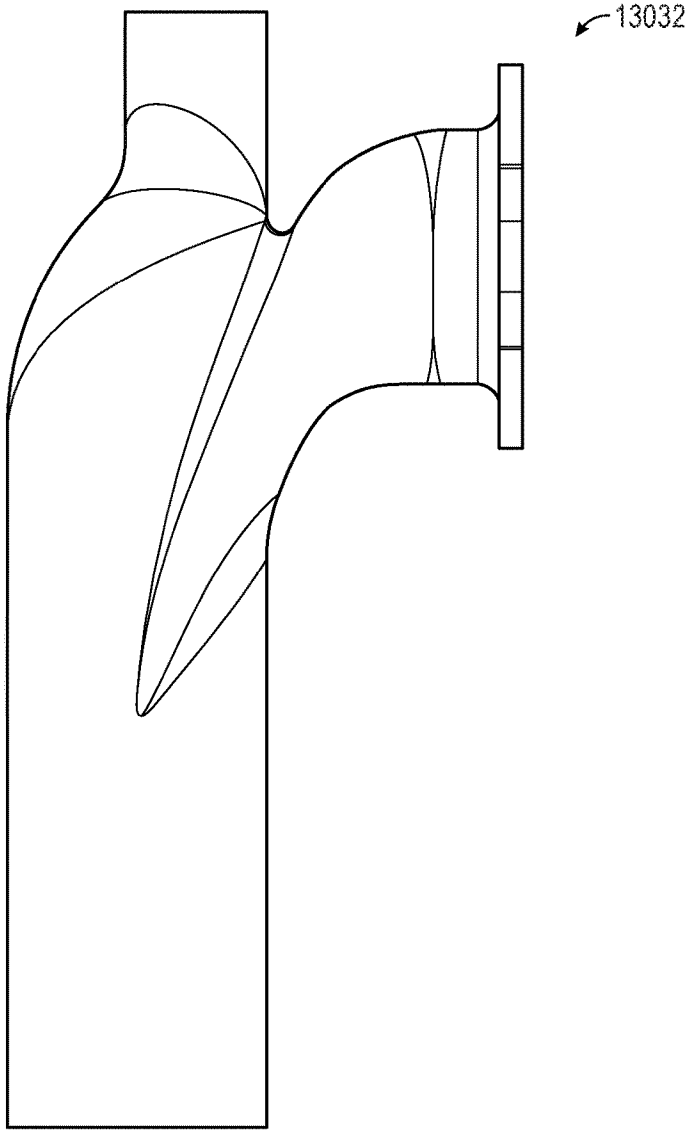
Figure 124:
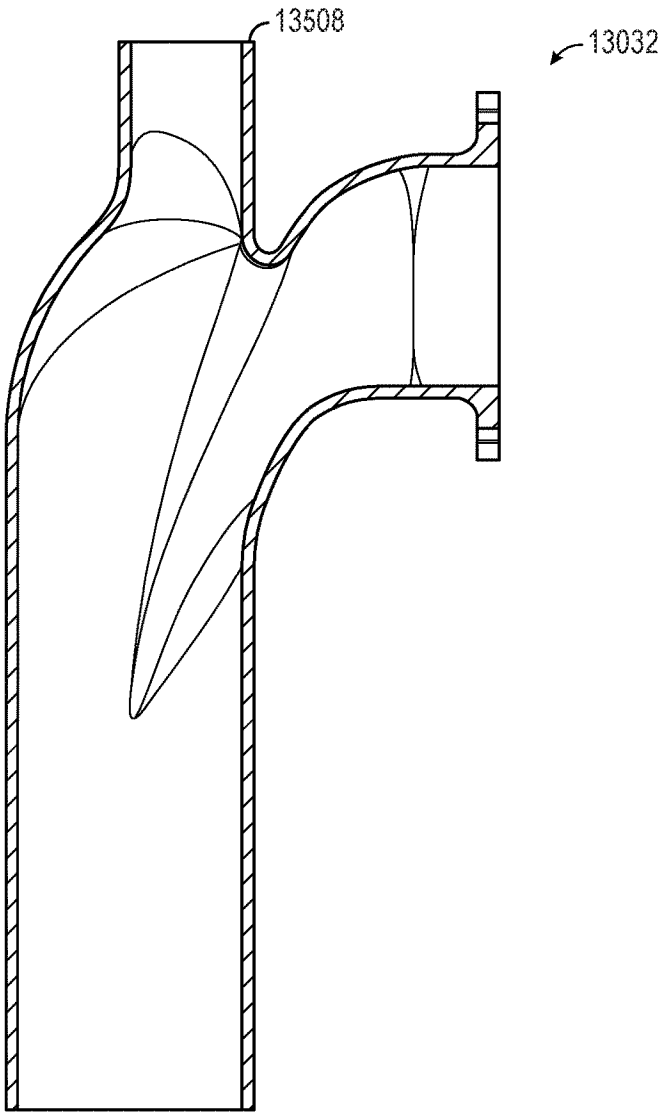

FIGS. 122-124 illustrate another embodiment of the fluid coupler 13032. The fluid couple 13032 is substantially similar to the fluid coupler 12032 so only the differences will be discussed in detail herein. The primary segment 13500 includes an elongated member having a first or downstream end 13504 having a first diameter, and a second or upstream end 13508 opposite the first end 13504 having a second diameter that is less than the first diameter. During use, the second end 13508 is configured for attachment to a vent pipe when installed in a vertical configuration.

Figure 125:
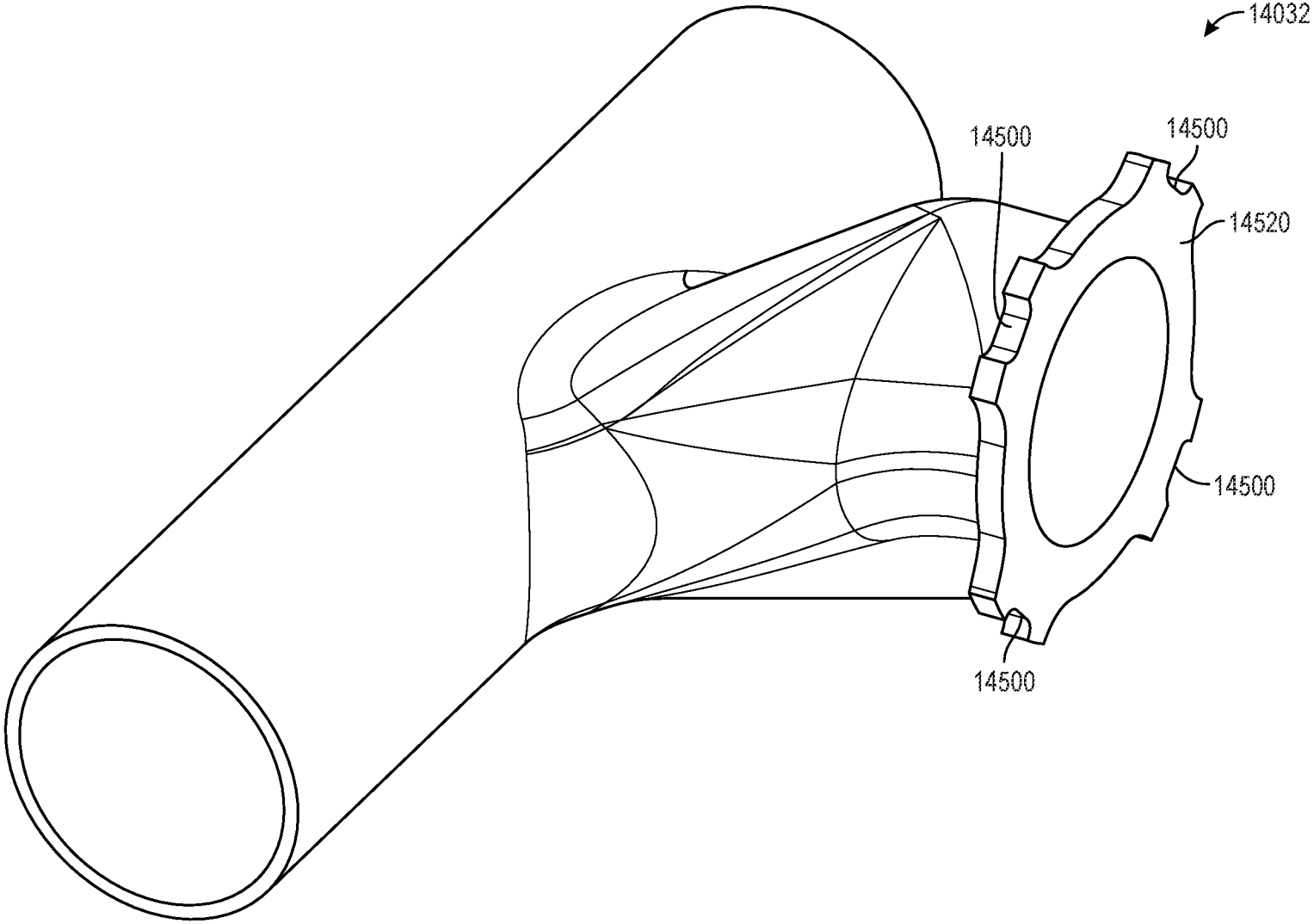
FIGS. 125-127 illustrate another embodiment of a fluid coupler.
Figure 126:
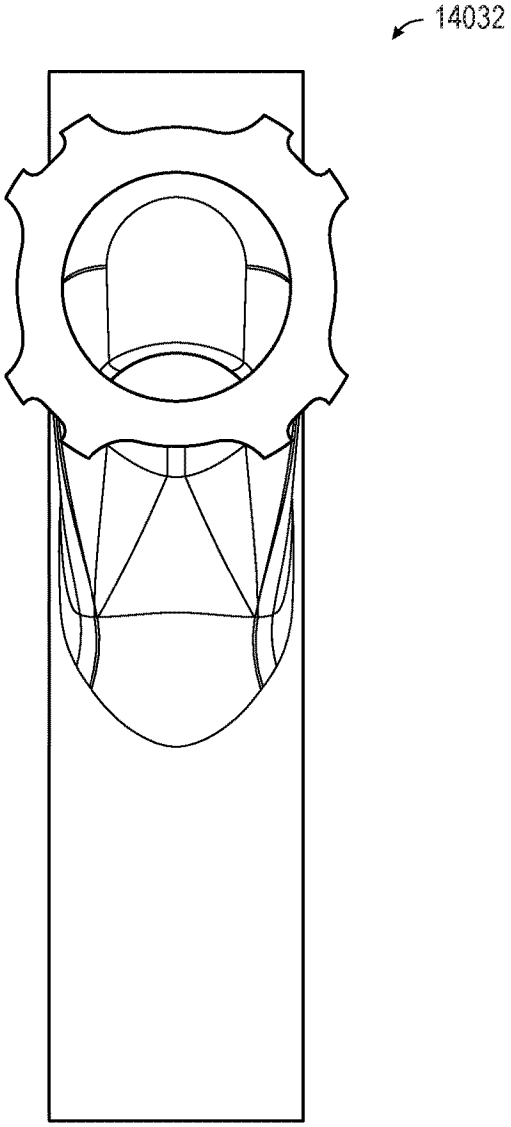
Figure 127:
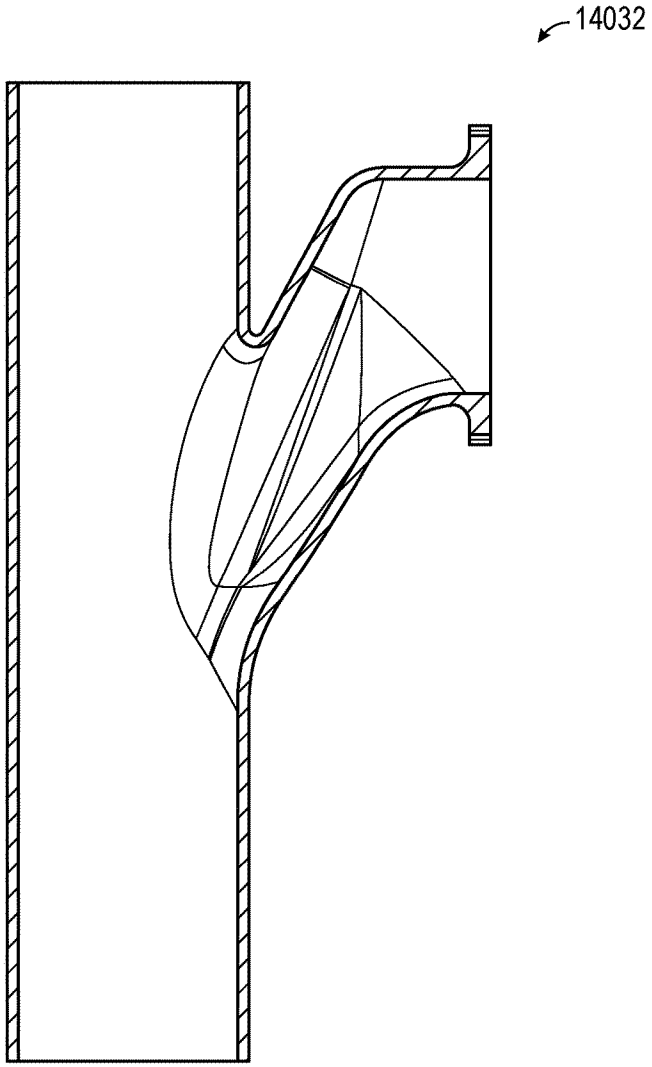
Figure 128:
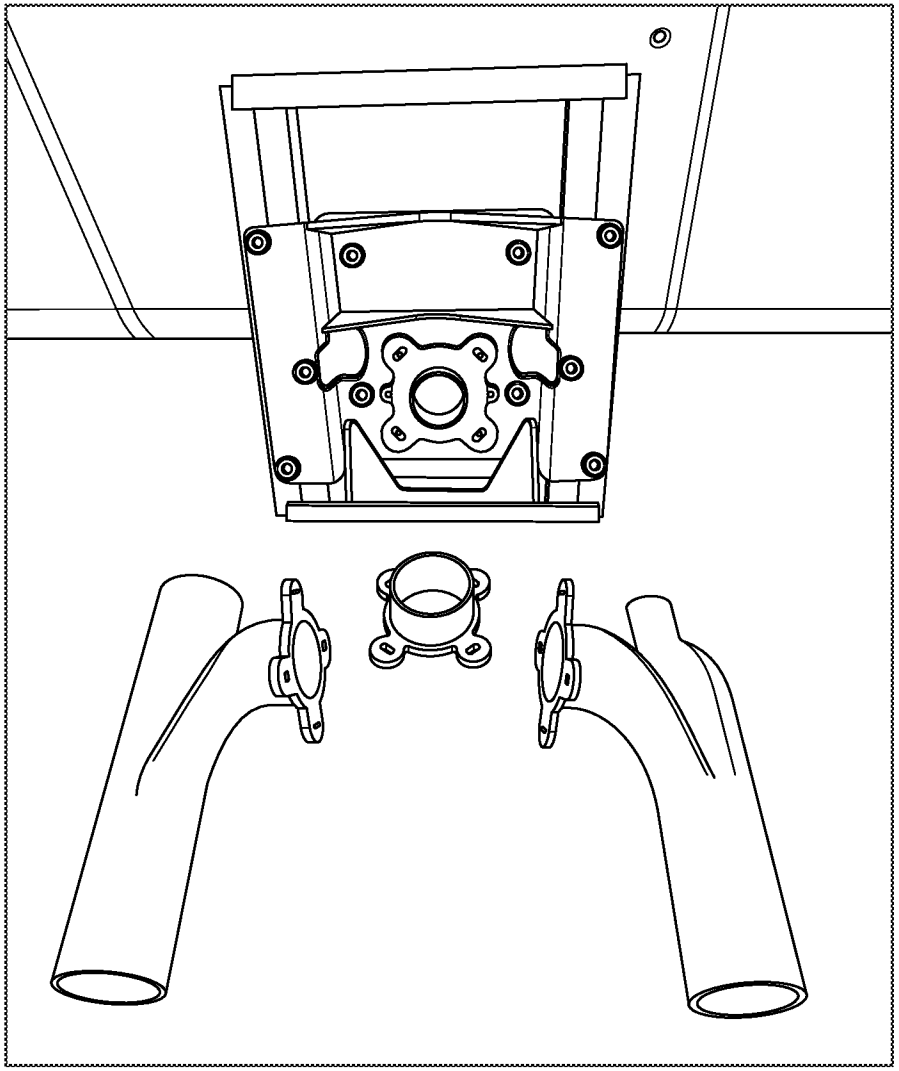
FIG. 128 illustrates the carrier assembly of FIG. 98 and the fluid couplers of FIGS. 118-124.

FIGS. 125-127 illustrates another embodiment of the fluid coupler 14032. The fluid coupler 14032 is substantially similar to the fluid coupler 12032 so only the differences will be discussed in detail herein. The flanged end 13520 includes four mounting aperture 13500 spaced 90 degrees apart. As shown in FIG. 125, each aperture 14500 is open (e.g., not completely enclosed) such that a fastener (not shown) can be inserted into and removed from the aperture 14500 without having to unthread the fastener from the corresponding aperture (e.g., the aperture of the mounting hub 8092). When installing the fluid coupler 14032 to a faceplate, the user first threads two of the four fasteners (e.g., the bottom two fasteners) into the mounting hub 8092. The user can then position the coupler 14032 such that the flanged end 13520 is in direct contact with the sealing surface 8096 and the bottom two fasteners are laterally introduced into within their corresponding apertures 13500 via the opening. With the coupler 14032 in place, the user can then tighten the two pre-positioned fasteners and introduce and fasten the remaining two fasteners.

FIGS. 129-146 illustrate another embodiment of a carrier assembly 15000 including various embodiments of outlet connectors 15032. The carrier assembly 15000 is substantially similar to the carrier assembly 10000 so only the differences will be discussed in detail herein. The carrier assembly 15000 is configured for installation within a modular wall assembly 15004, described below, whereby the carrier assembly 15000 provides a mounting location to which a water closet (not shown) may be attached. Once attached, the carrier assembly 15000 is configured to transmit any loads applied to the water closet (e.g., a person sitting thereon, and the like) into the wall assembly 15004 for support. In the illustrated embodiment, the carrier assembly 15000 not only provides physical support for the water closet but also serves as a fluid connection by placing the outlet of the water closet into fluid communication with a corresponding wastewater pipe of the plumbing system of the building (described below).

The modular wall assembly 15004 to which the carrier assembly 15000 is to be installed includes a pre-fabricated wall segment that is configured for installation within a building as a pre-assembled unit. More specifically, the modular wall assembly 15004 includes a bottom member 15012, a top member (not shown) opposite the bottom member 15012, and a plurality of uprights or studs 15020 extending between the bottom member 15012 and the top member. In the illustrated embodiment, each upright 15020 has a substantially "C" channel cross-sectional shape (channel stock). In such embodiments, the uprights 15020 may include any one of 1.25" by 3.625" studs, 1.25" by 1.625" studs, 1.25" by 2.5" studs, 1.25" by 4" studs, and 1.25" by 6" studs. However, in other embodiments, the uprights 15020 may have I-beam or other cross-sectional shapes such as but not limited to angle iron, bulb plate, T-bar, square bar, round bar, and the like). In still other embodiments, the uprights 15020 may be formed from wood such as a 2×4 nominal piece (e.g., 1.5" by 3.5" actual size).

Together, the bottom member 15012, the top member, and the uprights 15020 form a front wall surface 15022 and a rear wall surface 15026 opposite the front wall surface 15022. The front wall surface 15022 generally corresponds with the surface of the wall 15004 to which the water closet is installed. The pre-formed wall segment may also include a combination of single uprights (e.g., uprights formed from a single C-shaped stud) and double uprights (e.g., uprights formed from two C-shaped studs connected back-to-back). In still other embodiments different combinations of upright types may be combined and used. In the illustrated embodiment, the pre-formed wall segment also includes a sheet of drywall 15016 or other wall covering mounted to the front wall surface 15022 thereof.

As shown in more detail in FIGS. 141A-142A, the carrier assembly 15000 includes a faceplate 15028, a fluid coupler 15062, and an outlet tube or outlet connector 15032 coupled to the faceplate 15028. The faceplate 15028 of the carrier assembly 15000 includes a central portion 15036 and a pair of side portions 15040 flanking the central portion 15036 on opposite sides thereof. When installed, the central portion 15036 and the side portions 15040 are configured so that the mounting surface 15044 of the central portion 15036 is aligned with the front wall surface 15022 of the modular wall assembly 15004 (e.g., ±1/32", ±1/16"±1/8", ±1/4", ±1/3") while each side portion 15040 is coupled to the rear surface 15026 of a corresponding upright 15020 (e.g., a double upright 15024; see FIG. 129B). By doing so, the illustrated faceplate 15028 provides additional strength to the finished water closet assembly by minimizing the cantilevered length between the mounting surface 15044 of the faceplate 15028 and the water closet while allowing all of the mounting points between the carrier assembly 15000 and the uprights 15020 of the modular wall 15004 to be accessed via the rear surface 15026. By doing so, the user can install and perform maintenance on the faceplate 15028 or water closet without having to cut into or otherwise modify the visible wall materials (e.g., the drywall 15016) attached to the front wall surface 15022.

Figure 129A:
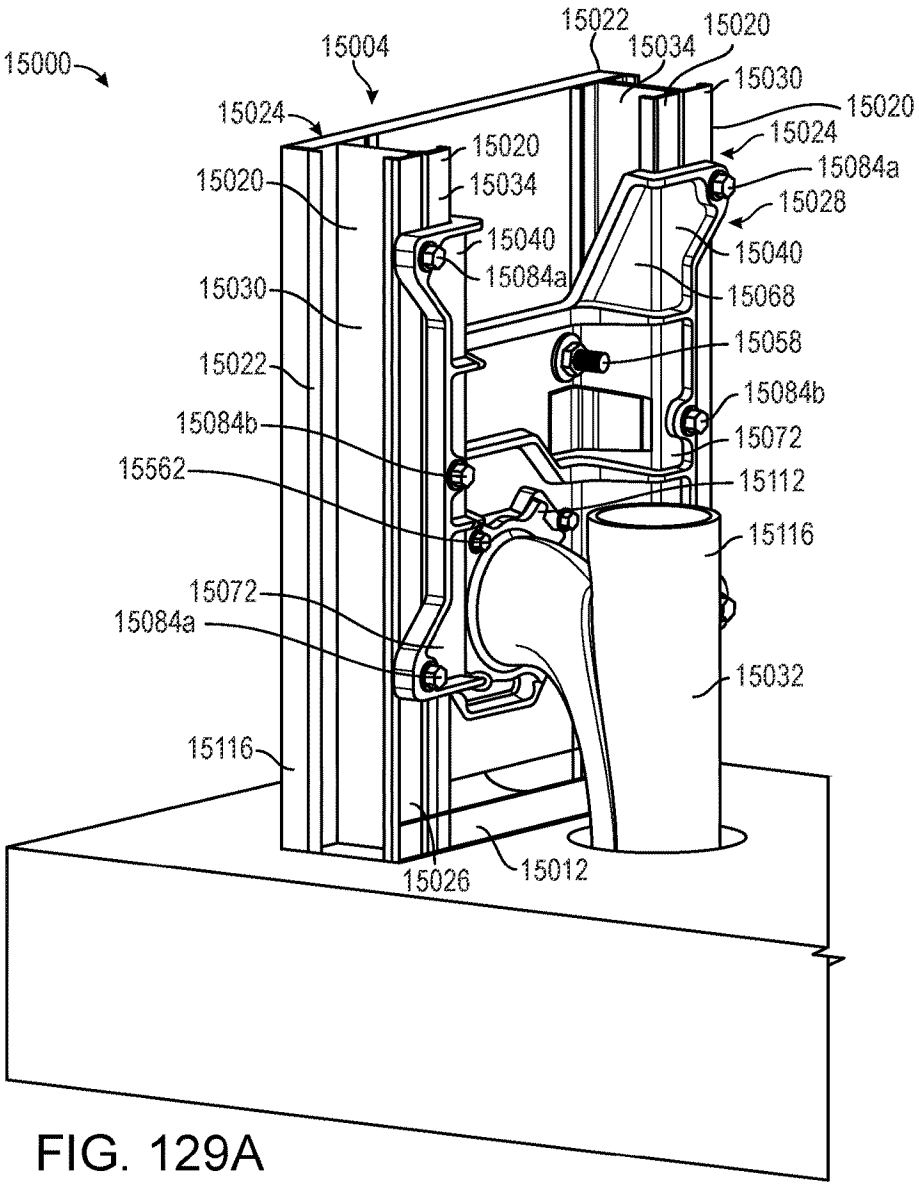
FIGS. 129A-129B illustrate another embodiment of a carrier assembly.
Figure 129B:
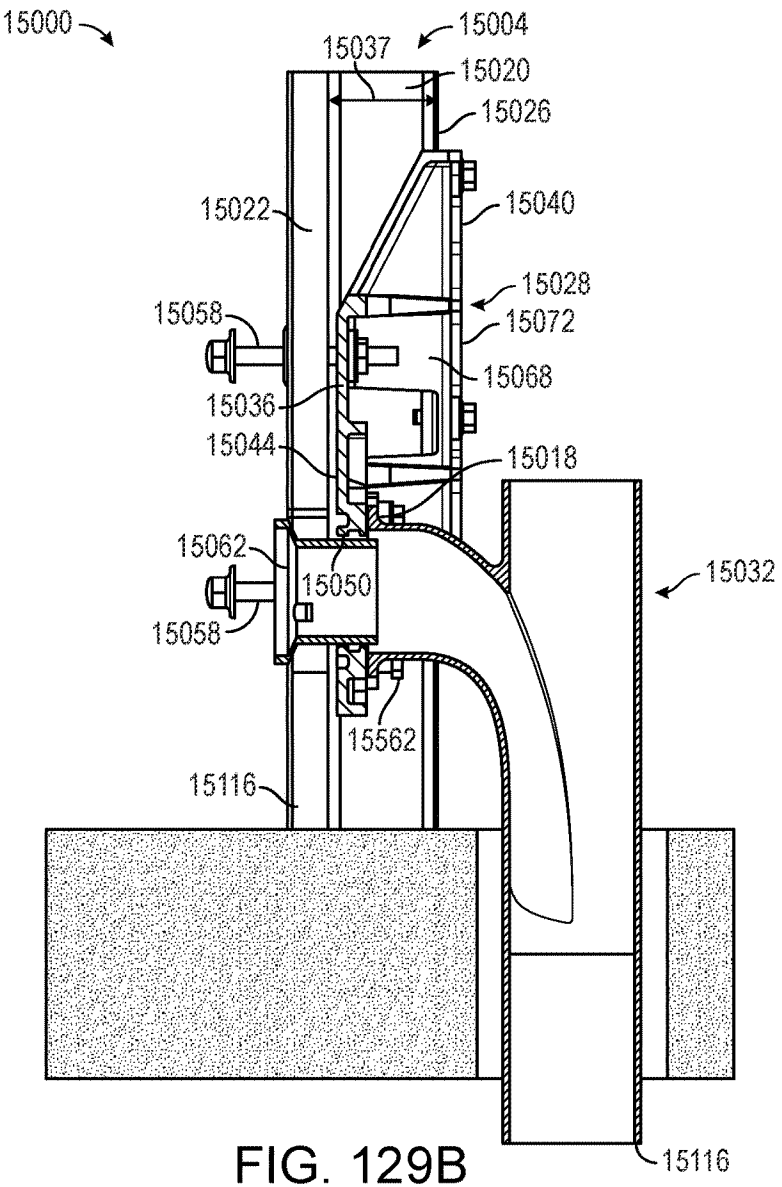

The central portion 15036 of the faceplate 15028 defines the mounting surface 15044, a fluid passageway 15050 sized to receive the fluid coupler 15062 therein, and a first plurality of mounting apertures 15054 configured to support a corresponding threaded mounting element 15058 (FIG. 129B). When assembled, the water closet is physically mounted to the faceplate 15028 via the threaded mounting elements 15058. The threaded mounting elements 15058 may fasten directly to threaded mounting apertures 15054 in the faceplate 15028 or may otherwise extend through the apertures 15054 and be secured by nuts or other fasteners (not shown) on the rear side of the faceplate 15028. The first set of mounting apertures 15054 are spaced apart on the faceplate 15028 and are configured to serve as mounting locations to attach and support a hung or cantilevered water closet to the faceplate 15028.

The fluid passageway 15050 includes an aperture formed into the faceplate 15028 that is sized to receive the fluid coupler 15062 therein. More specifically, the passageway 15050 includes a groove sized to receive a seal therein to form an adjustable water-tight connection with the fluid coupler 15062. The fluid coupler 15062, in turn, is axially adjustable relative to the central portion 15036 (e.g., sliding axially within the passageway 15050) to engage and form a water-tight seal with the outlet of the water closet. In other embodiments, the fluid passageway 15050 itself may form a water-tight seal with the water closet.

The central portion 15036 also includes a second set of mounting apertures 15056 (FIG. 142A) located on the faceplate 15028 and positioned for fastening a floor-mounted water closet to the faceplate 15028. As such, using both the first and second sets of apertures 15054, 15028 the faceplate 15028 is able to support both a wall mounted water closet and a floor mounted water closet. More specifically, the second set of apertures 15056 are formed into a boss extending from the back surface of the faceplate 15028 such that they are offset (e.g., recessed) relative to the surface of the mounting hub 15092, which is described in greater detail below. The recessed position of the bosses of the apertures 15056 permits a nut to be fastened (e.g., via a socket) to a stud or bolt extending through the aperture 15056 while still allowing a gasket to rest on the gasket face of the mounting hub 15092 without interference therebetween.

The central portion 15036 also includes a mounting hub 15092 extending from the back side thereof and corresponding with the fluid passageway 15050. More specifically, the mounting hub 15092 of the central portion 15036 is configured to provide a surface against which the outlet connector 15032 (described below) may be attached and form a water-tight seal therewith. The mounting hub 15092 includes a planar sealing surface 15096*a*, 15100*a* encircling the fluid passageway 15050. More specifically, the sealing surface includes an annular portion 15096*a* immediately encircling the fluid passageway 15050 and a plurality of mounting portions 15100*a* extending radially outwardly from the annular portion 15096*a* and corresponding to given mounting aperture 15534. In the illustrated embodiment, the sealing surface includes four mounting portions 15100*a* are each spaced 90 degrees apart from each other.

Each side portion 15040 of the faceplate 15028 is offset behind the central portion 15036 a setback distance 15037 generally corresponding to the width of the uprights 15020. As such, when both side portions 15040 are coupled to the rear surface 15026 of the uprights 15020, the mounting surface 15044 of the central portion 15036 is aligned with the front wall surface 15022 of the uprights 15020 (e.g., ±1/32", ±1/16"±1/8", ±1/4", ±1/3"). More specifically, each side portion 15040 includes a first leg 15068 extending rearwardly from the periphery of the central portion 15036, and a second leg 15072 extending outwardly from the first leg 15068 opposite the central portion 15036 to form a general "L" shape extending rearward from the central portion 15036. While the illustrated side portions 15040 include a pair of panels set at approximately 90 degrees to each other it is understood that in alternative embodiments other forms of side portion may be used, such as pipes, connecting members, and the like. In the illustrated embodiment, the offset distance 15037 is approximately 3.625"±10%. However, in other embodiments the offset distance may be 1.625"±10%, 1.25"±10%, 2.5"±10%, 4"±10%, 6"±10%. With reference to FIGS. 141A-142A, the second leg 15072 of each side portion 15040 defines a plurality of mounting apertures 15080*a*, 15080*b* sized to receive a fastener 15084*a*, 15084*b* (FIGS. 129A-129B) therethrough to removably couple the faceplate 15028 to a pair of adjacent uprights 15020 or double-uprights 15024. In the illustrated embodiment, each side portion 15040 includes a first set of mounting apertures 15080*a*, located so a fastener 15084*a* passing therethrough will couple with the first or outside upright 15030 of a double-upright 15024, and a second set of apertures 15080*b*, located so a fastener 15084*b* passing therethrough will coupled with the second or inside upright 15034 of the double-upright 15024. As such, once installed, the faceplate 15028 is directly connected to both uprights 15030, 15034 of both adjacent double-uprights 15024 for additional strength. Additionally, when loading is applied, the faceplate 15028 bears against both uprights 15030, 15034 of both adjacent double-uprights 15024. In the illustrated embodiment, each aperture of the first set of mounting apertures 15080*a* is positioned along a first vertical axis that generally corresponds with the location of the first upright 15030 while each aperture of the second set of mounting apertures 15080*b* is positioned along a second vertical axis that is offset from the first vertical axis and generally corresponds with the location of the second upright 15034. In the present invention, all of the fasteners 15084*a*, 15084*b* include bolts secured with nuts, however in alternative embodiments different forms of fastener may be used.

With continued reference to FIGS. 141A-142A, the faceplate 15028 also defines a pair of access apertures 15104. Each access aperture 15104 is formed into the faceplate 15028 and is configured to allow the user to access the backside of the fastener 15084*b* passing through the second set of mounting apertures 15080*b* via the rear surface 15026 of the modular wall 15004. More specifically, the faceplate 15028 includes an access aperture 15104 formed into the first leg 15068 of each side portion 15040 and also formed into a portion of the central portion 15036 that is adjacent to each respective side portion 15040. The access aperture 15104 is located adjacent to a corresponding aperture of the second set of mounting apertures 15080*b*. The access aperture 15104 extends a sufficient distance to permit the user to place his or her hand behind the fastener 15084*b* to gain access thereto (e.g., the nut applied to the back of the fastener 15084*b*). In other embodiments, the access aperture 15104 may be sized to allow a socket or wrench to gain access to the nut applied to the back of the fastener 15084*b*.

Figure 142A:
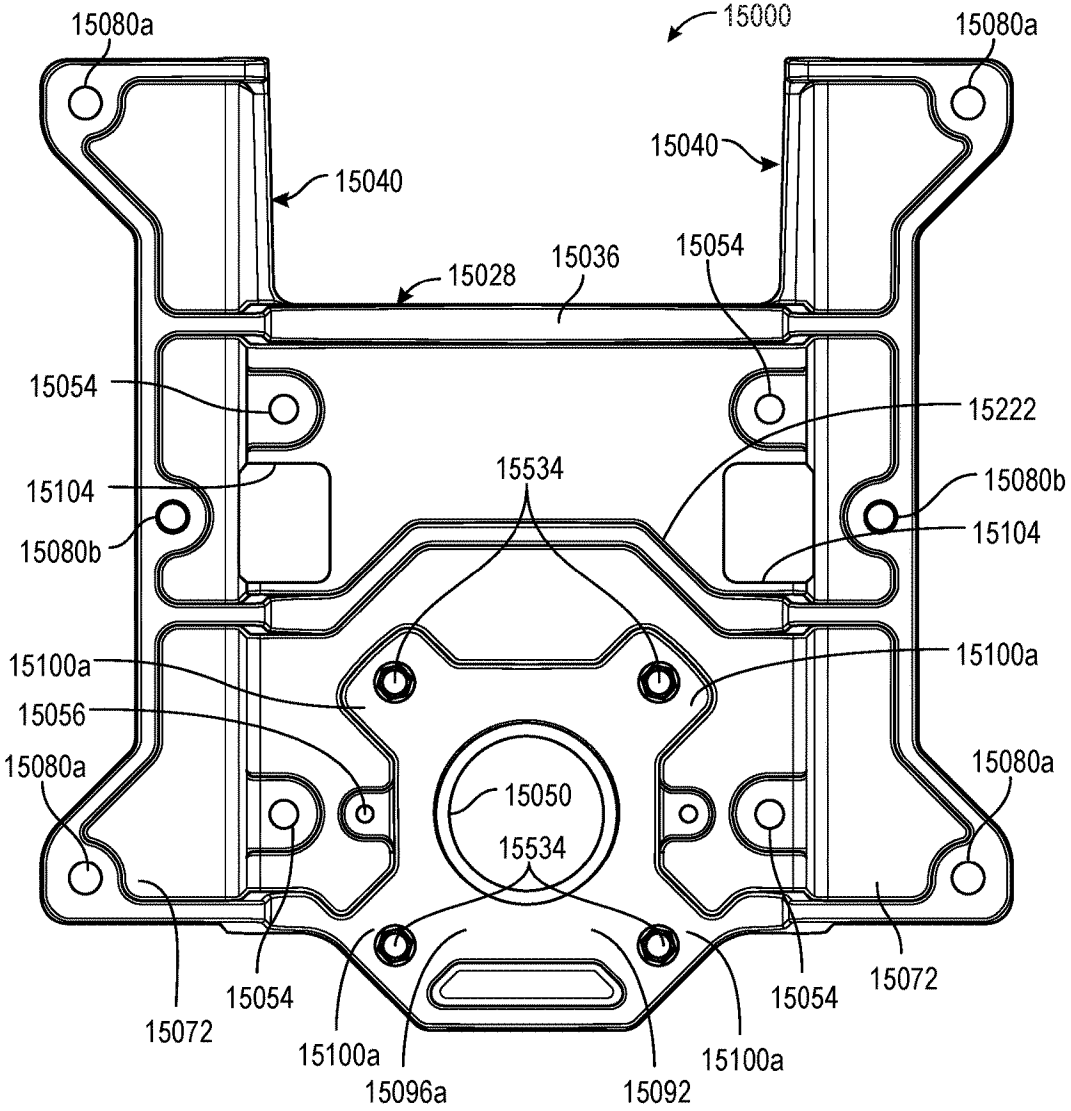

With continued reference to FIG. 142A, the faceplate 15028 includes a plurality of ribs 15222 that provide added strength and help to prevent warping or bending of the faceplate 15028 when a cantilevered load is applied to the faceplate 15028. As shown, the legs 15072 each include a rib 15222 (i.e., thin portion with increased thickness) running along the entirety of the outer periphery of the respective leg 15072. Additionally, the central portion 15036 of the faceplate includes three ribs 15222 that extend horizontally across the width of the central portion 15028 and to the ribs 15222 that extend vertically along the periphery of the legs 15072. The horizontal ribs 15222 include a first rib at the top of the central portion 15036, a second rib at the bottom of the central portion 15036, and a third rib located centrally within the central portion 15036 at a location between the mounting hub 15092 and the first rib. As shown in FIG. 142A, each horizontal rib 15222 extends along the backside of the central portion 15028 and are integrated into both side portions 15040.

Figure 142B:
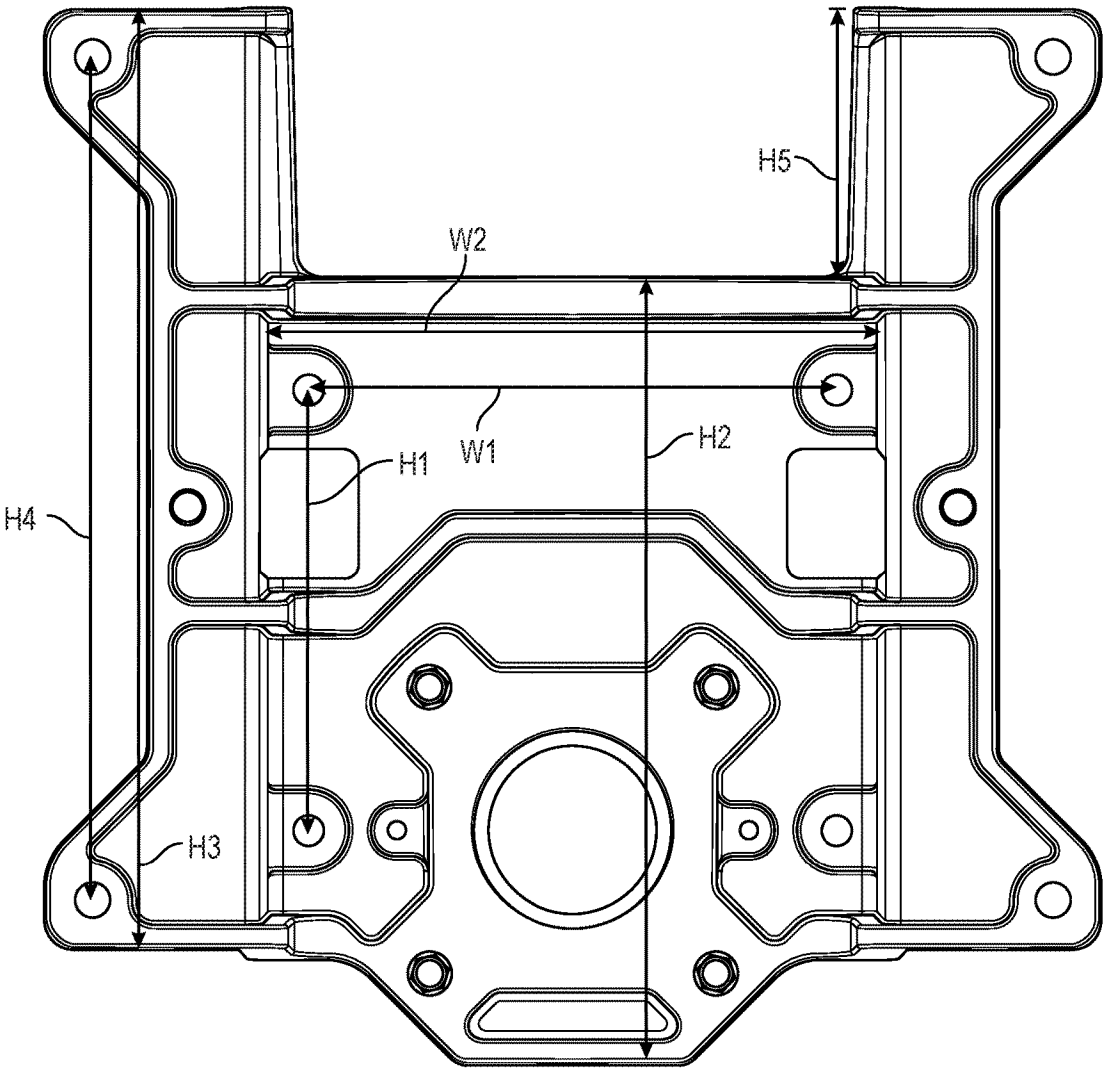

With reference to FIG. 142B, the first set of apertures 15054 in the faceplate 15028 are arranged in a rectangular array spaced apart from one another by distances that may be standardized in various jurisdictions or countries. For example, the horizontal width W1 between the apertures 15054 may be 9 inches (center to center) and the vertical height H1 between the apertures 15054 may be 7.5 inches (center to center). In some embodiments, the height H2 of the central portion 15036 of the faceplate 15028 (i.e., the portion between the legs 15068, 15072) may be approximately 75% (e.g., 75%, 70-80%, 60-90%, 50-100%) larger than the height H1 between the apertures 15054 or approximately 13 inches (e.g., 13 inches, 12-14 inches, 10-16 inches) in height. In some embodiments, the width W2 of the central portion 15036 of the faceplate 15028 may be approximately 15% (e.g., 15%, 10-20%, 5-25%, less than 25%, less than 20%) larger than the width between the apertures 15054 or approximately 10.5 inches (e.g., 10.5 inches, 10-11 inches, 9.5-11.5 inches) in width. By maintaining a narrow overall width W2 of the faceplate 15028, cantilevered weight of the water closet or a user on the water closet generates less bending or twisting of the faceplate 15028.

With continued reference to FIG. 142B, the height H3 of the legs 15072 is substantially taller than the height H2 of the central portion 15036. In some embodiments, the height H3 of the legs 15072 is approximately 20% (e.g., 20%, 20-30%, 20-40%, 20-50%, 15-25%, 10-30%, at least 20%) greater than the height H2 of the central portion 15036 or approximately 16 inches (e.g., 16 inches, 15-17 inches, 14-18 inches, at least 15 inches, at least 16 inches, no more than 18 inches, no more than 20 inches) in height. The vertical distance H4 between the uppermost and lowermost apertures 15080*a* for mounting the legs 15072 to the wall assembly 15004 is greater than the height H2 of the central portion 15036 and approximately 14 inches (e.g., 14 inches, 13-15 inches, at least 13 inches) in height with the uppermost aperture 15080 positioned at a vertical height above the central portion 15036. The achievable heights of various portions of the faceplate 15028 are maximally bounded by the available space within the wall assembly and may therefore be limited in height to, for example, eight feet, ten feet, or twelve feet.

In addition, the legs 15072 extend a distance H5 approximately 4.5 inches (e.g., 4.5 inches, 4-5 inches, 3.5-5.5 inches, 3-6 inches, at least 4 inches, at least 4.5 inches) above the top of the central portion 15036. Written another way, approximately 30% (e.g., 30%, 25-35%, 20-40%, at least 20%, at least 25%) of the height of the legs 15072 extends above the top of the central portion 15036. The extended leg height further counteracts the cantilevered forces applied to the face plate 15028. The overall height of the faceplate 15028 is a combination of the height H2 of the central portion 15036 and the height H5 of the legs 15072 above the central portion 15036. If the legs 15072 were to extend below a bottom surface of the central portion 15036, the overall height would additionally include any such height. In some embodiments, as shown, the overall height of the faceplate 15028 is approximately 17.5 inches (e.g., 17.5 inches, 17-18 inches, 16-19 inches, 15-20 inches, 15-22 inches). In some embodiments, the overall height of the faceplate 15028 does not exceed 18 inches. In other embodiments, the overall height of the faceplate 15028 does not exceed 20 inches. In yet other embodiments, the overall height of the faceplate 15028 does not exceed 22 inches.

Figure 142C:
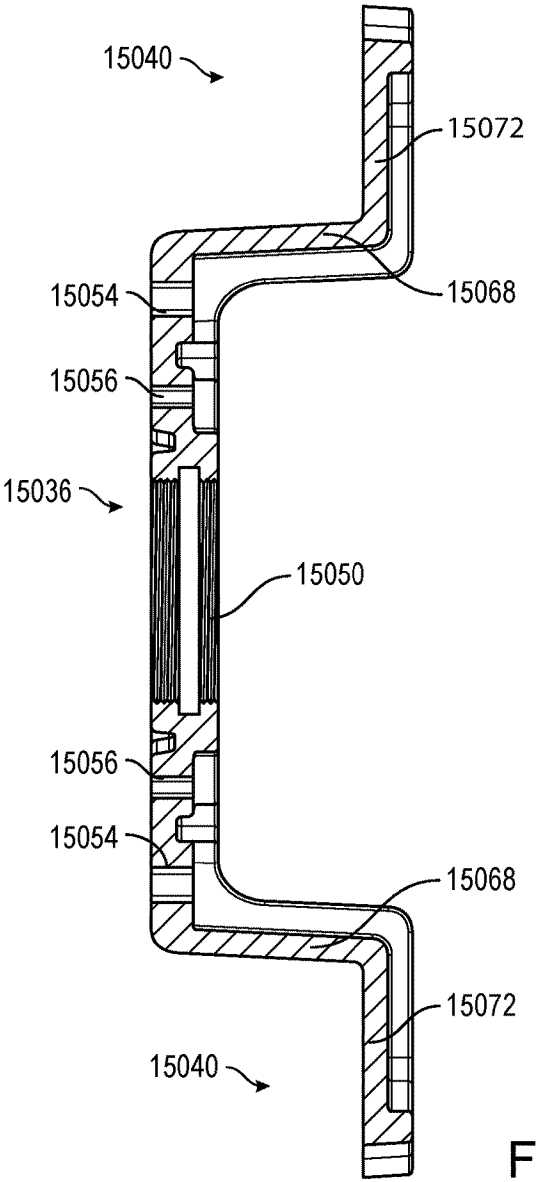
Figure 142D:
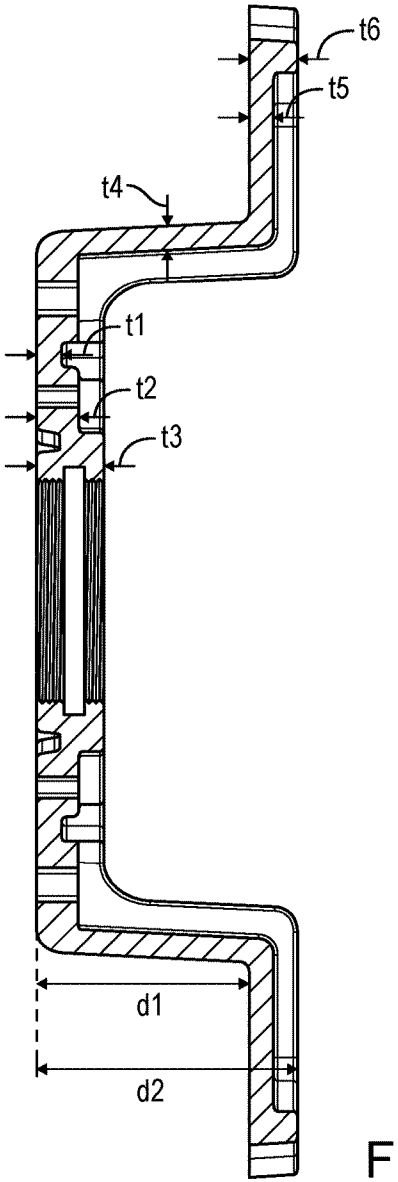

With reference to FIGS. 142C-142D, the central portion 15036 and the side portions 15040 of the faceplate have varying thicknesses, with six different thicknesses t1-t6 being labeled at the cross-section shown in FIGS. 142C-142D. As shown, this cross-section generally extends through the central axis of the mounting apertures 15054, 15056 and the fluid passageway 15050. A first thickness t1 (e.g., 0.375", 0.25"-0.50") of the central portion 15036 corresponds to a thickness of the central portion 15036 absent any bosses (e.g., for apertures/mounting holes, etc.) or stiffening ribs. A second thickness t2 (e.g., 0.625", 0.50"-0.75") of the central portion 15036 corresponds to a thickness of the central portion surrounding some through-holes, such as the mounting apertures 15054, 15056. The second thickness t2 is greater than the first thickness t1. A third thickness t3 (e.g., 1.0"-1.5") of the central portion 15036 corresponds to the thickness of the stiffening ribs 15222 and the mounting hub 15092. The third thickness t3 is greater than the second thickness t2. The thickness of the stiffening ribs 15222 may be the similar or dissimilar from the thickness of the mounting hub 15092, each having a thickness within the prescribed range and thicker than the second thickness t2.

With continued reference to FIGS. 142C-142D, the first leg 15068 of the side portions 15040 has a fourth thickness t4 (e.g., 0.375", 0.25"-0.50") that is similar to (e.g., the same, within ⅛" of) the first thickness t1 of the central portion 15036. The second leg 15072 of the side portions 15040 has a fifth thickness t5 (e.g., 0.375", 0.25"-0.50") that corresponds to a majority of the second leg 15072 and is similar to the first and fourth thicknesses t1, t4. The first and second legs 15068, 15072 further have a sixth thickness t6 (e.g., 0.75"-1.0") corresponding to the stiffening ribs 15222 located at the outer edge.

The L-shaped side portions 15040 result in a planar offset distance d1 (e.g., 3.625", 3"-4") between forward facing sides of the substantially parallel central portion 15036 and the second legs 15072. The planar offset distance d1 is substantially (e.g., at least two times, at least three times) greater than the thickness t3 of the thickest portion of the central portion 15036 or the thickness t6 of the thickest portion of the second leg 15072. A planar offset distance d1 of such great size (relative to the thickness of the faceplate) is accomplished by connecting the central portion 15036 to the second legs 15072 via the first legs 17068. The planar offset distance d1 may be similar to (e.g., +–0.25", +–0.5", +–0.75", +–1.00") the depth 15037 of the vertical wall member 15020 (FIG. 129B) such that when the forward face of the second leg 15072 abuts the rear of the vertical wall member 15020, the forward face of the central portion 15036 is aligned with (e.g., +–0.25", +–0.5", +–0.75", +–1.00") or at least nearer to the front of the vertical wall member 15020. In some embodiments, the distance d1 is at least 90% (e.g., 90%+, 95%+, 100%) the depth 15037 of the vertical wall member 15020. The overall depth d2 (e.g., 4", 3"-5", at least 3.5") of the faceplate 15028 is greater than the planar offset distance d1 by the thickness t6 of the second leg 15072. The overall depth d2 may be, for example, 20%, 15%-25%, 10%-30% thicker than the planar offset distance d1.

As shown in FIGS. 129A-129B, the carrier assembly 15000 also includes an outlet connector 15032 couplable to the fluid passageway 15050 of the faceplate 15028 to form a water-tight connection therewith. More specifically, the outlet connector 15032 is configured to be coupled to and establish a fluid connection between the water closet (e.g., via the fluid passageway 15050 and fluid coupler 15062) and the plumbing system of the corresponding building. In the illustrated embodiment, the outlet connector 15032 includes an elongated tube having a first end 15108 forming a mounting flange 15112 sized and shaped to correspond with the mounting hub 15092 of the faceplate 15028, and a second end 15116 forming a portion of an outlet pipe opposite the first end 15108. As shown in FIG. 129B, the outlet connector 15032 includes a bend therein to form a generally "J" shaped pipe such that the first end 15108 is set approximately 90 degrees from the second end 15116. When installed, the second end 15116 of the outlet connector 15032 is configured to be attached to a wastepipe of the building's plumbing system. The illustrated outlet connector 15032 is "J" shaped and produces a fluid connection between the water closet and the building's plumbing system.

The mounting flange 15112 of the outlet connector 15032 is configured so that it can be coupled to the mounting hub 15092 of the faceplate 15028 in a plurality of different orientations while maintaining fluid communication with the fluid passageway 15050 and a fluid tight seal with the faceplate 15028 in each position. More specifically, both the mounting flange 15112 and the mounting hub 15092 include corresponding annular sealing surfaces 15096*a*, 15096*b* and mounting elements 15100*a*, 15100*b* so that the outlet connector 15032 can be mounted to the faceplate 15028 into any position where the mounting elements 15100*a* of the outlet connector 15032 align with the mounting apertures 15100*b* of the faceplate 15028. As such, the number and position of mounting elements 15100*a*, 15100*b* defines the number of "mounting positions" that are possible between the two elements. In the illustrated embodiment, four mounting elements 15100*a*, 15100*b* are present in both components spaced 90 degrees apart. As such, the outlet connector 15032 can be coupled to the faceplate 15028 in four orientations spaced 90 degrees apart (e.g., so that the second end 15116 of the outlet connector 15032 is facing vertically up, vertically down, horizontally right, and horizontally left). However, in alternative embodiments more or fewer mounting elements 15100*a*, 15100*b* may be present to permit more or fewer mounting positions (e.g., eight mounting elements 15100*a*, 15100*b* allowing eight mounting locations spaced 45 degrees apart, or two mounting elements 15100*a*, 15100*b* allowing two mounting locations spaced 180 degrees apart, and the like). In still other embodiments, the number of mounting elements 15100*b* on the output connector 15032 may not match the number of mounting elements 15100*a* on the mounting hub 15092. In such embodiments, the mounting elements 15100*a*, 15100*b* are multiples of each other so that a plurality of mounting orientations may be present.

Figure 120:
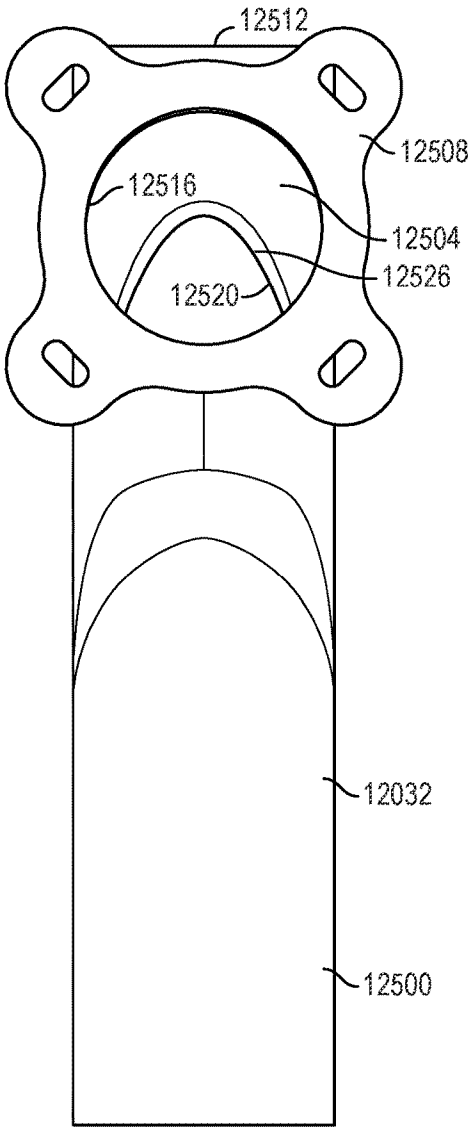
Figure 121:
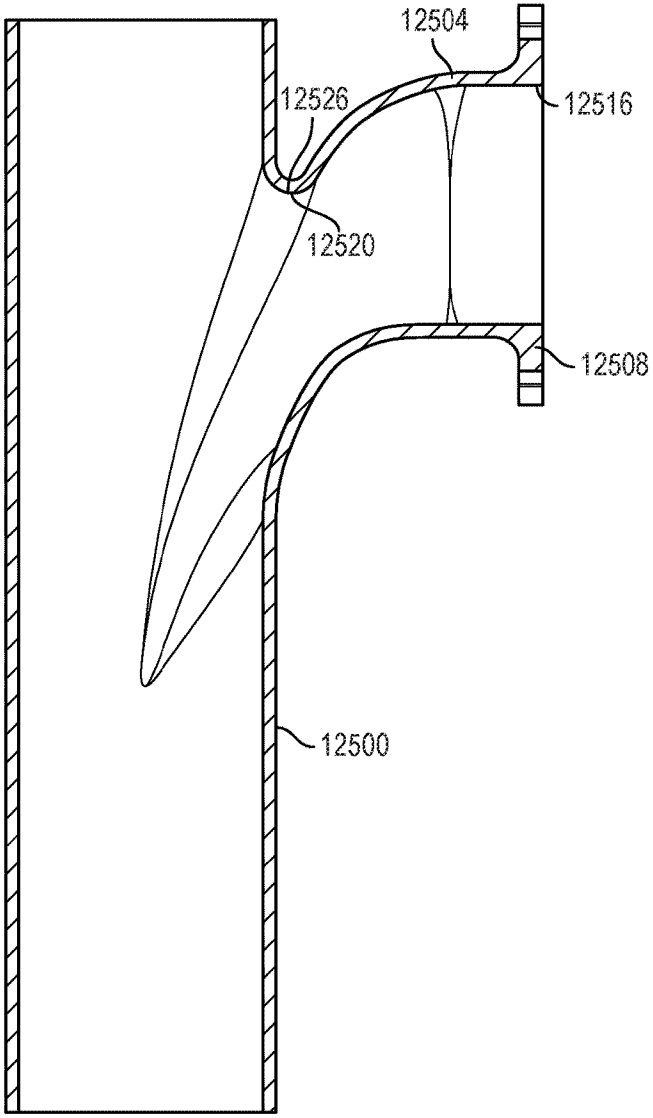

In the illustrated embodiment, the mounting elements 15100*a* of the faceplate 15028 include threaded apertures while the mounting elements 15100*b* of the outlet connector 15032 include slots 15132 so that fasteners passing through the slots 15132 and received within the threaded apertures can be used to couple the fluid coupler 15032 to the faceplate 15028. More specifically, the slots 15132 of the outlet connector 15032 are elongated so that the outlet connector 15032 can be rotated a few degrees in each direction at a particular mounting location. For example, if the outlet connector 15032 is mounted to the faceplate 15028 so that the second end 15116 is located at the 3 o'clock position (e.g., at 90 degrees), the outlet connector 15032 may further be rotated a few degrees clockwise and counterclockwise from that position (e.g., between 85 to 95 degrees). In some embodiments, such as those shown in FIGS. 129A-140C, the slots 15132 are open and located at the perimeter of the flange 15112. In other embodiments, such as shown in FIG. 120, at least some (e.g., two, four) of the slots 15132 are closed slots located within and not defined by the periphery of the flange 15112.

This capability is present at each of the four possible mounting locations (e.g., between 175 and 185 degrees if mounted at the 6 o'clock position, and the like) and allows the outlet pipe of the outlet connector 15032 to slope downwards when in the left or right orientations to encourage fluid flow through the outlet connector 15032 away from the water closet. A slope of 1/16 inch per foot corresponds to a rotational angle of 0.3 degrees relative to horizontal. If the desired pitch of the outlet pipe of the outlet connector 15032 corresponds to 1/16 inch per foot, the slots 15132 of the outlet connector 15032 allow for at least 0.6 degrees of total rotation. A slope of 1/8 inch per foot corresponds to a rotational angle of 0.6 degrees relative to horizontal. If the desired pitch of the outlet pipe of the outlet connector 15032 corresponds to 1/8 inch per foot, the slots 15132 of the outlet connector 15032 allow for at least 1.2 degrees of total rotation. A slope of 1/4 inch per foot corresponds to a rotational angle of 1.2 degrees relative to horizontal. If the desired pitch of the outlet pipe of the outlet connector 15032 corresponds to 1/4 inch per foot, the slots 15132 of the outlet connector 15032 allow for at least 2.4 degrees of total rotation. Such rotatable adjustments allow the same outlet connector 15032 to be oriented in the left orientation and the right orientation and still have the ability to slope downward at the desired angle. Larger slots 15132 permitting larger rotational angles (e.g., at least 3 degrees, at least 4 degrees, at least 5 degrees, at least 6 degrees, at least 7 degrees, at least 8 degrees, at least 9 degrees, at least 10 degrees, at least 15 degrees of total rotation) result in a larger range of angles at which the outlet connector 15032 can be sloped. In some embodiments, the slots 15132 allow for at least 3.7 degrees of rotation in each direction such that the outlet connector 15032 can be sloped at least 0.75" per foot.

In contrast to the slots shown and described with respect to FIG. 96, the slots 15132 are open slots, each being open at the radially outer edge of the slot 15132. The slots 15132 form a portion of the periphery of the mounting flange 15112 and can alternatively be described as elongated recesses in the periphery of the mounting flange 15112. Utilizing open slots 15132 as opposed to the closed slots shown in FIG. 96 allows an installer to more easily align the outlet connector 15032 relative to the faceplate 15028. With the lower two fasteners 15562 threaded partially (not to their full installed depth) into the faceplate 15028, the outlet connector 15032 is lowered onto the two fasteners 15562 such that the fasteners 15562 rest within the elongated slot 15132, providing a lower stop that will both align the outlet connector 15032 with the fluid passageway 15050 and bear at least a portion of the weight of the outlet connector 15032. With the outlet connector 15032 in place, the upper slots 15132 are also aligned with the upper apertures 15534.

The outlet connector 15032 is rotatable between positions in which the fluid from the water closet is drained to the left, to the right, or vertically downward and any of these positions may be desirable based on the arrangement of the carrier assembly 15000 and/or the material of the floor onto which the carrier assembly 15000 is positioned. In other systems, separate couplers (i.e., a vertical coupler, a left coupler, a right coupler) are required based on the desired fluid flow direction as the vent of the coupler must be oriented upwards and positioned above the flow of fluid through the coupler and the mount oriented to provide the necessary slope in the outlet itself for example, 1/8" or 1/4" per foot. If an installer attempts to install a prior art left-extending coupler such that it extends to the right, the vent extends downwards and the drainage pipe is pitched upwards. The outlet connector 15032 does not suffer from these drawbacks and can be installed in left, right, or vertical orientations. As such, a single outlet connector 15032 can be used in installations of any such orientations and even re-used if mounting conditions change.

Figure 130B:
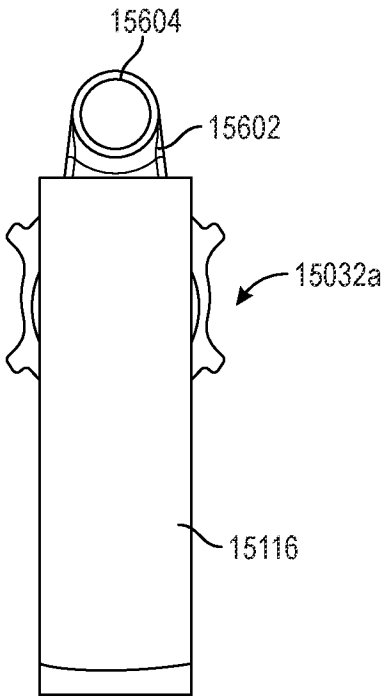
FIGS. 130A-140C illustrate various embodiments of fluid couplers.
Figure 130A:
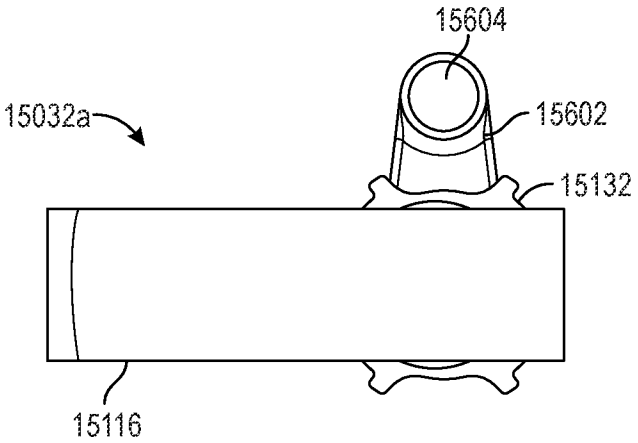
Figure 130C:
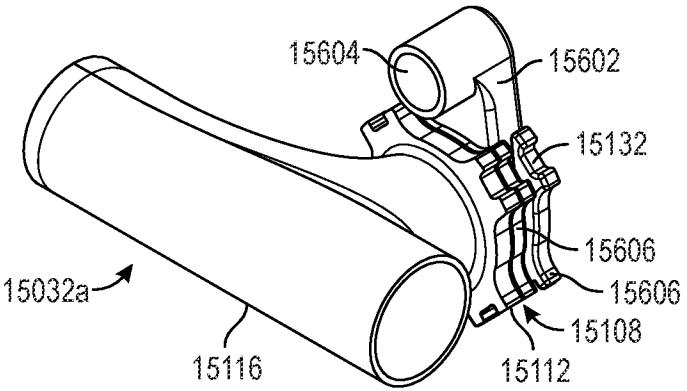
Figure 130E:
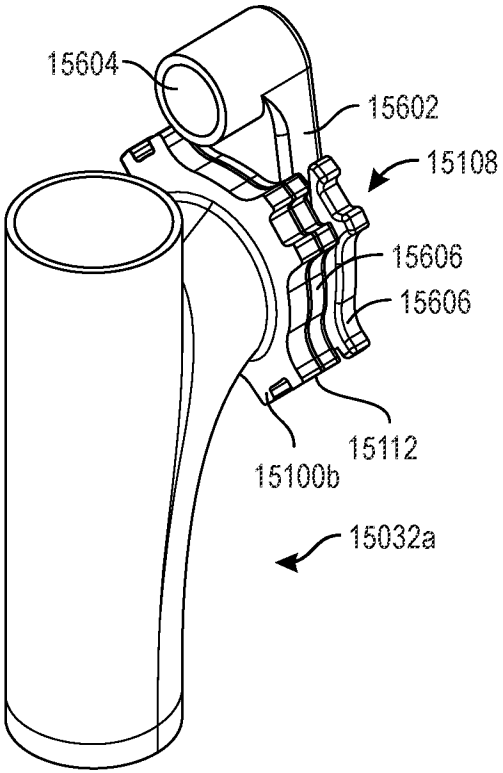
Figure 130D:
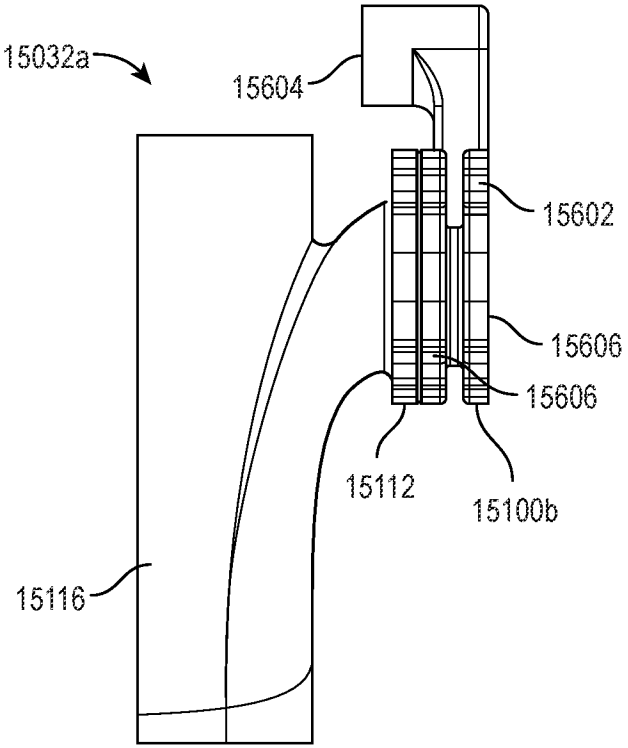
Figure 131B:
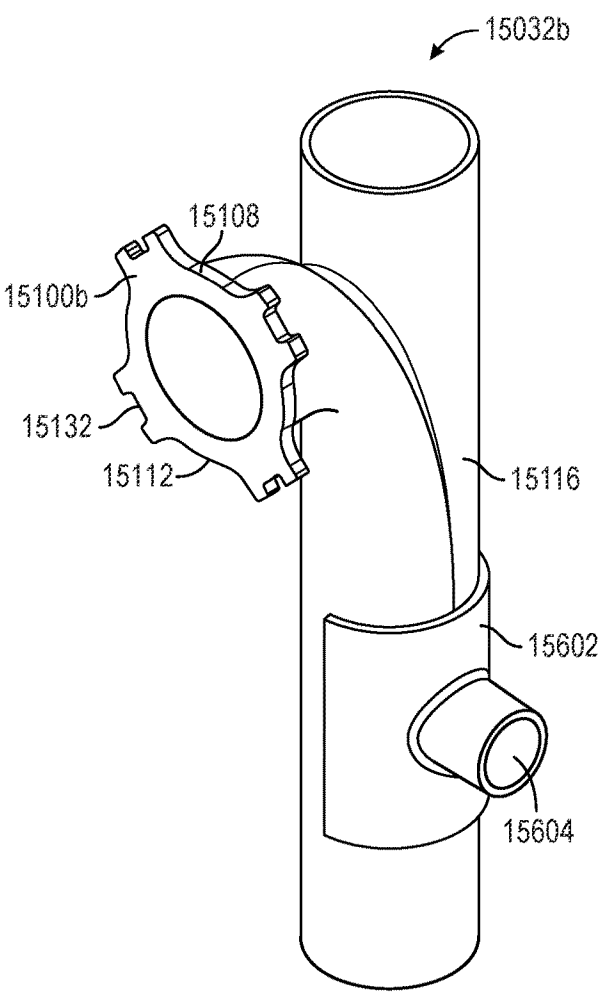
Figure 131A:
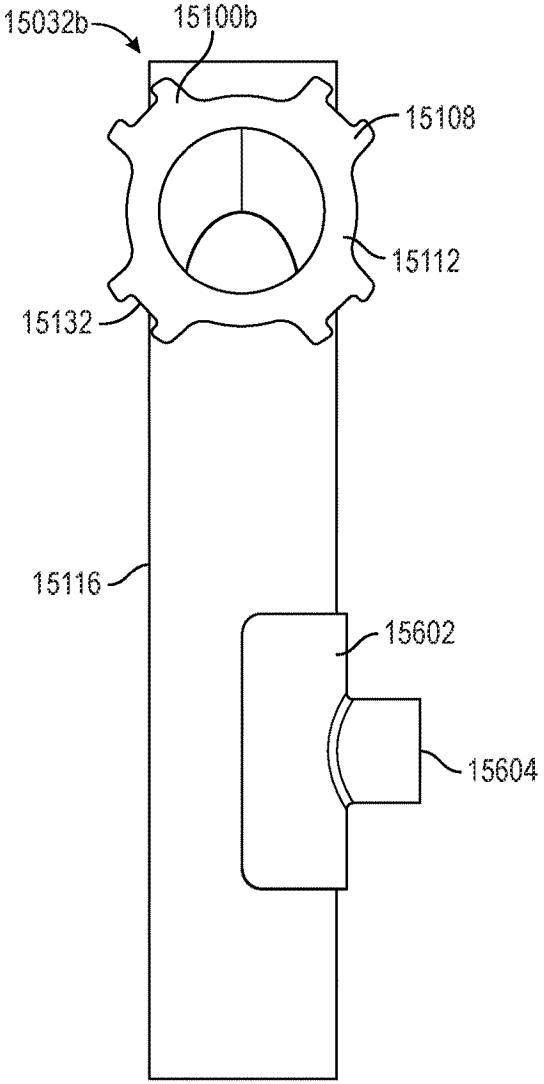

Various embodiments of outlet connectors 15032 are illustrated in FIGS. 130A-140B and 143-144 and are differentiated from one another based on an alphabetical suffix of the reference numeral (e.g., the fluid coupler illustrated in FIGS. 130A-130E is outlet connector 15032*a* and the outlet connector illustrated in FIGS. 131A-131*b* is outlet connector 15032B). Each outlet connector is similar to others described herein, except as described below.

The outlet connector 15032*a* illustrated in FIGS. 130A-130E is similar to the J-shaped fluid coupler 15032 illustrated in FIGS. 129A-129B but includes a separate vent body 15602 that, when installed, is sandwiched between the faceplate 15028 and the main body of the outlet connector 15032*a*. More specifically, the vent body 15602 includes a vent passage 15604 extending radially outwardly and away from a central body that, in turn, includes a first flange portion 15606 configured to engage and form a water-tight connection with the flange portion 15112 of the outlet connector 15032*a* and a second flange portion 15606 configured to form a water-tight connection with the faceplate

15028. As shown in FIG. 130C, the vent passage 15604 forms an L-shaped passage with an outlet that is parallel to the axis of the central body. Seals or gaskets may be located at these the two flange portions 14606.

As the vent body 15602 is a separate component from the outlet connector 15032*a* and the mating surfaces are rotationally identical, the vent body 15602 can be coupled to the fluid coupler in multiple different arrangements as shown in the differences between FIGS. 130C and 130E. When the outlet connector 15032*a* is rotated into a left orientation, the vent body 15602 can be coupled so that the vent passage 15604 vents vertically above the outlet connector 15032*a*. When the outlet connector 15032*a* is rotated into a right orientation, the vent body 15602 can be coupled so that the vent passage 15604 vents vertically above the outlet connector 15032*a*. When the outlet connector 15032*a* is rotated into a vertical orientation, the vent body 15602 can be coupled so that the vent passage 15604 vents vertically above the outlet connector 15032*a*. As such, the outlet connector 15032*a* in combination with the vent body 15602 can be used in any desired orientation.

The outlet connector 15032*b* illustrated in FIGS. 131A-131B includes a separate vent body 15602 formed as a saddle joint that can be coupled to the outlet connector 15032*b* at any rotational position along the cylindrical body of the outlet connector 15032*b*. The vent body 15602 defines a vent passage 15604 that can provide access to the interior of the outlet connector via a drilling process after the vent body 15602 is coupled to the outlet connector 15032*b*. By orienting the vent passage 15604 at the desired location and orientation, the outlet connector 15032*b* can be utilized in either of the left or right orientations.

The outlet connector 15032*c* illustrated in FIGS. 132A-132D includes a separable vent body 15602 defining a vent passage 15604 and located upstream of the outlet pipe 15116 and coupled to the outlet pipe 15116 via a connection of two mating flanges 15610, 15612. Similar to the flanged connection of the outlet connector 15032*a*, the vent body 15602 is capable of connecting to the outlet connector 15032*c* at four distinct locations based on the attachment pattern of the flanges 15610, 15612. As such, the outlet connector 15032*c* is capable of coupling to the faceplate 15028 in left, right, or vertical orientations.

Figure 133A:
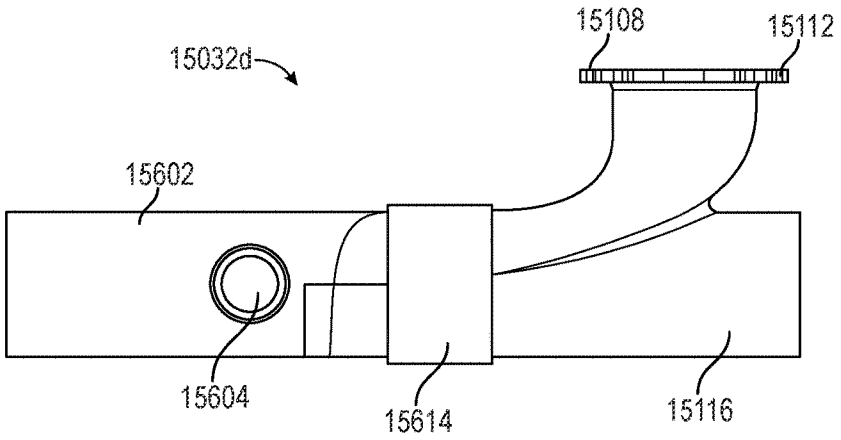
Figure 133B:
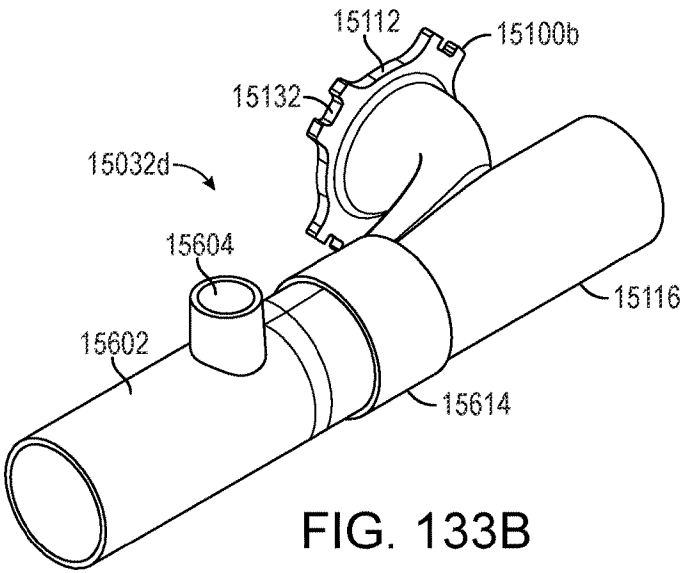

The outlet connector 15032*d* illustrated in FIGS. 133A-133B includes a separable vent body 15602 defining a vent passage 15604, located downstream of the outlet pipe 15116, and coupled to the outlet pipe 15116 via a no hub band 15614. The no hub band 15614 is configured to couple the vent body 15602 to the coupler 15032*d* when the vent body 15602 is in any rotated position (rotation about its central axis) relative to the outlet connector 15032 such that the vent passage 15604 is rotated into an upwards facing orientation when coupled to the outlet connector 15032*d*.

Figure 134B:
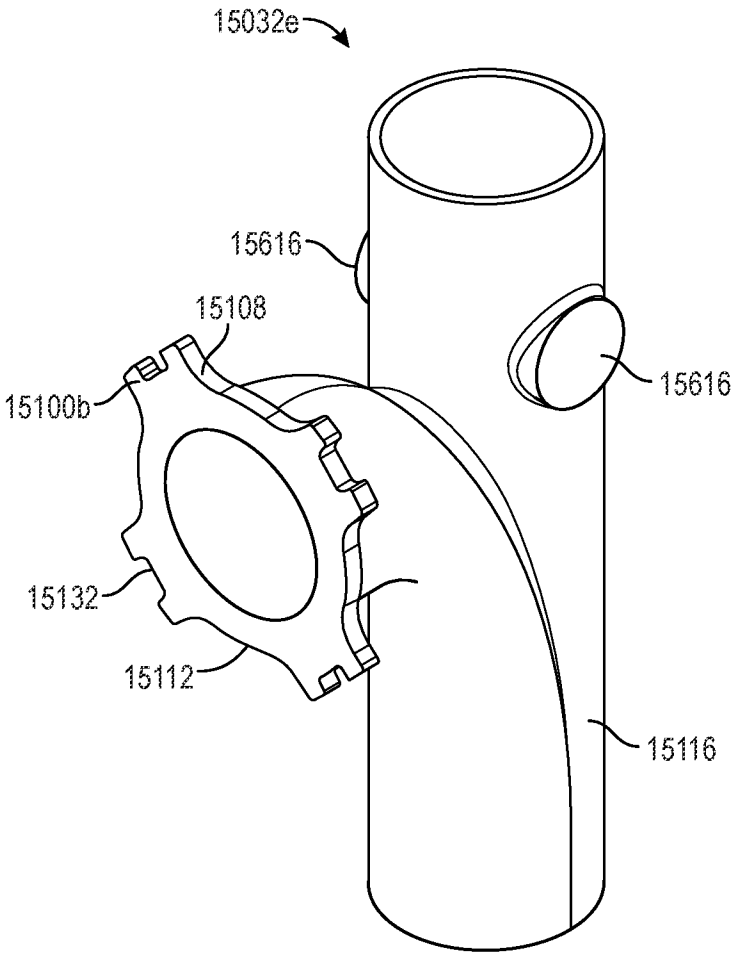
Figure 134A:
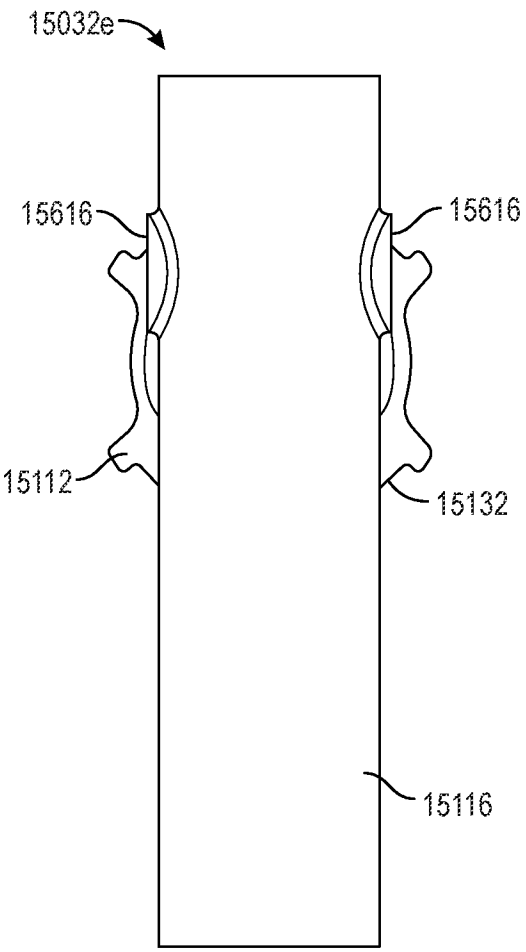
Figure 134C:
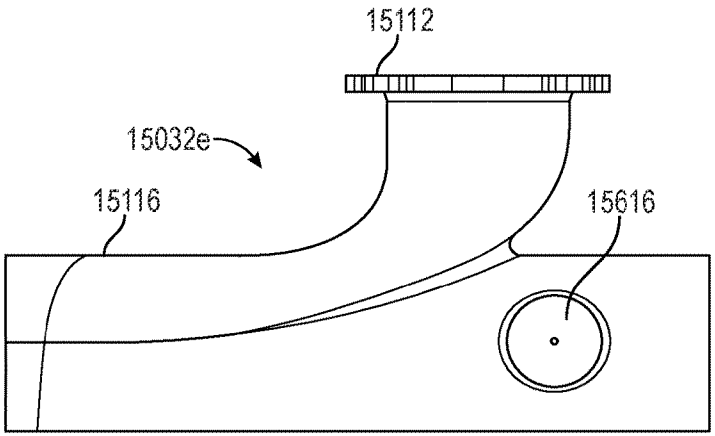

The outlet connector 15032*e* illustrated in FIGS. 134A-134C includes bosses 15616 that extend radially outward from the second end 15116 of the outlet connector 15032*e*. A vent passage (not shown) can be coupled to either of the bosses and the endcap of the boss 15616 can be drilled through to provide a vent passage therethrough. As the bosses 15616 are offset from one another by 180 degrees (located on opposite sides of the cylindrical pipe portion 15116), the installer can use the same outlet connector 15032*e* for either a leftward extending or rightward extending coupler by utilizing the appropriate boss 15616 as a vent.

Figure 135A:
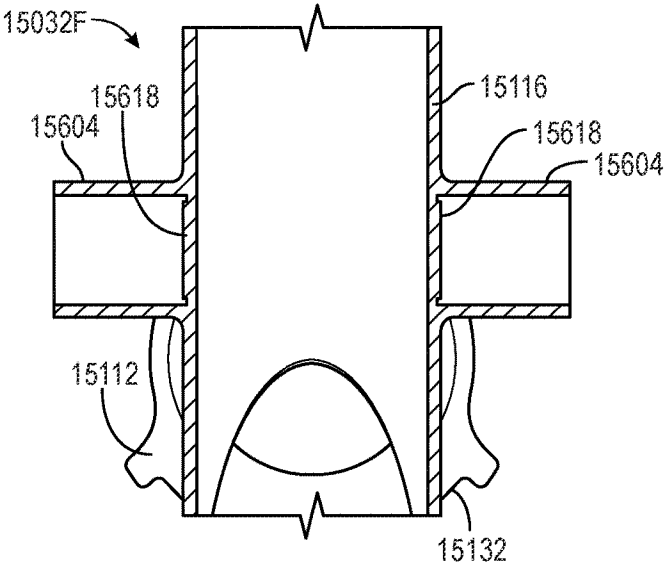
Figure 135B:
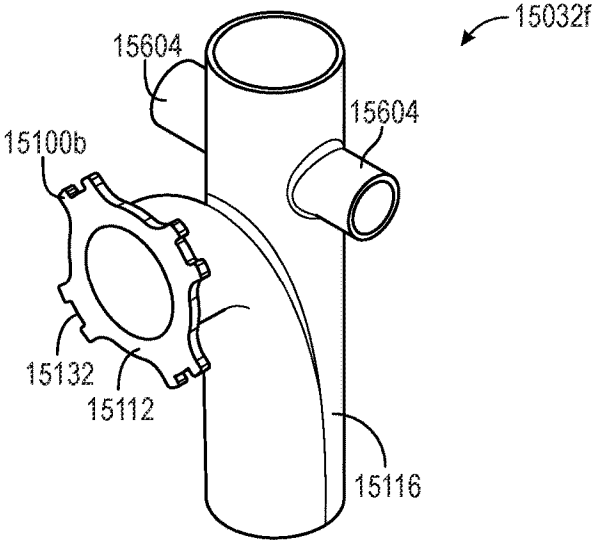
Figure 135C:
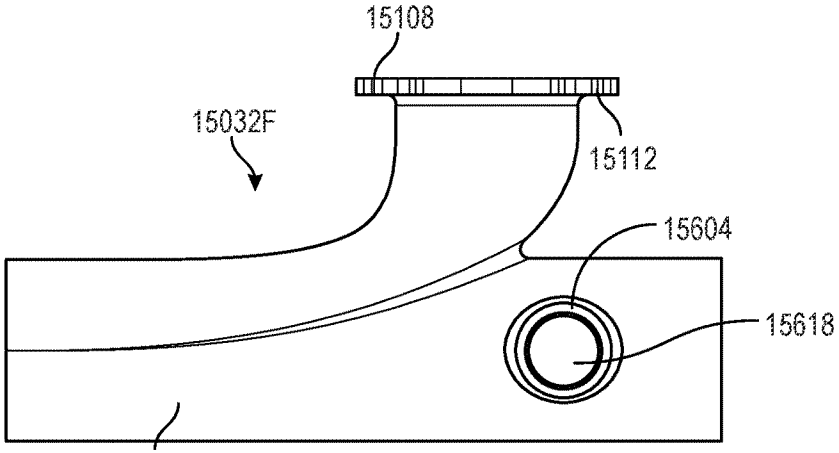
Figure 136B:
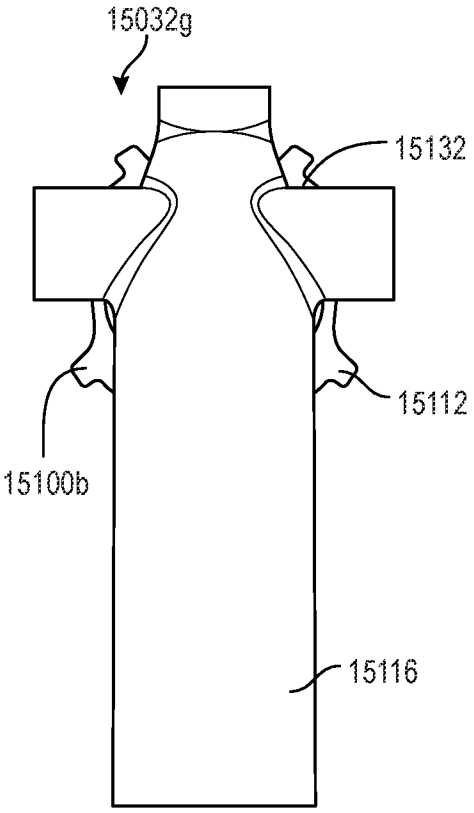
Figure 136A:
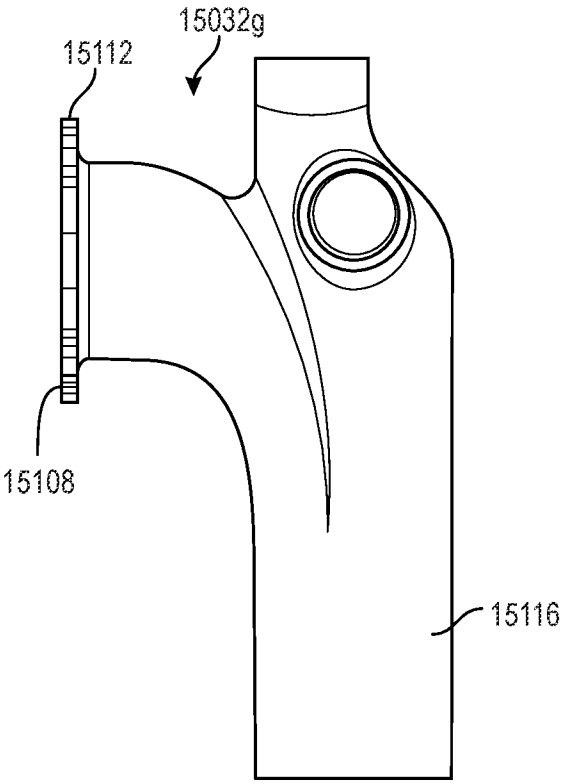
Figure 136D:
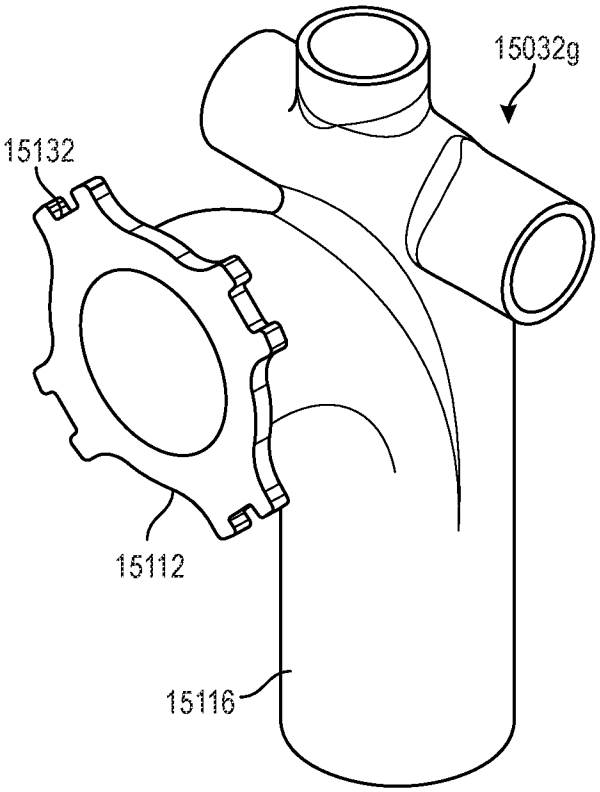
Figure 136C:
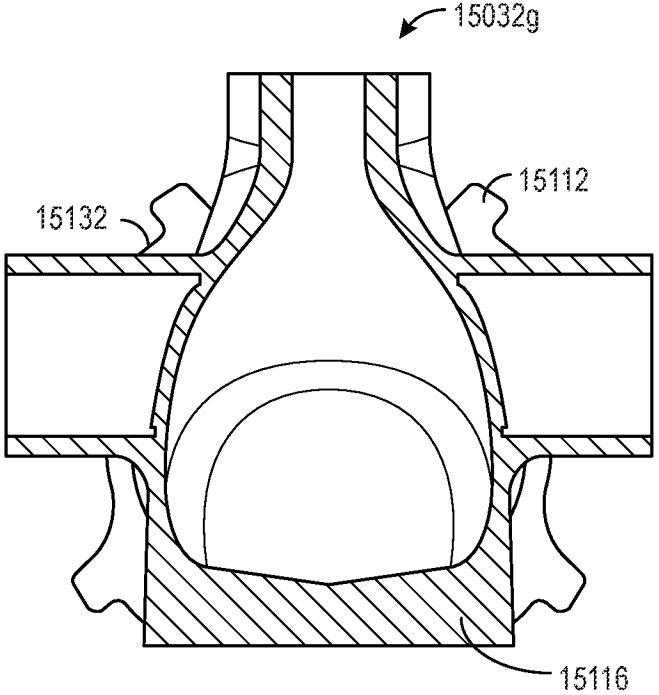
Figure 137B:
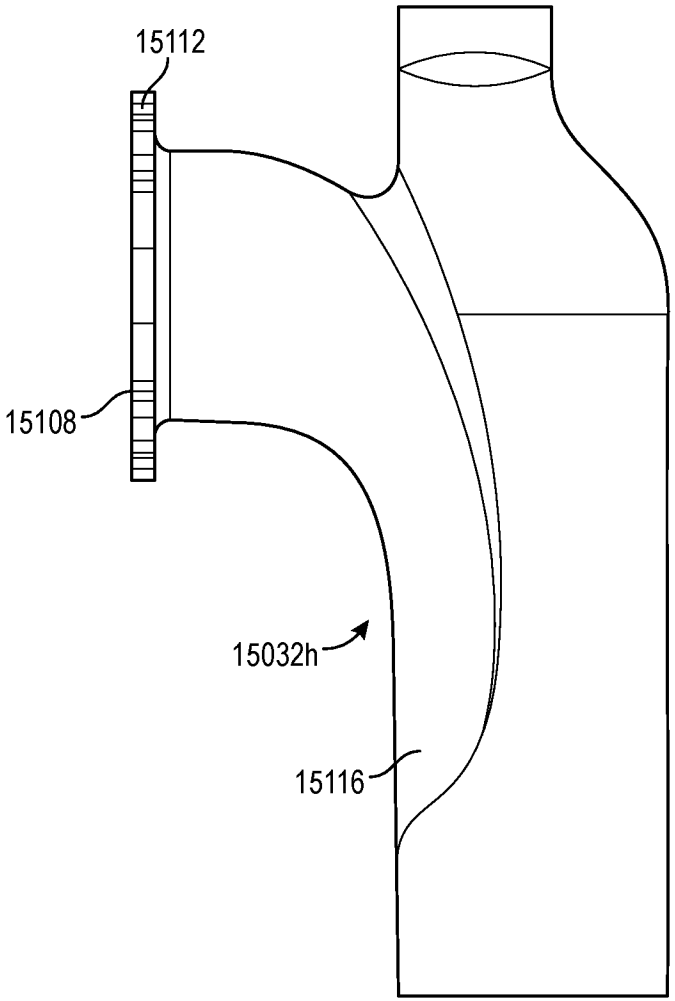
Figure 137A:
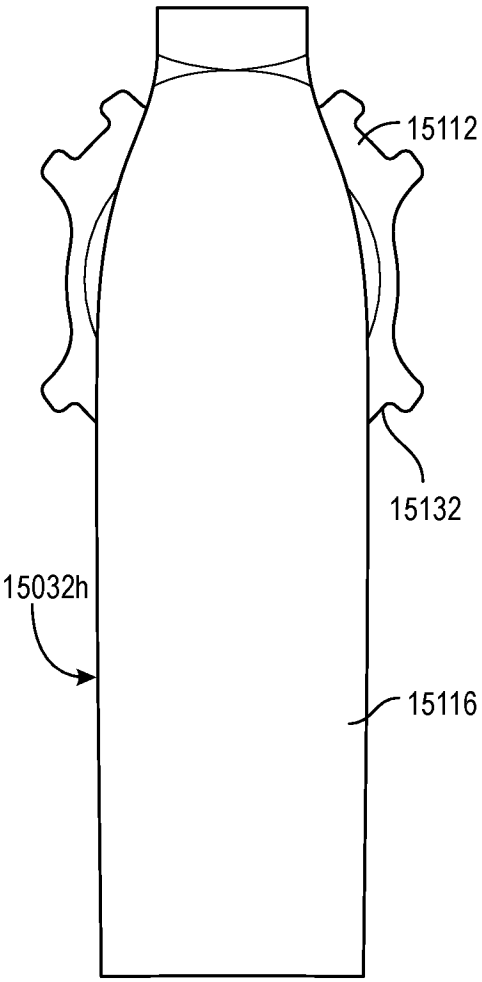
Figure 137C:
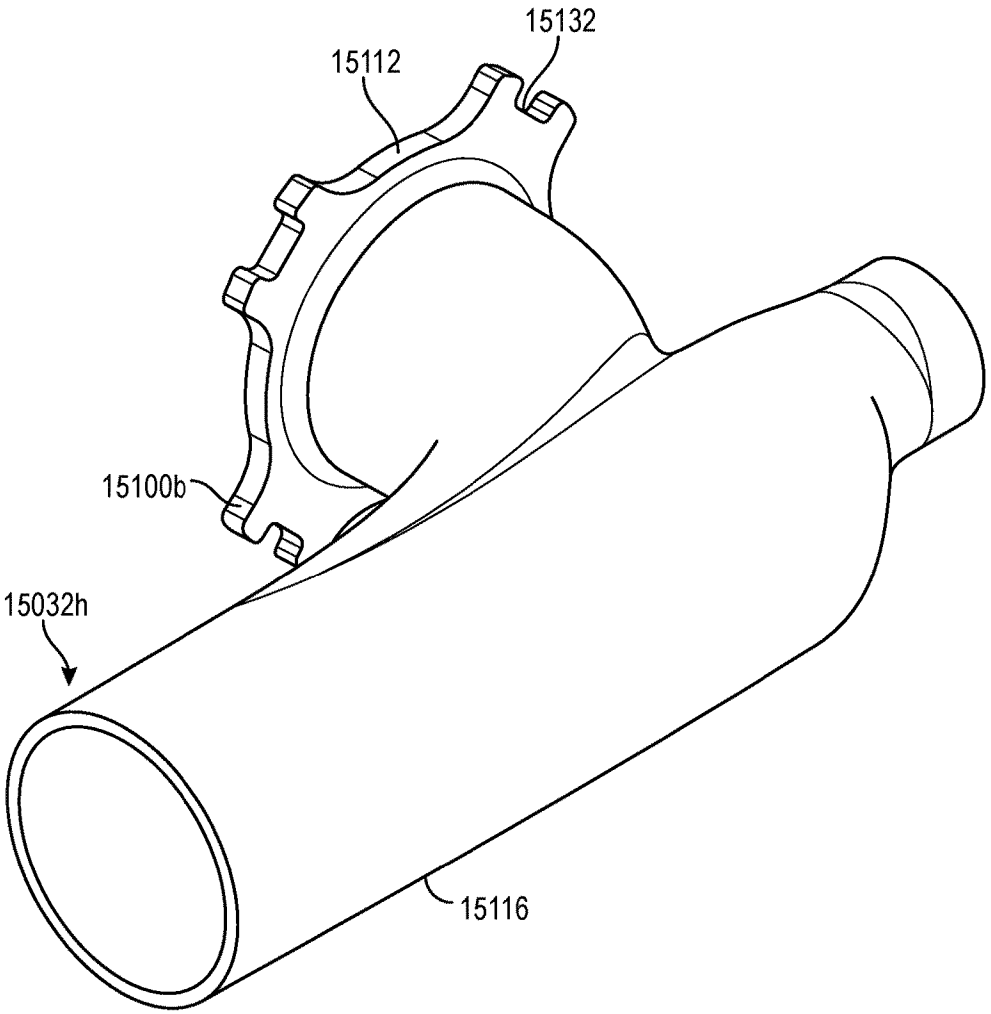

The outlet connector 15032*f* illustrated in FIGS. 135A-135C is similar to the outlet connector 15032*e* though instead of including boss features that can each mate with a vent passage, the vent passages 15604 are integrally formed with the second end 15116 at a location upstream of J-shaped junction. The vent passages 15604 are similarly on opposing sides such that one can be selectively opened to function as a vent. The vent passages 15604 are initially closed off by a plug 15618 that can be hammered out (or otherwise removed) to open the vent path 15604 to the remainder of the interior of the outlet connector 15032*f*. The plugs 15618 may include a thin-walled perimeter to define the breaking point for opening the vent path 15604.

Figure 139:
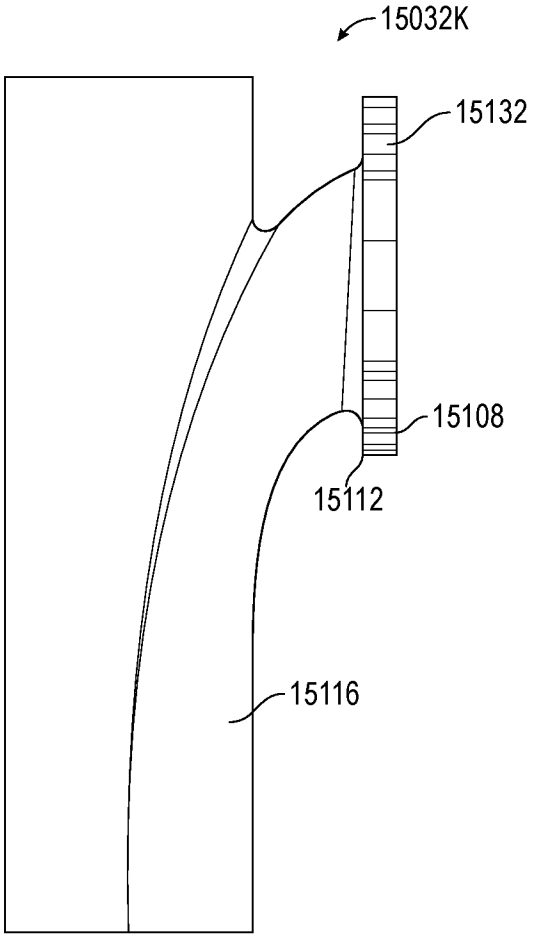

The outlet connector 15032*g* illustrated in FIGS. 136A-136D is similar to the outlet connector 15032*f* though an upstream portion of the outlet pipe 15116 has a reduced diameter (e.g., 2-inch diameter compared to a 4-inch diameter at the downstream portion) that is axially offset from the remainder of the outlet pipe 15116. The reduced diameter portion is located nearer to the flange 15112 such that the reduced diameter portion is located nearer to the wall assembly 15004 and may move into the wall cavity. The outlet connector 15032*h* illustrated in FIGS. 137A-137C omits a vent pipe though can be modified to include a vent pipe similar to those shown in FIGS. 130A-136D. The outlet connector 15032*k* illustrated in FIG. 139 is similar to the outlet connector 15032*h*, though the diameter of the upstream and downstream portions is consistent (e.g., 4-inch diameter).

Figure 132B:
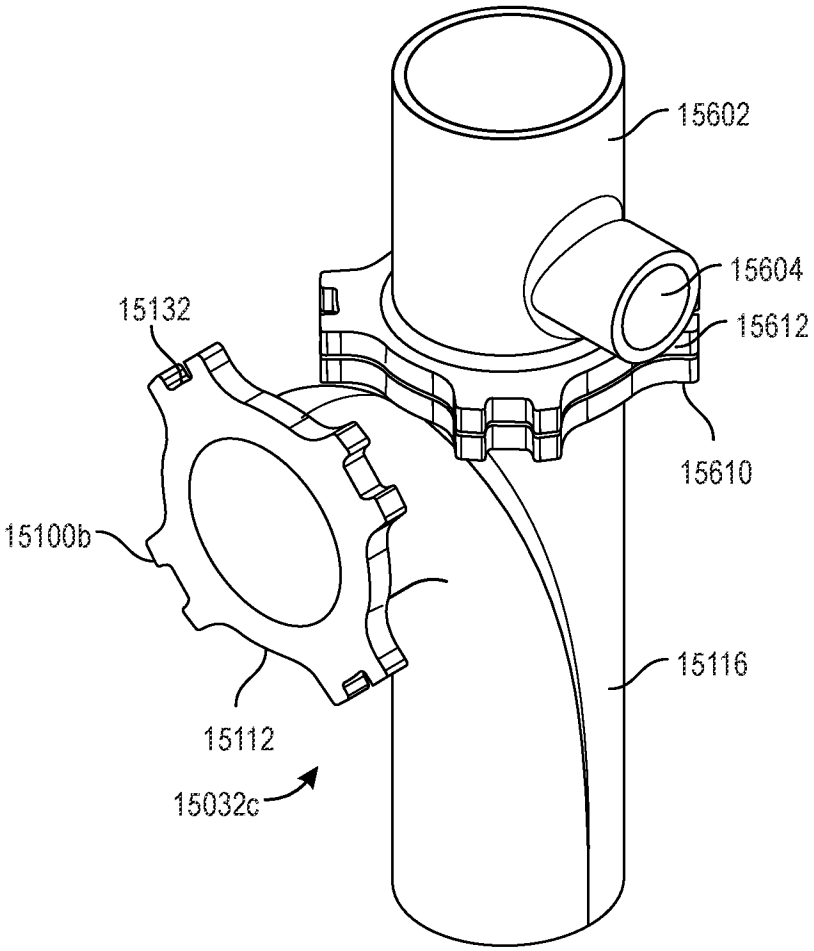
Figure 132A:
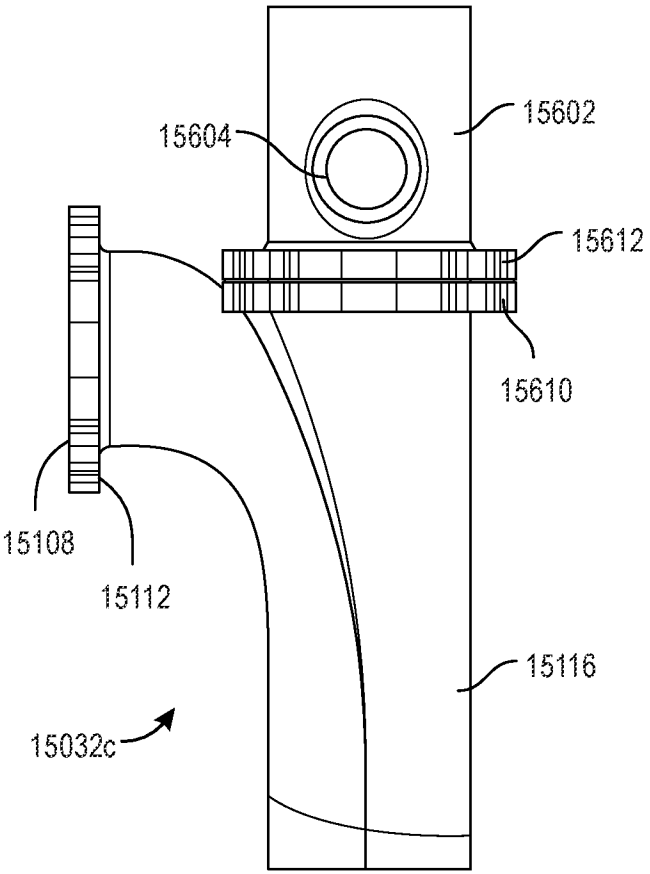
Figure 132D:
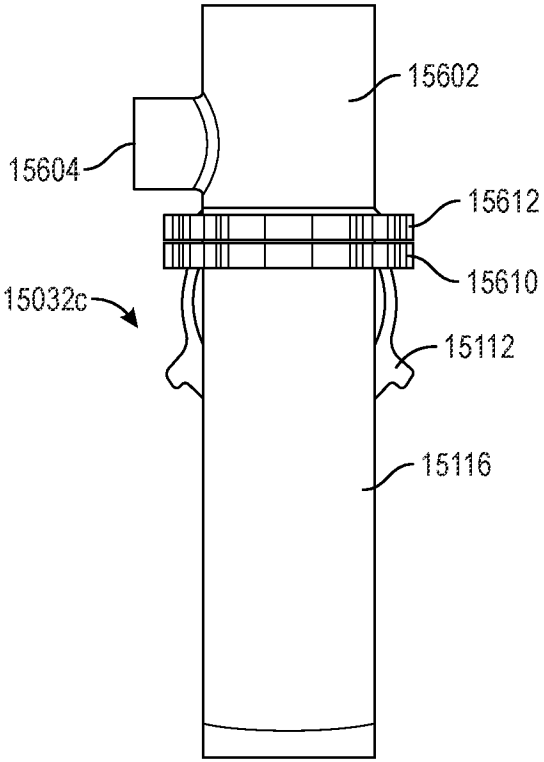
Figure 132C:
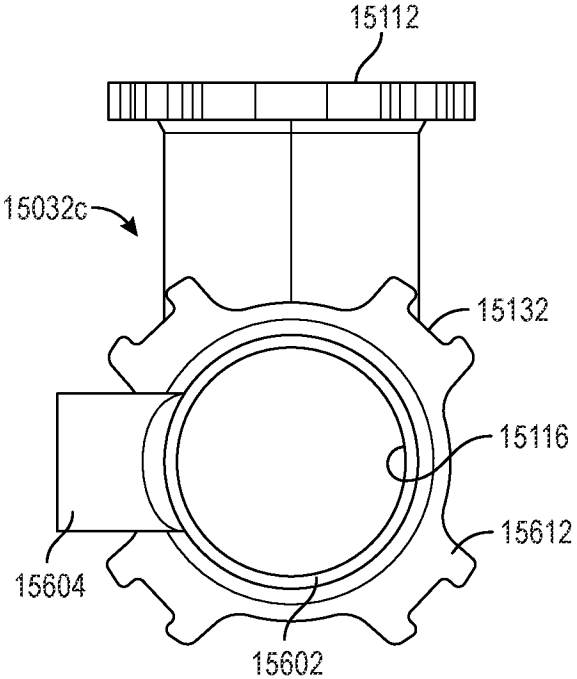
Figure 138A:
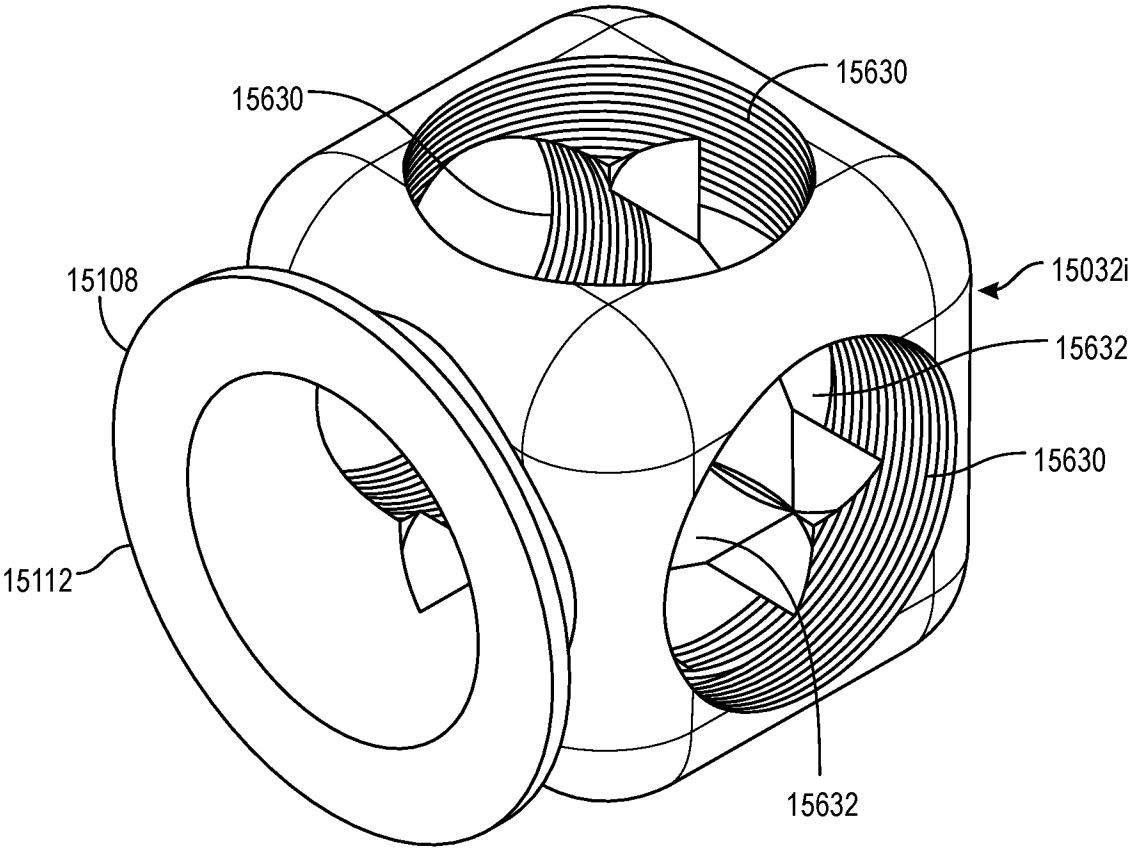
Figure 138D:
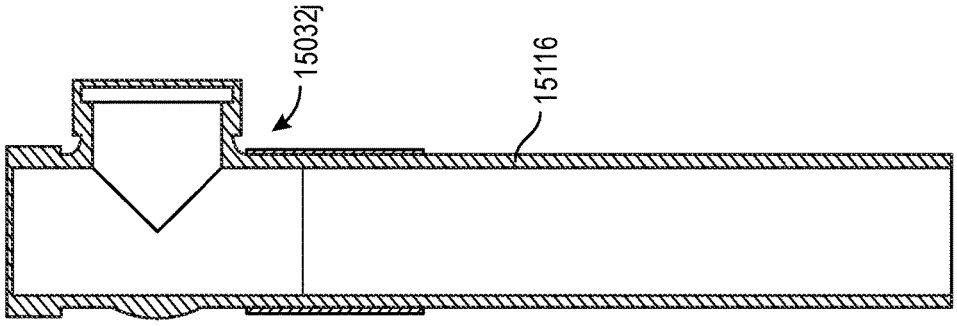
Figure 138C:
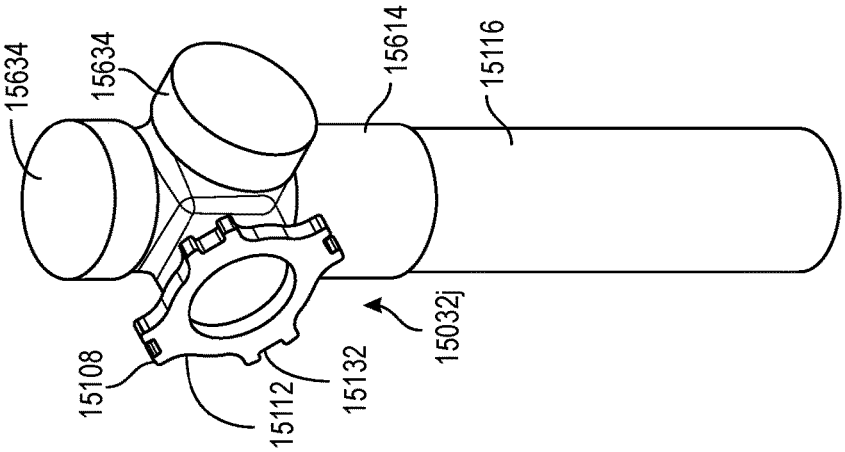
Figure 138B:
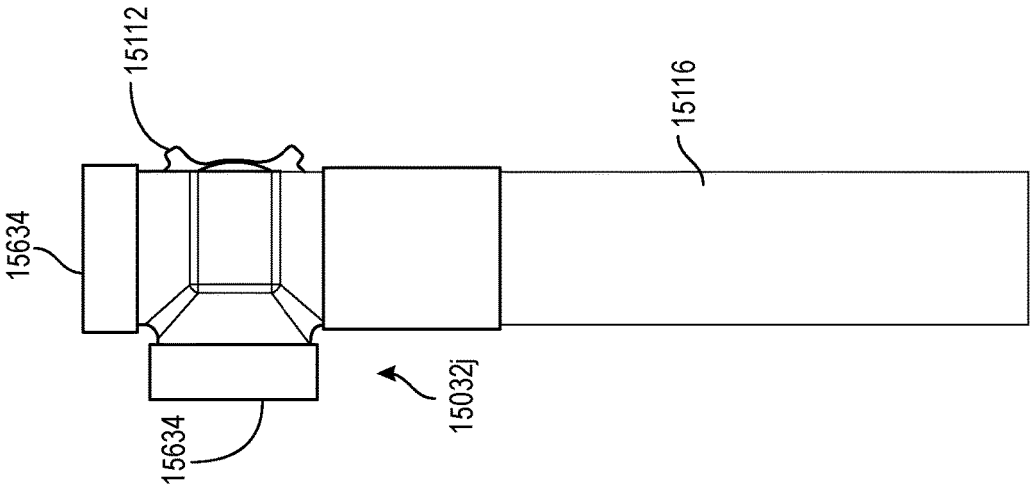

The outlet connector 15032*i*, 15032*j* illustrated in FIGS. 138A-132D is a modular cube having a flange 15112 for coupling to the faceplate 15028 and includes five other sides, some of which have openings 15630 (e.g., threaded openings), and others which have solid surfaces 15632. In the orientation shown in FIG. 138A, the front face of the cube is defined by the flange 15112, the rear face opposite the front face has a solid surface 15632. The opposing left and right sides define openings 15630 therein. The top surface defines an opening 15630 therein and the bottom surface opposite the top surface is defined by a solid surface 15632. The modularity of the outlet connector 15032*i*, 15032*j* allows an installer to couple upstream pipes, downstream pipes, vents, and/or plugs 15634 to the three openings 15630 in any configuration such that the outlet connector can direct the fluid flow in the appropriate direction. Additionally, while threaded openings 15630 are shown in FIG. 138A, non-threaded openings or cylindrical bosses may be used in combination with other attachment styles (e.g., no hub band 15614) to connect the modular cube to upstream pipes, downstream pipes, vents, and/or plugs 15634. Furthermore, while the illustrated embodiment has a cube shape with three apertures, it is understood that in other embodiments more or fewer apertures may be present. Furthermore, other shapes (e.g., an octagon, hexagon, and the like) may also be present to orient the apertures at different angular and special orientations with respect to each other.

Figure 140B:
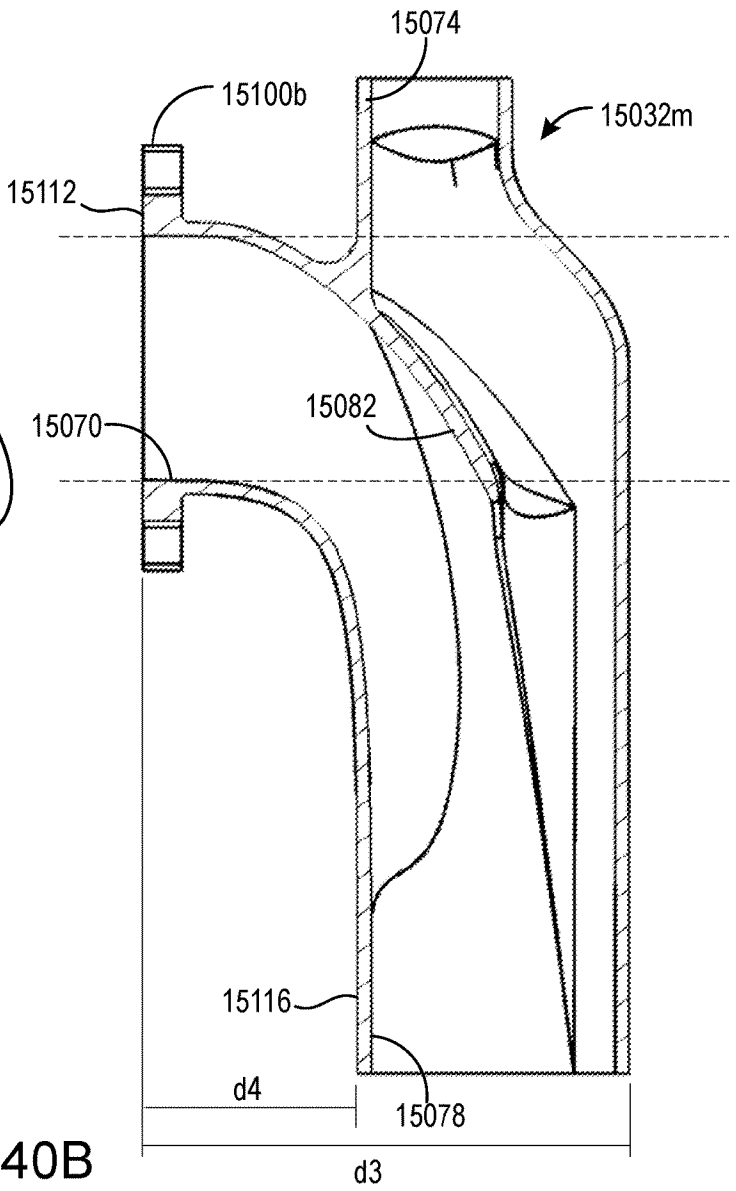
Figure 140A:
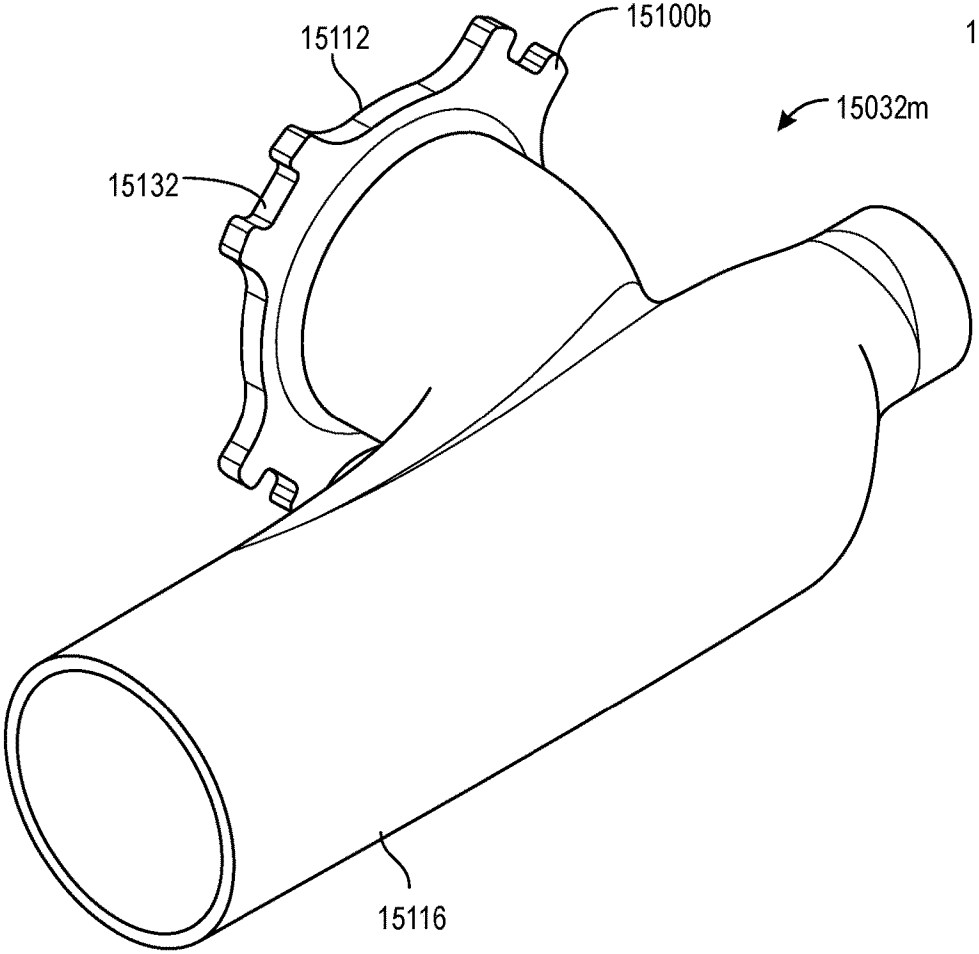
Figure 140C:
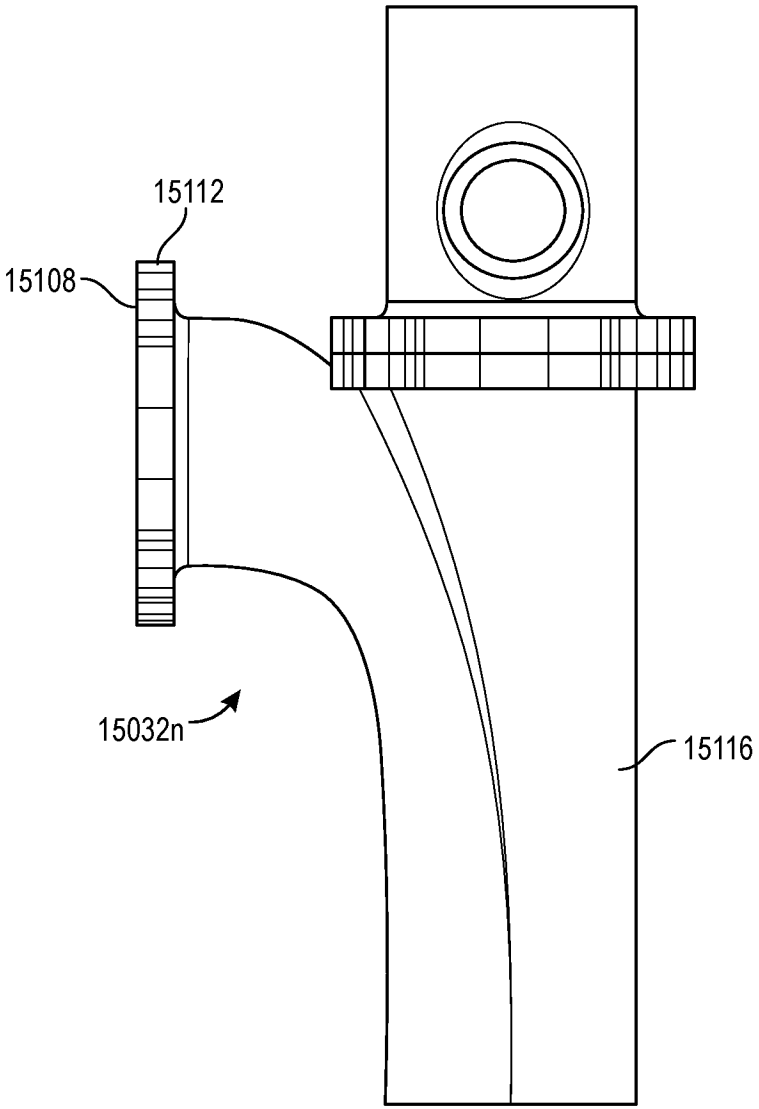

The outlet connectors 15032*m*, 15032*n* illustrated in FIGS. 140A-140C are examples of two outlet connector that can both be used with the same faceplate 15028 based on the similar geometry of the flange 15112 that engages the faceplate 15028. As such, an installer can choose which of the outlet connector 15032*a-n* is most appropriate for the installation situation. In some embodiments, adjacent faceplates 15028 within a wall assembly 15004 can include different outlet connector 15032*a-n*.

As shown in the cross-section of FIG. 140B, the outlet connector 15032*m* includes an inlet 15070 at the flange 15112, a vent portion 15074 or vent opening located at one end of the outlet pipe 15116, and a downstream portion 15078 or downstream opening located at a second end of the outlet pipe 15116. The inlet 15070 is located between the vent portion 15074 and the downstream portion 15078 along a length of the outlet pipe 15116. The desired outlet flow direction through the outlet pipe 15116 is from the inlet 15070 and to the downstream portion 15078. To prevent flow in the opposite direction (i.e., from the inlet 15070 towards the vent portion 15074), the outlet connector 1532*m* includes an internal diverter 15082 that directs flow towards the downstream portion 15078.

The diverter 15082 follows the contour of the inlet portion into the interior of the outlet pipe 15116 to separate the outlet pipe 15116 into a first portion nearer the inlet 15070 and a second portion spaced apart from the inlet 15070 by the first portion. At a specific position along the length of the outlet pipe 15116, the first portion defines a passage between the inlet 15070 and the downstream portion 15078 that is separate from a passage between the vent portion 15074 and the downstream portion 15078 at the same specific position. As shown, the internal diameter of the inlet 15070 extends between two diametrically opposed extents (identified by parallel lines) in the lengthwise direction of the outlet pipe 15116 and the specific position is between the two diametrically opposed extents. In the embodiment shown, all positions between the two diametrically opposed extents meet the requirements of the specific position such that the outlet pipe 15116 is separated into separate first and second chambers at all positions along the length of the outlet pipe 15116 aligned with the inlet 15070 (e.g., between the diametric extents). As such, fluid entering the inlet 15070 perpendicular to the diameter of the inlet 15070 contacts the diverter 15082 and is redirected towards the downstream portion 15078 and away from the vent portion 15074. The diverter 15082 is illustrated within the outlet connector 15032*m*, though may otherwise be incorporated into any of the outlet connectors illustrated herein. As shown, the diverter 15082 is formed integrally with the remainder of the outlet connector 15032*m*, though in other embodiments may be a separable component. In still other embodiments, the inlet defines an inlet cross-sectional area defining an inlet area virtual volume projected axially therewith, and where the diverter 15082 is sized and shaped such that no part of the inlet area virtual volume is projected onto the wall of the outlet pipe. In still other embodiments, the diverter 15082 is sized and shaped such that no more than 10%, 15%, and 20% of the inlet area virtual volume is projected onto the wall of the outlet pipe.

With continued reference to FIG. 140B, the distance between the flange 15112 of the outlet connector 15032*m* and the nearest portion of the outlet pipe 15116 is signified by measurement d4. The distance between the flange 15112 of the outlet connector 15032*m* and the furthest portion of the outlet pipe 15116 is signified by measurement d3, with the difference between d3 and d4 corresponding to the diameter of the outlet pipe. In some embodiments, it is desirable to decrease the measurement d4 while still allowing sufficient flow through the inlet 15070 such that the outlet connector 15032*m* can be installed within thin walls or takes up less space within the wall. In some embodiments, the distance d4 is less than half (e.g., less than 50%, less than 45%, less than 35%, less than 30%, between 25%-50%) of the distance d3. Written another way, the distance d3 is less than the diameter of the outlet tube 15116. In the illustrated embodiment, the distances d3, d4 correspond to the diameter of the downstream portion 15078. However, in other embodiments, such as FIG. 139, the distances d3, d4 may additionally or alternatively correspond to a measurement corresponding to a portion upstream of the connection between the inlet 15070 and the outlet tube 15116. In still other embodiments, the distance d3 is approximately 125% the corresponding outlet tube 15116 diameter (±10%). In still other embodiments, the distance d3 is between 100% and 125% of the corresponding outlet tube 15116 diameter. In still other embodiments, the distance d3 is between 100% and 130% the distance d3 is between 100% and 125% of the corresponding outlet tube 15116 diameter. In still other embodiments, the distance d3 is between 100$ and 135% of the corresponding outlet tube 15116 diameter.

Figure 143:
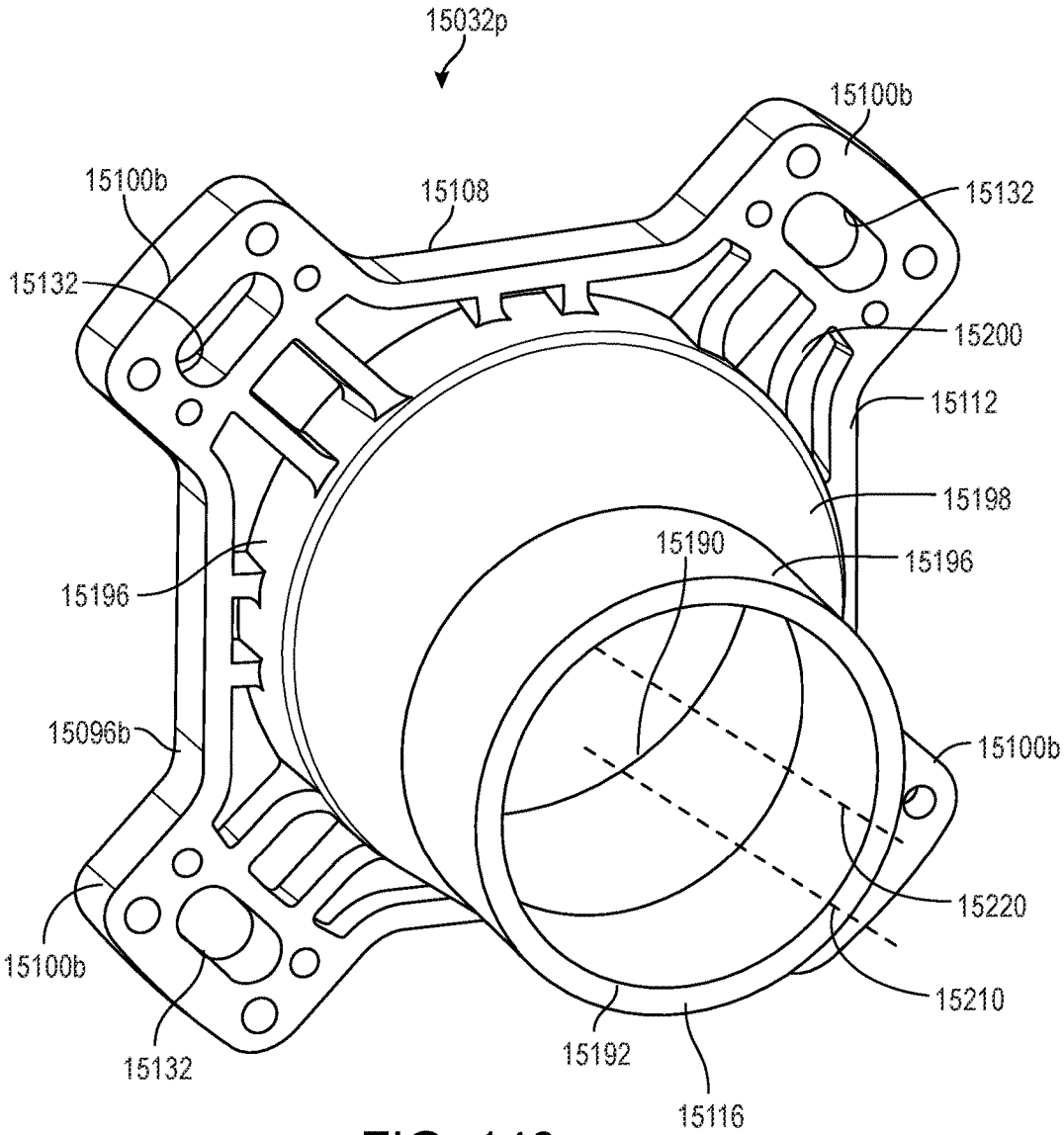
Figure 144:
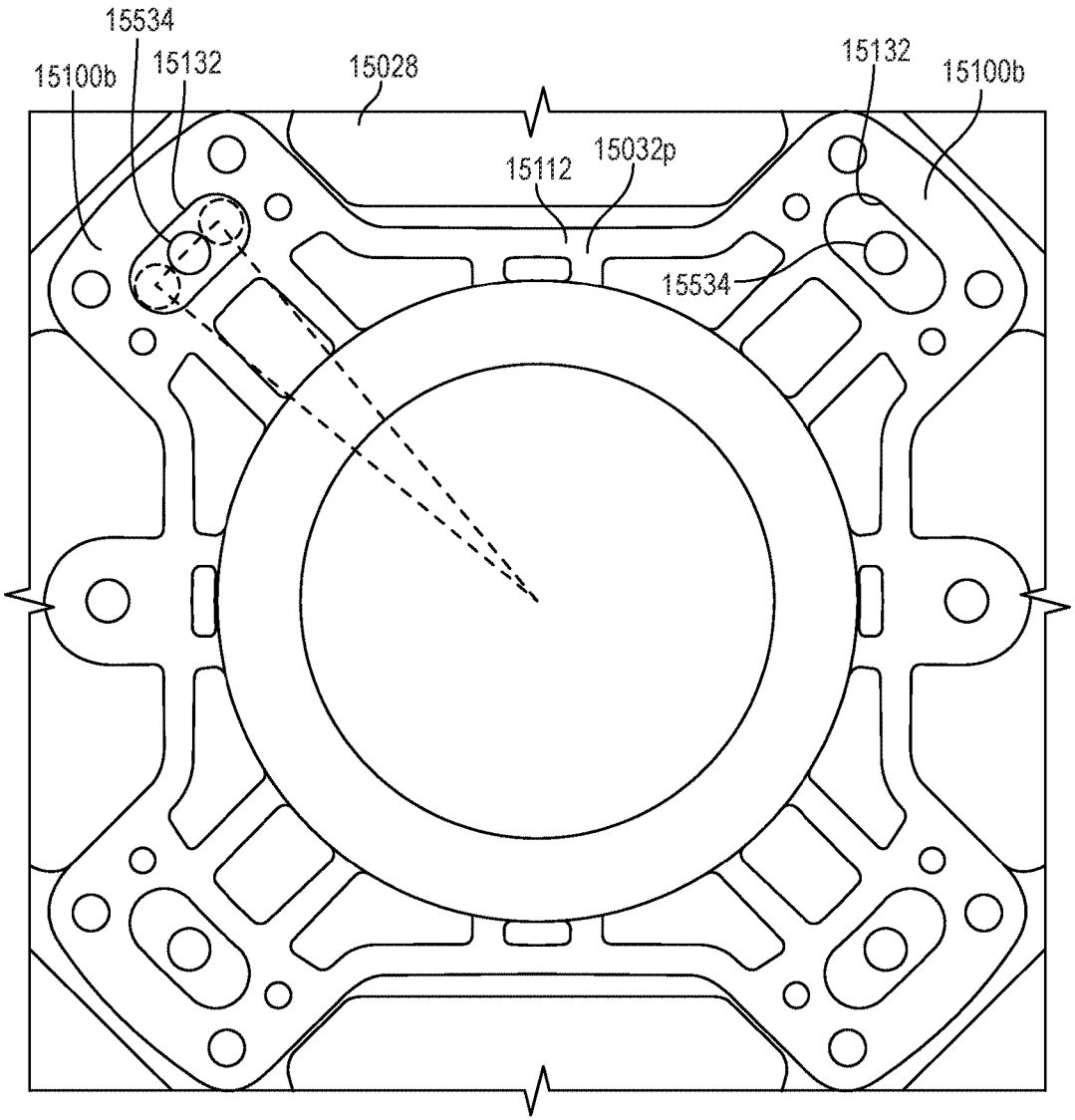

In some embodiments, the flange or outlet connector 15032*p* shown in FIGS. 143-144 may be made of polyvinyl chloride (PVC) (e.g., formed entirely of PVC) and may therefore be solvent welded to downstream fluid couplers and/or outlet pipes. In other embodiments, the outlet connector 15032*p* may be cast iron and attached to downstream outlet connector and/or outlet pipes via, for example, a no hub band.

The outlet connector 15032*p* includes a planar first end 15108 forming the mounting flange that fixes and seals against the faceplate 15028. The opening 15190 (e.g., 3-inch diameter, 4-inch diameter) at the first end 15108 is sized similar to the opening 15050 in the faceplate, though narrows down to a smaller opening 15192 (e.g., 2-inch diameter) at the second end 15116. The central axis 15220 of the smaller diameter portion 15192 at the second end 15116 is offset from the central axis 15210 of the larger diameter portion at the first end 15108 such that the outlet connector 15032*p* is not rotationally symmetrical. The axis 15220 of the smaller diameter opening 15192 is offset to be located below the axis 15210 of the larger diameter opening 15190, though the entirety of the smaller diameter opening 15192 is visible within the larger diameter opening 15190 when viewed perpendicular to the axes 115210, 15220 of the openings. For example, if the larger diameter opening 15190 has a diameter of four inches and the smaller diameter opening 15192 has a diameter of two inches, the distance between the axes 15210, 15220 of the respective openings 15190, 15192 is no greater than one inch.

A first cylindrical portion 15194 sized similar to the opening 15190 extends from the first end 15108 towards the second end 15116 and a second cylindrical portion 15196 sized similar to the opening 15192 extends from the second end 15116 toward the first end 15108. A transition portion 15198 extends between the first and second cylindrical portions 15194, 15196 to connect them such that the three portions 15194, 15196, 15198 form a channel or passage between the opposed openings 15190, 15192. Ribs 15200 that extend in a generally radial direction provide support between the first cylindrical portion 15194 and the mounting elements 15100*b*. The thickness of most areas of the outlet connector 15032*p* is consistent such that substantial warping is avoided when formed (especially if formed of PVC) and the sealing surfaces are flat.

Figure 141A:
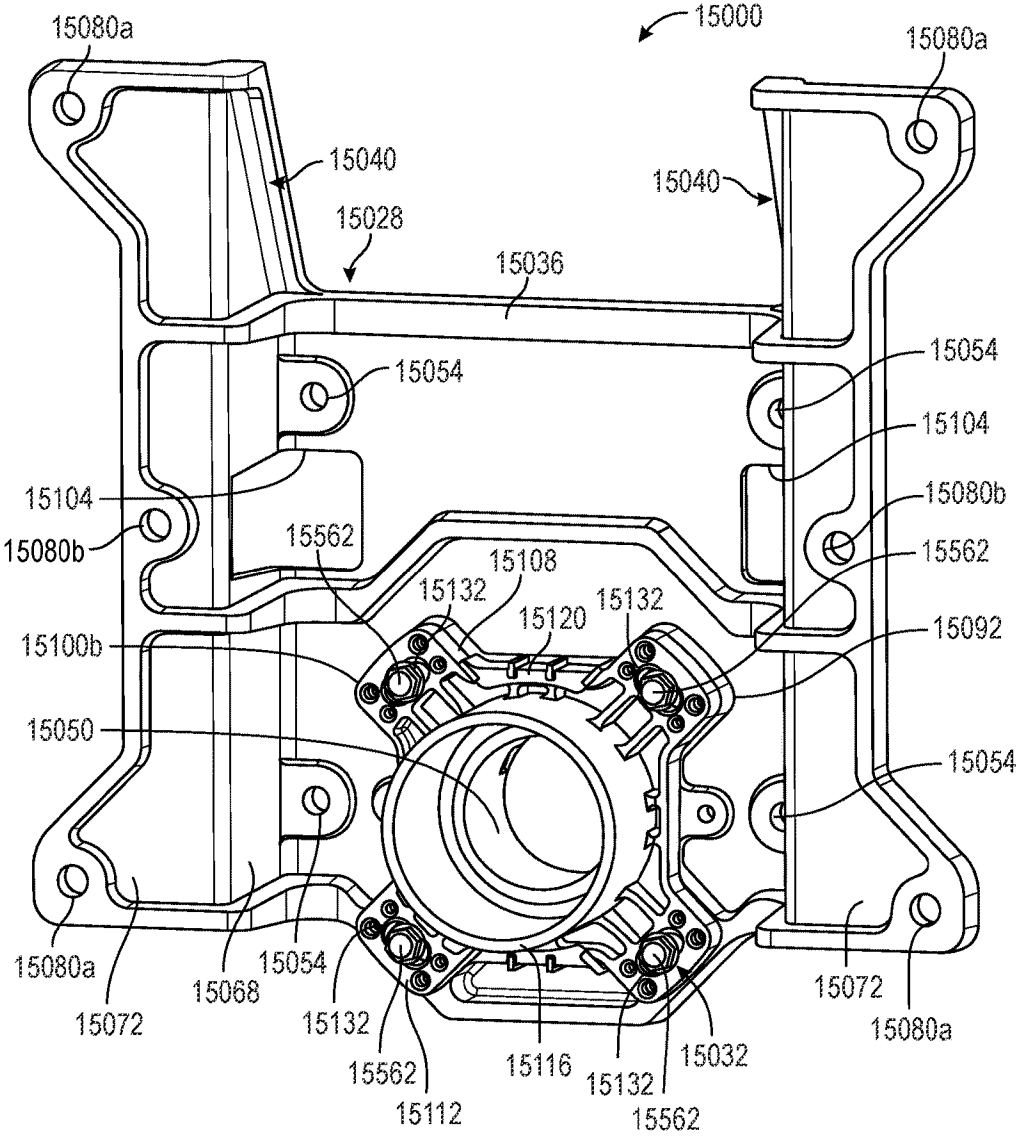
FIGS. 141A-146 illustrate the carrier assembly of FIGS. 129A-129B.
Figure 141B:
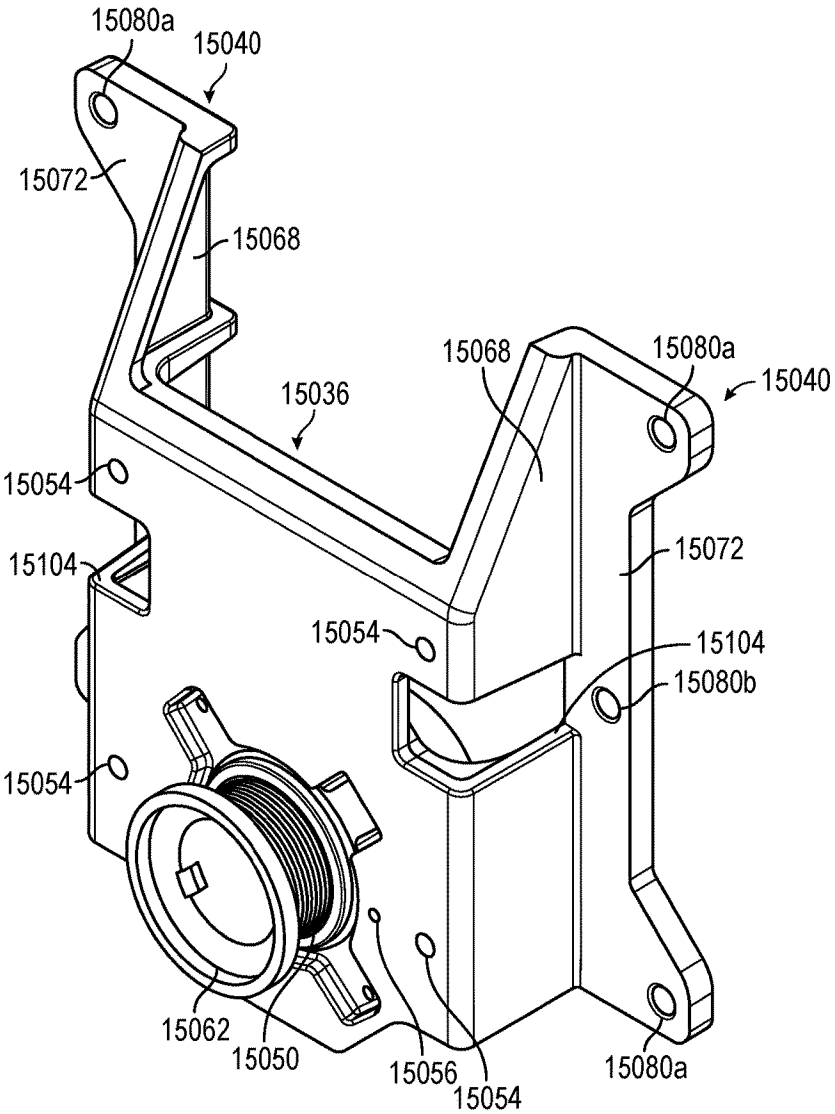
Figure 145:
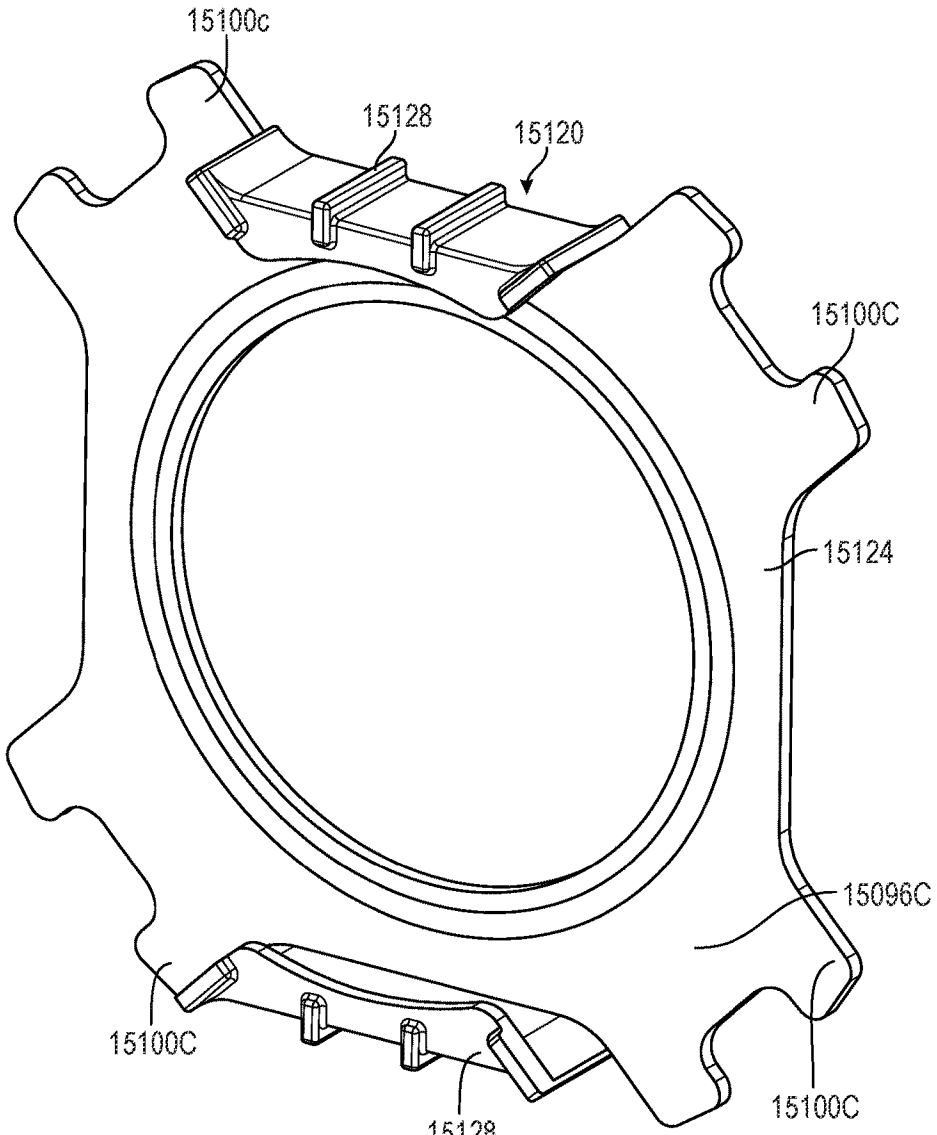

As shown in FIGS. 129A-129B and 141A, the outlet connector 15032 is coupled to the faceplate 15028 using a gasket 15120, which is shown in greater detail in FIG. 145. The gasket 15120 is formed from a gasket material (e.g., rubber, cardboard, and the like) and includes a planar body 15124 with a size and shape that generally corresponds to the shape of the mounting hub 15092 and the mounting flange 15112. More specifically, the body 15124 includes an annular sealing surface 15096*c* and four mounting elements 15100*c* extending radially outwardly therefrom.

The gasket 15120 also forms one or more channels or pockets 15128 configured to at least partially receive a portion of a mounting element 15100*b* of the mounting flange 15112 of the outlet connector 15032 therein. By doing so, the gasket 15120 is removably coupled to the first end 15108 of the outlet connector 15032 and properly aligned therewith without using a separate adhesive. In the illustrated embodiment, the gasket 15120 includes a pair of pockets 15128 spaced 180 degrees apart (e.g., to receive opposite mounting elements 15100*b* therein) but in other embodiments more or fewer pockets 15128 may be present. During assembly, the pockets 15128 allow the user to couple the gasket 15120 to the first end of the outlet connector 15032 where it will remain in place even with no fasteners present. With the gasket 15120 in position, the outlet connector 15032 may then be maneuvered relative to the faceplate 15028 and installed without having to hold the gasket 15120 in place. The gasket 15120 stretches to locate the pockets 15128 about opposing portions of the flange 15112 and is therefore elastically deformed into engagement with the flange 15112. Once positioned on the flange 15112, the pockets 15128 are clamped onto the flange 15112 and would require further elastic deformation to remove the gasket 15120 from the flange 15112. In the illustrated embodiment, the gasket 15120 may be removably secured to the first end 15108 of the outlet connector 15032 without reducing the internal cross-sectional area of the first end 15108. Stated differently, the gasket 15120 is configured so that no portion extends radially inwardly beyond the opening of the first end 15108.

Figure 146:
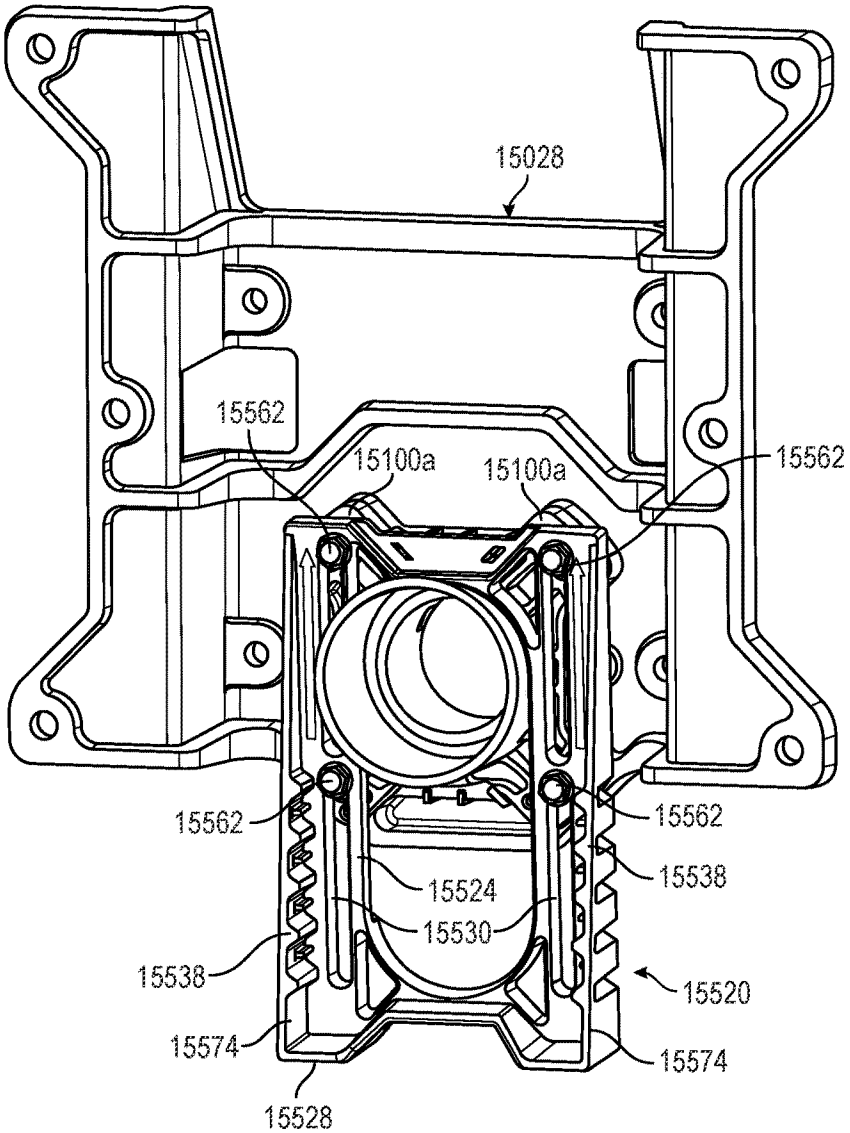

As shown in FIG. 146, the carrier assembly 15000 also includes an installation foot 15520. The foot 15520 is substantially wedge shaped having an upright portion 15524 and a bottom portion 15528 extending substantially perpendicular from the upright portion 15524 and triangular braces 15574 connecting the upright portion 15524 and the bottom portion 15528 along the widthwise edges of the installation foot 15520 such that the thickness of the foot decreases from the bottom portion 15528 to an upper end of the upright portion 15524. The braces 15574 strengthen the foot 15520 to prevent bending of the upright portion 15524 relative to the bottom portion 15528. The upright portion 15524 defines a pair of vertical slots 15530 sized and spaced to allow a plurality of fasteners 15562 to pass therethrough and be received within the apertures 15534 of the mounting hub 15092. As shown, the fasteners 15562 and apertures 15534 are those associated with mounting the outlet connector 15032 to the faceplate 15028. The upright portion 15524 also includes a series of graduations 15538 formed into or otherwise printed thereon and that are positioned so they are visible when the foot 15520 is mounted to the faceplate 15028. More specifically, the graduations 15538 are positioned so that the indicated graduation (e.g., the graduation 15538 aligned with the corresponding indicating indicia on the faceplate 15028) generally corresponds to the vertical mounting height of the fluid passageway 15050 from the floor.

To mount the faceplate 15028 to the modular wall assembly 15004, the user first loosely mounts the installation foot 15520 to the mounting hub 15092 by passing a plurality of fasteners 15562 through both of the vertical slots 15530 and into a corresponding aperture 15534. With the fasteners left loose to allow movement between the faceplate 15028 and the foot 15520, the user may then adjust the foot 15520 relative to the faceplate 15028 (e.g., in a generally vertical direction) until the graduation 15538 corresponding to the desired mounting height of the fluid passageway 15050 is aligned with indicating indicia on the faceplate 15028.

Once aligned, the user can then tighten the fasteners 15562 to fix the foot 15520 relative to the faceplate 15028. With the foot 15520 locked in place, the user can then rest the bottom portion 15528 on the floor or bottom member 15012 whereby the foot 15520 supports the weight of the faceplate 15028 while maintaining the fluid passageway 15050 at the desired mounting height. With the weight removed, the user can then properly position the faceplate 15028 between two studs 15020 without having to hold the faceplate 15028 in place. With the faceplate 15028 positioned between two adjacent studs 15020, the user can then drill the necessary holes in the studs 15020 and secure the faceplate 15028 in position by passing a fastener through each of the mounting apertures 15080*a*, 15080*b*. The foot 15520 is then removed from the installed faceplate 15028 by removing the fasteners 15562 so that the outlet connector 15032 can be mounted to the faceplate 15028.

With the faceplate 15028 installed, the user may then install the outlet connector 15032. Do to so, the user may first secure the gasket 15120 to the first end 15108. The combined gasket 15120 and connector 15032 may then be secured to the faceplate 15028 by threading a set of fasteners 15562 into the corresponding threaded apertures 15534. In the illustrated embodiment, the faceplate 15028 is configured so that faceplate 15028 and the outlet connector 15032 can be installed by introducing all bolts on the same side of a plane running coincident with the surface of the central portion 15036.

What is claimed is:

1. A water closet carrier assembly for mounting a water closet having an outlet to a plurality of vertical wall members, the water closet carrier assembly comprising:

a faceplate including:

a central portion extending in a widthwise direction between a first side and a second side, the central portion including a mounting surface and a water closet outlet opening configured to align with an outlet of the water closet;

a first side portion coupled to the central portion at the first side, the first side portion including a first side portion mounting aperture; and a second side portion coupled to the central portion at the second side, the second side portion including a second side portion mounting aperture;

a first fastener configured to couple the first side portion to a first vertical wall member of the plurality of vertical wall members via the first side portion mounting aperture; and a second fastener configured to couple the second side portion to a second vertical wall member of the plurality of vertical wall members via the second side portion mounting aperture, wherein the faceplate is configured to be supported solely by the plurality of vertical wall members, wherein each of the first side portion and the second side portion includes a first leg extending transversely from the central portion and a second leg extending transversely from the first leg, wherein the first leg of the first side portion is configured to contact a first surface of a respective vertical wall member and the second leg of the first side portion is configured to contact a second surface of the respective vertical wall member, wherein the mounting surface of the central portion is configured to be aligned with a third surface of the respective vertical wall member, the third surface spaced opposite the second surface of the respective vertical wall member.

2. The water closet carrier assembly of claim 1, wherein the second leg of the first side portion includes the first side portion mounting aperture and wherein the second leg of the second side portion includes the second side portion mounting aperture.

3. The water closet carrier assembly of claim 1, further comprising an outlet connector configured to couple to an outlet pipe and coupled to the faceplate and surround the water closet outlet opening, the outlet connector having a mounting flange configured to couple to the faceplate.

4. The water closet carrier assembly of claim 3, further comprising a gasket configured to provide a seal between the outlet connector and the faceplate, the gasket having a pocket that extends around and at least partially receives a portion of the mounting flange.

5. The water closet carrier assembly of claim 3, wherein the outlet connector is configured to couple to the faceplate in a first position in which the outlet pipe slopes downwards in a first direction and in a second position in which the outlet pipe slopes downwards in a second direction, offset from the first direction by more than 90 degrees.

6. The water closet carrier assembly of claim 5, wherein, in the first position, the outlet pipe slopes downwards by at least 1/16 inch per foot relative to a horizontal plane, and wherein, in the second position, the outlet pipe slopes downwards by at least 1/16 inch per foot relative to the horizontal plane.

7. The water closet carrier assembly of claim 3, wherein the outlet pipe extends along an axis that is perpendicular to a central axis of the outlet connector.

8. The water closet carrier assembly of claim 1, wherein the central portion extends between a top and a bottom in a heightwise direction that is perpendicular to the widthwise direction, and wherein the first side portion mounting aperture and the second portion mounting aperture are located at a height above the top of the central portion.

9. The water closet carrier assembly of claim 1, wherein the first and second side portions each extend above a top of the central portion.

10. The water closet carrier assembly of claim 1, wherein the central portion includes an access aperture positioned adjacent the first side portion mounting aperture such that a user is capable of accessing the first fastener and the first side portion mounting aperture through the access aperture.

11. The water closet carrier assembly of claim 1, wherein the central portion of the faceplate has a thickness extending between a front side for abutting the water closet and a rear side opposite the front side, wherein the rear side includes a mounting flange surrounding the water closet outlet opening.

12. The water closet carrier assembly of claim 1, further comprising a first plurality of water closet mounting apertures and a second plurality of water closet mounting apertures for a floor-mounted rear-outlet water closet, wherein the first plurality of water closet mounting apertures are separate from the second plurality of water closet mounting apertures.

13. The water closet carrier assembly of claim 1, wherein the central portion is located in a first plane that is oriented perpendicular to a central axis of the water closet outlet opening, and wherein the first side portion and the second side portion are coplanar and are located in a second plane that is oriented perpendicular to the central axis and axially offset from the first plane.

14. The water closet carrier assembly of claim 13, wherein the second leg of the first side portion includes the first side portion mounting aperture and wherein the second leg of the second side portion includes the second side portion mounting aperture.

15. The water closet carrier assembly of claim 13, further comprising an outlet connector configured to couple to an outlet pipe and coupled to the faceplate and surround the water closet outlet opening, the outlet connector having a mounting flange configured to couple to the faceplate.

16. The water closet carrier assembly of claim 15, further comprising a gasket configured to provide a seal between the outlet connector and the faceplate, the gasket having a pocket that extends around and at least partially receives a portion of the mounting flange.

17. The water closet carrier assembly of claim 15, wherein the outlet connector is configured to couple to the faceplate in a first position in which the outlet pipe slopes downwards in a first direction and in a second position in which the outlet pipe slopes downwards in a second direction, offset from the first direction by more than 90 degrees.

18. The water closet carrier assembly of claim 1, wherein a contact height of the first side portion is one to two times as large as a width of the central portion.

19. A water closet carrier assembly for mounting a water closet having an outlet to a plurality of vertical wall members, the water closet carrier assembly comprising:

a faceplate including:

a central portion extending in a widthwise direction between a first side and a second side, the central portion including a water closet outlet opening configured to align with an outlet of the water closet;

a first side portion integrally formed with the central portion at the first side, the first side portion including a first mounting aperture and a second mounting aperture, the second mounting aperture offset from the first mounting aperture in the widthwise direction; and a second side portion integrally formed with the central portion at the second side, the second side portion including a third mounting aperture and a fourth mounting aperture, the fourth mounting aperture offset from the third mounting aperture in the widthwise direction;

wherein the faceplate is configured to be supported solely by the plurality of vertical wall members;

wherein at least one of the first side portion and the second side portion includes a first leg extending transversely from the central portion and a second leg extending transversely from the first leg, wherein the first leg contacts a first surface of a respective vertical wall member and the second leg contacts a second surface of the respective vertical wall member.

* * * * *